US006442951B1

(12) United States Patent
Maeda et al.

(10) Patent No.: US 6,442,951 B1
(45) Date of Patent: Sep. 3, 2002

(54) HEAT EXCHANGER, HEAT PUMP, DEHUMIDIFIER, AND DEHUMIDIFYING METHOD

(75) Inventors: Kensaku Maeda; Yoshiro Fukasaku, both of Kanagawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/720,877

(22) PCT Filed: Jun. 30, 1999

(86) PCT No.: PCT/JP99/03512

§ 371 (c)(1),
(2), (4) Date: Apr. 20, 2001

(87) PCT Pub. No.: WO00/00774

PCT Pub. Date: Jan. 6, 2000

(30) Foreign Application Priority Data

| | | |
|---|---|---|
| Jun. 30, 1998 | (JP) | 10-199847 |
| Jul. 7, 1998 | (JP) | 10-207181 |
| Jul. 16, 1998 | (JP) | 10-218574 |
| Aug. 20, 1998 | (JP) | 10-250424 |
| Aug. 20, 1998 | (JP) | 10-250425 |
| Sep. 10, 1998 | (JP) | 10-274359 |
| Sep. 16, 1998 | (JP) | 10-280530 |
| Sep. 18, 1998 | (JP) | 10-283505 |
| Sep. 22, 1998 | (JP) | 10-286091 |
| Oct. 6, 1998 | (JP) | 10-299167 |
| Nov. 24, 1998 | (JP) | 10-332861 |
| Nov. 24, 1998 | (JP) | 10-333017 |
| Dec. 4, 1998 | (JP) | 10-345964 |

(51) Int. Cl.[7] ..... F24F 3/147; F24F 3/00; F24F 11/02; F28D 7/16; F25B 1/00

(52) U.S. Cl. ..... 62/94; 62/93; 62/2.71

(58) Field of Search ..... 62/93, 94, 271, 62/513, 331

(56) References Cited

U.S. PATENT DOCUMENTS

| | | | | |
|---|---|---|---|---|
| 4,540,420 A | * | 9/1985 | Wharton et al. | 62/181 |
| 4,887,438 A | * | 12/1989 | Meckler | 62/271 |
| 4,918,942 A | * | 4/1990 | Jaster | 62/335 |
| 5,325,676 A | * | 7/1994 | Meckler | 62/93 |

(List continued on next page.)

FOREIGN PATENT DOCUMENTS

| | | | |
|---|---|---|---|
| JP | 55-38492 | * | 3/1980 |
| JP | 61-18432 | * | 2/1986 |
| JP | 10-26433 | | 1/1998 |
| JP | 10-26434 | | 1/1998 |
| JP | 10-54586 | | 2/1998 |
| JP | 10-26369 | | 4/1998 |

*Primary Examiner*—William C Doerrler
(74) *Attorney, Agent, or Firm*—Armstrong, Westerman, Hattori, LLP

(57) ABSTRACT

A heat exchanger of a high heat exchange efficiency with a small size for its large heat exchanger duty is provided. The heat exchanger comprises: a first compartment 310 for flowing a first fluid A; a second compartment 320 for flowing a second fluid B; a first flow passage 251 passing through the compartment and for flowing the third fluid for exchanging heat with the first fluid A; and a second flow passage 252 passing through the compartment and for flowing the third fluid for exchanging heat with the first fluid B; the first and second flow passages 251, 252 are formed as an integral passage; the third fluid flows through from the first flow passage 251 to the second flow passage 252; the third fluid evaporates in the first flow passage 251 at a specific pressure; the third fluid condenses in the second flow passage 252 at the approximately specific pressure. Since the third fluid flows from the first flow passage to the second flow passage, heat transfer from the first compartment to the second compartment is allowed. High heat transfer coefficient is achieved due to evaporating heat transfer or condensing heat transfer.

40 Claims, 49 Drawing Sheets

U.S. PATENT DOCUMENTS

| | | | | | |
|---|---|---|---|---|---|
| 5,364,455 | A | | 11/1994 | Komareni et al. | 95/117 |
| 5,448,895 | A | * | 9/1995 | Coellner et al. | 62/94 |
| 5,718,122 | A | | 2/1998 | Maeda | 62/185 |
| 5,758,509 | A | | 6/1998 | Maeda | 62/94 |
| 5,761,923 | A | * | 6/1998 | Maeda | 62/271 |
| 5,761,925 | A | | 6/1998 | Maeda | 62/476 |
| 5,791,157 | A | | 8/1998 | Maeda | 62/483 |
| 5,816,065 | A | * | 10/1998 | Maeda | 62/271 |
| 5,931,015 | A | | 8/1999 | Maeda | 62/271 |
| 5,943,874 | A | | 8/1999 | Maeda | 62/271 |
| 5,950,447 | A | | 9/1999 | Maeda | 62/271 |

* cited by examiner (a)

(b)

DETAIL OF 300d PORTION

VIEW X-X

VIEW Y-Y

FIG. 17

TABLE OPERATION MODE & ON/OFF OF APPARATUS

| APPARATUS | COOLING | DEHUMIDIFYING |
|---|---|---|
| DESICCANT WHEEL 113 | ON | ON |
| BLOWER 102 | ON | ON |
| BLOWER 140 | ON | ON |
| BLOWER 160 | ON | OFF |
| WATER SPRAY 325 | OPERATED | OFF |
| COMPRESSOR 260 | ON | ON |

FIG. 21

TABLE OPERATION MODE & ON/OFF OF APPARATUS

| APPARATUS | COOLING | DEHUMIDIFYING | HEATING | DEFROSTING |
|---|---|---|---|---|
| DESICCANT WHEEL113 | ON | ON | OFF | OFF |
| BLOWER 102 | ON | ON | ON | OFF |
| BLOWER 140 | ON | ON | ON | OFF |
| BLOWER 160 | ON | OFF | OFF | ON |
| 4WAY-VALVE265 | 261 & 201<br>262 & 207 | 261 & 201<br>262 & 207 | 261 & 207<br>262 & 201 | 261 & 201<br>262 & 207 |
| 4WAY-VALVE280 | 203 & 206<br>205 & 202 | 203 & 206<br>205 & 202 | 203 & 202<br>205 & 206 | 203 & 202<br>205 & 206 |
| 3WAY-VALVE145 | 129 & 130A | 129 & 130A | 129 & 130B | 129 & 130B |
| WATER SPRAY325 | OPERATED | OFF | OFF | OFF |
| COMPRESSOR260 | ON | ON | ON | ON |
| SENSOR OF EXPANSION VALVE270 | 275A | 275A | 275B | 275A |

(a)

(b)

(c)

HEAT EXCHANGER, HEAT PUMP, DEHUMIDIFIER, AND DEHUMIDIFYING METHOD

TECHNICAL FIELD

The invention relates to a heat exchanger, a heat pump, a dehumidifier, and dehumidifying method, in particular to a heat exchanger for exchanging heat between two fluids through a third fluid, a heat pump and a dehumidifier provided with such a heat exchanger and to a dehumidifying method by exchanging heat through the third fluid.

BACKGROUND ART

In order to exchange heat between large amounts of fluids of a relatively small mutual temperature difference, for instance between air conditioning process air and ambient air for cooling, a rotary type heat exchanger of a large capacity and a cross flow heat exchanger 3 as shown in FIG. 49 have been used. Such heat exchangers have been used for instance in a desiccant air conditioning system to cool in advance process air A to be introduced into a room using ambient air B before such introduction occurs.

Such conventional heat exchangers have problems in that they are large in volume and take up too large an installation area, and that heat cannot be utilized sufficiently due to poor heat exchange efficiency.

Therefore, the object of the invention is to provide a heat exchanger of a high heat exchange efficiency with a small size relative to its large heat exchanging duty.

DISCLOSURE OF INVENTION

The heat exchanger of the invention comprises a first compartment for flowing a first fluid; a second compartment for flowing a second fluid; a first fluid passage passing through the first compartment for flowing a third fluid for exchanging heat with the first fluid; and a second fluid passage passing through the second compartment for flowing the third fluid for exchanging heat with the second fluid; and is configured such that the first and second flow passages are formed as an integral flow passage, the third fluid flows through from the first flow passage to the second flow passage, the third fluid evaporates on the heat transfer surface located on the flow passage side of the first flow passage at a specific pressure, and condenses on the heat transfer surface located on the flow passage side of the second flow passage at approximately the specific pressure.

With such configuration described above, since the third fluid, or a refrigerant for example, flows from the first to the second fluid passages it can transfer heat from the first to the second compartment. Since the third fluid evaporates at the specific pressure on the heat transfer surface located on the flow path side of the first flow passage, the third fluid can take heat from the first fluid. Since the third fluid 250 condenses at almost the specific pressure on the heat transfer surface located on the flow path side of the second flow path, the third fluid can give heat to the second fluid. Since the above-mentioned heat transfer is evaporating heat transfer or condensing heat transfer, the heat transfer coefficient is much higher in comparison with only heat transfer by conduction or convection. Since the first and second flow passages are made as an integral body, arrangement as a whole is made compact. In the description above, the expression of "at almost the specific condensing pressure" is used because a flow is present from the first to the second flow passages, and there is a flow loss even though it is very small. Substantially, the pressure can be deemed to be the same.

With another configuration in which the second fluid contains moisture, the efficiency of cooling the third fluid by means of the second fluid can be enhanced by utilizing the latent heat of evaporation of water.

With still another configuration in which a third fluid passage for flowing the third fluid for exchanging heat with the second fluid is additionally arranged parallel to the second flow passage and passes through the second compartment, and in which the third fluid substantially bypasses the first compartment and is supplied to the third flow passage and flows through the second compartment, it allows the third fluid to be of a phase different from the phase of the third fluid flowing through the first fluid passage to flow through the third flow passage.

It may also be configured such that the third fluid in liquid phase is introduced to the first flow passage and the third fluid in vapor phase is introduced to the third flow passage. For example, the fluid is separated into vapor phase and liquid phase using a vapor-liquid separator. In this way, it is possible to evaporate the liquid-phase third fluid in the first flow passage, and condense the vapor-phase third liquid in the third flow passage.

Another heat exchanger of the invention is configured such that a plurality of the first passages are disposed with different evaporating pressures in the respective passages. With such a configuration, pressures in the plurality of flow passages are arranged in the high to low or low to high order of the different pressures in the plurality of flow passages according to the temperature changes of the first fluid flowing through the first compartment or of the second fluid flowing through the second compartment. With such a configuration, the plurality of flow passages in which evaporation or condensation occurs at different pressures are arranged for example in the order of high to low pressure. Therefore, for example, in case the first fluid is deprived of sensible heat, temperature of the first fluid lowers during the time it enters and exits the first compartment. If the specific temperatures are arranged in the high to low order according to the temperature drop, heat exchange efficiency can be enhanced. This, in turn, enables effective use of heat. In other words, a plurality of flow passages are arranged such that the first and second fluids flow in normal and reverse directions, respectively. In this way, the first and second fluids flow in a counterflow manner to each other.

The heat pump of the invention comprises a pressure raiser for raising the pressure of a refrigerant; a first heat exchanger for condensing the refrigerant whose pressure has been boosted with the pressure raiser by taking heat from the refrigerant with a high temperature fluid under a first pressure; a first throttle for reducing to a second pressure the refrigerant that has been condensed with the first heat exchanger; a second heat exchanger for evaporating the refrigerant that has been reduced in pressure with the first throttle by the heat from the first fluid under the second pressure, and for condensing the refrigerant, after the evaporation, by taking heat from the refrigerant with a second fluid; a second throttle for reducing the pressure of the refrigerant to a third pressure, after being condensed with the second heat exchanger; and a third heat exchanger for evaporating the refrigerant that has been reduced in pressure with the second throttle, by imparting heat from low temperature fluid under the third pressure. With such a configuration, since the second heat exchanger is provided for performing heat exchange utilizing the evaporation and condensation of the refrigerant, heat can be exchanged between the first and the second fluids with a high heat exchange efficiency. Incidentally, while the word "pressure raiser" in the above description typically refers to the compressor for compressing the refrigerant in vapor phase, it can also refer to a device comprising for example, an absorber that can be installed in an absorption refrigerator, a lean absorption pump for pumping up lean solution which has absorbed refrigerant in the absorber, and a generator for generating the refrigerant from lean solution pumped up with the pump.

A dehumidifier of the invention comprises a moisture adsorber containing a desiccant for adsorbing moisture in the process air; and a process air cooler for cooling the process air from which moisture has been adsorbed with the desiccant. The process air cooler is configured to cool the process air by the evaporation of the refrigerant and to cool and condense the evaporated refrigerant by means of a cooling fluid in the process air cooler.

The evaporated refrigerant is condensed typically by cooling with the cooling fluid on the downstream side as it flows in one direction as a whole in the process air cooler. The phrase "in one direction as a whole" refers to the fact that the vapor and also the liquid phase refrigerant as a whole flow in the same direction, although there may be local reverse eddies if the flow is turbulent.

A dehumidifying method of the invention comprises a first step of cooling the process air with a refrigerant that evaporates at a low pressure; a second step of raising to a high pressure the pressure of the refrigerant that has evaporated in the first step; a third step of heating regeneration air for regenerating the desiccant with the refrigerant that condenses at the high pressure; a fourth step of regenerating the desiccant by desorbing moisture from the desiccant with the regeneration air heated in the third step; a fifth step of adsorbing moisture in the process air with the desiccant regenerated in the fourth step; a sixth step of cooling the process air from which moisture has been removed by adsorption in the fifth step, by evaporating the refrigerant that has condensed in the third step at an intermediate pressure between the low and high pressures; and a seventh step of condensing the refrigerant that has evaporated at the intermediate pressure, at a pressure which is approximately the same as the intermediate pressure.

With the dehumidifying method described above, since the so-called economizer cycle can be utilized, the refrigerating effect of the refrigerant can be enhanced and, in its turn, air can be dehumidified with a high COP.

Another dehumidifier of the invention comprises a first refrigerant-air heat exchanger having a first refrigerant inlet-outlet and a second refrigerant inlet-outlet, and for causing heat exchange between the refrigerant and the process air; a compressor having an intake port and a discharge port for taking in and discharging the refrigerant, the second refrigerant inlet-outlet being disposed to be selectively connectable to either the intake port or the discharge port; a second refrigerant-air heat exchanger having a third refrigerant inlet-outlet and a fourth refrigerant inlet-outlet and for causing heat exchange between the refrigerant and the process air, with either the intake or discharge port whichever has not been connected to the second refrigerant inlet-outlet, being disposed to be connectable to the third refrigerant inlet-outlet; and a third refrigerant-air heat exchanger disposed on the upstream side of the process air flow through the first refrigerant-air heat exchanger, having a fifth refrigerant inlet-outlet and a sixth refrigerant inlet-outlet and for causing heat exchange between the process air, the refrigerant and the cooling fluid, with the fourth refrigerant inlet-outlet being disposed to be connectable to either the fifth refrigerant inlet-outlet or the sixth refrigerant inlet-outlet; and a moisture adsorber disposed on the upstream side of the process air flow passing through the third refrigerant-air heat exchanger and having a desiccant for adsorbing moisture in the process air; and is configured such that whichever of the fifth refrigerant inlet-outlet or the sixth refrigerant inlet-outlet that has not been connected to the fourth refrigerant inlet-outlet is connected to the first refrigerant inlet-outlet; when the fourth refrigerant inlet-outlet and the fifth refrigerant inlet-outlet are interconnected, the third refrigerant-air heat exchanger cools the process air passing through the third refrigerant-air heat exchanger by the evaporation of the refrigerant supplied from the fourth refrigerant inlet-outlet to the fifth refrigerant inlet-outlet, and cools and condenses the evaporated refrigerant with the cooling fluid, so that the condensed refrigerant can be supplied to the first refrigerant-air heat exchanger.

In that case, since devices are arranged to permit selective connections, the operation mode of the dehumidifier can be changed.

Still another dehumidifier of the invention comprises a moisture adsorber having a desiccant for adsorbing moisture in the process air; and a process air cooler, disposed on the downstream side of the process air flow relative to the moisture adsorber, for cooling the process air from which moisture has been adsorbed with the desiccant; and is configured such that the process air cooler cools the process air by the evaporation of the refrigerant and condenses the evaporated refrigerant in the process air cooler; and the process air cooler has a plurality of evaporating pressures of the process air cooling refrigerant and, corresponding thereto, a plurality of condensing pressures at which the refrigerant is cooled and condensed with the cooling fluid. In that case, since there are a plurality of refrigerant evaporating pressures and, corresponding thereto, a plurality of refrigerant condensing pressures, and since the plurality of evaporating pressures are set to be different from each other, the plurality of evaporating pressures and condensing pressures can be arranged in the high to low order or low to high. This makes it possible to perform the heat exchange between the process air and the cooling fluid in almost the so-called counter flow manner.

Still another dehumidifier of the invention comprises a moisture adsorber having a desiccant which adsorbs moisture from the process air and which is regenerated with the regeneration air; a heat pump, having a compressor for compressing a refrigerant, for pumping up heat from a low temperature heat source to a high temperature heat source using the process air as the low temperature heat source and the regeneration air as the high temperature heat source; and a process air cooler for cooling the process air from which moisture has been removed by adsorption with the desiccant; and is configured such that the refrigerant, before being drawn into the compressor, is heated with the refrigerant after being compressed with the compressor and after it has exchanged heat with the regeneration air before regenerating the desiccant. In that case, since the refrigerant before being drawn into the compressor is heated with the refrigerant after being compressed with the compressor and after exchanging heat with the regeneration air before it has regenerated the desiccant, that is, the refrigerant in an almost saturated state before being drawn into the compressor can be heated with the refrigerant which has exchanged heat, the discharge temperature of the refrigerant compressed with the compressor increases, which in its turn permits the increase of the regeneration air temperature.

Still another dehumidifier of the invention comprises a moisture adsorber having a desiccant for adsorbing moisture which in turn is desorbed with regeneration air; a first heat pump for pumping up heat from a first evaporation temperature to a first condensation temperature by circulating a refrigerant and configured to condense the refrigerant, after evaporating the refrigerant at a first intermediate temperature between the first condensation temperature and the first evaporation temperature, at a temperature which is almost equal to the first intermediate temperature; and a second heat pump for pumping up heat from a second evaporation temperature which is lower than the first evaporation temperature to a second condensation temperature which is lower than the first condensation temperature by circulating a refrigerant and configured to condense the refrigerant, after evaporating the refrigerant at a second intermediate temperature between the second condensation temperature and the second evaporation temperature, at a temperature which is almost equal to the second intermediate temperature; and is configured such that the process air from which moisture is desorbed with the desiccant is cooled with the refrigerant that evaporates at the higher temperature of the first and the second intermediate temperatures, subsequently is also cooled with the refrigerant which evaporates at the lower intermediate temperature, then is cooled with the refrigerant which evaporates at the first evaporation temperature, and then is cooled with the refrigerant which evaporates at the second evaporation temperature; and the regeneration air is heated with the refrigerant that condenses at either a temperature which is almost equal to the first intermediate temperature or a temperature which is almost equal to the second intermediate temperature whichever lower, then is heated with the refrigerant that condenses at the rest of the two temperatures whichever higher, then is heated with the refrigerant that condenses at the second condensation temperature, then is heated with the refrigerant that condenses at the first condensation temperature, and then the moisture in the desiccant is desorbed with the heated regeneration air.

With the configuration described above, since at least two heat pumps are provided, heat drop through each heat pump is smaller in comparison with a configuration comprising only a single heat pump. Also, since the process air cooler is provided, each heat pump works in the economizer cycle and makes it possible to provide a dehumidifier of a high COP.

Such a dehumidifier may also be configured such that the heat pump is provided with a process air cooler and a condenser, with the condenser disposed in a position vertically above the process air cooler. In that case, since the condensed refrigerant liquid flows downward, the gravitational force as well as refrigerant pressure can be utilized to feed the refrigerant liquid from the condenser to the process air cooler. Therefore, it is suitable for use with the so-called low pressure refrigerant.

A dehumidifier of the invention comprises a first air flow passage having a first intake port at its one end and a first discharge port at its other end so as to permit a first air flow from the first intake port to the first discharge port; and a desiccant wheel through which the first air flow passes, and the rotary shaft of which is disposed vertically; and is configured such that one of the desiccant and the first air flow removes moisture from the other; and the first air flow passage mainly includes a downward flow passage portion extending vertically downward and an upward flow passage portion extending vertically upward.

With such a configuration, since the dehumidifier is provided with the desiccant wheel with its rotary shaft disposed vertically and with the passage of the first air flow mainly including the downward flow passage portion extending vertically downward and the upward flow passage portion extending vertically upward, an orderly arrangement is possible in which the first air flow through the dehumidifier mainly reciprocates vertically, the first air flow need not change its direction immediately before and after the desiccant wheel, and the humidifier is made compact with a small installation compartment due to the vertically arranged major devices.

In still another dehumidifier of the invention, the first intake port is disposed on or in the vicinity of the top surface of the dehumidifier and the first discharge port is disposed on or in the vicinity of the top surface of the dehumidifier. In that case, it is configured that the first air flow runs from the downward flow passage portion to the upward flow passage portion.

Since the first intake port is disposed on or in the vicinity of the top surface of the dehumidifier and the first discharge port is disposed on or in the vicinity of the top surface of the dehumidifier, the space from the top surface or the vicinity of the top surface of the dehumidifier to a position of certain height in the dehumidifier can be utilized as the first air flow passage to simplify the first air flow passage, and to reduce the size and installation area of the dehumidifier.

In still another dehumidifier of the invention, the first intake port is disposed on or in the vicinity of the bottom surface of the dehumidifier and the first discharge port is disposed on or in the vicinity of the bottom surface of the dehumidifier. In that case, the first air flow runs from the upward flow passage portion to the downward flow passage portion.

Since the first intake port is disposed on or in the vicinity of the bottom surface of the dehumidifier and the first discharge port is disposed on or in the vicinity of the bottom surface of the dehumidifier, the space from the bottom surface or the vicinity of the bottom surface of the dehumidifier to a position of certain height in the dehumidifier can be utilized as the first air flow passage to simplify the first air flow passage, and to reduce the installation area.

Still another dehumidifier of the invention comprises a second air flow passage having a second intake port at its one end and a second discharge port at its other end to permit a second air flow from the second intake port to the second discharge port; and is configured such that, in case moisture is removed from the desiccant with the first air flow, the moisture is removed from the desiccant to the second air flow, and that, in case moisture is removed from the desiccant to the first air flow, moisture is removed from the desiccant with the second air flow; and that the second air flow mainly includes a flow passage portion vertically directed upward.

Since the second air flow passage is configured to mainly include the vertically directed upward flow passage portion, both the first and the second air flow passages are directed upward, and the first and the second air flow passages are arranged in good order, the first and the second air flow direction need not be changed immediately before and after the desiccant wheel, major devices may be disposed in a vertical tier with one device over another, and the dehumidifier is made compact to reduce the installation area.

In still another dehumidifier of the invention, the second intake port is disposed on or in the vicinity of the bottom surface of the dehumidifier and the second discharge port is disposed on or in the vicinity of the top surface of the dehumidifier.

Since the second intake port is disposed on or in the vicinity of the bottom surface of the dehumidifier and the second discharge port is disposed on or in the vicinity of the top surface of the dehumidifier, a length almost equal to the height from the bottom to the top surface of the dehumidifier can be utilized as a second air flow passage to make the dehumidifier compact.

Still another dehumidifier of the invention is characterized in that the first air is process air.

Still another dehumidifier of the invention is characterized in that the first air is regeneration air.

Still another dehumidifier of the invention is characterized in that the first air is process air and the second air is regeneration air.

Still another dehumidifier of the invention comprises a first heat exchanger configured to cool the process air and that the desiccant is configured to remove moisture from the process air before the process air is cooled with the first heat exchanger.

Since the desiccant processes the process air before it is cooled with the first heat exchanger, namely since the process air which has passed through the desiccant is cooled with the second heat exchanger, it is possible to maintain a high heat exchange efficiency while making the dehumidifier compact and reducing the installation area.

Still another dehumidifier of the invention comprises a first heat exchanger configured to cool the process air; a second heat exchanger configured to heat the regeneration air; and a heat pump having a low and a high temperature heat sources; and is configured such that the second heat exchanger constitutes the low temperature heat source while the first heat exchanger constitutes the high temperature heat source.

A dehumidifier of the invention comprises a process air blower (which may be a fan, depending on the air flow loss along the air path) for blowing process air; a regeneration air blower for blowing regeneration air; a compressor for compressing a refrigerant; a refrigerant condenser for heating the regeneration air by condensing the compressed refrigerant; a refrigerant evaporator for cooling the process air by evaporating the refrigerant condensed with the refrigerant condenser; and a desiccant wheel having a rotary shaft disposed vertically and a desiccant which is regenerated as the regeneration air heated with the refrigerant condenser passes through the desiccant and the process air is processed as it passes through the desiccant; and the process air blower, the regeneration air blower, and the compressor are located in a position vertically below the desiccant wheel, while the refrigerant condenser is located in a position vertically above the desiccant wheel.

With the configuration described above, in which the rotary shaft of the desiccant wheel is disposed vertically, the process air blower, the regeneration air blower, and the compressor are located in a position vertically below the desiccant wheel, and the refrigerant condenser is located in a position vertically above the desiccant wheel, since the major devices are arranged in the vertical direction, the devices are arranged in a compact size in the horizontal direction and the installation area is reduced. Here, the term "major devices" refers to the blowers, the compressor, the desiccant wheel, the refrigerant condenser, and the refrigerant evaporator and the like.

This application is based on the Japanese patent applications enumerated below and the contents of these applications are incorporated herein by reference to constitute part of this application: Patent application 10-199847 filed on Jun. 30, 1998, Patent application 10-207181 filed on Jul. 7, 1998, Patent application 10-218574 filed on Jul. 16, 1998, Patent application 10-332861 filed on Nov. 24, 1998, Patent application 10-333017 filed on Nov. 24, 1998, Patent application 10-345964 filed on Dec. 4, 1998, Patent application 10-250424 filed on Aug. 20, 1998, Patent application 10-250425 filed on Aug. 20, 1998, Patent application 10-274359 filed on Sep. 10, 1998, Patent application 10-286091 filed on Sep. 22, 1998, Patent application 10-280530 filed on Sep. 16, 1998, Patent application 10-283505 filed on Sep. 18, 1998, and Patent application 10-299167 filed on Oct. 6, 1998.

The invention will be more perfectly understood from the following description in details. Further scope of application of the invention will also become clear from the following description in details. However, the detailed description and specific examples are the preferred embodiments of the invention and described only for the purpose of illustration. Various changes and modifications may be made by those skilled in the art within the spirit and scope of the invention.

It is not intended to dedicate any disclosed embodiments to the public, and to the extent any disclosed modifications or alterations may not literally fall within the scope of the claims, they are considered to be part of the invention under the doctrine of equivalents.

BRIEF DESCRIPTION OF DRAWINGS

FIG. 17 is a table of operation modes of the dehumidifying air conditioner and operations of various devices as an embodiment of the invention.

FIG. 21 is a table of operation modes of the dehumidifying air conditioner shown in FIG. 18 and operations of various devices.

BEST MODE FOR CARRYING OUT THE INVENTION

While embodiments of the invention will be hereinafter described, the scope of the invention is not limited by the embodiments.

Now the embodiments of the invention will be described, referring to the appended drawings. Incidentally, counterparts in more than one of the drawings are provided with the same or similar symbols and the explanation of them may not be repeated.

Figure 1:
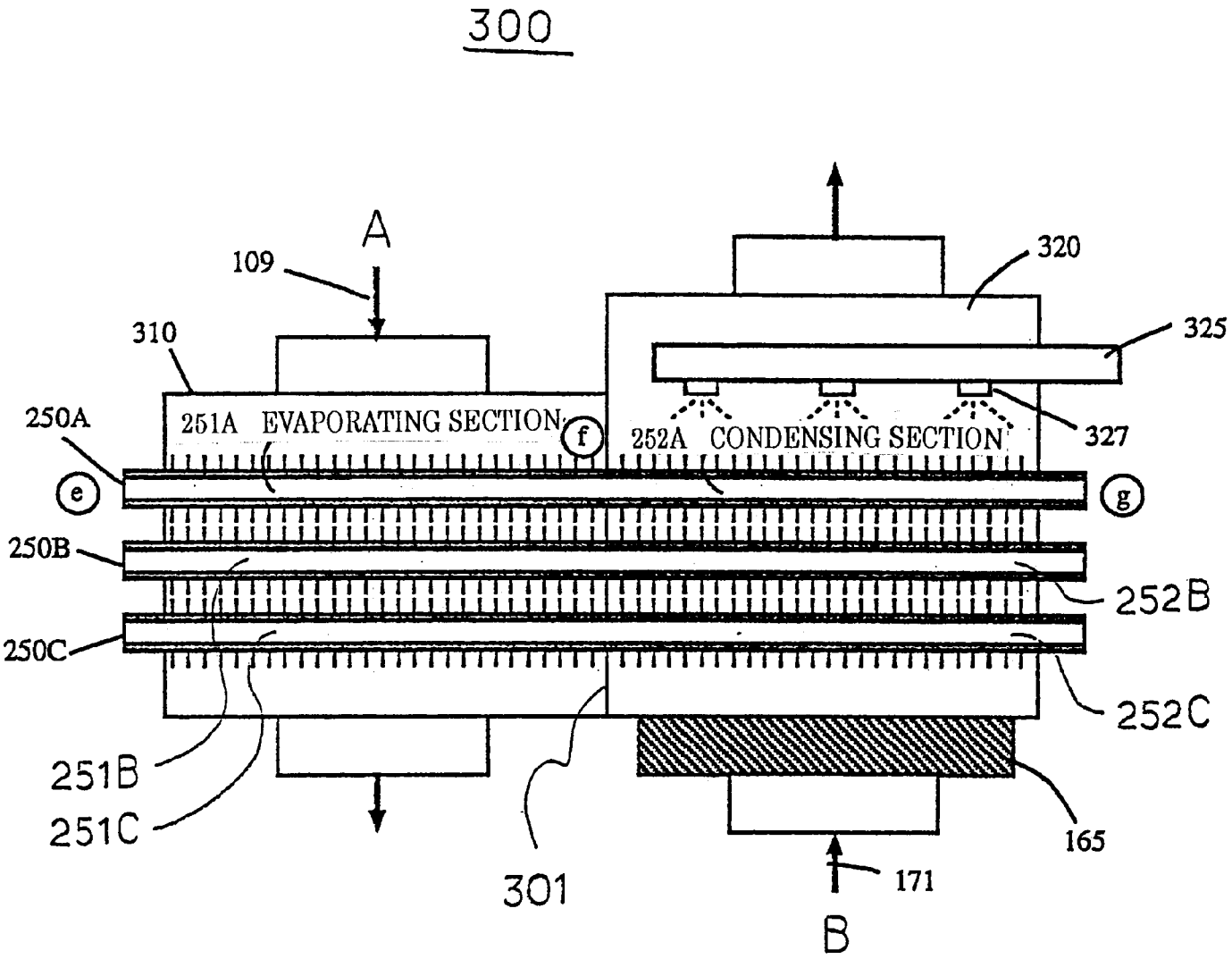
FIG. 1 is a schematic, cross sectional view of a heat exchanger as an embodiment of the invention.

FIG. 1 is a schematic cross sectional view of a heat exchanger as an embodiment of the invention. In the drawing, a heat exchanger 300 comprises a first compartment 310 for flowing a first fluid or process air A and a second compartment 320 for flowing a second fluid or external (ambient) air B, disposed side by side with a partition wall 301 interposed therebetween.

A plurality of heat exchanging tubes as fluid passages for flowing a refrigerant 250 are arranged generally horizontally to pass through the first compartment 310, the second compartment 320, and the partition wall 301. Part of the heat exchanging tube passing through the first compartment is an evaporating section 251 as a first fluid passage (A plurality of evaporating sections are referred to as 251A, 251B and 251C. In case the plurality of evaporating sections need not be discussed individually, hereinafter they will be simply referred to as 251). Part of the heat exchanging tube passing through the second compartment is a condensing section second fluid passage (A plurality of evaporating sections are referred to as 252A, 252B and 252C. In case the plurality of condensing sections need not be discussed individually, hereinafter they will be simply referred to as 252).

In the embodiment shown in FIG. 1, the evaporating section 251A and the condensing section 252A are configured to an integral passage with a single tube. The same is true for the evaporating sections 251B, 251C and the condensing section 252B, 252C. Since the two sections 251 and 252 are made up of a single tube and since the two compartments 310 and 320 are disposed side by side with the partition wall 301 interposed between the two compartments, the heat exchanger 300 as a whole can be made in a small size.

Such a configuration can be manufactured by arranging a plurality of plate fins on the evaporating section side, one partition wall 301, and a plurality of plate fins on the condensing section side, each having holes of a diameter nearly equal to (practically slightly greater than) the outside diameter of the heat exchanging tube, with the holes aligned, inserting a plurality of heat exchanging tubes into the holes, and expanding the diameter of the heat exchanging tubes by means of tube diameter expanding rods, hydraulic pressure, ball passage, etc. The form of the plate fin on the evaporating section side (first compartment side) may be different from that on the condensing section side (second compartment side). For example, the plate fin on the evaporating section side may be provided with louvers or wrinkles to disturb the flow of the first fluid, while the plate fin on the condensing section side may be formed flat.

In the embodiment shown in FIG. 1, the evaporating sections are arranged in the order of, from top downward in the drawing, 251A, 251B and 251C, and the condensing sections in the order of 252A, 252B and 252C from top downward.

It is configured that the process air A as the first fluid enters from above the first compartment through a duct 109 and flows out downward, and that the external air B as the second fluid enters from under the second compartment through a duct 171 and flows out upward. That is to say, the process air A and the external air B flow in counter directions each other.

A water spray pipe 325 is disposed in the upper part of the second compartment 320, namely above the heat exchanging tubes which constitute the condensing section 252. The water spray 325 is provided with nozzles 327 at appropriate intervals so that water flowing through the water spray pipe 325 is sprayed over the heat exchanging tubes which constitute the condensing section 252.

An evaporating humidifier 165 is disposed at the inlet for the second fluid B the second compartment 320. The evaporating humidifier 165 is made of a material having both moisture absorbing property and air-permeability such as ceramic paper or nonwoven fabric.

Figure 2:
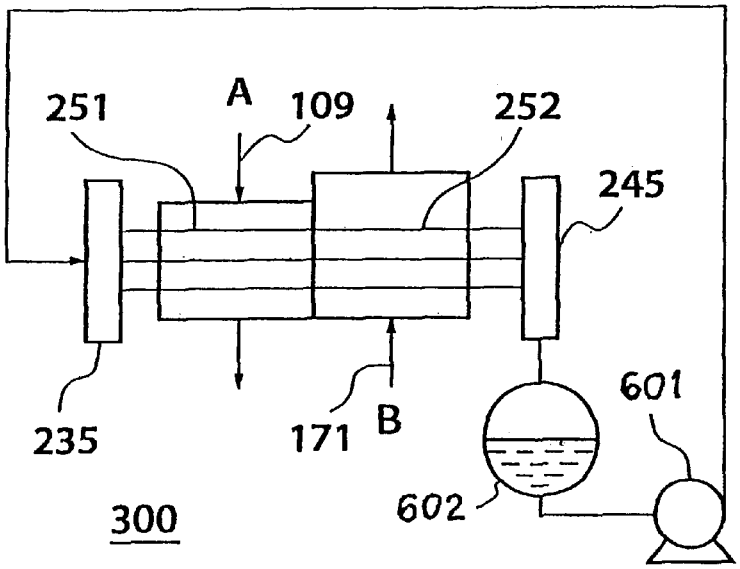
FIG. 2 is a conceptual view of a heat exchanger as an embodiment of the invention.
Figure 2:
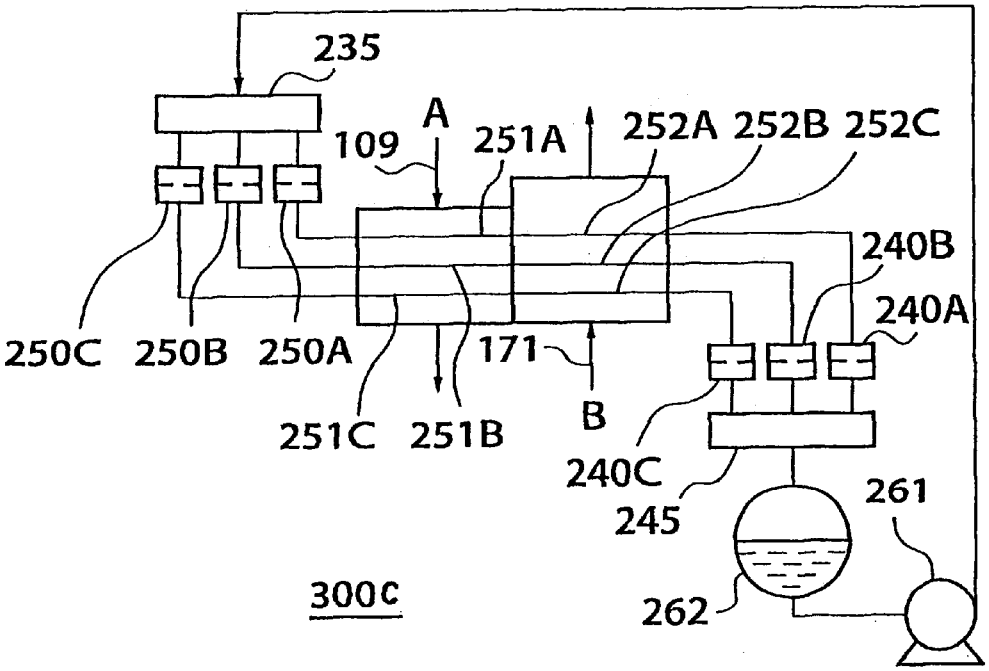

As shown in FIG. 2, the heat exchanger 300 may be provided with a refrigerant circulator 601 as a means for supplying and circulating a liquid state refrigerant. The refrigerant circulator 601 is, for example, a pump for circulating a refrigerant liquid. In FIG. 2(*a*), the refrigerant liquid sent from the pump 601 is supplied to a header 235 disposed at the inlet of the first fluid passage 251, then to the evaporating section 251 being the first flow passage connected to the header 235, and evaporates there as it exchanges heat with the process air A flowing through the first compartment. The evaporated refrigerant flows to the condensing section 252 and there condenses by exchanging heat with the external air B flowing through the second compartment. The condensed and liquefied refrigerant reaches a header 245 connected to the condensing section 252, flows down through a refrigerant pipe connected to the header 245, flows down by gravity and stored in a liquid refrigerant tank 602 placed vertically below the header 245, returns to the inlet of the pump 601 through the refrigerant pipe connected to the liquid refrigerant tank 602, and is supplied through a discharge pipe connected to the outlet of the pump 601 to the header 235. Thereafter, the cycle consisting of the above steps is repeated.

The evaporating pressure in the evaporating section 251, in its turn the condensing pressure in the condensing section 252, namely the specific pressure (the second pressure) of the invention is determined by the temperature of the process air A and the temperature of the external air B. Since the heat exchanger 300 in the embodiment shown in FIGS. 1 and 2 utilizes heat transfer by evaporation and heat transfer by condensation, it is excellent in both heat transfer coefficient and heat exchange efficiency. Since the refrigerant as the third fluid flows through the evaporating section 251 to the condensing section 252, namely since it is forced to flow generally in one direction as a whole, it has a high heat exchange efficiency. The heat exchange coefficient Φ will be described later, referring to FIG. 4.

The inside surfaces of the heat exchange tubes constituting the evaporating section 251 and the condensing section 252 are preferably made to be high performance heat transfer surfaces by providing spiral grooves like the inside surface of a rifle gun barrel. The refrigerant liquid flowing along the inside ordinarily flows so as to wet the inside surface. If the spiral grooves are provided, heat transfer coefficient increases as the boundary layer of the flow is disturbed.

While the process air A flows through the first compartment 310, the fins provided on the outer side of the heat exchange tubes are preferably made in a louver shape to disturb the flow of the fluid. However, in case water is sprayed, the fins are preferably flat and covered with an anti-corrosion coating. This is to prevent corrosive substances that may be present mixed in with the water from corroding the fins and the tubes as such substances become high in concentration as water evaporates. Also, the fins are preferably made of aluminium, copper, or alloys thereof.

In the case of FIG. 2(*b*), a throttle such as an orifice is interposed between the header 235 and the evaporating section 251. With such a configuration, it is possible to provide a heat exchanger of an extremely high heat exchange efficiency because heat can be exchanged between the first and the second fluids in counterflow manner. The plurality of evaporating sections 251A, 251B and 251C are respectively provided with throttles 250A, 250B and 250C. The corresponding condensing sections 252A, 252B and 252C are respectively provided, between the header 245 and them, with throttles 240A, 240B and 240C.

In such a configuration, the process air A flows at right angles to the heat exchange tubes so as to come into contact in succession with the evaporating sections 251A, 251B and 251C in that order in the first compartment to exchange heat with the refrigerant. The external air B of a lower temperature at the inlet than the process air temperature is forced to flow at right angles to the heat exchange tubes so as to come into contact in succession with the condensing sections 252C, 252B and 252A in that order. In such a case, while the evaporating pressures (temperatures) of the refrigerant are determined for each group of sections provided with the throttles, in the evaporating section, they are in the order of high to low for the sections 251A, 251B and 251C. In the condensing section, they are in the order of low to high for the sections 252C, 252B and 252A. Since the flows of the process air A and the external air B are in counter flow with each other, an extremely high heat exchange heat exchange efficiency Φ such as over 80% can be realized.

The specific pressures, or the evaporating pressures in the plurality of evaporating sections 251A, 251B and 251C can be different from each other as a result of providing mutually independent throttles 250A, 250B and 250C at the inlets of the respective evaporating sections. The process air is made to flow into the first compartment so that it comes into contact with evaporating sections 251A, 251B and 251C in that order. Since the process air is deprived of its sensible heat, its temperature lowers along the length from the inlet to the outlet. As a result, the evaporating pressures in the evaporating sections 251A, 251B, and 251C lower in that order, and the evaporation temperatures are arranged in high to low order.

In exactly the same manner, the condensing temperatures are in the order of 252C, 252B and 252A from low to high. Like the evaporating sections, since the condensing sections are provided with mutually independent throttles 240A, 240B and 240C, they can have mutually independent condensing pressures and temperatures. When the external air is made to flow from the inlet to the outlet of the second compartment so as to come into contact with the condensing sections 252C, 252B and 252A in the order, the condensing pressures are arranged in that order. Therefore, when the flows of the process air A and the external air B are noted, since they are in the so-called counterflow, as described above, a high heat exchange efficiency can be achieved.

Since the refrigerant as a whole flows in one direction from the evaporating section 251 to the condensing section 252, the evaporating pressure is slightly higher than the condensing pressure. However, since the evaporating section 251 and the condensing section 252 are configured with a continuous heat exchange tube, the evaporating pressure is deemed to be substantially the same as the condensing pressure.

Figure 3:
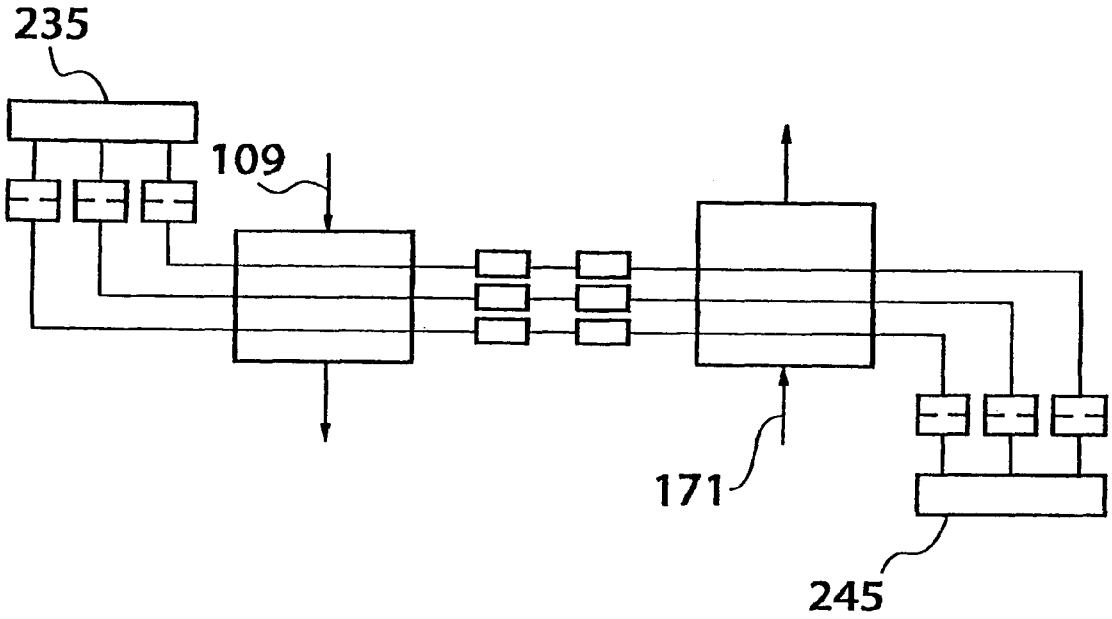
FIG. 3 is a conceptual view of a heat exchanger as an embodiment of the invention.

Another embodiment of the invention will be described in reference to FIG. 3. FIG. 3 shows an arrangement, based on the heat exchanger shown in FIG. 2, in which the first compartment is separated from the second compartment, and furthermore, the first fluid passage is separated from the second fluid passage. That is to say, the evaporating sections 251A, 251B and 251C are respectively connected to the condensing sections 252A, 252B and 252C. Headers are provided between the first and the second flow passages for each of the sections A, B and C and connected through piping. Also in this arrangement, the performance of the heat exchanger remains basically the same, but ease of manufacture and layout flexibility are improved.

Figure 4:
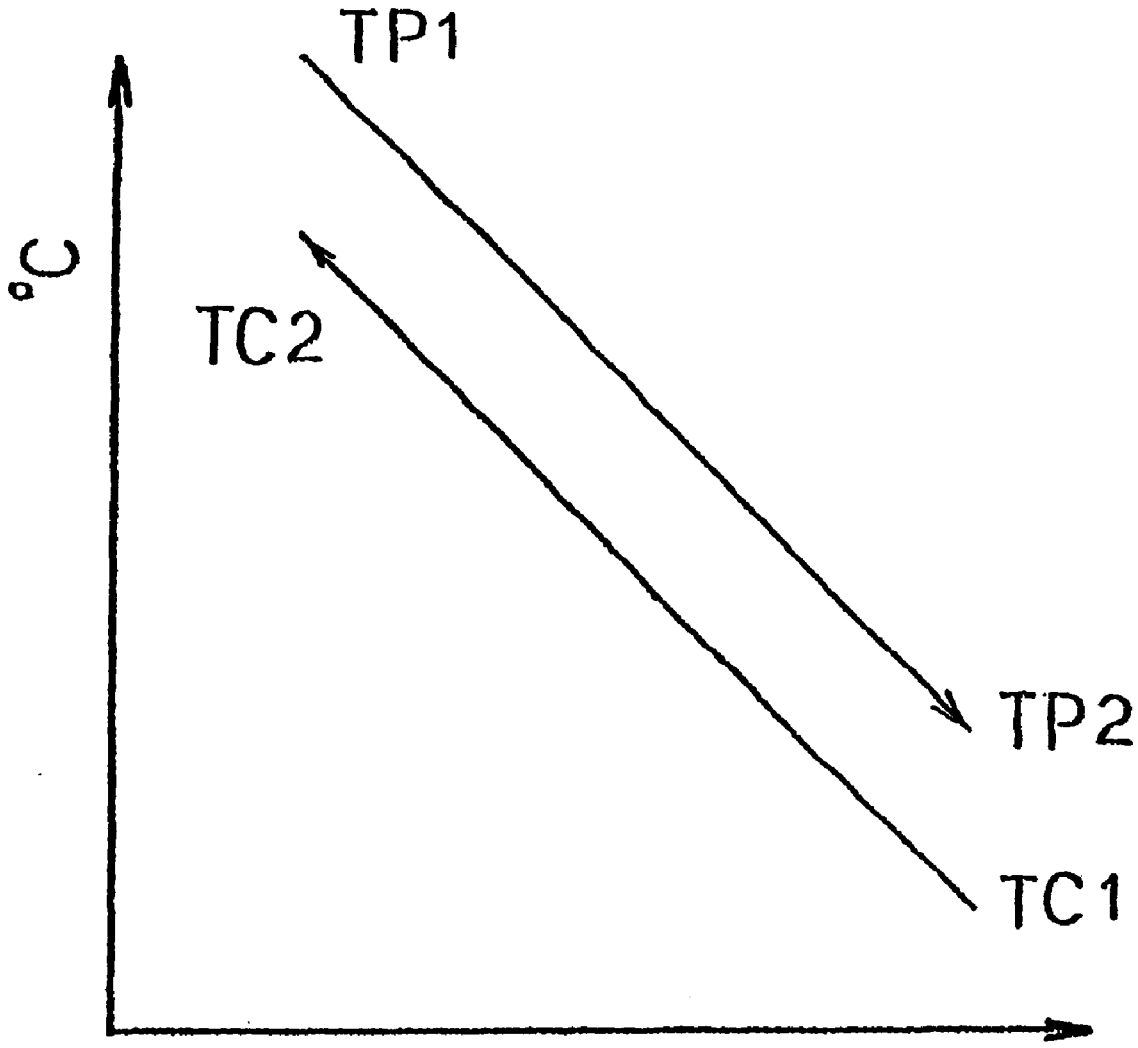
FIG. 4 is a chart for explaining the heat exchange efficiency of heat exchange.

Referring to FIG. 4, heat exchange efficiency will be described. In FIG. 4, the symbol TP1 stands for the temperature of the fluid on the higher temperature side at the inlet of the heat exchanger, TP2 for the outlet temperature, TC1 for the fluid on the lower temperature side at the inlet of the heat exchanger, and TC2 for the outlet temperature. When the symbol $\phi$ is assumed to be the heat exchange efficiency, and the cooling of the fluid on the higher temperature side is noted, namely when the purpose of the heat exchange is cooling, $\phi=(TP1-TP2)/(TP1-TC1)$. When the heating of the fluid on the lower temperature side is noted, namely name when the purpose of the heat exchange is heating, $\phi=(TC2-TC1)/(TP1-TC1)$.

With the heat exchanger of the invention described above, since the third fluid flow through from the first fluid passage to the second fluid passage, heat can be transferred from the first compartment to the second compartment. Since the third fluid evaporates at the specific pressure on the heat transfer surface on the fluid path side of the first fluid passage, the third fluid takes heat from the first fluid. Since the third fluid condenses at nearly the same pressure as the specific pressure on the heat transfer surface on the fluid path side of the second fluid passage, the third fluid imparts heat to the second fluid. Since the above-mentioned heat transfer is effected by evaporating or condensing heat transfer, the heat transfer efficiency is much higher in comparison with heat transfer by conduction or convection. Therefore, when it is used, for example, in desiccant air conditioner, it can be favorably used in place of a cross flow type heat exchanger of a low heat exchange efficiency or a rotary type heat exchanger of a large volume, and it can remarkably improve the efficiency of the desiccant air conditioner.

As will be described later, referring to FIG. 12, when a vapor-liquid separator is provided, heat exchange in the heat exchanger of the invention is uniform since the refrigerant gas and the refrigerant liquid are separated.

Figure 5:
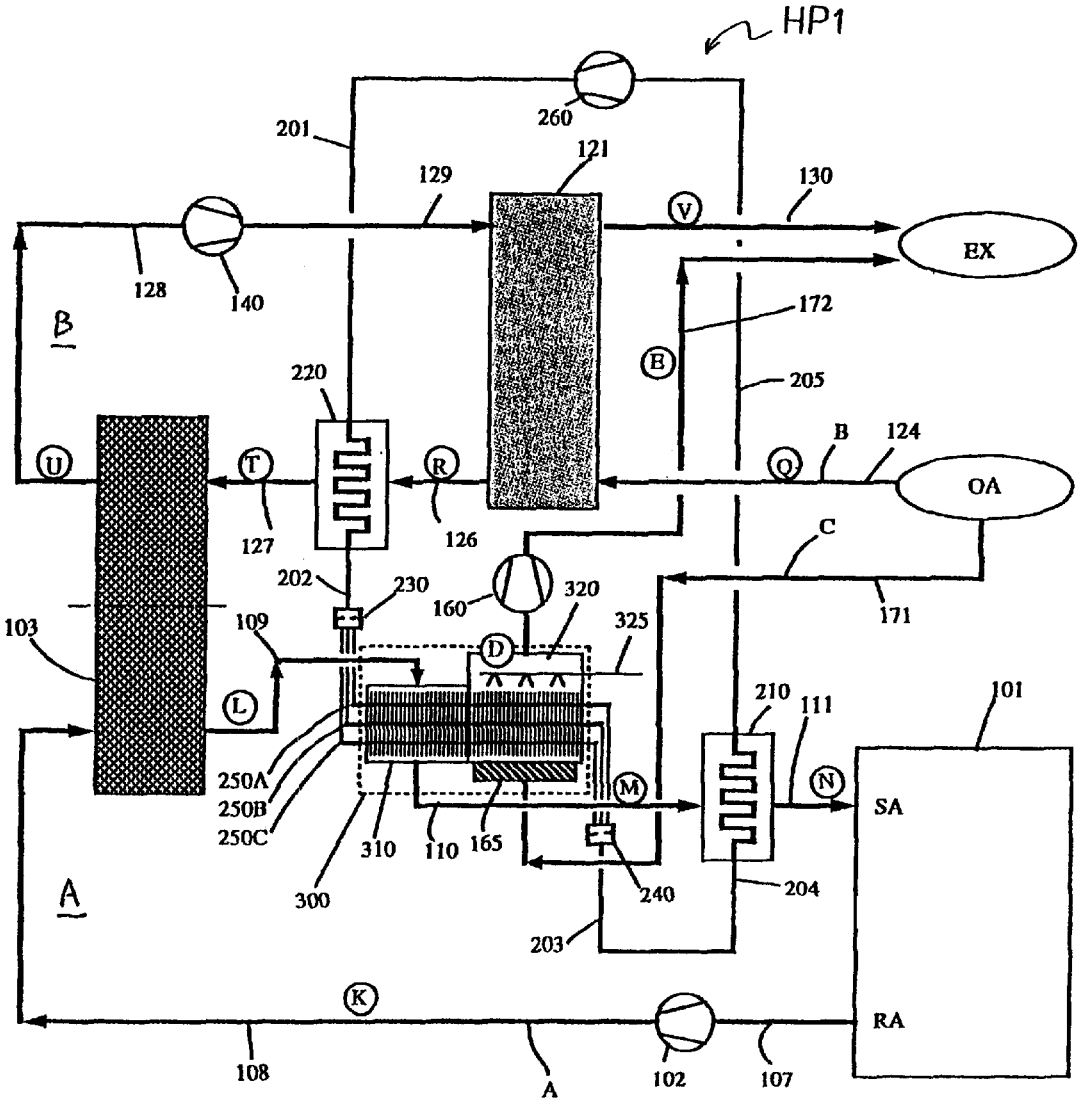
FIG. 5 is a flow chart of a heat pump and a dehumidifying air conditioner as embodiments of the invention.
Figure 6:
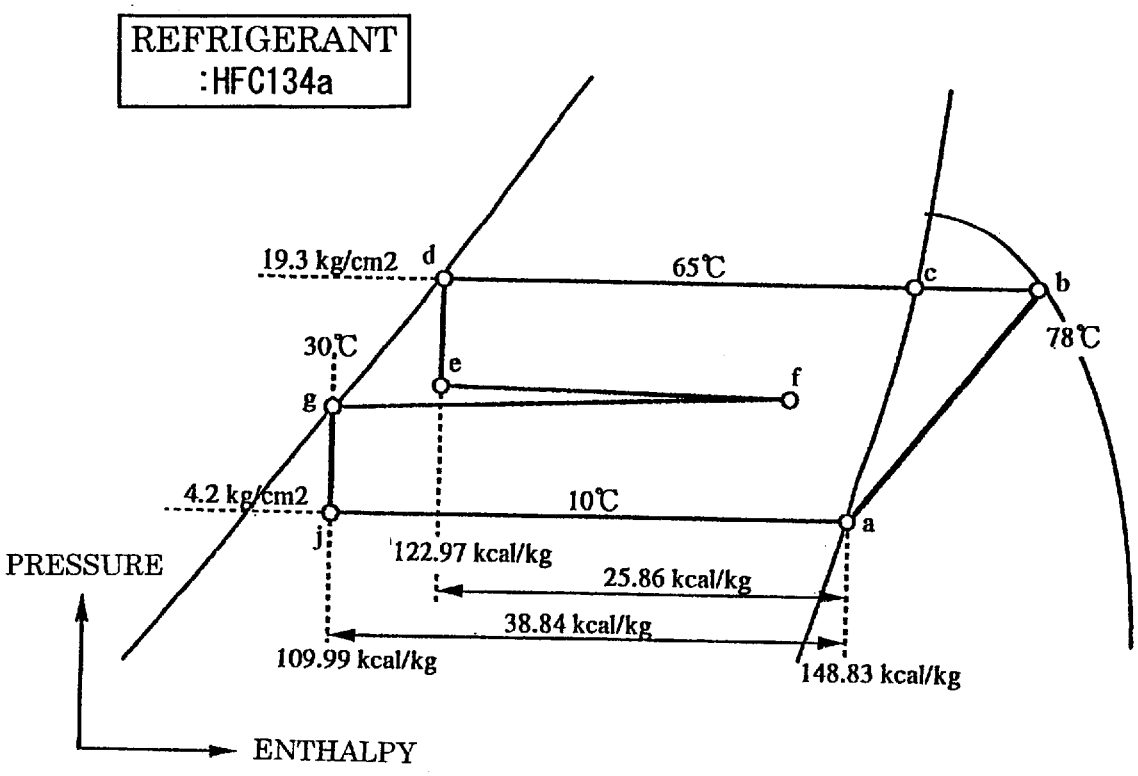
FIG. 6 is a Mollier chart for the heat pump shown in FIG. 5.

Referring to FIG. 5, an embodiment of a heat pump HP1 of a high COP will be described together with explanation of an embodiment of a desiccant air conditioner incorporating the heat pump HP1, having a high COP and arranged so as to be compact in size. The heat exchanger shown in FIG. 1 is suitable for use in the heat pump HP1. FIG. 6 is a Mollier chart for explaining the refrigerant cycle of the heat pump HP1 or the first embodiment of the invention.

This air conditioning system is to lower the humidity of the process air by means of a desiccant (drying agent) and to maintain in a comfortable environment the air conditioning space to which the process air is supplied.

Referring to FIG. 5, the path of the process air as the first fluid will be described. As shown, air to be processed RA is taken from a space 101 to be processed using a blower 102 through an intake passage or a duct 107. The discharge port of the blower 102 is connected through a duct 108 to the inlet on the process air side of a desiccant wheel 103 which serves as a moisture adsorber. The outlet on the process air side of the desiccant wheel 103 is connected through a duct 109 to the inlet of a first compartment 310 of a heat exchanger 300 serving as the second heat exchanger explained in reference to FIG. 1.

The process air is dried as its moisture is removed by adsorption in the desiccant wheel 103 and reaches the heat exchanger 300 through the duct 109. The temperature of the process air is raised by the heat of adsorption as the moisture is adsorbed with the desiccant.

In the first compartment 310, the process air is cooled by the refrigerant that evaporates in the evaporating section 251. The process air outlet of the first compartment 310 is introduced through a duct 110 to a cooler 210 which serves as a third heat exchanger. The process air which has been dried and cooled to an extent is further cooled here, made into the process air SA having an appropriate humidity and an appropriate temperature, and returned through a duct 111 to the air conditioning space 101.

Next, the path of the outside (ambient) air as the second fluid on the second compartment 320 side of the heat exchanger 300 will be described. A duct 171 for drawing outside air from the outdoors OA is connected to the inlet of the second compartment 320. The outside air drawn in through the duct 171 is humidified with an evaporating humidifier 165, deprived of its sensible heat, and its temperature lowers. The outside air of the lowered temperature, when it passes through the second compartment 320, takes heat from the refrigerant in the condensing section 252, and causes the refrigerant to condense.

The heat exchanging tube 252 is arranged to receive spray water from a spray pipe 325. The outside air is cooled also with the sprayed water. The sensible heat of the outside air and the evaporating heat of the sprayed water cause the refrigerant in the condensing section 252 to condense.

A duct 172 is connected to the outside air outlet of the second compartment 320. A blower 160 is disposed in the middle of the duct 172. The outside air that has been used for condensing the refrigerant is discharged as exhaust EX through the duct 172 to the outdoors.

Next will be described the path of the refrigerant which serves as the third fluid for the heat pump HP1. As shown, the refrigerant gas compressed by a refrigerant compressor 260, which serves as a pressure raiser, is introduced to a regeneration air heater (as a cooler or condenser when seen from the refrigerant side) 220 through a refrigerant gas piping 201 connected to the discharge port of the compressor 260. The temperature of the refrigerant gas compressed with the compressor 260 is raised by the heat of compression which, in turn, heats the regeneration air. The refrigerant gas itself condenses as it is deprived of its heat.

The refrigerant outlet of the heater 220 is connected to the inlet of the evaporating section 251 of the heat exchanger 300 through a refrigerant passage 202. A throttle 230 (serving also as a header) is provided in a position which is in the middle of the refrigerant passage 202 and in the vicinity of the inlet of the evaporating section 251. In this embodiment, the header 230 is constituted to include the throttle.

The refrigerant liquid coming out of the heater 220 is reduced in pressure, expanded, and part of it evaporates (flashes). The refrigerant in the state of liquid-gas mixture reaches the evaporating section 251 and here flows so as to wet the inside wall of the tubes of the evaporating section, evaporates, and cools the process air flowing in the first compartment 310.

Since the evaporating section 251 and the condensing section 252 constitute a continuous tube, or an integral flow passage, the refrigerant that has evaporated (and that which has not evaporated) flows into the condensing section 252 and is deprived of its heat by the sprayed water and by the outside air flowing through the second compartment. However, although not shown, it may alternatively be configured such that the first section 310 and the second section 320 are separated, and accordingly the evaporating section 251 and the condensing section 252 are made separate, and respectively installed in different places. In that case, the evaporating section 251 and the condensing section 252 will be communicated with each other through, for example, piping.

The outlet side of the condensing section 252 is connected to the cooler (as an evaporator when seen from the refrigerant side) 210 through a refrigerant liquid piping 203. A throttle 240 (serving also as a header) is provided in the middle of the refrigerant liquid piping 203. While the attachment position of the throttle 240 may be anywhere between just after the condensing section 252 and the inlet of the cooler 210, preferably it is just before the inlet of the cooler 210. The reason is that the insulation of the piping becomes thicker, because the refrigerant after the throttle 240 becomes considerably colder than the atmosphere. In that case, the throttle 240 and the header are preferably separate. The refrigerant that has condensed in the condensing section 252 is reduced in pressure by the throttle 240, expanded to lower the temperature, evaporates as it enters the cooler 210, and cools the process air with its evaporation heat. The throttles 230, 240 may be for example orifices, capillary tubes, expansion valves, or the like.

The refrigerant vaporized into the gaseous state in the cooler 210 is led to the intake side of the refrigerant compressor 260 and the above cycle is repeated thereafter.

Next the path of the regeneration air B for regenerating the desiccant will be described. The outside air drawn in from outdoors through an outside air duct 124 is fed into a sensible heat exchanger 121. The sensible heat exchanger 121 is a heat exchanger of a rotor-shape and configured such that a large volume rotor filled with a heat storage material rotates in a housing divided into two compartments, with one compartment for flowing the outside air just drawn in while the other compartment is for flowing a fluid for exchanging heat with the outside air.

The outside air heated to a certain extent with the sensible heat exchanger 121 reaches the heater 220 through a duct 126, here further heated with the refrigerant gas to a higher temperature, and introduced as the regeneration air through a duct 127 into a regeneration side of the desiccant wheel 103.

The regeneration air after regenerating the desiccant with the desiccant wheel 103 is led to the sensible heat exchanger 121 through ducts 128, 129 interconnecting the desiccant wheel 103 and the other compartment of the sensible heat exchanger 121. A blower 140 is provided between the ducts 128, 129 to draw in outside air, and to flow the regeneration air.

The regeneration air after exchanging heat with (giving heat to) the outside air is discharged as exhaust EX through a duct 130. Incidentally, the positions of the blowers 102, 140 and 160 are not limited to those described above but may be any positions along the respective fluid passages for blowing.

In the described process air cooler 300 for use in the heat pump and the dehumidifying air conditioner, it is assumed that the refrigerant flows through in one direction from the evaporating section 251 side to the condensing section 252 side. However, another configuration may be used in place of the above: for example, the evaporating section 251 and the condensing section 252 are made in an integral tube with both its ends closed, as a so-called heat pipe so that the refrigerant condensed in the condensing section 252 is returned to the evaporating section 251 by utilizing capillary phenomenon or the like, and vaporized again there, thus causing the refrigerant to circulate within the single tube. In that case too, the heat transfer likewise utilizes both evaporation and condensation and such advantages are obtained that a high heat transfer coefficient is achieved and that the constitution as the heat exchanger for exchanging heat between the process air and the cooling fluid can be simplified.

Referring to FIG. 6, the function of the heat pump HP1 as an embodiment of the invention in the air conditioning system shown in FIG. 5 will be described. FIG. 6 is a Mollier chart when HFC 134*a* is used as the refrigerant. In this chart, the horizontal axis represents enthalpy and the vertical axis represents pressure.

As shown, the point a corresponds to the state at the refrigerant outlet of the cooler 210 shown in FIG. 5, in a saturated gas state. The pressure is 4.2 kg/cm$^2$ as the third pressure, the temperature is 10° C., and the enthalpy is 148.83 kcal/kg. This gas is drawn in and compressed with the compressor 260 and the state of the gas at the discharge port of the compressor 260 is shown at the point b. In this state, the pressure is 19.3 kg/cm$^2$ as the first pressure, and the temperature is 78° C., in the superheated state.

The refrigerant gas is cooled in the heater 220 and reaches the state represented by the point c on the Mollier chart. At this point, is the refrigerant in a saturated gas state with a pressure of 19.3 kg/cm$^2$ and a temperature of 65° C. Further cooling and condensation under this pressure leads to the state of point d. This point is in a saturated liquid state with the same pressure and the temperature as those at the point c, namely 19.3 kg/cm$^2$ and 65° C., and with an enthalpy of 122.97 kcal/kg.

The refrigerant liquid is reduced in pressure with the throttle 230 and flows into the evaporating section 251 of the heat exchanger 300. This state is represented by the point e on the Mollier chart. The temperature is about 30° C. The pressure is the second pressure of the invention or a specific pressure. In this embodiment, an intermediate value (intermediate pressure) between 4.2 kg/cm$^2$ and 19.3 kg/cm$^2$, namely a saturation pressure corresponding to 30° C. Here, the refrigerant is in the state of mixture of liquid. and gas as part of the liquid has evaporated. The refrigerant liquid evaporates in the evaporating section 251 under the second pressure and reaches under the same pressure as the state represented by the point f which is between the saturated liquid line and the saturated gas line. Here, almost all the liquid has evaporated. Incidentally at the point e, the ratio of refrigerant liquid to gas is the inverted ratio of the difference between the enthalpy at the points where the saturated pressure line of 30° C. crosses the saturated liquid line and the saturated gas line and the enthalpy at the point (d). Therefore, as is clear from the Mollier chart, liquid is greater in weight. However, since the gas is overwhelmingly greater in volumetric ratio, a large amount of gas mixes with the liquid in the evaporating section 251, the liquid evaporates in the state of wetting the inside surfaces of the tubes of the evaporating section 251.

The refrigerant in vapor phase or in vapor-liquid mixture phase represented by the point f flows into the condensing section 252. In the condensing section 252, the refrigerant is deprived of its heat by the outside air flowing through the second compartment and/or with the sprayed water, and reaches the state represented with the point g. This point is on the saturated liquid line on the Mollier chart, at a temperature of 30° C. and with an enthalpy of 109.99 kcal/kg.

The refrigerant in the state of point g is reduced in pressure with the throttle 240, to 4.2 kg/cm$^2$ which is the saturation pressure at 10° C., and, as a refrigerant liquid-gas mixture, reaches the cooler 210 (as an evaporator when seen from the refrigerant), takes heat from the process air, evaporates into the state of saturated gas of the point a on the Mollier chart, drawn again into the compressor 260, and thereafter the above-cycle is repeated.

As described above, in the heat exchanger 300, the state of the refrigerant changes from the point e to f because of evaporation in the evaporating section 251, and from the point f to g because of condensation in the condensing section 252. Since the changes are evaporation heat transfer and condensation heat transfer, the heat transfer efficiency is very high.

Furthermore, when the compression heat pump HP1 including the compressor 260, the heater (refrigerant condenser) 220, the throttles 230, 240, and the cooler (refrigerant evaporator) 210 is not provided with a heat exchanger 300, since the refrigerant in the state of point d in the heater (refrigerant condenser) 220 is returned to the cooler (refrigerant evaporator) 210, the differential enthalpy that can be used in the cooler (refrigerant evaporator) 210 is only 25.86 kcal/kg (=148.83−122.97). In case the heat exchanger 300 is provided as in the embodiment of the invention, the differential enthalpy is 38.84 kcal/kg (=148.83−109.99), which means a decrease in the amount of gas circulating in the compressor 260 for the same cooling load, and in its turn a decrease in the required power can be as much as 33%. That is to say, the same effect as an economizer for taking in flash gas in a medium state is obtained though the compressor 260 is of a single stage type or a multiple (for example two) stage type.

Figure 7:
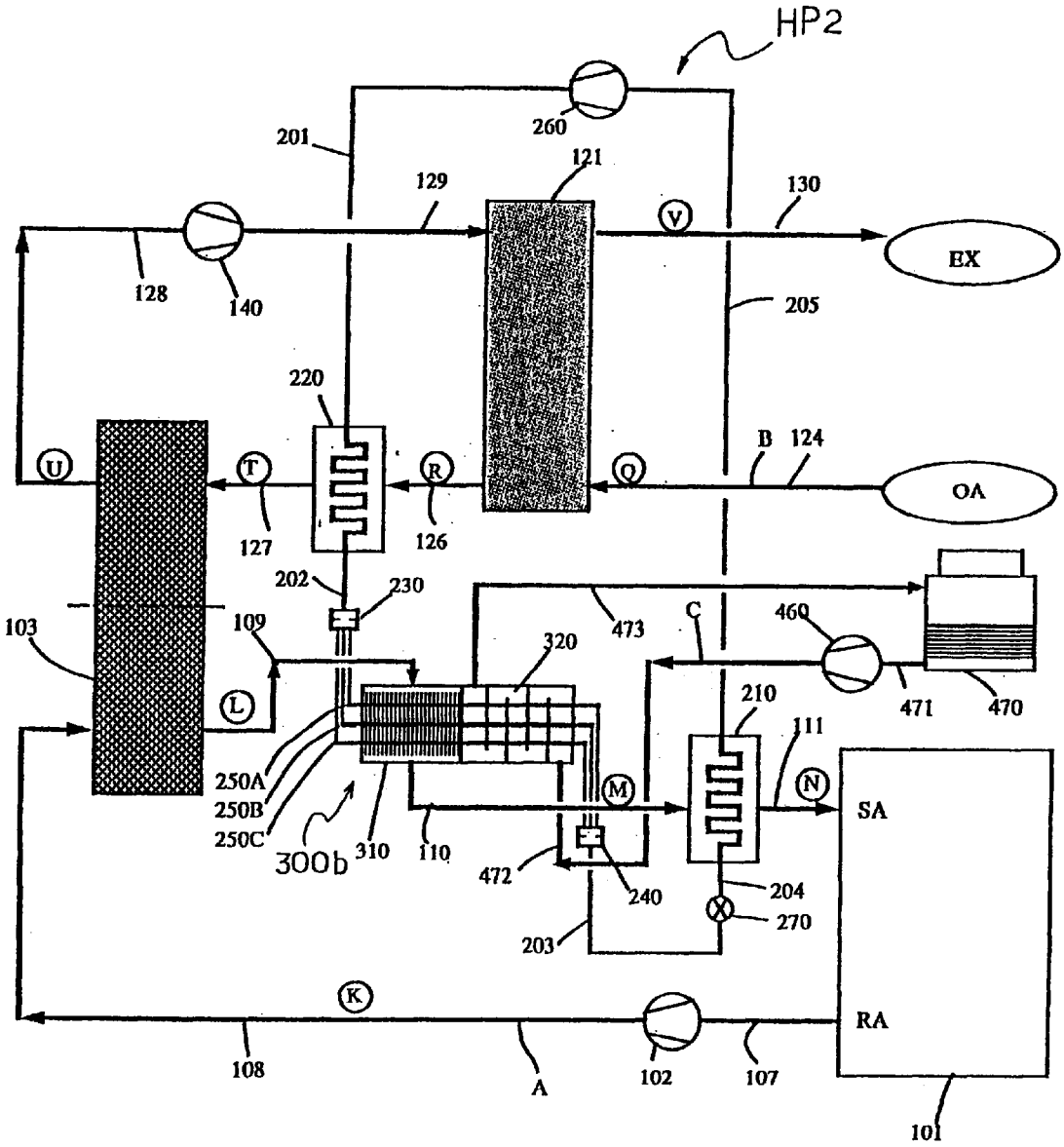
FIG. 7 is a flow chart of a desiccant air conditioner using the heat pump as another embodiment of the invention.

Referring to FIG. 7, another embodiment of a heat pump HP2 will be described together with an explanation of another embodiment of a desiccant air conditioner incorporating the heat pump P2. The configuration and function of the embodiment of FIG. 7 are the same as those of FIG. 5 except water is used as the second fluid to flow through the second compartment of the heat exchanger 300*b* used in place of the heat exchanger 300. As shown, cooling water cooled with a cooling tower 470 installed outdoors to about 32° C. in summer is led to the intake port of a cooling water pump 460 through a cooling water piping 471 connected to the bottom portion of the cooling tower 470, and sent to the second compartment of the heat exchanger 300*b* through a cooling water piping 472 connected the discharge port.

In the second compartment of the heat exchanger 300*b*, the cooling water meanders around obstruction plates provided at right angles to the heat exchanging tubes outside the heat exchanging tubes. A cooling water piping 473 is connected to the cooling water outlet of the second compartment so that the cooling water heated to a temperature raised with the heat exchanger 300*b* is returned to the cooling tower. In this way, in contrast to the embodiment of FIG. 5 in which the refrigerant is condensed in the condensing section with the outside air, in this embodiment the refrigerant is condensed in the condensing section with the cooling water. Since the refrigerant cycle for the heat pump HP2 is the same as that shown in FIG. 6, the explanation is not repeated.

Next, referring to FIG. 8, another embodiment of a heat pump HP3 will be described together with explanation of another embodiment of a desiccant air conditioner incorporating the heat pump HP3. With this embodiment, since counterflow heat exchanging can be carried out between the first and the second fluids, a heat pump or a dehumidifying air conditioner of a high COP can be provided. The heat pump HP3 uses a heat exchanger 300*c* as shown schematically in FIG. 2(*b*) or FIG. 9. The heat exchanger 300*c* shown in FIG. 9 has basically the same configuration as that of the heat exchanger 300 shown in FIG. 1, except the former is not provided with the water spray pipe 325, the nozzles 327, or the evaporating humidifier 165.

Figure 8:
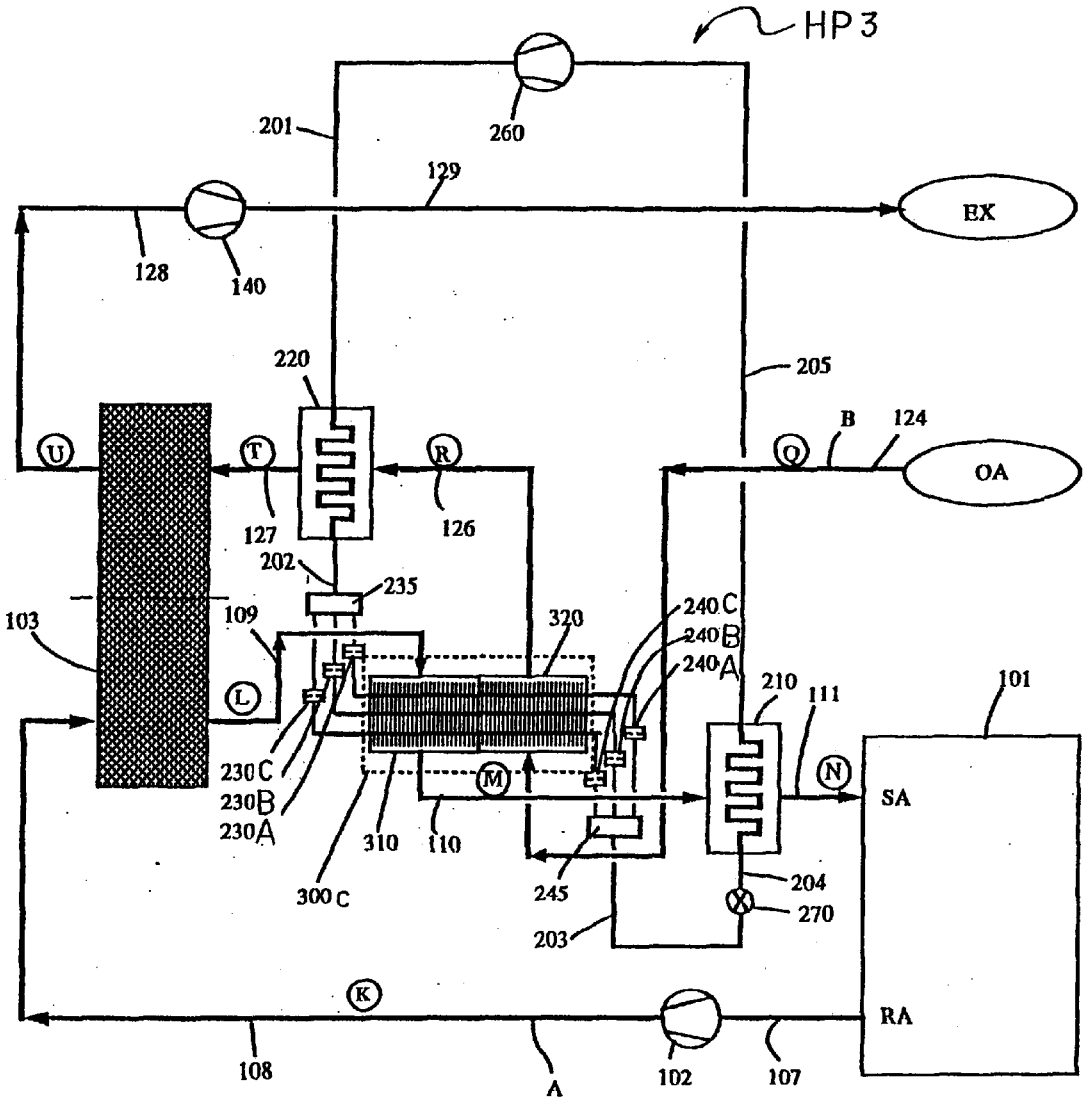
FIG. 8 is a flow chart of a heat pump and a dehumidifying air conditioner as different embodiments of the invention.
Figure 9:
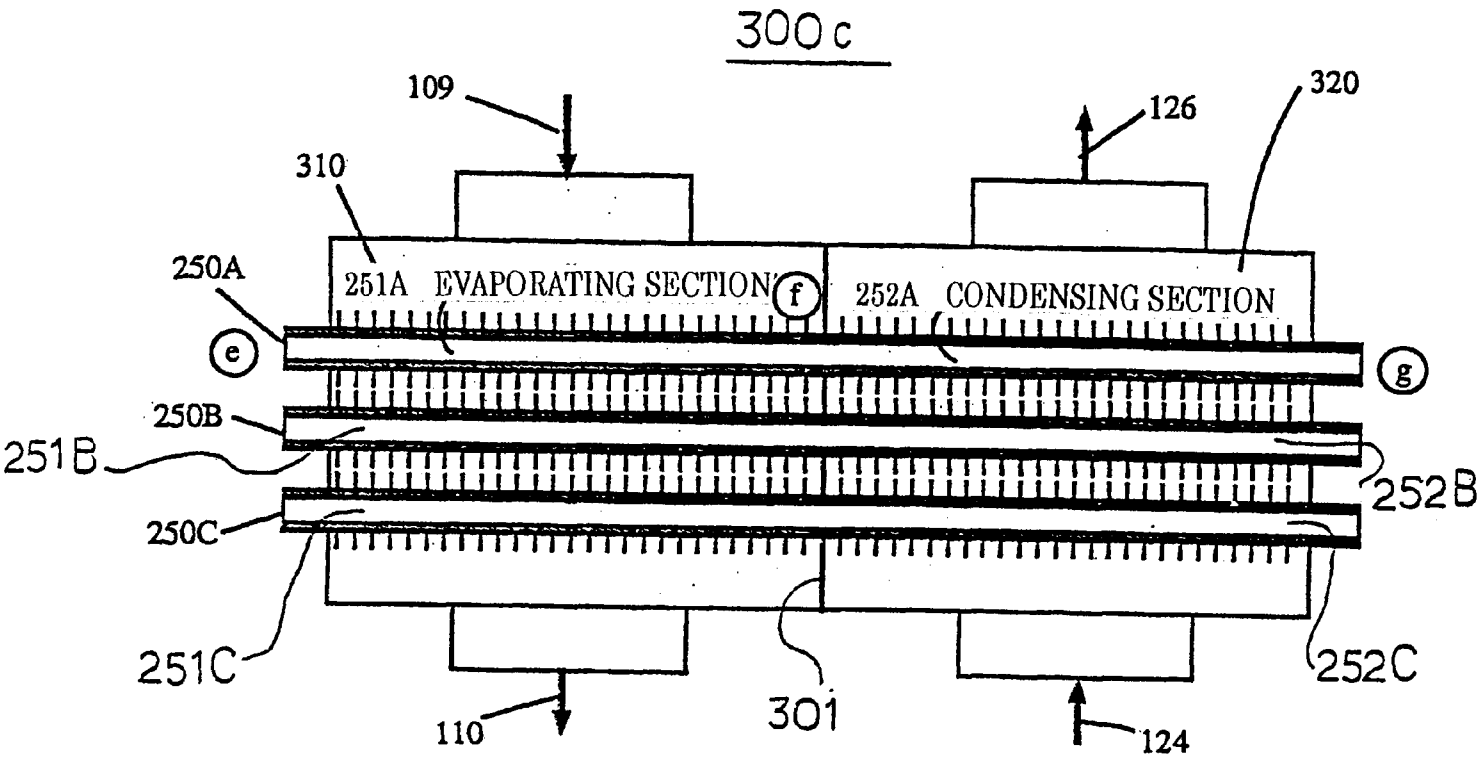
FIG. 9 is a diagramatical, cross sectional view of a heat exchanger suitable for use in the heat pump shown in FIG. 8.
Figure 10:
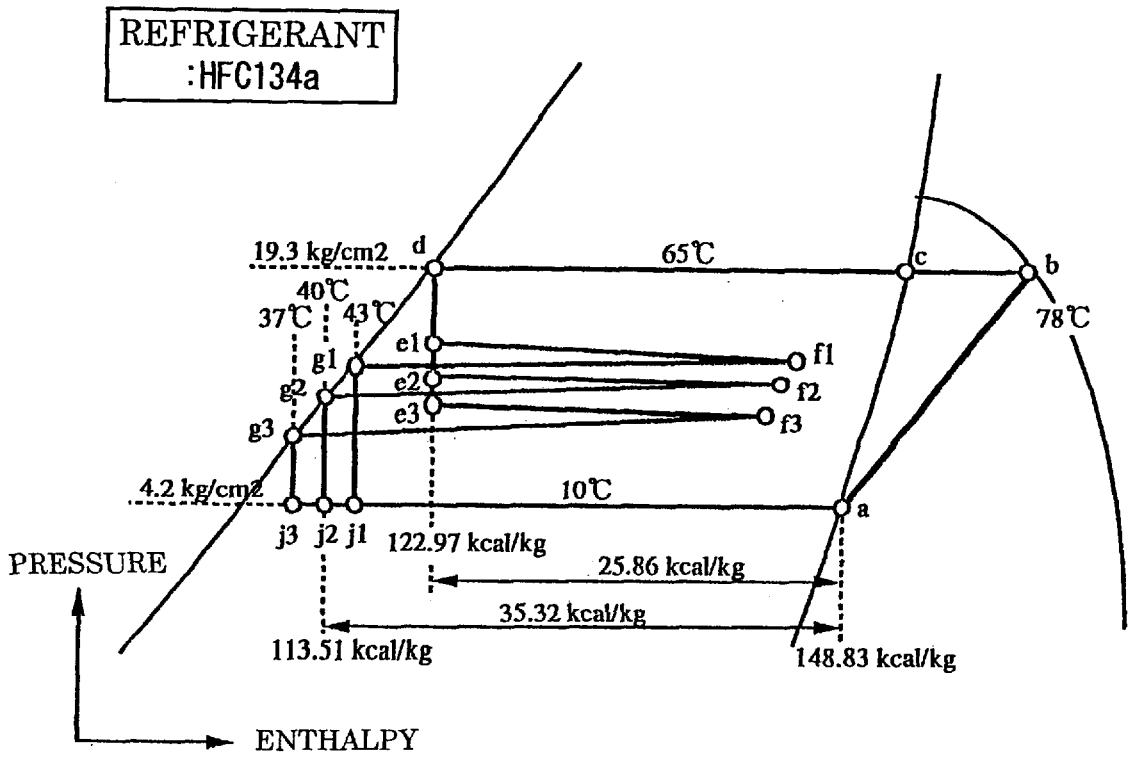
FIG. 10 is a Mollier chart for the heat pump shown in FIG. 8.
Figure 15:
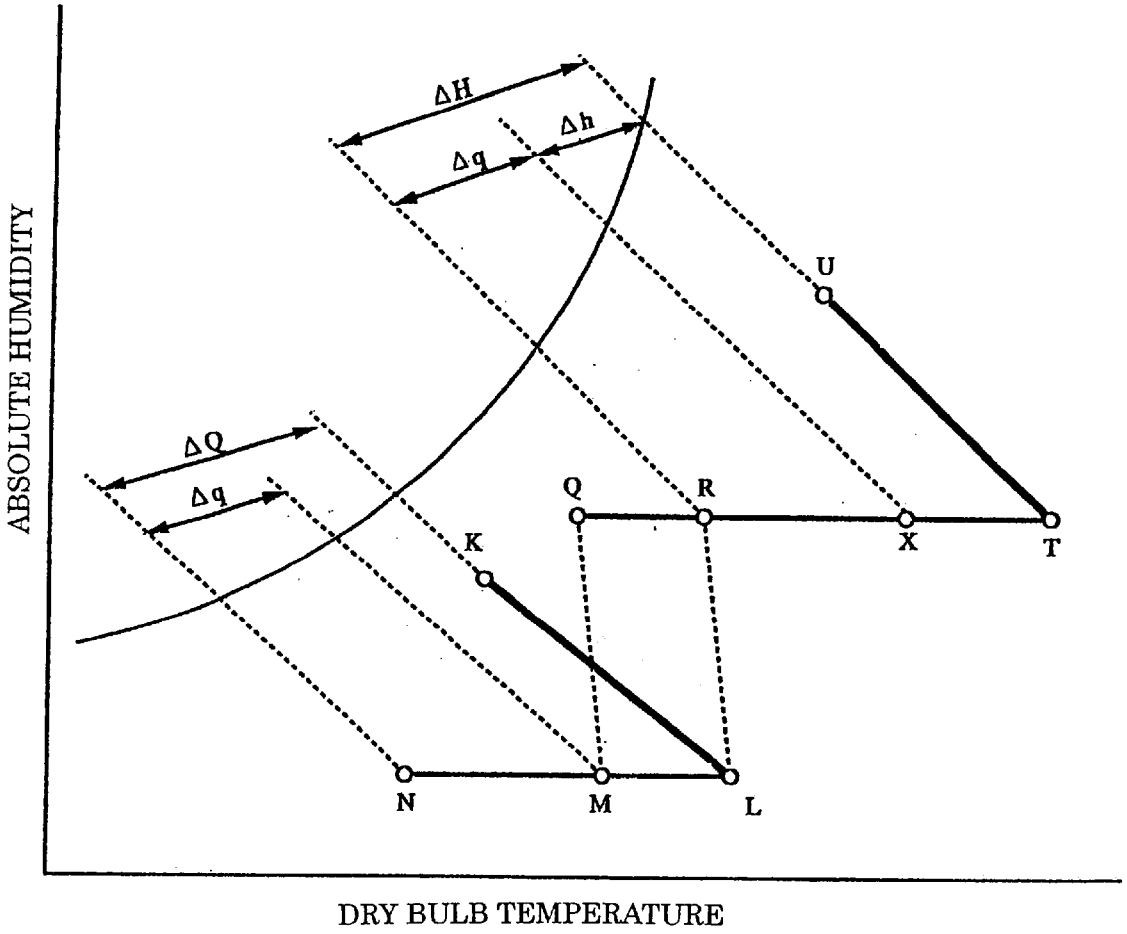
FIG. 15 is a moist air chart for explaining the operation of the dehumidifying air conditioner shown in FIG. 8.

FIG. 8 is a flow chart of an air conditioning system including a desiccant air conditioner, a dehumidifying air conditioner, as an embodiment of the invention. FIG. 9 is a schematic cross sectional view of an example heat exchanger as a process air cooler of the invention for use in the air conditioning system shown FIG. 8. FIG. 10 is a refrigerant Mollier chart for the heat pump HP3 included in the air conditioning system shown FIG. 8. FIG. 15 is a humid air chart for a dehumidifying air conditioner as an embodiment of the invention.

The air conditioning system shown in FIG. 8 is to lower the humidity of the process air by means of a desiccant (drying agent) and to maintain an air conditioning space 101 to which the process air is supplied in a comfortable environment. In this embodiment, the path of the process air as the first fluid is the same as that shown in FIG. 5. That is, as shown, the devices are arranged along the path of the process air A from the air conditioning space 101, in the order of, the blower 102, the desiccant wheel 103 filled with a desiccant and serving as a moisture adsorber, a process air cooler 300*c* of the invention, and the refrigerant evaporator (as a cooler when seen from the refrigerant) 210, so that the process air returns to the air conditioning-space 101.

The outside air, first as the cooling fluid for the process air cooler 300*c*, is led from the outdoors OA along the path of the regeneration air B to the process air cooler 300*c*, and secondly as the regeneration air through the refrigerant condenser (as a heater when seen from the regeneration air) 220, the desiccant wheel 103, and the blower 140 for circulating the regeneration air, in that order, and discharged as exhaust EX outdoors.

Furthermore, along the refrigerant path from the refrigerant evaporator 210, the compressor 260 for compressing the refrigerant made into the gas state by evaporation with the refrigerant evaporator, the refrigerant condenser 220, the header 235, a plurality of throttles 230A, 230B, 230C branched off the header 235 and disposed parallel to each other, the process air cooler 300*c*, a plurality of throttles 240A, 240B, 240C corresponding to the plurality of throttles 230A, 230B, 230C, and the header 245 for collecting flows from those throttles are arranged in that order, so that the flow returns to the refrigerant evaporator 210. The heat pump HP3 is constituted by including the refrigerant evaporator 210, the compressor 260, the refrigerant condenser 220, a plurality of throttles 230A, 230B, 230C, the process air cooler 300*c*, and the plurality of throttles 240A, 240B, 240C.

As described above, the heat exchanger 300*c* for use in the heat pump HP3 shown in FIG. 8 is provided with the throttles such as orifices disposed between the header 235 and the evaporating section 251. A plurality of evaporating sections 251A, 251B and 251C are respectively provided with throttles 230A, 230B and 230C. Also the condensing sections 252A, 252B and 252C corresponding to the above-mentioned sections are provided with throttles 240A, 240B and 240C disposed between those sections and the header 245. Here, for example the evaporating section 251A corresponding to the throttle 240A is shown as a single tube in the drawing. However, a plurality of the tubes may be provided side by side to increase their number in the direction normal to the drawing surface. That is, the throttle 240A may bundle a group of evaporating sections. The same applies to other throttles 240B, 240C and corresponding evaporating sections 251B, 251C.

With such a configuration, the process air A flows at right angles to the heat exchange tubes in the first compartment so as to come into contact with the evaporating sections 251A, 251B, and 251C in that order, and exchanges heat with the refrigerant. The outside air B with its inlet temperature being lower than that of the process air flows at right angles to the heat exchanging tubes in the second compartment so as to come into contact with the condensing sections 252C, 252B and 252A in that order. In such a case, while the evaporation pressures (temperatures) or condensation pressures (temperatures) are determined for each group of sections provided with throttles, they are arranged in the high to low order of 251A, 251B and 251C in the evaporating section, and in the low to high order of 252C, 252B and 252A in the condensing section. That is, the refrigerant of the process air cooler 300*c* cools the process air A at a plurality of evaporation pressures, and the refrigerant is cooled and condensed with the outside air B as a cooling fluid at a plurality of condensing pressures corresponding to the evaporating pressures. Those evaporation pressures and condensation pressures are arranged in the high to low or low to high order.

In this way, when the flows of the process air A and the outside air B are noted, both of the flows exchange heat by the so-called counterflows, which achieves an extremely high heat exchange efficiency Φ, for example 80% or higher.

Here, how the plurality of evaporation pressures are arranged in the high to low order will be further described. The evaporation pressures in the plurality of evaporating sections 251A, 251B and 251C can be independent or different from each other as a result of providing respective sections with respectively independent throttles 230A, 230B and 230C. When the process air is made to flow through the first compartment so as to come into contact successively with the evaporating sections 251A, 251B and 251*c* in that order, the process air is deprived of its sensible heat and its temperature decreases along its flow from the inlet to the outlet. As a result, the evaporation pressures in the evaporating sections 251A, 251B and 251C decrease and are arranged in that order from high to low.

Quite likewise, the condensation temperatures are arranged in the low to high order of 252C 252B and 252A. Like the evaporating sections, since the respective condensing sections are provided with mutually independent throttles 240A, 240B and 240C, the respective condensing sections can have mutually independent condensation pressures and mutually independent condensation temperatures. When the outside air is made to flow through the second compartment from its inlet to outlet so as to come into contact successively with the condensing sections 252C, 252B and 252A in that order, the condensation pressures are arranged in that order from low to high. Therefore, when the flows of the process air A and the outside air B are noted as described before, they form a so-called counterflow type of heat exchanger to achieve a high heat exchange efficiency. Here, the evaporating section 251A and the condensing section 252A may be constituted with mutually independent heat pipes, and the same constitution applies to the evaporating section 251B and the condensing section 252B, and to the evaporating section 251C and the condensing section 252C. Still, the same function is obtained that the heat can be exchanged in counterflow manner.

In the process air cooler 300*c* shown in FIG. 9, the first compartment 310 and the second compartment 320 are disposed side by side on both sides of the partition plate 301, and the evaporating section and the condensing section are formed by an integral, continuous tube. However, the heat exchanger may also be configured as shown in FIG. 3 in which the first compartment 310 and the second compartment 320 and also the first and the second flow passages are disposed separately. In other words, in such a configuration, the evaporating sections 251A, 251B and 251C are respectively connected to corresponding condensing sections 252A, 252B and 252C through an appropriate header and connection piping. In that case, the function of the heat exchanger also remains unchanged from that shown in FIG. 9. However, versatility in positioning of devices increases as a result of separation of the first and the second compartments 310 and 320.

The header 245 on the condensing section 252 side is connected to the refrigerant evaporator (as a cooler when seen from the process air) 210 through the refrigerant liquid piping 203. While the attachment positions of the throttles 240A, 240B and 240C may be anywhere between just after the condensing sections 252A, 252B and 252C and the inlet of the refrigerant evaporator 210, preferably they are just before the inlet of the refrigerant evaporator 210. The reason is that the insulation for the piping for the refrigerant after the throttles 240A, 240B and 240C where the refrigerant becomes considerably colder than the atmosphere may be made thinner. The refrigerant liquid condensed in the condensing sections 252A, 252B and 252C is cooled to lower temperatures by pressure reduction and expansion, enters and evaporates in the refrigerant evaporator 210 to cool the process air by the evaporation heat. The throttles 230A, 230B and 230C, and 240A, 240B and 240C may be for example orifices, capillary tubes, expansion valves, or the like.

Here, the throttles 240A, 240B and 240C are usually orifices or the like of a constant opening. Apart from those constant opening throttles, it may also be configured such that an expansion valve 270 is disposed between the header 245 and the refrigerant evaporator 210, and also a temperature sensor (not shown) is disposed at the refrigerant outlet of the refrigerant evaporator 210 or in the heat exchanging portion of the refrigerant evaporator 210 to detect the superheat temperature and to regulate the opening of the expansion valve 270. In this way, the refrigerant is prevented from being supplied in an excessive amount to the refrigerant evaporator 210, and the refrigerant liquid that has been left out of evaporation is prevented from being drawn into the compressor 260.

The refrigerant evaporated into the gaseous state in the refrigerant evaporator 210 is led to the intake side of the refrigerant compressor 260, and the above-described cycle is repeated thereafter.

In the embodiment shown in FIG. 8, the outside air as the second fluid is used as the regeneration air for regenerating the desiccant. As shown, a duct 124 is connected to the inlet of the second compartment 320 to introduce outside air from outdoors OA. The outside air introduced through the duct 124 enters the second section 320 and, while flowing through the section, takes heat from the refrigerant in the condensing section 252 and causes the refrigerant to condense. Here, the condensing section 252 is constituted to include sections 252C, 252B and 252A with their condensation temperatures arranged in that order from low to high. Therefore, the outside air exits the second compartment 320 after contacting the condensing section 252A of the highest temperature. The outlet of the second compartment 320 is connected through a duct 126 to the heater 220. The outside air heated to a certain extent in the second compartment 320 is led to the heater 220, additionally heated there, and as the regeneration air reaches the desiccant wheel 103 through a duct 127 which interconnects the heater 220 and the desiccant wheel 103.

As described above, the regeneration air introduced into the desiccant wheel 103, after heating to regenerate the desiccant, is discharged through ducts 128 and 129 leading from the desiccant wheel 103 to the outside air. The blower 140 is disposed between the ducts 128 and 129 to draw in outside air, and to flow it through the regeneration air path.

Next, the path of the refrigerant will be described. As shown, the refrigerant gas compressed with the refrigerant compressor 260 is led through a refrigerant gas piping 201 connected to the outlet of the compressor to the regeneration air heater (as a condenser when seen from the refrigerant) 220. The refrigerant gas compressed with the compressor 260 is at a higher temperature due to compression heating, and the heat is used to heat the regeneration air. The refrigerant gas itself loses heat and condenses.

A refrigerant piping 202 is connected to the refrigerant outlet of the heater 220 to further lead to the header 235 where it is divided into a plurality (three in FIG. 8) of refrigerant branches respectively provided with throttles 230A, 230B and 230C. The throttles 230A, 230B and 230C are respectively connected to the evaporating sections 251A, 251B, and 251C. Therefore, it is configured such that evaporation occurs at different pressures or in turn at different temperatures respectively in the evaporating sections 251A, 251B and 251C. The throttles 230A, 230B and 230C are respectively disposed in the vicinities of the evaporating sections 251A, 251B and 251C. The throttles may be in the form of orifices, capillary tubes, expansion valves, or the like. While FIG. 8 shows only three throttles, they may be provided in any number, two or more, according to the number of the evaporating sections 251 and the condensing sections 252.

The refrigerant liquid coming out of the heater (refrigerant condenser) 220 is reduced in pressure and expanded with the throttles 230A, 230B and 230C, and part of it evaporates (flashes). The refrigerant in the state of liquid-gas mixture reaches the evaporating sections 251A, 251B and 251C and flows there so as to wet the inside walls of the tubes of the evaporating section, evaporates, and cools the process air flowing through the first compartment 310.

Each of the evaporating sections 251A, 251B and 251C and each of the condensing sections 252A, 252B and 252C are respectively constituted with a series of tubes, namely as individual flow passages, so that the refrigerant that has evaporated (and that has not evaporated) flows into the condensing sections 252A, 252B and 252C and is deprived of its heat with the outside air flowing through the second compartment and condenses.

The outlet sides of the condensing sections 252A, 252B and 252C are respectively provided with throttles 240A, 240B and 240C. Beyond the throttles 240A, 240B and 240C is disposed the header 245 to which is connected the refrigerant piping 203 so as to lead the refrigerant to the cooler 210.

With such a constitution, the refrigerant liquid condensed in the condensing sections 252A, 252B and 252C is cooled by reduction in pressure and expansion with the throttles 240A, 240B and 240C and collected in the header 245, enters and evaporates in the cooler 210 to cool the process air by its evaporation heat.

Next, referring to FIG. 10, the function of the heat pump HP3 will be described. FIG. 10 is a Mollier chart when a refrigerant HFC134*a* is used. In this chart, the horizontal axis represents enthalpy, and the vertical axis represents pressure.

As shown, the point a corresponds to the state at the refrigerant outlet of the cooler 210 shown in FIG. 8, in a saturated gas state. In the example shown, the pressure is 4.2 $kg/cm^2$ as the third pressure or a low pressure, the temperature is 10° C., and the enthalpy is 148.83 kcal/kg. This gas is drawn in and compressed with the compressor 260 and the state of the gas at the outlet of the compressor 260 is shown at the point b. In this state, the pressure is 19.3 $kg/cm^2$ and the temperature is 78° C.

The refrigerant gas is cooled in the heater (refrigerant condenser) 220 and reaches the state represented by the point c on the Mollier chart. This point represents a saturated gas state with a pressure of 19.3 $kg/cm^2$ as a first pressure or a high pressure, and a temperature of 65° C. Further cooling and condensation under this pressure leads to the state of point d. This point represents a saturated liquid state with the same pressure and the temperature as those at the point c, namely 19.3 $kg/cm^2$ and 65° C., and with an enthalpy of 122.97 kcal/kg.

The state of part of the refrigerant reduced in pressure with the throttle 230A and flowed into the evaporating section 251A is represented with the point e1 on the Mollier chart. Its temperature becomes 43° C. Its pressure is one of a plurality of different pressures (second pressure) of the invention and a saturation pressure corresponding to the temperature of 43° C. Similarly, the state of the refrigerant reduced in pressure with the throttle 230B and has flowed into the evaporating section 251B is represented with the point e2 on the Mollier chart. Its temperature becomes 40° C. Its pressure is one of a plurality of different pressures (second pressure) of the invention and a saturation pressure corresponding to the temperature of 40° C. Likewise, the state of the refrigerant reduced in pressure with the throttle 230C and flowed into evaporating section 251C is shown by the point e3 on the Mollier chart, with a temperature of 37° C. and a saturation pressure corresponding to the temperature of 37° C. as one of the plurality of different pressures of the invention.

At whichever of the points e1, e2 or e3, the refrigerant is located, part of the refrigerant liquid evaporates (flashes) and is in the state of mixture of liquid and gas. In each of the evaporating sections, the refrigerant evaporates under one of the plurality of different pressures and respectively reach intermediate points f1, f2 and f3 between the saturated liquid line and the saturated vapor line for respective pressures.

The refrigerant in those states flows into the respective condensing sections 252A, 252B, and 252C. In each condensing sections, the refrigerant is deprived of its heat with the outside air flowing through the second compartment and respectively reaches the points g1, g2, and g3. These points are on the saturated liquid line on the Mollier chart. Their temperatures are 43° C., 40° C., and 37° C., respectively. These refrigerant liquids reach the points j1, j2, and j3 through respective throttles. The pressure at these points is 4.2 kg/cm$^2$, the saturation pressure for 10° C.

Here, the refrigerant is in the state of a mixture of liquid and gas. These refrigerants flow into the single header 245 and the enthalpy of the joined flow is an average of the enthalpy values at the points g1, g2, and g3 respectively weighted with the corresponding flow rates of the refrigerant. In this embodiment, the value is approximately 113.51 kcal/kg. Even though it is 3-layered, the reason for the higher enthalpy than in the case shown in FIG. 6 is that water is not sprayed in the second compartment.

The refrigerant evaporates as it takes heat from the process air in the cooler (refrigerant evaporator) 210 to be in the state of point a on the Mollier chart and drawn into the compressor 260 again, and thereafter the above-described cycle is repeated.

As described above, the refrigerant evaporates in each evaporating section and condenses in each condensing section in the heat exchanger 300*c*. Since heat is transferred by evaporation and condensation, the heat transfer efficiency is extremely high. Moreover, since the process air flowing downward from the upper part of the first compartment 310 in the drawing is cooled from a higher to a lower temperature at temperatures arranged in the high to low order of 43° C., 40° C., and 37° C., heat exchange efficiency is higher in comparison with the case of cooling at a single temperature of, for example, 40° C. The same is true for the condensing section. That is, in the second compartment 320, since the outside air (regeneration air) is heated from a lower to a higher temperature as the air flows up from the lower part in the drawing at temperatures arranged in the low to high order of 37° C., 40° C. and 43° C., heat exchange efficiency is higher in comparison with the case of heating at a single temperature of, for example, 40° C.

Furthermore, when the compression heat pump HP3 including the compressor 260, the heater (refrigerant condenser) 220, the throttles 230, 240, and the cooler (refrigerant evaporator) 210 is not provided with a heat exchanger 300C, since the refrigerant in the state of point d in the heater (refrigerant condenser) 220 is returned to the cooler (refrigerant evaporator) 210, the differential enthalpy that can be used in the cooler (refrigerant evaporator) 210 is only 25.86 kcal/kg. In case that the heat exchanger 300C is provided as in this embodiment of the invention, the differential enthalpy is 35.32 kcal/kg (=148.83−113.51), which means a decrease in the amount of gas circulating in the compressor 260 for the same cooling load, and in its turn a decrease in the required power by as much as 27%. On the other hand, the cooling effect that can be accomplished with the identical power can be improved by as much 37%. That is to say, the same effect as an economizer for taking in flash gas in a medium state is obtained whether the compressor 260 is of a single stage type or a multiple (for example two) stage type, in the same manner as the embodiment described, referring to FIG. 5 or 7. Therefore, high COP can be achieved. The function of the dehumidifier of this embodiment using a humid chart will be described later referring to FIG. 15.

Figure 11:
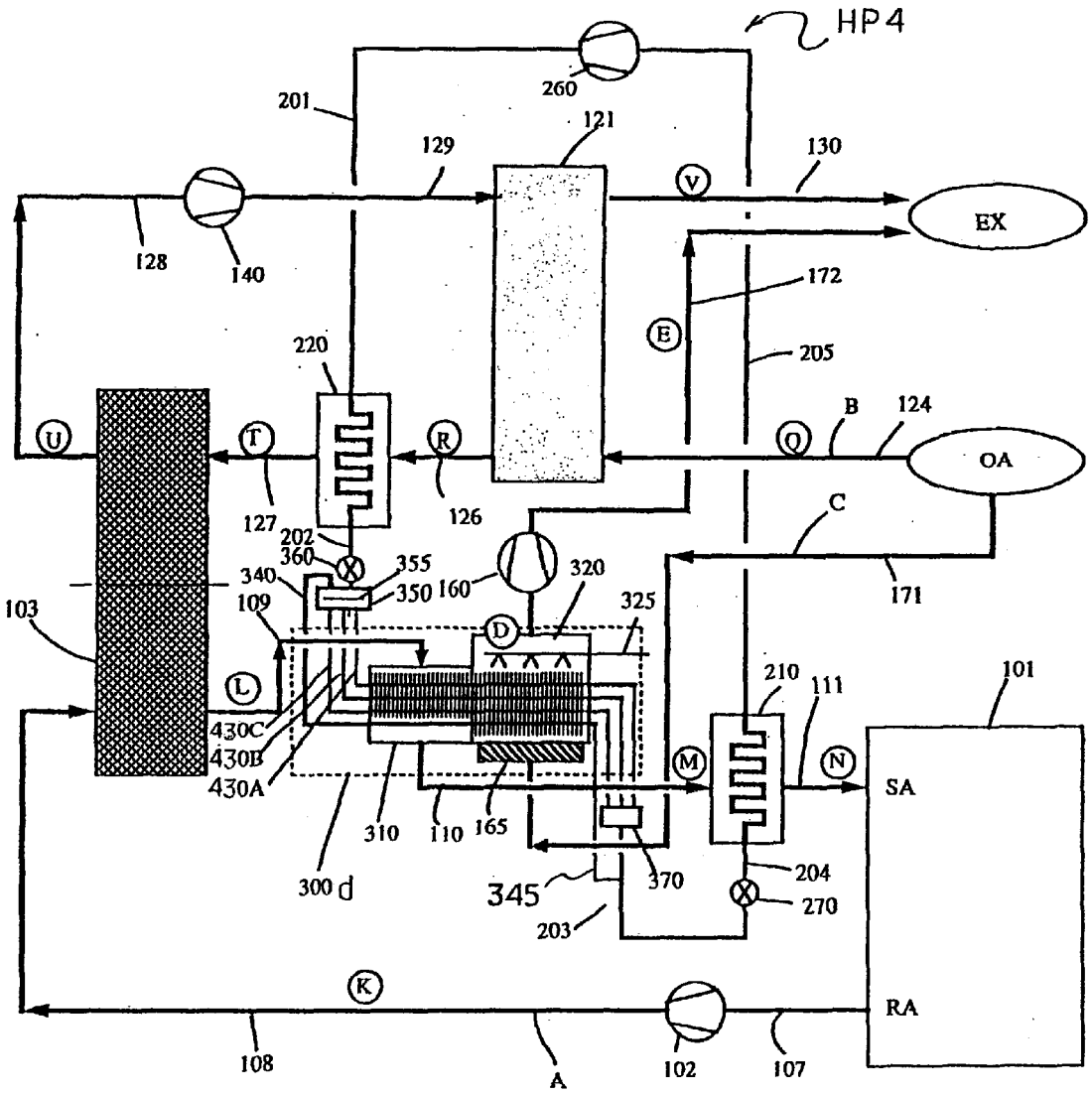
FIG. 11 is a flow chart of a dehumidifying air conditioner as another embodiment of the invention.

Next, referring to FIG. 11, another embodiment of a heat pump HP4 will be described together with explanation of another embodiment of a desiccant air conditioner incorporating the heat pump HP4. With this embodiment, since the refrigerant supplied to the second heat exchanger (process air cooler) for exchanging heat between the first and the second fluids is separated into vapor phase and liquid phase before the refrigerant flows into the second heat exchanger, heat exchange becomes uniform, thus making it possible to provide a heat pump or a dehumidifying air conditioner of a high COP. FIG. 12 shows the constitution of a heat exchanger 300*d* as the second heat exchanger suitable for use in the heat pump HP4. FIG. 13 is a Mollier chart for explaining the refrigerant cycle of the heat pump HP4.

Since the path of the process air, the path of the regeneration air, and the path of the cooling fluid are the same as those of the air conditioner as shown in the embodiment FIG. 5, explanations will not repeated.

Here, the path of the refrigerant of the heat pump HP4 will be described. As shown, the refrigerant gas compressed with a refrigerant compressor 260 is drawn to a regeneration air heater 220 through a refrigerant gas piping 201 connected to the outlet of the compressor 260. The temperature of the refrigerant gas compressed with the compressor 260 is increased by the heat of compression which in turn heats the regeneration air. The refrigerant gas itself condenses as it is deprived of its heat.

The refrigerant outlet of the heater 220 is connected to the inlets of the evaporating sections 251A, 251B and 251C of the heat exchanger 300*d* through a refrigerant passage 202. The throttle 360 in the form of an expansion valve or the like is provided in the middle of the refrigerant passage 202. A vapor-liquid separator 350 is provided between the throttle 360 and evaporating sections 251A, 251B and 251C. The constitution of the heat exchanger 300*d* will be described later in detail referring to FIG. 12.

Liquid refrigerant coming out of the heater 220 is reduced in pressure with the expansion valve 360 as the first throttle, expands, and part of the liquid refrigerant evaporates (flashes). The liquid-vapor mixture of refrigerant is separated into vapor and liquid with the vapor-liquid separator 350, the refrigerant liquid reaches the evaporating sections 251A, 251B and 251C, evaporates in the tubes of the evaporating sections 251A, 251B and 251C, and cools the process air flowing through the first compartment 310.

The evaporating section 251 and the condensing section 252 constitute a continuous tube. That is, since they constitute a single flow passage, the refrigerant that has evaporated (and that has not evaporated) flows into the condensing section 252, and is deprived of its heat with the outside air flowing through the second compartment, then condenses. However, it is also possible to constitute the first and the second compartments separately, and to constitute the evaporating and condensing sections separately. In that case, the evaporating and condensing sections maybe communicated with each other, for example through piping.

The outlet side of the condensing section 252 is connected through the refrigerant liquid piping 203, the expansion valve 270 as the second throttle, and another refrigerant liquid piping 204 to the cooler 210. The refrigerant that has condensed in the condensing section 252 is reduced in pressure with the throttle 270, cooled by expansion, evaporates as it enters the cooler 210 (as an evaporator when seen from the refrigerant side), and cools the process air with its evaporation heat. The throttles 360 and 270 may be for example orifices, capillary tubes, as well as expansion valves.

The refrigerant evaporated into the gaseous state in the cooler 210 is led to the intake side of the refrigerant compressor 260, and thereafter the above-described cycle is repeated.

The vapor-liquid separator 350 is configured to include a container into which vapor-liquid mixture flows, and an obstruction plate 355 placed to face the inflow of the vapor-liquid mixture. When the vapor-liquid mixture strikes the obstruction plate 355, the liquid is separated from the vapor, the vapor flows out of a vapor outlet provided side by side with the vapor-liquid mixture inlet, and flows to the heat exchanger 300*d* through a refrigerant piping 340 connected to the vapor outlet. The refrigerant liquid flow out of a liquid outlet disposed in a position vertically below the container of the vapor-liquid separator. To the liquid outlet are connected liquid piping 430A, 430B and 430C respectively communicating with the evaporating sections 251A, 251B and 251C.

Figure 12:
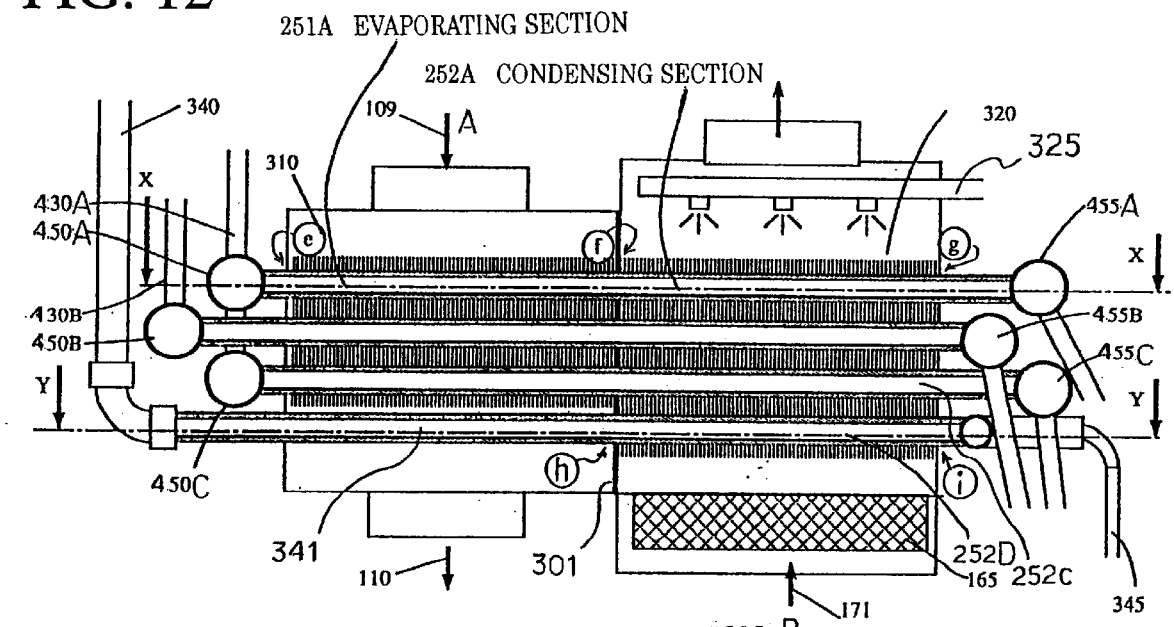
FIG. 12 are a sectional front and a sectional plan views, showing a heat exchanger suitable for use in the dehumidifying air conditioner shown in FIG. 11.
Figure 12:
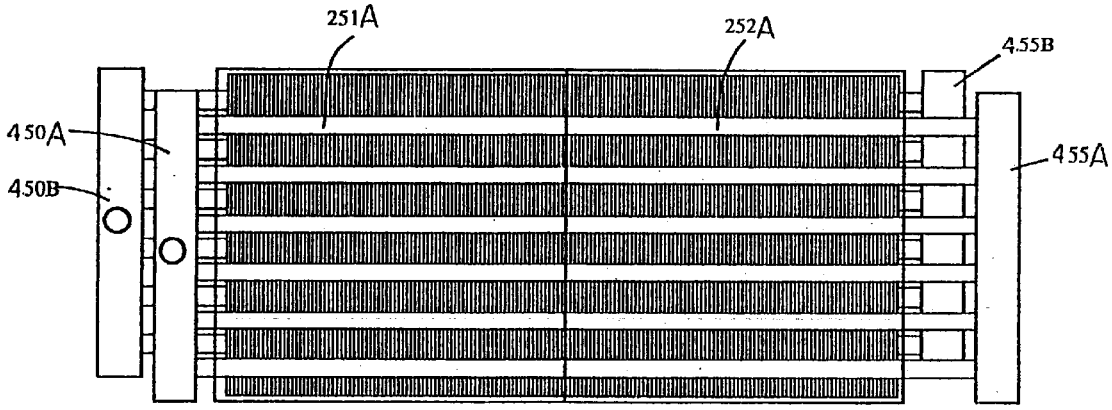
Figure 12:
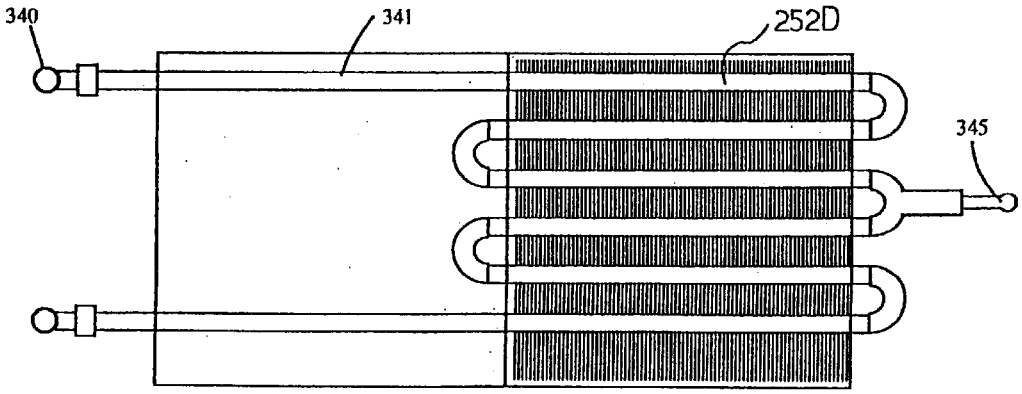
Figure 13:
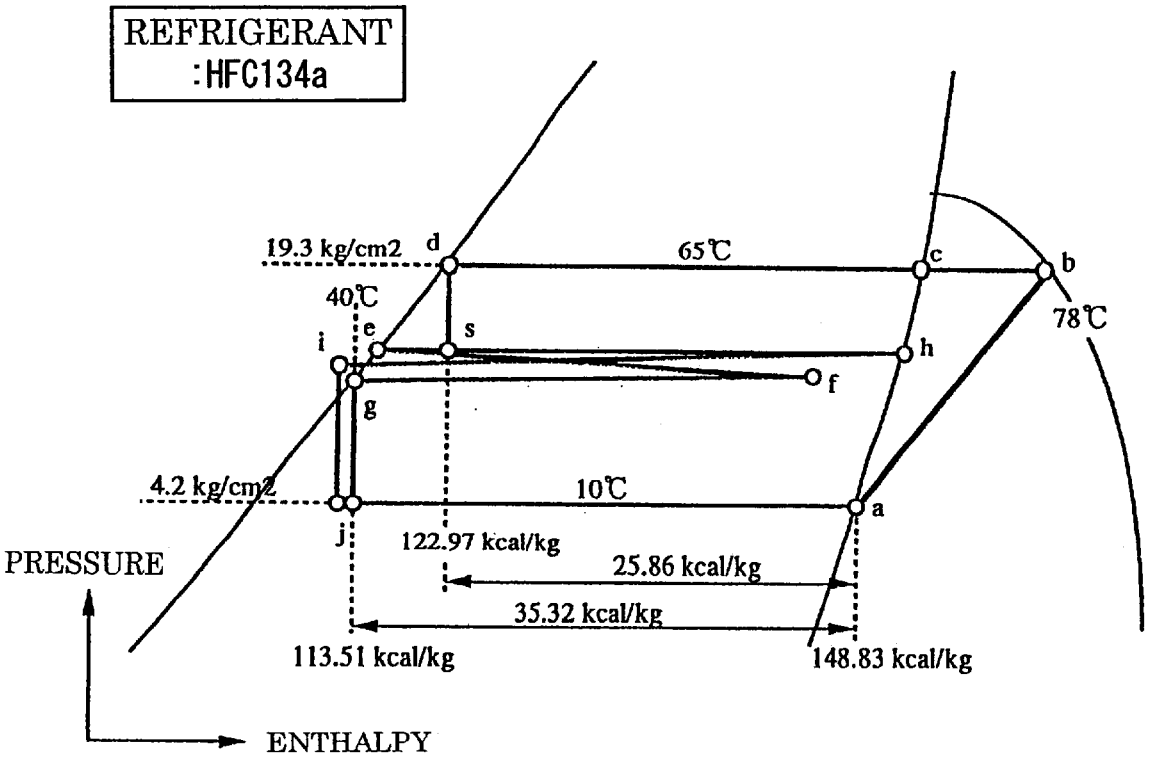
FIG. 13 is a Mollier chart for the heat pump shown in FIG. 11.

Referring to FIG. 12, the constitution of the heat exchanger 300*d* as the second heat exchanger suitable for use in the heat pump HP4 as an embodiment of the invention will be described. The heat exchanger 300*d* can be used in place of the heat exchanger 300 in the heat pump HP1 described referring to FIG. 5. As shown, the heat exchanger 300*d* is similar to the heat exchanger shown in FIG. 1 in that the first compartment 310 for flowing the process air A as the first fluid and the second compartment 320 for flowing the outside air B as the second fluid are disposed adjacent to each other through a single partition wall 301.

Also, the positioning of the evaporating sections 251A, 251B and 251C, condensing sections 252A, 252B and 252C, water spray pipe 325, evaporation humidifier 165, process air passages 109, 110, and outside air passage 171 are similar to those of the heat exchanger shown in FIG. 1.

The evaporating sections 251A, 251B and 251C are connected to headers 450A, 450B and 450C respectively connected to refrigerant piping 430A, 430B and 430C. Each of the evaporating sections 251A, 251B and 251C is constituted with a plurality of (six in the example of FIG. 12) heat exchange tubes joined to each of the headers 450A, 450B and 450C.

A refrigerant vapor piping 340 passes through the first compartment 310 of the heat exchanger 300*d* through a tube 341. The tube 341 is disposed to pass through the partition wall 301 and further through the second compartment 320. In the example shown in FIG. 12, two parallel tubes 341 are disposed, with each tube passing through the 35 second compartment 320 three times. Here, part of the tube 341 within the second compartment 320 is provided with fins attached to the outer side of the tube to accelerate heat exchange in the same manner as in the condensing sections 252A, 252B and 252C. That part is referred to as the condensing section 252D. The condensing section 252D is disposed in a position on the upstream side of the outside air flow in the condensing section 252C and between the condensing section 252C and the evaporation humidifier 165. In the condensing section 252D, the refrigerant vapor is deprived of its heat with the second fluid or the outside air and condenses. Incidentally, the condensing section 252D may be disposed on the downstream side of the outside air flow in the condensing section 252A.

Since the tube 341 scarcely contributes to the heat exchange in the first compartment 310, the tube 341 practically bypasses the first compartment 310. Therefore, the tube 341 may be routed to bypass the first compartment 310 in actual constitution, in other words, the tube 341 is routed outside the first compartment 310 and connected to the condensing section 252D in the second compartment.

The refrigerant liquid outlet sides of the condensing sections 252A, 252B and 252C are respectively provided with headers 455A, 455B and 455C to bring together the condensing sections 252A, 252B and 252C that each is constituted with a plurality of tubes. Tubes from respective headers are further brought together with a header 370 (FIG. 11) which in turn is connected to the expansion valve 270 as described above through the refrigerant piping 203. The refrigerant liquid from the condensing section 252D is drawn out through a refrigerant piping 345 connected to the condensing section 252D and joins the passage 203 on the downstream side of the header 370. Incidentally, the piping 345 may be connected to the header 370.

Referring to the Mollier chart of FIG. 13, the function of the heat pump HP4 as an embodiment of the invention will be described. The Mollier chart of FIG. 13 is for the use of the refrigerant HFC 134*a*, with the horizontal axis indicating enthalpy and the vertical axis indicating pressure.

In the drawing, the points a, b, c and d are the same as those in the Mollier chart of FIG. 6 and so their explanations are omitted. The refrigerant liquid in the state of the point d is reduced in pressure with the throttle 360 and flows into the vapor-liquid separator 350. Then, the separated refrigerant vapor flows through the piping 340 into the tube 341 as a vapor in the state of the point h where the isobaric line of the saturation pressure corresponding to 40° C. intersects the saturated vapor line, and flows into the condensing section 252D. There the vapor condenses as its heat is taken with the outside air (that is cooled with the water from the spray pipe and the evaporation humidifier), reaches the saturation liquid line or typically supercooled, and reaches the point i beyond the saturated liquid line.

The liquid separated with the vapor-liquid separator 350 is in the state of the intersection e between the saturated liquid line and the isobaric line of the saturation pressure corresponding to 40° C. This liquid evaporates in the evaporating section 251 as it reaches the point f, then condenses in the condensing section 252 to be in the liquid state of point g. The liquid in the state of the point i and the liquid in the state of the point g are mixed together in the header 370, and reduced in pressure in the expansion valve 270 to be the refrigerant (vapor-liquid mixture) of a pressure of 42.2 kg/cm$^2$ and a temperature of 10° C.

As described above, in this embodiment, almost no vapor-phase content is contained in the refrigerant led to the heat exchange tubes (heat transfer pipe) constituting the evaporating sections 251A, 251B and 251C of the second heat exchanger 300*d*. As a result, the amount of the refrigerant led to the evaporating sections 251A, 251B and 251C becomes uniform, the process air as the first fluid is cooled uniformly by the evaporation in the evaporating sections 251A, 251B and 251C, and the amount of refrigerant that condenses on the heat transfer pipe of the condensing sections 252A, 252B and 252C is made up of the refrigerant that has evaporated in the evaporating sections 251A, 251B and 251C. If the vapor phase is contained, the heat transfer lacks uniformity since the condensation amount in the condensing section that contains vapor phase is especially large. However, if the liquid phase only is present, such a problem does not occur.

In this way, the amount of heat transferred by the heat pipe function (change in refrigerant phase, especially the heat transfer function by evaporation and condensation) of the heat transfer pipe is made uniform from one heat transfer pipe to another, heat transfer is made uniform in the entire heat exchanger 300*d*. As a result, an undesirable situation is prevented, namely the air as the first and the second fluid is prevented from passing through without contributing to the heat transfer. Therefore, the dehumidifying air conditioner as an embodiment provided with the heat pump HP4 makes it possible to improve the heat exchange efficiency between the first fluid, the process air, and the second fluid, the cooling medium (outside air) or the regeneration air, and to improve functional reliability.

An embodiment of the invention will be hereinafter described with specific numerical values. Calculating conditions are assumed that; the heat transfer amount is 2 USRt, the evaporation temperature is 10° C., the economizer temperature (saturation temperature corresponding to the second pressure) is 40° C., the condensation temperature is 65° C., the refrigerant is HFC 134*a*, and the pipe diameter is 12 mm. Also assumed that; the inside diameter of the heat transfer pipe is 8.3 mm, and the number of the heat transfer pipe is 40 (in case of three tiers as shown in FIG. 12, for example 13, 14, and 13 pipes are disposed in respective tiers in a staggered pattern). Here, the refrigerant circulation amount is calculated by reading the enthalpy values of the points on the Mollier chart of FIG. 13 as:

$$2\times3024/(138.83-113.51)=171.23\ \text{kg/h}=0.0476\ \text{kg/s}.$$

Comparative Example

The refrigerant in vapor-liquid phase after being expanded in the expansion valve is branched into a large number of heat transfer pipes constituting a single pass of the heat exchanger. Since the heat transfer pipes have to be disposed in a single pass in the second heat exchanger, the number of branches increases.

Dryness immediately after expansion valve: (122.97−113.51)/39.42=0.242 (The value 39.42 is the enthalpy difference between points h and e or g in FIG. 13.)

Specific volume of two-phase mixture refrigerant immediately after expansion valve: $0.00087261\times(1-0.242)+0.020032\times0.242=0.00551\ \text{m}^3/\text{kg}$ Flow velocity 1 (in three piping of 12 mm diameter): $0.0051\times0.0476\times4/(0.012\times0.012\times3.14\times3)=0.773$ m/s Flow velocity 2 (in 40 heat transfer pipe of 8.3 mm diameter): $0.0051\times0.0476\times4/(0.0083\times0.0083\times3.14\times40)=0.121$ m/s At the flow velocity 1, the refrigerant flows through the pipe in the state of almost uniform vapor-liquid mixture. At the flow velocity 2 in the branched heat transfer pipes, since the velocity is too slow, the refrigerant is separated by gravity into two, vapor and liquid phases, with the vapor phase flowing on the upper side while the liquid phase flowing on the lower side. In this way, since the flow velocity becomes extremely slow after branching, it is difficult to distribute the vapor phase refrigerant in the state of being uniformly mixed with the liquid phase refrigerant. This in turn results in that, since the situations of the flow are different before and after the branching, the refrigerant cannot be distributed uniformly.

Embodiment

Dryness immediately after expansion valve: 0

Specific volume of liquid refrigerant immediately after expansion valve: $0.00087261\ \text{m}^3/\text{kg}$ Flow velocity 3 (in three pipes of 12 mm diameter): $0.00087261\times0.0476\times(1-0.242)\times4/(0.012\times0.012\times3.14\times3)=0.0928$ m/s Flow velocity 4 (in 40 heat transfer pipes of 8.3 mm diameter): $0.00087261\times0.0476\times(1-0.242)\times4/(0.0083\times0.0083\times3.14\times40)=0.0146$ m/s In this way, since both of the flow velocities 3 and 4 are slow and that the refrigerant in liquid phase only flows, the refrigerant is uniformly distributed to the heat transfer tubes.

The above embodiment is described for the case in which the outside air is cooled by the evaporation heat of water using the evaporation humidifier and the water spray pipe and the air is used as the second fluid. However, it is also possible to have a constitution in which, like the third embodiment shown in FIG. 8, the regeneration air is heated in the second compartment.

With the invention described above, since the second heat exchanger that causes the refrigerant to evaporate and also to condense under the second pressure which is lower than the first pressure is provided, the enthalpy difference per unit amount of refrigerant can be increased. Therefore, it is possible to provide a heat pump capable of increasing the enthalpy difference per unit amount of refrigerant and accordingly capable of highly improving the COP.

Therefore, if the heat pump of the invention is used as the heat source of a desiccant air conditioner for example, it is possible to greatly increase the efficiency of the desiccant air conditioner.

When the second heat exchanger is provided with a vapor-liquid separator, since the refrigerant vapor is separated from the refrigerant liquid, heat exchange in the second heat exchanger is uniform.

Figure 14:
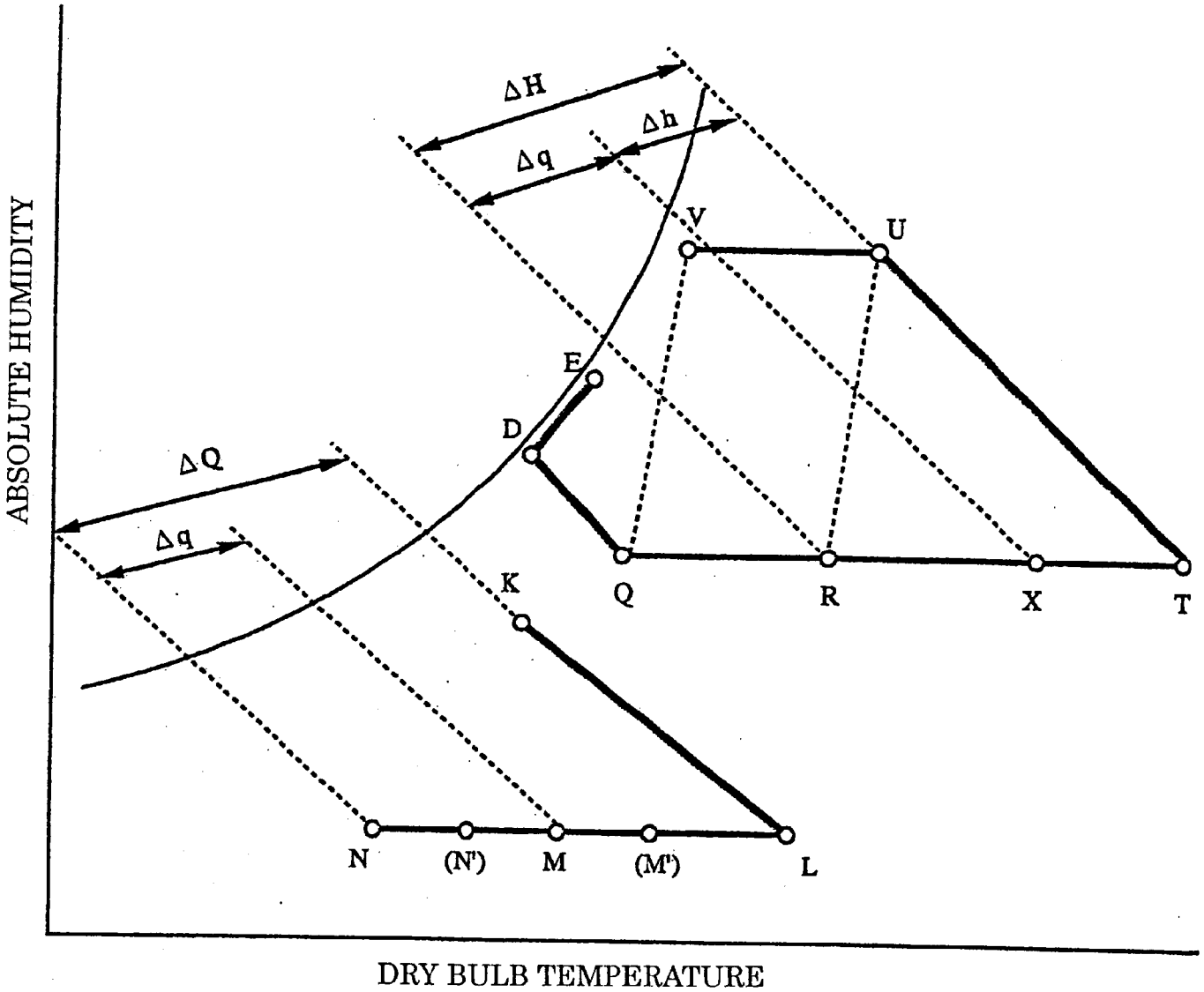
FIG. 14 is a moist air chart for explaining the operation of the dehumidifying air conditioner shown in FIG. 5.

A dehumidifying air conditioner of the invention will be hereinafter described referring to FIG. 14 for its function, and referring to FIG. 5 as appropriate for its constitution. In FIG. 14, conditions of air in various portions are indicated with letters D, E, K to N, and Q to X. These letters correspond to those in circles shown in the flow chart of FIG. 5.

First, the flow of the process air A will be described. In FIG. 14, the process air (state K) is drawn in from the space to be air-conditioned, or the conditioning space 101 through the process air passage 108 by means of the blower 102, and sent into the desiccant wheel 103. Here, the air is deprived of its moisture with the desiccant disposed in the drying element 103*a* (FIG. 16, to be explained later) or made to be of a lower absolute humidity and reaches the state L of a higher dry bulb temperature due to the adsorption heat of the desiccant. This air is sent through the process air passage 109 to the first compartment of the process air cooler 300.

There the air, while remaining at a constant absolute humidity, is cooled with the refrigerant evaporating in the evaporating section 251 (Fig.) to be in the state M, and enters the cooler 210 through the passage 110. Here, the air, also remaining at a constant absolute humidity, is further cooled to the state N. This air, as the process air SA that has been dried and cooled to appropriate humidity and temperature, is returned through the duct 111 to the air conditioning space 101.

Next, the flow of the regeneration air B will be described. In FIG. 14, the regeneration air (state Q) is drawn in from outdoors OA through the regeneration air passage 124 to the heat exchanger 121. Here, the introduced air exchanges heat with the higher temperature regeneration air to be discharged (air in the state U to be described later) to raise the dry bulb temperature, and reaches the state R. This air is sent through the passage 126 to the refrigerant condenser (as a heater when seen from the regeneration air) 220 where the air is heated to a higher dry bulb temperature, and reaches the state T. This air is sent through the passage 127 to the desiccant wheel 103 where the air removes moisture from the desiccant in the drying element 103*a* (FIG. 16) to regenerate the desiccant. As the air adsorbs the moisture, the absolute humidity of the air increases, the dry bulb temperature decreases due to the water adsorption heat of the desiccant, and the air reaches the state U. This air is drawn through the passage 128 into the blower 140 for circulating the regeneration air and sent through the passage 129 into the heat exchanger 121, and as described before, exchanges heat with the regeneration air (air in the state Q) that is not yet sent into the desiccant wheel, and the air itself becomes cooler in the state V, and discharged EX through the passage 130.

Next, the flow of the outside air C as a cooling fluid will be described. The outside air C (in the state Q) from outdoors OA is sent through the passage 171 into the second compartment 320 of the process air cooler 300. There, first the air absorbs moisture in the humidifier 165 and brings about a higher absolute humidity through iso-enthalpy change while bringing about a lower dry bulb temperature, and reaches the state D. The state D is approximately on the saturation line in the humid vapor chart. This air cools the refrigerant in the condensing section 252 while further absorbing moisture supplied through the water spray piping 325 in the second compartment 320. This air changes approximately along the saturation line to a higher absolute humidity and a higher dry bulb temperature, reaches the state E, and is discharged EX through the passage 172 with the blower 160 disposed in the middle of the passage 172.

In further reference to FIG. 14 here, functions of the humidifier 165 and the, water spray piping 325 will be described. With the air conditioner described above, as will be understood from the cycle on the air side shown on the humid air chart of FIG. 14, when it is assumed that; the amount of heat imparted to the regeneration air for regenerating the desiccant in the humidifier is $\Delta H$, the amount of heat pumped up from the process air is $\Delta q$, and the driving energy of the compressor is $\Delta h$, then $\Delta H=\Delta q+\Delta h$. A cooling effect $\Delta Q$ obtained as a result of regeneration with the heat amount $\Delta H$ is greater as the temperature of the outside air (state Q) for exchanging heat with the process air after moisture adsorption (state L) is lower. That is, the greater the $\Delta Q-\Delta q$, the greater $\Delta Q$. Therefore, spraying water, etc. to the outside air as the cooling fluid is effective to improve cooling effect. In FIG. 14, the points denoted by the states M' and N' indicate how the states M and N would change if the evaporation humidifier 165 and the water spray piping 325 were not used.

An embodiment of the invention will be described referring to FIG. 15 for its function, and Referring to FIG. 8 as appropriate for its configuration. In FIG. 15, conditions of air at various points are indicated with letter symbols K to N, Q, R, X, T and V. These letter symbols correspond to those in circles shown in the flow chart of FIG. 8.

Since the flow of the process air A is the same as in the case of FIG. 14, the explanation therefor is not repeated. However, the process air cooler through which the process air passes is shown as 300*c*, and therefore, its details are different in some points as shown in FIG. 9.

Next, the flow of the regeneration air will be described. In FIG. 15, the regeneration air (state Q) is introduced from outdoors OA through the regeneration air passage 124 to the second compartment 320 of the process air cooler 300*c*. Here, the introduced air exchanges heat with the condensing refrigerant to raise the dry bulb temperature, and reaches the state R. This air is sent through the passage 126 to the refrigerant condenser (as a heater when seen from the regeneration air) 220 where the air is heated to a higher dry bulb temperature, and reaches the state T. This air is sent through the passage 127 to the desiccant wheel 103 where the air removes moisture from the desiccant in the drying element 103*a* (FIG. 16) to regenerate the desiccant. As the air adsorbs the moisture, the absolute humidity of the air increases, the dry bulb temperature decreases due to the moisture adsorption heat of the desiccant, and the air reaches the state U. This air is drawn through the passage 128 into blower 140 for circulating regeneration air and discharged EX through the passage 129.

With the air conditioner described above, the relation among the amount of heat $\Delta H$, the amount of heat Aq pumped from the process air, and the driving energy $\Delta h$ of the compressor shown in the cycle on the air side on the humid air chart of FIG. 15 is the same as that explained Referring to FIG. 14, and thus, $\Delta H=\Delta q+\Delta h$. With this embodiment, since the heat exchange efficiency of the process air cooler 300*c* is very high, cooling effect can be enhanced remarkably.

As described above, since the heat pump or the dehumidifying device of this invention is configured such that it includes the process air cooler, that the process air cooler cools the process air by the evaporation of the refrigerant, and that the evaporated refrigerant is cooled and condensed with the cooling fluid, it is possible to utilize evaporating heat transfer and condensing heat transfer both having high heat transfer coefficients and to carry out heat transfer between the process air and the cooling fluid with a high rate of heat transfer. Since the heat transfer between the process air and the cooling fluid is effected through the refrigerant, component layout of the dehumidifying air conditioner is facilitated. Moreover, a plurality of refrigerant evaporating pressures are used, and also a plurality of condensing pressures are used corresponding to the evaporation pressures for the refrigerant that is cooled and condensed with the cooling fluid, and the evaporating pressures are typically arranged in the high to low order. That is to say, in the case of the evaporation temperatures being arranged in the high to low order, the heat exchange between the process air and the cooling fluid can be effected in the so-called counterflow manner. This in turn makes it possible to provide a dehumidifying air conditioner having a high COP and a compact configuration.

When the heat pump is configured to include the refrigerant evaporator, the compressor, and the condenser, and is further constituted to supply the refrigerant condensed with the condenser to the process air cooler, the same refrigerant used in the process air cooler can also be used in the heat pump, and the COP of the heat pump increases. As a result, it is possible to enhance the efficiency of the dehumidifying air conditioner remarkably.

Figure 16:
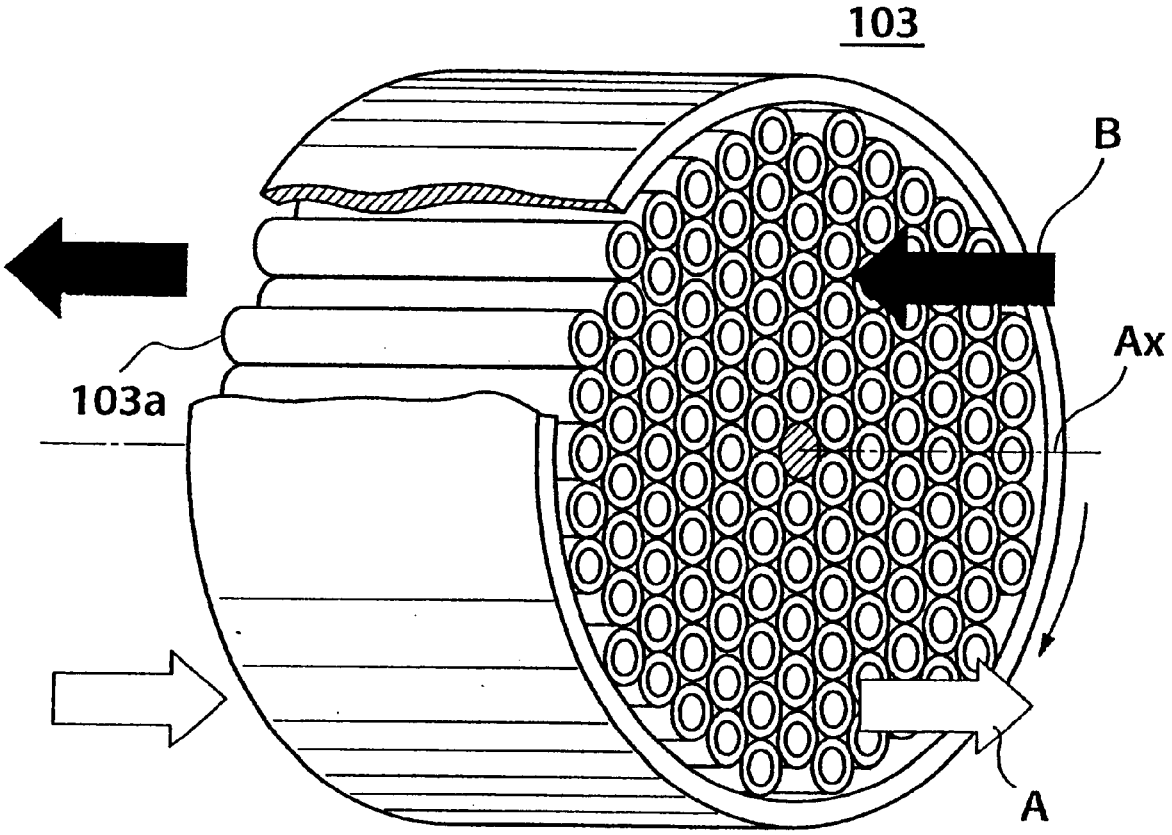
FIG. 16 is a perspective view of one configurational example of a desiccant wheel.

Referring to FIG. 16, a desiccant wheel as a moisture adsorber suitable for use in the dehumidifying air conditioner as an embodiment of the invention will be herein after described. As shown,the desiccant wheel 103 is formed as a thick disk-shaped wheel for rotation about a rotation axis AX, filled with a desiccant having gaps for permitting passage of gas. It is constituted for example with a bundle of a plurality of tubular drying elements 103*a* with their axes parallel to the rotation axis AX. This wheel is configured such that it rotates in one direction about the rotation axis AX and that the process air A and the regeneration air B flow in and out parallel to the rotation axis AX. The drying elements 103*a* are disposed to come into contact with the process air A and the regeneration air B by turns as the wheel 103 rotates. Incidentally in FIG. 16, the outer circumferential portion of the desiccant wheel 103 is shown as partially broken away. While FIG. 16 seems to show gaps between the outer circumferential portion of the wheel 103 and part of the drying elements 103*a,* actually the drying elements 103*a* are tightly packed as a bundle in the wheel 103. Generally the process air (A, indicated with white arrows in the drawing) and the regeneration air (B, indicated with black arrows in the drawing) are arranged to flow parallel to the rotation axis AX in counterflow manner to each other, each flowing through about each half of the circular compartment of the desiccant wheel 103. The flow passages of the process air and the regeneration air are divided with an appropriate partition plate (not shown) so that both of the flows do not mix with each other.

It is possible that a desiccant material is packed into the tubular drying elements 103*a,* that the tubular elements 103*a* themselves are made of the desiccant material, that the drying elements 103*a* are painted with the desiccant material, or that the drying elements 103*a* are made of a porous material and impregnated with the desiccant material. Each of the drying elements 103*a* may be formed in the tube shape of a circular cross section as shown, or in the tube shape of a hexagonal cross section to be bundled together into a honeycomb structure. In any case, it is configured such that the air flows in the thickness direction of the disk-shaped wheel 103.

Figure 49:
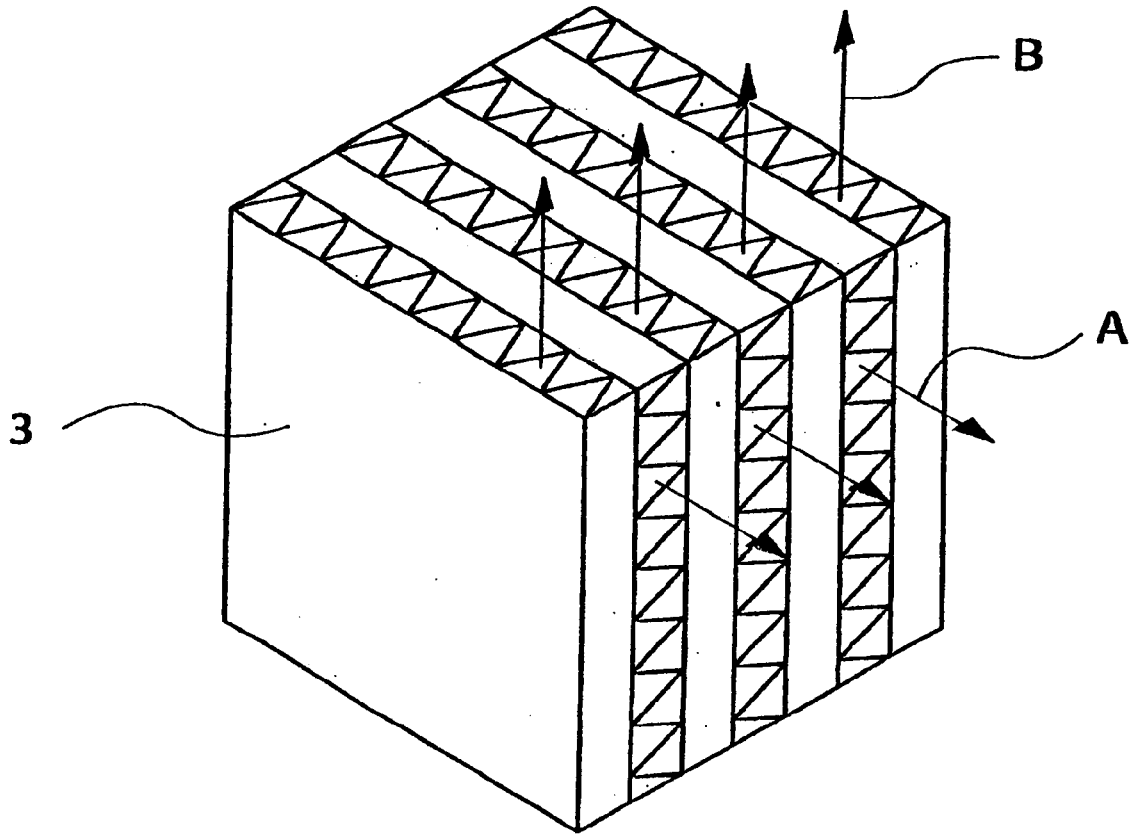
FIG. 49 is a perspective view of a conventional heat exchanger.

Since the heat exchanger 121 (Refer to FIGS. 5, 7 and 11) has to pass a large amount of regeneration air, the heat exchanger is a conventionally used cross-flow type of heat exchanger for example as shown in FIG. 49 for flowing the regeneration air B1 of a low temperature and the regeneration air B2 of a high temperature at right angles to each other, or a rotary type heat exchanger which is similar in constitution to the desiccant wheel shown in FIG. 16 and is filled with a heat storing material of a large thermal capacity in place of the drying elements. In that case, the low temperature regeneration air B1 corresponds to the process air A of FIG. 16, and the high temperature regeneration air B2 corresponds to the regeneration air B.

Next, referring to the table of FIG. 17, the operation modes of the dehumidifying air conditioner as an embodiment of the invention, which is explained above, referring to FIG. 5, and functions of its various devices will be described. As shown in the table, the dehumidifying air conditioner of this embodiment can be operated in the cooling operation mode and the dehumidifying operation mode. In the cooling operation mode, all of the desiccant wheel 103, the blower 102, the blower 140, the blower 160, the water spray 325, and the compressor 260 are in operation or functioning. The flows of the cooling fluid and the refrigerant are the same as those already described.

In the dehumidifying operation mode, while the desiccant wheel 103, the blower 102, the blower 140, and the compressor 260 are in operation, the blower 160 is stopped and the water spray 325 is inoperative. In that case, in FIG. 5, the outside air C as the cooling fluid is not flowing and water is not sprayed in the second compartment 320. Therefore, the refrigerant is not deprived of its heat between the throttles 230 and 240. Although the refrigerant might be heated (or cooled) transiently with the process air flowing through the first compartment 310, in the end the evaporation temperature of the refrigerant becomes the same level as the process air temperature between the throttles 230 and 240, and they balance each other at the same level, and there is no in- or outflow of heat. Therefore, when the humid air chart of FIG. 14 is considered, cooling is nonexistent between the states L and M. Since the process air, after being dehumidified with the desiccant wheel 103, is only cooled with the refrigerant evaporator 210, the state of the process air when it is returned to the conditioning space is low in absolute humidity and the dry bulb temperature is almost the same as the state K. That is, this operation mode is basically the dehumidifying mode. Incidentally, in the embodiment of FIG. 7, the same dehumidifying operation mode as that described above is possible if the cooling water pump 460 is stopped.

As described above, since the heat pump or the dehumidifier of this invention is configured such that it includes the process air cooler, that the process air cooler cools the process air by the evaporation of the refrigerant, and that the evaporated refrigerant is cooled and condensed with the cooling fluid, it is possible to utilize evaporating heat transfer and condensing heat transfer both having high heat transfer coefficients and to carry out heat transfer between the process air and the cooling fluid with a high rate of heat transfer. Since the heat transfer between the process air and the cooling fluid is effected through the refrigerant, component layout of the dehumidifying air conditioner is facilitated.

When the heat pump is configured to include the refrigerant evaporator, the compressor, and the condenser, and is further configured to supply the refrigerant condensed with the condenser to the process air cooler, the same refrigerant used in the process air cooler can also be used in the heat pump, and as a result, it is possible to enhance the efficiency of the dehumidifying air conditioner remarkably.

Figure 18:
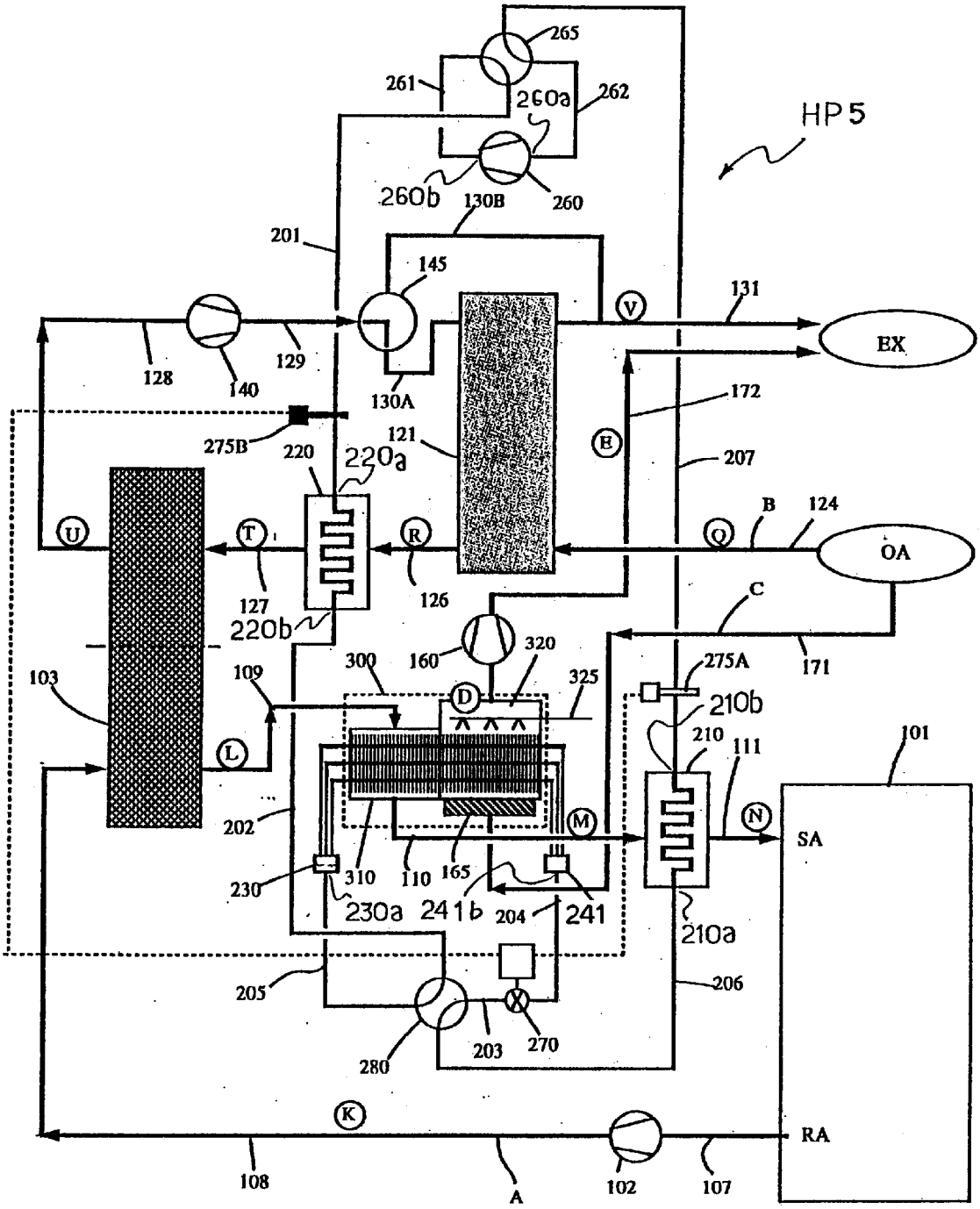
FIG. 18 is a flow chart of a heat pump and a dehumidifying air conditioner as an embodiment of the invention.

FIG. 18 is a flow chart of an air conditioning system including a dehumidifying air conditioner or desiccant air conditioner as an embodiment of the invention. The dehumidifying air conditioner of this embodiment has a high COP, constituted as a compact package, and its operation mode can be switched to either the cooling operation or heating operation. The heat exchanger shown in FIG. 1 is suitable for use as the third refrigerant heat exchanger 300 of this invention used in the air conditioning system of FIG. 18. Also, the refrigerant Mollier chart of the heat pump HP5 included in the air conditioning system of FIG. 18 is the same as that shown in FIG. 6, and the humid air chart when the air conditioning system of FIG. 18 is operated in the cooling mode operation is the same as that explained Referring to FIG. 14.

Referring to FIG. 18, the configuration of the dehumidifying air conditioner as an embodiment of the invention will be described. This air conditioning system is to maintain an air conditioning space 101 to which the process air is supplied as a comfortable environment mainly by reducing the humidity of the process air with a desiccant (drying agent). As shown, it is configured by arranging devices along the path of the process air A from the air conditioning space 101 in the order of; the blower 102 for circulating the process air, the desiccant wheel 103 filled with the desiccant, the third refrigerant heat exchanger 300 of this invention (when seen from the process air, a cooler in the cooling operation mode, not used as a heat exchanger in the heating operation mode), and the first refrigerant heat exchanger 210 (when seen from the process air, a cooler in the cooling operation mode, and a heater in the heating operation mode), and that the process air is returned to the air conditioning space 101.

Also, it is configured by arranging devices along the path of the regeneration air B from outdoors OA in the order of; the passage 124, the sensible heat exchanger 121 which is the heat exchanger for exchanging heat between the air before entering the desiccant wheel 103 and the air after exiting the desiccant wheel 103, the passage 126, the second refrigerant-air heat exchanger 220 (when seen from the regeneration air B side, a heater in both cooling operation mode and defrosting operation mode, and a cooler in heating operation mode), the passage 127, the desiccant wheel 103, the passage 128, the blower 140 for circulating the regeneration air, a switching mechanism 145, and the heat exchanger 121, and that the regeneration air B is discharged EX outdoors. The three-way valve 145 serving as a switching mechanism or a bypass value is disposed in the regeneration air passage 129 between the heat exchanger 121 and the discharge port of the blower 140 so that the regeneration air is made to bypass the heat exchanger 121 and discharged directly.

Along the path of the outside air taken from outdoors OA as the cooling fluid C, the third refrigerant-air heat exchanger 300, and the blower 160 for circulating the cooling fluid are disposed in that order to discharge EX the outside air outdoors.

Next, the path of the refrigerant will be described. In FIG. 18, the refrigerant flow is set to the cooling operation mode. First, along the path of the refrigerant, a first refrigerant passage 207 connected to the second refrigerant intake/discharge port 210*b* (serving as a refrigerant outlet in cooling operation mode) of the first refrigerant-air heat exchanger 210 (serving as a refrigerant evaporator in cooling operation mode) is connected to the compressor 260 for compressing the refrigerant that has evaporated in the first refrigerant-air heat exchanger. The refrigerant compressor 260 is connected through the refrigerant passage 201 to the third refrigerant intake/outlet port 220*a* (serving as a refrigerant inlet in cooling operation mode) provided on the second refrigerant-air heat exchanger 220 (serving as a refrigerant condenser in cooling operation mode). The fourth refrigerant intake/outlet port 220*b* (serving as a refrigerant outlet in cooling operation mode) provided on the second refrigerant-air heat exchanger is connected to the fifth refrigerant intake/outlet port 230*a* (serving as a refrigerant inlet in cooling operation mode) provided on the third refrigerant-air heat exchanger 300 (serving as a process air cooler in cooling operation mode) through the refrigerant passage 202. A throttle 230 is disposed adjacent to the fifth refrigerant port 230*a* or in the refrigerant passage 202. A sixth refrigerant intake/outlet port 241*b* (serving as a refrigerant outlet in cooling operation mode) provided on the third refrigerant-air heat exchanger 300 is connected to the first refrigerant intake/outlet port 210*a* (serving as a refrigerant inlet in cooling mode) of the first refrigerant-air heat exchanger through refrigerant passages 204, 203, and 206. An expansion valve 270 is disposed between the refrigerant passages 203 and 204.

The refrigerant compressor 260 has a refrigerant intake port 260*a* and a refrigerant discharge port 260*b*. A four-way valve 265 as a first switching mechanism is provided so that the refrigerant passage 207 connected to the second refrigerant intake/outlet port 210*b* can be selectively connected to either the refrigerant intake port 260*a* or the refrigerant discharge port 260*b*, and that the refrigerant passage 201 can be connected to either the refrigerant intake port 260*a* or the refrigerant discharge port 260*b* whichever is not connected to the refrigerant passage 207. To describe it further, it is constituted that two settings can be selected: In one setting, a refrigerant passage 262 is connected to the refrigerant intake port 260*a*, a refrigerant passage 261 is connected to the refrigerant discharge port 260*b*, the four-way valve 265 effects intercommunication between the refrigerant passages 207 and 262, and the refrigerant passages 261 and 201 are intercommunicated (cooling operation mode, dehumidifying operation mode, and defrosting operation mode). In the other setting, the refrigerant passages 207 and 261 are intercommunicated and the refrigerant passages 262 and 201 are intercommunicated (heating operation mode) (Refer to the table of FIG. 21).

The embodiment of FIG. 18 is configured such that; a four-way valve 280 as the second switching mechanism is disposed adjacent to the third refrigerant-air heat exchanger 300, the refrigerant passage 202 can be selectively connected to one of the fifth refrigerant intake/discharge port 230*a* and the sixth refrigerant intake/discharge port 241*b* of the third refrigerant-air heat exchanger 300, and the refrigerant passage 206 can be connected to either the fifth refrigerant intake/discharge port 230*a* or the sixth refrigerant intake/discharge port 241*b* whichever is not connected to the refrigerant passage 202. To describe it further, it is constituted that two settings can be selected: In one setting, the refrigerant passage 205 is connected to the fifth refrigerant port 230*a*, the refrigerant passage 204 is connected to the sixth refrigerant intake/discharge port 241*b*, the refrigerant passage 203 is connected through the expansion valve 270 to the sixth refrigerant port 241*b*, the four-way valve 280 effects intercommunication between the refrigerant passages 202, 205 and between the refrigerant passages 204, 203 and 206 (cooling operation mode and dehumidifying operation mode). In the other setting, the refrigerant passages 202, 203 are intercommunicated and the refrigerant passages 205, 206 are intercommunicated (heating operation mode and defrosting operation mode) (Refer to the table of FIG. 21).

Here, the connecting relation of the three-way valve 145 as a bypass valve will be described. The air inlet side of the three-way valve 145 is connected to an air passage 129, and one of two branching outlets is connected to an air passage 130A, so as to lead air to the heat exchanger 121. The other of the two outlets is connected to an air passage 130B, so that the air bypasses the heat exchanger 121 and is discharged. The air passage 129 is configured to be selectively switched between a setting in which it communicates with the air passage 130A (cooling operation mode and dehumidifying mode) and a setting in which it communicates with the air passage 130B (heating operation mode and defrosting mode) (Refer to the table of FIG. 21).

Now, referring to FIG. 18, refrigerant flow between devices will be described.

First, a cooling operation mode in which a first switching mechanism or four-way valve 265, a second switching mechanism or four-way valve 280, and a third switching mechanism or three-way valve are set will be described. In FIG. 18, refrigerant gas compressed by the refrigerant compressor 260 is introduced into the second refrigerant-air heat exchanger (regeneration air heater and refrigerant condenser) 220 through a refrigerant gas pipe 261, four-way valve 265, and refrigerant gas pipe 201 connected to the discharge port of the compressor. The temperature of refrigerant gas compressed by the compressor 260 has been raised by compression heat, and the gas heats the refrigerant air in the second refrigerant-air heat exchanger 220. Heat is taken from the refrigerant gas itself which then condenses.

Refrigerant liquid exiting a refrigerant outlet 220*b* of the second refrigerant-air heat exchanger 220 is introduced to an inlet of an evaporating section 251 of a third refrigerant-air heat exchanger 300 through a refrigerant path 202, the second switching mechanism 280, and a refrigerant path 205. In the middle of the refrigerant path 205, in the vicinity of the inlet of the evaporating section 251 is disposed a header, in which is provided a throttle 230. The throttle 230 may be disposed in the middle of the refrigerant path 205 in addition to the header.

Refrigerant liquid exiting the second refrigerant-air heat exchanger 220 is reduced in pressure at the throttle 230 to expand, and part of the liquid refrigerant is evaporated (flushed). The refrigerant, that is, the mixture of the liquid and the gas, reaches the evaporating section 251, where the liquid refrigerant flows while wetting the inner walls of the tubes in the evaporating section, and evaporates to cool the process air flowing in the first compartment.

The evaporating section 251 and a condensing section 252 are of an integral tube. That is, they constitute an integrated fluid passage, and therefore, the evaporated refrigerant gas (and unevaporated refrigerant liquid as well) flows into the condensing section 252, then loses their own heat by the sprayed water and the outside air (ambient air) in the second compartment to condense.

At the outlet side of the condensing section 252 is provided a header 241. A refrigerant outlet 241*b* is connected to a first refrigerant-air heat exchanger 210 through a refrigerant liquid pipe 204, an expansion valve 270, a refrigerant path 203, the four-way valve 280, and a refrigerant path 206. A fixed throttle may be provided in place of the expansion valve 270.

In that case, the throttle may be provided in, for example, the header 241, or either of the refrigerant paths 204, 203. That is, the throttle or the expansion valve 270 may be, when considering cooling mode only, located at any position immediately behind the condensing section 252 to the inlet of the second refrigerant-air heat exchanger 210, but in this embodiment considering also other operation modes and, it is located immediately behind the condensing section 252 and the four-way valve 280. However, if it is disposed at a place as close to the inlet 210*a* of the first refrigerant-air heat exchanger 210 as possible, thermal insulation on the piping after the throttle or the expansion valve 270 can be minimized for refrigerants significantly colder than the atmospheric temperature. Refrigerant liquid condensed in the condensing section 252 is lowered in pressure and expanded with the throttle or the expansion valve 270 to decrease in temperature, flows into the first refrigerant-air heat exchanger 210 to be evaporated, and cools the process air by the evaporating heat. Throttles 230, 270 disposed before and after the third refrigerant-air heat exchanger 300 may be, for example, orifices, capillary tubes or expansion valves.

In the embodiment of FIG. 18, a throttle provided after the third refrigerant-air heat exchanger 300 is the expansion valve 270 with two heat sensors. In the cooling operation mode shown in FIG. 18, a heat sensor 275A is activated as a sensor, which is disposed in the refrigerant path between the first refrigerant-air heat exchanger 210 and the refrigerant compressor 260. The activated sensor is shown in the figure in the white block and the deactivated sensor in the shaded one. Then sensor 275A detects the degree of superheating of the refrigerant gas flowing out from the first refrigerant-air heat exchanger 210 used as a refrigerant evaporator in the cooling operation mode, and the opening of the expansion valve 270 is adjusted so that the refrigerant gas turns into dry gas.

Refrigerant, which is evaporated to be gasified in the first refrigerant-air heat exchanger 210, is then introduced into a suction port 260*a* of the refrigerant compressor 260 through a refrigerant path 207, the first switching mechanism 265 and a refrigerant path 262, and the foregoing cycle is repeated.

As the functions of the heat pump HP5 in the cooling operation mode is the same as described with reference to FIG. 6, explanation is not repeated.

Referring to FIG. 18 again, a case of dehumidifying operation mode will be described. In the dehumidifying operation mode, connecting relations among the first, second, and third switching mechanisms 265, 280, 145 are the same as that in the cooling operation mode. While a desiccant wheel 103, blower 102, blower 140, and compressor 260 are operated, a blower 160 is stopped and a water spray 325 is not activated. At this time, in FIG. 18, no outside air C as a cooling fluid flows and no water is sprayed to the second compartment 320, so that no heat is lost from refrigerant between the throttle 230 and the expansion valve 270. Though the refrigerant may be transitionally heated (or cooled) by the process air flowing in the first compartment 310, and the evaporation temperature of refrigerant between the throttle 230 and the expansion valve 270 will eventually become levelled with that of the process air temperature, be in balance without any bi-directional heat transfer. Therefore, when considering from the moist air chart in FIG. 14, no cooling occurs between the state L and the state M, and the process air is simply cooled by the first refrigerant-air heat exchanger 210 after being dehumidified by the desiccant wheel 103, and the process air returned to the air conditioning space is therefore lower in absolute humidity compared with the state K, and the dry-bulb temperature is in a state not significantly different from the state K. That is, this operation mode is basically a dehumidifying operation mode.

Now, referring to FIG. 19, a heating operation mode will be described. In the heating operation mode, the first switching mechanism 265, the second switching mechanism 280 and the third switching mechanism 145 are in a connecting relation shown in FIG. 19, as described above. While the blower 102, blower 140 and compressor 260 are operated, the desiccant wheel 103 and blower 160 are stopped, and the water spray 325 is not activated. Regarding the sensor of the expansion valve 270, a sensor 275B disposed in the refrigerant path between the second refrigerant-air heat exchanger 220 and the refrigerant compressor 260 is active.

Figure 19:
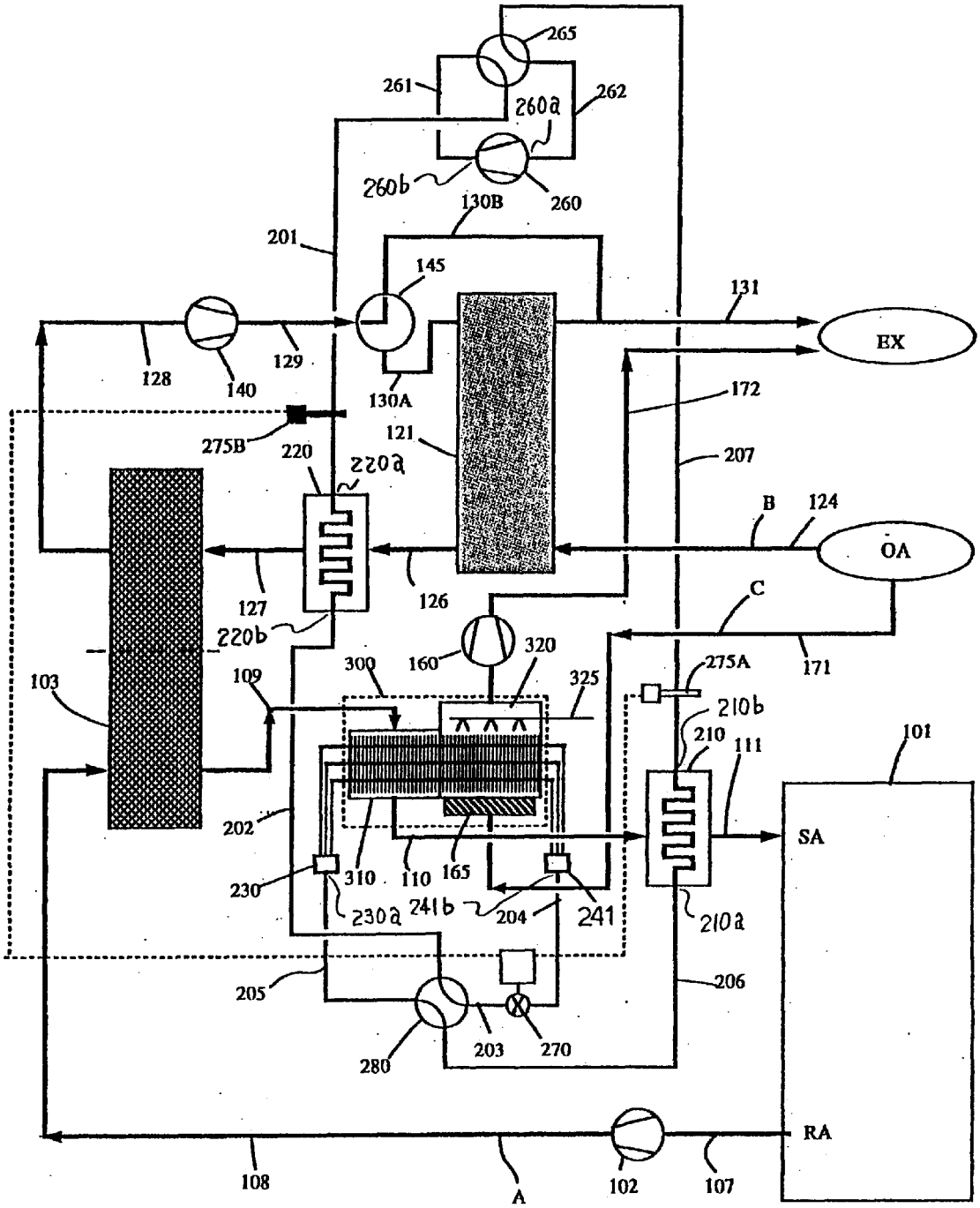
FIG. 19 is a flow chart when the dehumidifying air conditioner shown in FIG. 18 is operated in a heating operation mode.

In FIG. 19, refrigerant discharged from a discharge port 260*b* of the refrigerant compressor 260 is sent to the second refrigerant port 210*b* through the refrigerant path 261, four-way valve 265, and refrigerant path 207, and releases heat into the first refrigerant-air heat exchanger 210 (acting as a refrigerant condenser in the heating operation mode), to be condensed. This obtained heat, heats the process air in a heat exchanging relation with refrigerant in the first refrigerant-air heat exchanger 210.

Refrigerant condensed in the first refrigerant-air heat exchanger 210 is sent to the third refrigerant-air heat exchanger 300 through the refrigerant path 206, four-way valve 280, and refrigerant path 205. Since the blower 160 is not operated in the heating operation mode, refrigerant passes through the third refrigerant-air heat exchanger 300 without exchanging heat with other fluid, and is sent to the second refrigerant-air heat exchanger 220 (acting as a refrigerant evaporator in the heating operation mode) through the refrigerant path 204, expansion valve 270, refrigerant path 203, four-way valve 280, and refrigerant path 202. In the second refrigerant-air heat exchanger 220, it absorbs heat and is then evaporated. This heat is obtained from the outside air used for regeneration air during the cooling mode. To the contrary, the outside air in a heat exchanging relation with the refrigerant is cooled by the evaporating refrigerant.

The refrigerant evaporated in the second air heat exchanger 220 reaches a suction port 260*a* though the refrigerant path 201, four-way valve 265, and refrigerant path 262, and then compressed in the refrigerant compressor 260. The refrigerant cycle is repeated in this way. The degree of superheating of the refrigerant at the outlet of the second refrigerant-air heat exchanger 220 is detected by the sensor 275B of the expansion valve 270, and the opening of the expansion valve 270 is adjusted so that this refrigerant gas is in a dry state.

The flow of process air A in the heating operation mode is the same as in the cooling operation, but the desiccant wheel 103 is stopped and no dehumidifying operation is performed. Process air passing through the desiccant wheel is heated by refrigerant in the first refrigerant-air heat exchanger 210, resulting in the increase of dry-bulb temperature, and then supplied, as the air having with adequate dry-bulb temperature, to the air conditioning space 101. A humidifier (not shown) may be disposed between the heat exchanger 210 and the air conditioning space 101.

The flow of outside air B during the heating operation is the same as in the cooling operation, except that it bypasses the heat exchanger 121. Since no heat exchanging is performed in the heat exchanger 121, the outside air passes through the heat exchanger to reach the second refrigerant-air heat exchanger 220 where it is cooled by evaporating refrigerant, and reaches the desiccant wheel 103. Since the desiccant wheel 103 is stopped, it passes through there without exchanging water and is discharged through the blower 130. The third switching mechanism 145 may not be disposed in part 129, but may be disposed between the path 124 and the path 126 so as to bypass the heat exchanger 121.

Next, referring to FIG. 20, a defrosting operation mode will be described. In the defrosting operation mode, the first switching mechanism 265, the second switching mechanism 280 and the third switching mechanism 145 are in a connecting relation shown in FIG. 20, as described above. While the blower 160 and the compressor 260 are operated, the desiccant wheel 103, blower 160 and blower 140 are usually stopped, and the water sprays 325 are not activated. The sensor 275A is active as a sensor of the expansion valve 290. The blowers 102 and 140 may be operated.

Figure 20:
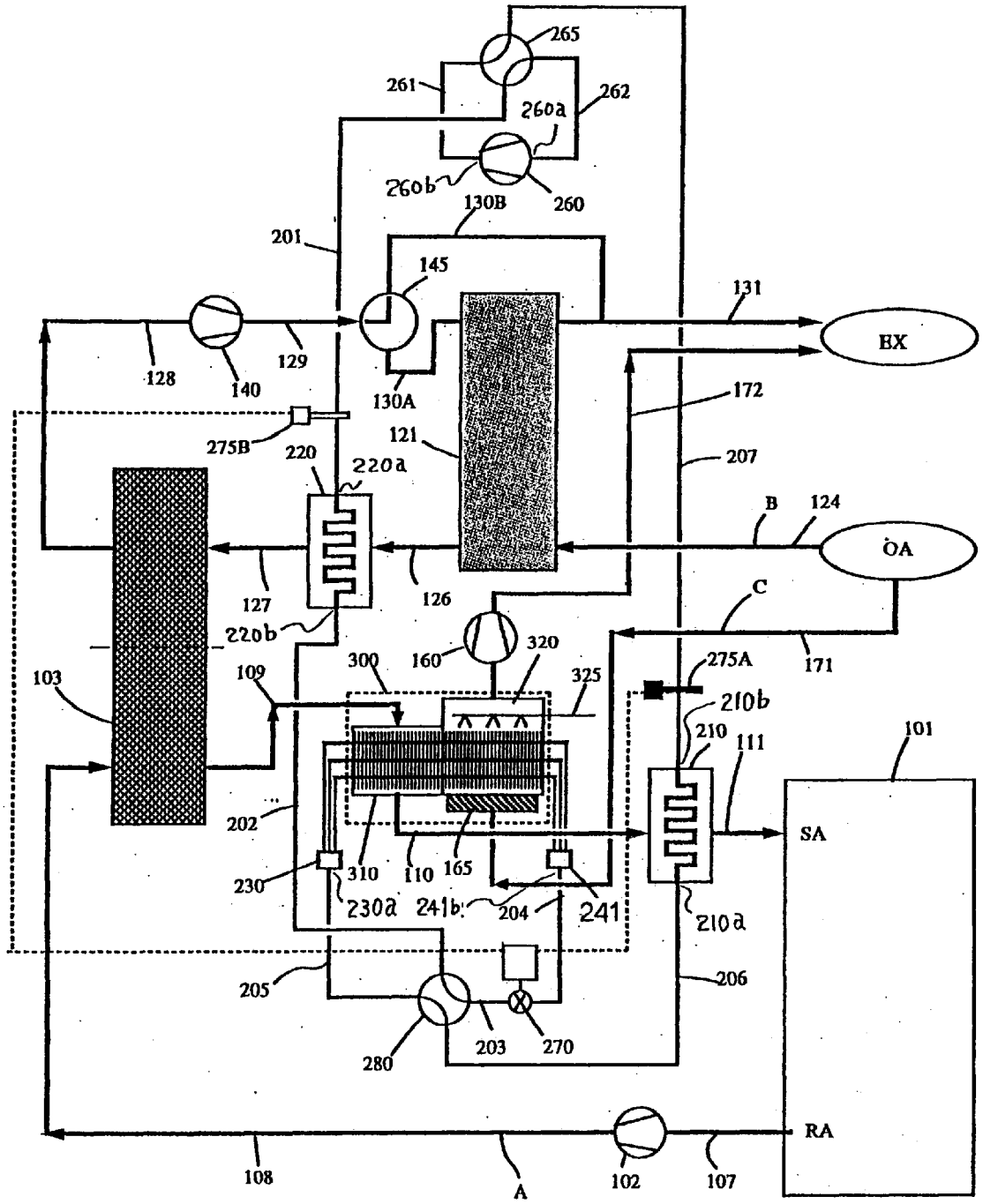
FIG. 20 is a flow chart when the dehumidifying air conditioner shown in FIG. 18 is operated in a defrosting operation mode.

In FIG. 20, refrigerant discharged from the discharge port 260*b* of the refrigerant compressor 260 is sent to the third refrigerant port 220*a* through the refrigerant path 261, four-way valve 265, and refrigerant path 201, and releases heat into the second refrigerant-air heat exchanger 220 to be condensed. This obtained heat, melts or sublimates and defrosts the frost deposited on the heat transfer surface on the air side of the second refrigerant-air heat exchanger 220. The refrigerant condensed in the second refrigerant-air heat exchanger 220 is sent to the third refrigerant-air heat exchanger 300 through the refrigerant path 202, four-way valve 280, refrigerant path 203, expansion valve 270, and refrigerant path 204. In the defrosting operation mode, since the blower 160 is operated and no water is sprayed, the refrigerant obtains heat by exchanging heat with outside air C, and then evaporates. The evaporated refrigerant is sent to the first refrigerant-air heat exchanger 210 through the refrigerant path 205, four-way valve 280, and refrigerant path 206. In the defrosting operation mode, since the blower 102 is stopped, it passes through the first refrigerant-air heat exchanger 210 without exchanging heat, returns to the refrigerant compressor 260 through the refrigerant path 207, four-way valve 265, and refrigerant path 262, and the foregoing refrigerant cycle is repeated. The degree of superheating of the refrigerant at the outlet of the third refrigerant-air heat exchanger 300 is detected by the sensor 275A of the expansion valve 270, and the opening of the expansion valve 270 is adjusted so that this refrigerant gas is in a dry state. In the defrosting operation as described above, the heat pump HP5 can draw heat from outside air C to remove the frost from the second refrigerant-air heat exchanger 220. Thus, a large amount of heat can be drawn for a short time for defrosting, and defrosting time can be reduced.

Further, in the defrosting operation mode, since the blower 102 is not operated, no process air A is circulating, and since the blower 140 is not operated, no regeneration air B is circulating. Therefore, in this embodiment, no process air is cooled in the defrosting operation mode, so that a high heating effect can be maintained without an uncomfortable feeling, being created in the air conditioning space 101.

Operation of the different devices has been described in different operation modes, and now the operating modes of the dehumidifying air conditioner of an embodiment of this invention and operation of the devices are summarized in a table of FIG. 21. As shown in the table, the dehumidifying air conditioner of this embodiment is adapted to operate in a cooling operation mode, dehumidifying operation mode, heating operation mode and defrosting operation mode. The state of operation and stoppage of the main devices, connection of the switching mechanisms, and sensors used in the expansion valves are as described hereinbefore.

According to this invention as described above, the humidifying air conditioner comprises a third refrigerant-air heat exchanger, and is capable of switching the selective, connecting relation of the suction port and discharge port of the refrigerant compressor to the second and third refrigerant ports, as well as the selective, connecting relation of the fifth and sixth refrigerant ports to the fourth and first refrigerant ports, therefore it is possible to provide a dehumidifying air conditioner capable of cooling operation, heating operation, as well as defrosting operation, and having an increased COP and compact size.

Figure 22:
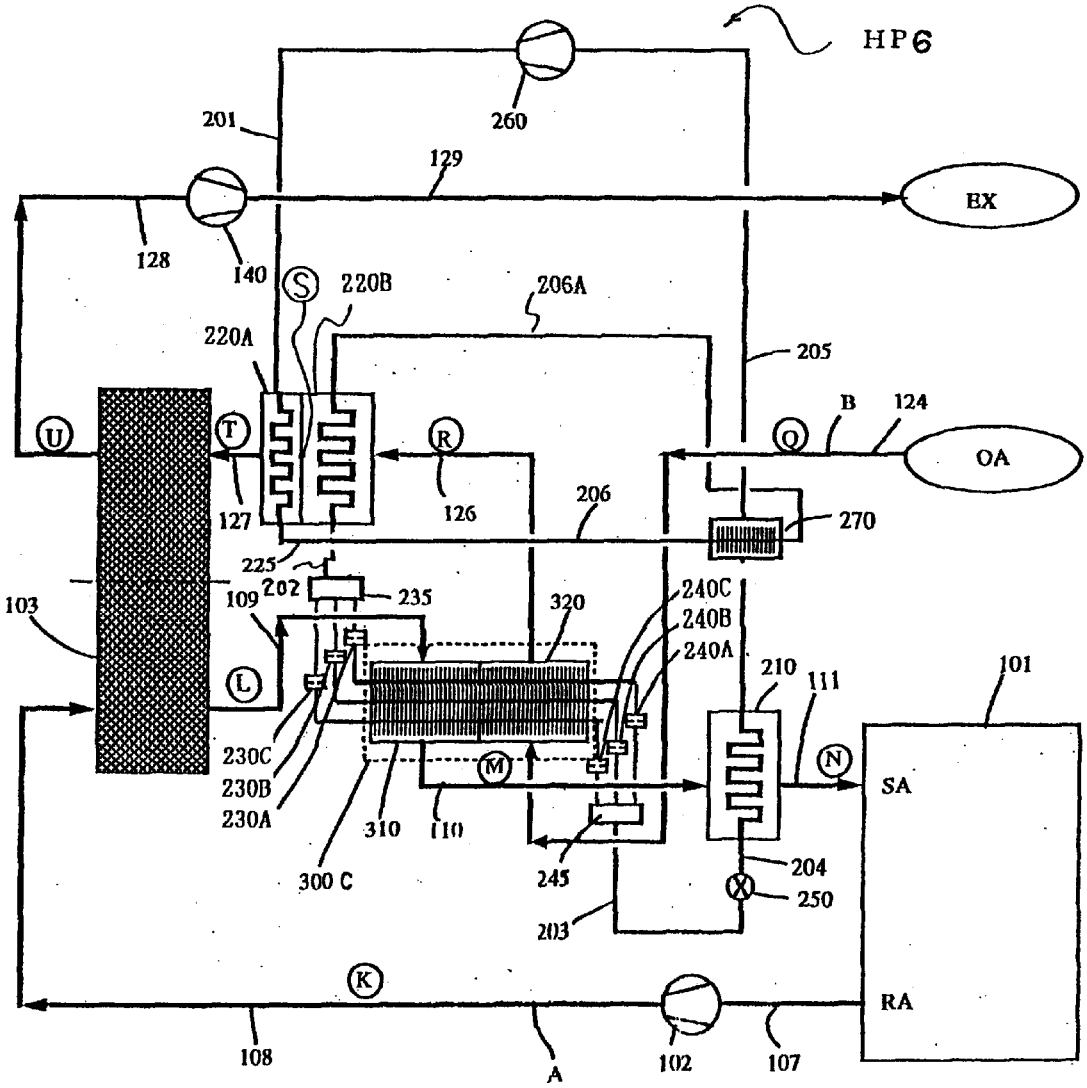
FIG. 22 is a flow chart of a dehumidifying air conditioner as another embodiment of the invention.
Figure 23:
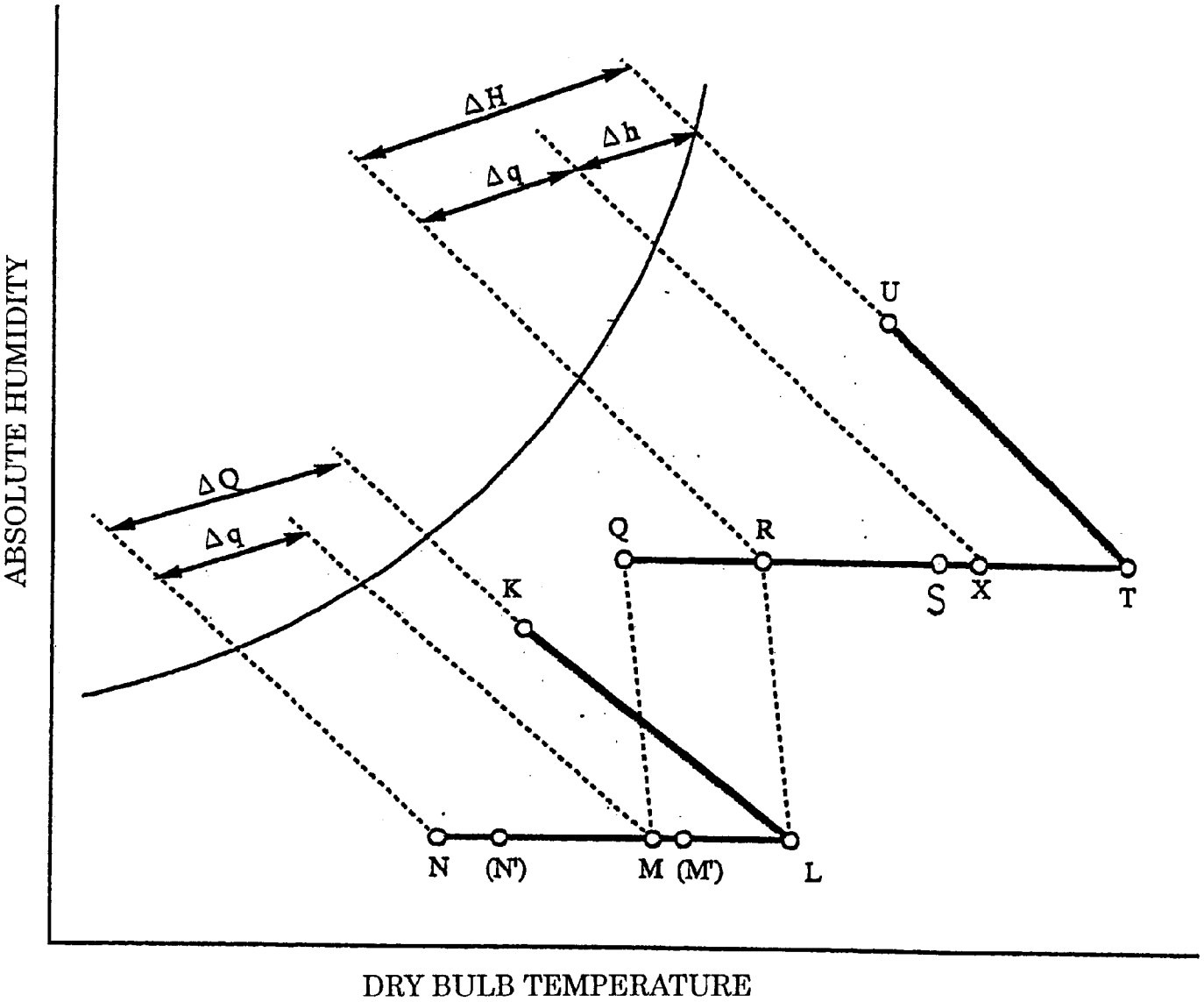
FIG. 23 is a moist air chart for explaining the operation of the dehumidifying air conditioner shown in FIG. 22.
Figure 24:
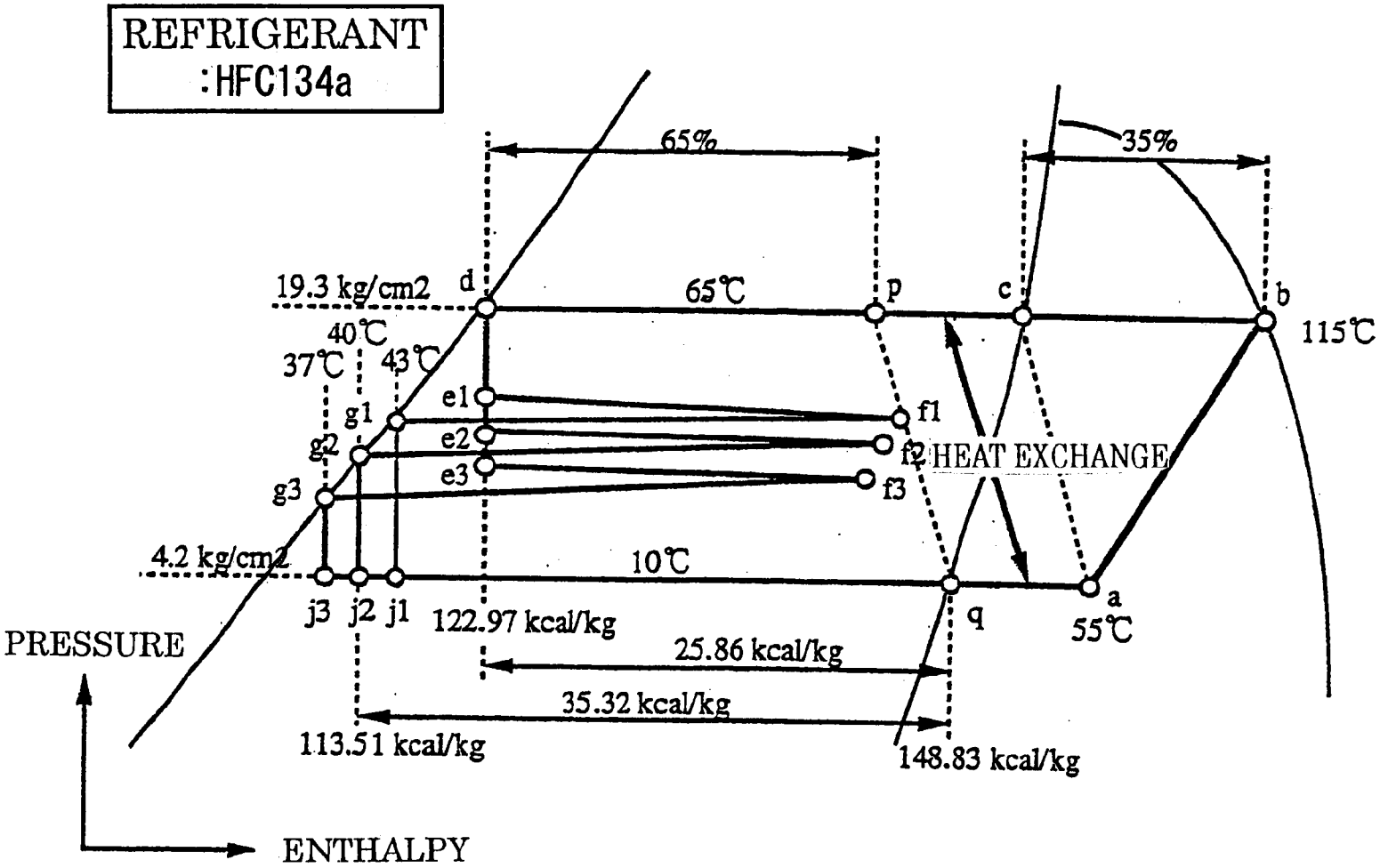
FIG. 24 is a Mollier chart for the heat pump used in the dehumidifying air conditioner shown in FIG. 22.
Figure 25:
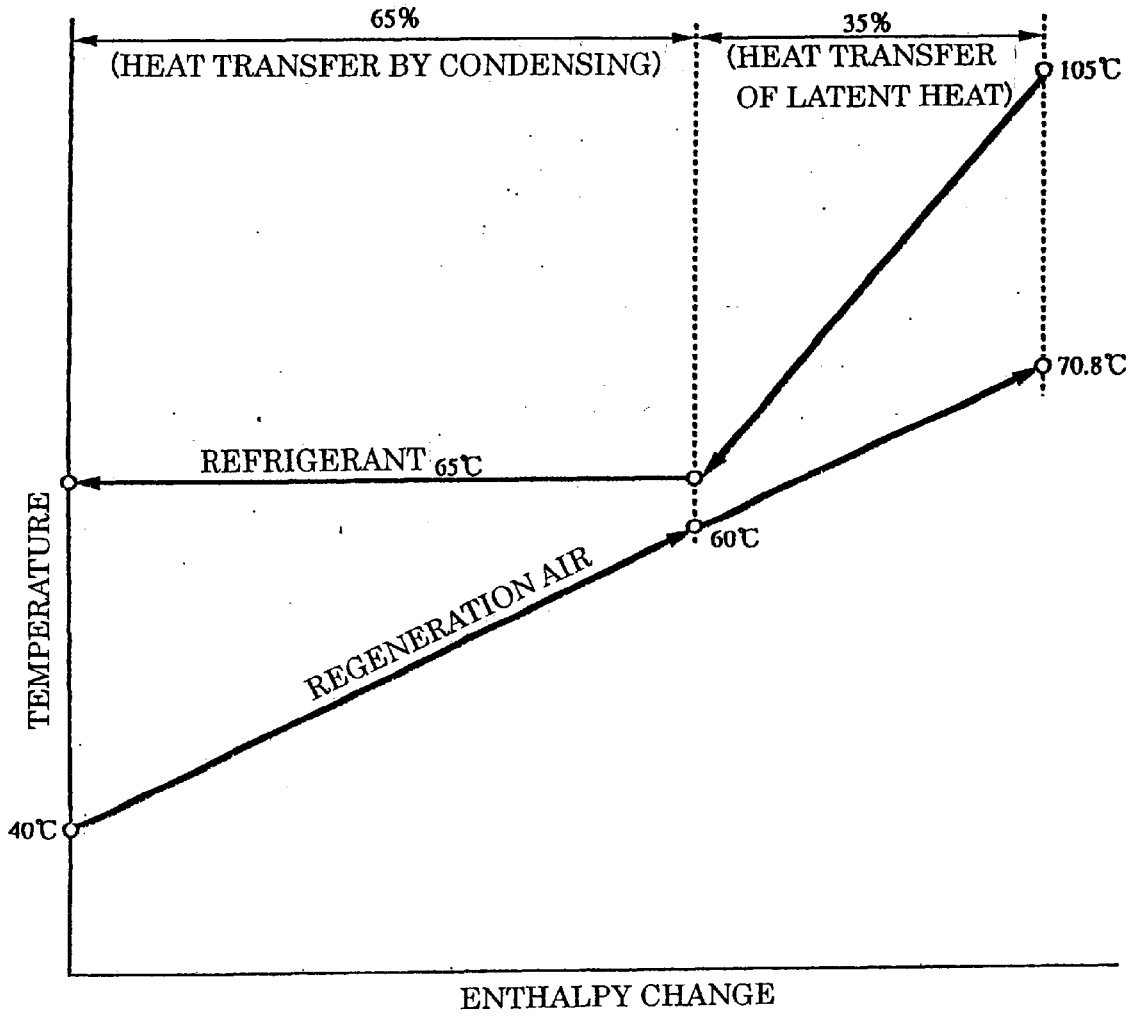
FIG. 25 is a diagram for explaining enthalpy change amount versus temperature change of the regeneration air and the refrigerant used in the dehumidifying air conditioner shown in FIG. 22.

FIG. 22 shows a flow chart of the dehumidifying air conditioner of an embodiment of this invention, that is, an air conditioning system with a desiccant air conditioner. The dehumidifying air conditioner in this embodiment is capable of raising the regeneration temperature, in addition to its increased COP and compact size. For the process air cooler of this invention used with this air conditioning system, the heat exchanger as described with reference to FIG. 9 is suited. FIG. 23 is a humid air chart of the dehumidifying air conditioner shown in FIG. 22. FIG. 24 is a refrigerant Mollier chart of the heat pump HP6 incorporated in the air conditioning system of FIG. 22, and FIG. 25 is a chart showing the enthalpy and temperature change of refrigerant and regeneration air in the heat exchangers 220B, 220A incorporated in this embodiment.

Referring to FIG. 22, the constitution will be described of the dehumidifying air conditioner of an embodiment of this invention. The air conditioning system is characterized in that the process air temperature is lowered by desiccant (drying agent), and the air conditioning space 101 supplied with process air is maintained in a comfortable environment. In the figure, the structure of the devices along the path of process air from the air conditioning space 101 through the desiccant wheel 103 back to the air conditioning space 101 is the same as that of the system described in FIG. 8.

It is arranged such that outside air is first introduced, as cooling fluid, from outside OA into the process air cooler 300*c* along the path of regeneration air B, passes through, as regeneration air, the refrigerant condenser (as a heater viewed from regeneration air) 220B, refrigerant sensible heat heat-exchanger 220A, desiccant wheel 103, and blower 140 for providing regeneration air circulation, in this order, and discharged to the outside EX. The refrigerant sensible heat heat-exchanger 220A is also referred to as a first high heat source heat-exchanger, and the refrigerant condenser 220B as a second high heat source exchanger.

Further, it is configured such that the devices along the path of refrigerant beginning at refrigerant evaporator 210 are arranged in the following order: a refrigerant heat exchanger 270 for exchanging heat between cold refrigerant gas evaporated in the refrigerant evaporator 210 to be gasified and hot refrigerant introduced from the refrigerant sensible heat heat-exchanger 220A; a compressor 260 for compressing refrigerant gas passing through the refrigerant heat exchanger 270 to be heated by exchanging heat with hot refrigerant from the refrigerant sensible heat heat-exchanger 220A; a refrigerant sensible heat heat-exchanger 220A for absorbing mainly the sensible heat of refrigerant delivered after being compressed by the compressor 260 to turn the refrigerant into saturated refrigerant vapor; a refrigerant heat exchanger 270 for exchanging heat between the refrigerant gas from the refrigerant sensible heat heat-exchanger 220A and the refrigerant gas from the refrigerant evaporator 210 as described above; a refrigerant condenser 220B for absorbing mainly latent heat of refrigerant to condense the refrigerant; a header 235; a plurality of throttles 230A, 230B, 230C branched off from the header and disposed in parallel; a process air cooler 300*c;* a plurality of throttles 240A, 240B, 240C corresponding to the throttles 230A, 230B, 230C; and a header 245 for collecting flows from these throttles, and thus the refrigerant gas returns to the refrigerant evaporator 210 again. An expansion valve 250 may be provided between the header 245 and the refrigerant evaporator 210, as shown in the figure. In this way, the heat pump HP6 is configured, including the refrigerant evaporator 210; compressor 260; refrigerant sensible heat heat-exchanger 220A; refrigerant condenser 220B; plurality of throttles 230A, 230B, 230C; process air cooler 300; plurality of throttles 240A, 240B, 240C.

The heat exchanger 300*c* as a process air cooler incorporated in this embodiment is described with reference to FIG. 9.

Functions of the embodiment of this invention will be described with reference to the humid air chart in FIG. 23, and for the structure, to FIG. 22 as appropriate. In FIG. 23, alphabetical symbols K-N, Q, R, X, T, and U denote the states of air in respective sections. Those symbols correspond to the encircled letters in the flow chart of FIG. 22.

First, the flow of process air A will be described. In FIG. 23, process air (in the state K) from the air conditioned space 101 is drawn by the blower 102 through the process air path 107, and sent through the process air path 108 into the desiccant wheel 103, where it is adsorbed of its moisture by desiccant in the drying elements 103*a* (FIG. 16) to, lower absolute humidity, and raise the dry-bulb temperature using the adsorption heat of the desiccant, and then reaches the state L. This air is sent through the process air path 109 to the first compartment 310 of the process air cooler 300, where it is cooled by evaporated refrigerant with absolute humidity kept constant in the evaporating section 251 (FIG. 9), to be turned into air in the state M, and enters the cooler 210 through the path 110. There, it is further cooled, with absolute humidity kept constant, to be turned into air in the state N. This air is returned to the air conditioning space 101 via the duct 111, as process air SA with an adequate humidity and at an adequate temperature.

Next, the flow of regeneration air B will be described. In FIG. 23, regeneration air (the state Q) from the outside OA is drawn through the regeneration air path 124 and sent to the second compartment 320 of the process air cooler 300, where it exchanges heat with condensing refrigerant (exchanges heat indirectly with process air), raises the dry-bulb temperature, and turns into air in the state R. This air is sent through the path 126 into the refrigerant condenser (as a heater viewed from regeneration air) 220B, where it is heated to raise the dry-bulb temperature, then turns into air in the state S, further enters the sensible heat heat-exchanger 220A, and is heated further to turn into air in the state T. This air is sent through the path 127 into the desiccant wheel 103, by which moisture is removed from the desiccant in the drying elements 103*a* (FIG. 16) for regeneration, then raises its own absolute humidity and lowers dry-bulb temperature by moisture removal heat, and enters the state U. This air is drawn through the path 128 into the blower 140 for providing regeneration air circulation, and discharged EX through the path 129.

In the air conditioner as described above, the relation of heat quantity $\Delta H$ applied to regeneration air, heat quantity $\Delta q$ drawn from process air, and drive energy $\Delta h$ of the compressor is the same as described in FIG. 14. In this embodiment, heat exchange efficiency of the process air cooler 300*c* is very high, thereby remarkably improving cooling effect.

Next, referring to the flow chart in FIG. 22 and the Mollier chart in FIG. 24, the flow of refrigerant between devices, and functions of the heat pump HP6 will be described.

In FIG. 22, refrigerant compressed by the refrigerant compressor 260 is introduced into the sensible heat heat-exchanger 220A through the refrigerant gas pipe 201 connected to the discharge port of the compressor. The refrigerant gas compressed by the compressor 260 is raised in temperature by compression heat, and the regeneration air is heated by this heat. In this state, refrigerant is deprived mainly of its sensible heat. As a result, the refrigerant is approximately in the state of saturation, but actually, in the state of superheat which may turn into the state of saturation if the refrigerant is deprived of only a small amount of heat, or in the wetting state, that is, in the perfect saturated gas (or the perfect saturated gas mixed with liquid condensed from part of refrigerant. The state in the vicinity of the saturated gas is referred to as a state of approximate saturation. The refrigerant in the state of approximate saturation is introduced through the refrigerant pipe 225 into the refrigerant heat exchanger 270, where it exchanges heat with cold refrigerant gas before taken into the compressor 260, then evaporates in the refrigerant evaporator 210, turns in part into the wetting state, and is introduced through the refrigerant path 206A into the refrigerant condenser as a (heater viewed from regeneration air) 220B, where it is deprived of its heat to be condensed.

The refrigerant outlet of the refrigerant condenser 220B is connected via the refrigerant path 202 to the header 235 provided at the inlet of the evaporating section 251 of the heat exchanger or the process air cooler 300*c*. Between the header 235 and the evaporating section 251, throttles 230A, 230B, 230C are provided corresponding to the evaporating sections 250A, 250B, 251C, respectively. While only three throttles are shown in FIG. 22, any number of throttles more than one may be arranged depending on the number of the evaporating sections 251 or the condensing sections 252.

Liquid refrigerant exiting the refrigerant condenser (as a heater viewed from regeneration air) 220B is lowered in pressure at the throttles 230A, 230B, 230C and then expanded, and part of the liquid refrigerant is evaporated (flushed). Refrigerant which is the mixture of the liquid and gas, reaches the evaporating sections 251A, 251B, 251C, where the liquid refrigerant flows in the tubes of the evaporating sections while wetting the inner wall of the tubes is evaporated, and cools the process air flowing in the first compartment.

As described above, the evaporating sections 251A, 251B, 251C and the condensing section 252A, 252B, 252C are formed with a series of tubes, respectively, constituting an integral path, respectively.

The heat exchanger 300*c* for heat pump shown in FIG. 22 is the same as described with reference to FIG. 8, in that throttles are interposed between the header 235 and the evaporating section, that the throttles are allocated separately to a plurality of evaporating sections, and that throttles are allocated separately to the corresponding condensing sections between them and the header, respectively.

In the constitution, as described with reference to FIG. 8, the process air cooler 300*c* is configured such that there exists a plurality of evaporating pressures of refrigerant which cools process air A, and a plurality of condensing pressures of refrigerant which is cooled by outside air B and condensed, corresponding to the foregoing evaporating pressures, and the plurality of the evaporating pressures or the condensing pressures are arranged from high to low or from low to high in order of their pressure level. In this way, noting the flow of process air A and that of outside air B, they exchange heat, so to speak, in counter flow relation, so that a remarkably high heat exchange efficiency $\phi$, for example over 80%, can be realized.

Here, throttles 230A, 230B, 230C and throttles 240A, 240B, 240C are provided before and after the process air cooler 300*c*, respectively. Alternatively, throttles may be provided immediately before the header 235 or in the header 235, or after the header 245 or in the header 245, one for each place, thereby simplifying the plurality of pressures of evaporating sections or condensing sections into one value. In this case, the process air and the regeneration air are not necessarily in counter flow relation, but evaporating heat transfer and condensing heat transfer can be utilized, so that high heat transfer coefficient can be likewise applied to the heat transfer between process air and regeneration air.

As described above with reference to FIG. 9, the evaporating section and condensing section are constituted integrally by a series of heat-exchange tubes, but they may be replaced with a heat exchanger having a first and a second compartment separated as shown in FIG. 3.

This header 245 on the condensing section 252 side is connected by the refrigerant liquid pipe 203 to the refrigerant evaporator 210 (as a cooler viewed from process air). Throttles 240A, 240B, 240C may be disposed anywhere from a place immediately after the condensing sections 252A, 252B, 252C to the inlet of the refrigerant evaporator. 210, but if they are disposed immediately before the inlet of the refrigerant evaporator 210, thermal insulation of pipes can be thinner for the refrigerant after the throttles 240A, B, C at a temperature significantly lower than the atmospheric temperature. The refrigerant condensed in the condensing sections 252A, B, C is lowered in pressure and expanded to decrease in temperature, then enters the refrigerant evaporator 210 to be evaporated, and cools the process air by the evaporating heat. Throttles 230A, B, C or 240A, B, C may be orifices, capillary tubes or expansion valves, etc.

Next, referring to FIG. 24, functions of the heat pump HP6 will be described. FIG. 24 is a Mollier chart of the system using HFC 134*a* as refrigerant. In this chart, the horizontal axis represents the enthalpy and the vertical axis the pressure.

In the figure, the point q represents the state at refrigerant outlet of the refrigerant evaporator 210 shown in FIG. 22, and it is in the state of q saturated gas. The pressure is 4.2 kg/cm$^2$, the temperature 10° C., and the enthalpy 148.83 kcal/kg. A state in which this gas is heated in the refrigerant heat exchanger 270 is shown by the point a. The pressure of this state is 4.2 kg/cm$^2$ (actually lowered by the amount of pressure loss in the refrigerant pipes and the heat exchanger, which is neglected here. The same is applied to the following description), and the temperature 55° C. The refrigerant gas in this state is drawn into the compressor 260 to be compressed and reaches the state b at the discharge port of the compressor 260. In the state of the point b, the pressure is 19.3 kg/cm$^2$ and the temperature 115° C. If no heat exchanger is provided in the inlet path of the compressor, this temperature should be 80° C. or so, but in this embodiment, it shows 115° C. This is because refrigerant has been heated in the refrigerant heat exchanger 270.

This refrigerant gas is deprived mainly of sensible heat in the sensible heat heat-exchanger 220A and reaches the point c. This point represents the state of approximately saturated gas; the pressure is 19.3 kg/cm$^2$ and the temperature 65° C. The gas exchanges heat with cold refrigerant before intake to the compressor 260, deprived of its heat, and reaches the point p. This point represents the wetting state in which refrigerant gas and refrigerant liquid coexist. This refrigerant is further deprived of its heat in the refrigerant condenser 220B and reaches the point d. This point represents the state of saturated liquid; the pressure and temperature are the same as those of the point c or q, and the pressure is 19.3 kg/cm$^2$, the temperature 65° C., and the enthalpy 122.97 kcal/kg.

The state of part of the refrigerant liquid which is lowered in pressure at the throttle 230A and flows in the evaporating section 251A, is represented at the point e1 on the Mollier chart. The temperature is approximately 43° C. The pressure is one of a plurality of different pressures, a saturated pressure corresponding to the temperature of 43° C. Likewise, the state of refrigerant lowered in pressure at the throttle 230B and flowing in the evaporating section 251B, is represented at the point e2 on the Mollier chart; the temperature is 40° C. and the pressure is also one of a plurality of different pressures, a saturated pressure corresponding to the temperature of 40° C. Likewise, the state of refrigerant lowered in pressure at the throttle 230C and flowing in the evaporating section 251C, is represented at the point e3 on the Mollier chart; the temperature is 37° C. and the pressure is also one of a plurality of different pressures, a saturated pressure corresponding to the temperature of 37° C.

At any point of e1, e2, e3, the refrigerant is in a state in which part of the liquid is evaporated (flushed) and the liquid and the gas are mixed together. The refrigerant liquids are each evaporated in the respective evaporating sections 251A, B, C under the pressure of one of the foregoing respective plurality of different pressures, and reach the points f1, f2, f3, for respective pressures, intermediate between the saturated liquid line and saturated gas line.

The refrigerants in these states flow in the condensing sections, 252A, 252B, 252C. In the condensing sections,the refrigerants are each deprived of their heat by outside air flowing the second compartment, and reach the respective points g1, g2, g3. These points are on the saturated liquid line in the Mollier chart. The temperatures are 43° C., 40° C. and 37° C., respectively. These refrigerant liquids each pass through the throttles and reach the respective points j1, j2, j3. The pressures at these points are a saturated pressure of 4.2 kg/cm$^2$ at 10° C.

Here, the refrigerants are in a state of mixture of liquid and gas. These refrigerants join at one header 245, therefore the enthalpy at this point is an average of enthalpies at the points g1, g2, g3 weighted by the corresponding refrigerant flow rates, and amounts to approximately 113.51 kcal/kg in this example.

This refrigerant deprives process air of its heat in the refrigerant evaporator 210, evaporates into q saturated gas in the state of the point q on the Mollier chart, and flows again in the refrigerant heat exchanger 270. In this way, the above described cycle is repeated.

Functions of the heat exchanger 300*c* is the same as described with reference to FIG. 9. That is, process air is cooled from a higher temperature to a lower temperature as it flows from the upper side to the lower side on the figure in the first compartment 310, at temperatures 43° C., 40° C. and 37° C. in order of temperature level, so that heat exchange efficiency can be improved compared with that obtained when process air is cooled at one temperature of, for example, 40° C. Also, outside air (regeneration air) is heated from a lower temperature to a higher temperature as it flows from the lower side to the upper side on the figure in the second compartment 320, at temperatures 37° C., 40° C. and 43° C. in order of temperature level, so that heat exchange efficiency can be improved compared with that obtained when process air is heated at one temperature of, for example, 40° C.

Further, if the heat exchanger 300*c* is provided, the compression heat pump HP6 including the compressor 260, refrigerant condenser 220B, throttles and refrigerant evaporator 210, is able to reduce the required power of the compressor by 27%, as described with reference to FIG. 10. Oppositely saying, the cooling effect achievable with the same power can be improved by 37%.

Further, as a result that refrigerant is heated in the refrigerant heat exchanger 220A before it is drawn into the compressor 260, the ratio of the heat quantity of regeneration air heated at temperatures above the condensing temperature of the refrigerant in the sensible heat heat-exchanger 270 to that of regeneration air heated at a constant condensing temperature in the condenser 220B is 35%:65%. Compared with the example of FIG. 10 in which the ratio is approximately 12%:88%, the difference is great.

Referring to FIG. 25, the temperature rise of the regeneration air in the foregoing dehumidifying air conditioner will be described. FIG. 25 is a chart showing the relation of regeneration air vs. changes (variation) in enthalpy of high pressure refrigerant in the heat pump HP6 used for the heat source of the regeneration air. When refrigerant in the heat pump exchanges heat with regeneration air, changes in enthalpy of refrigerant and regeneration air are the same because of heat balance. Since air undergoes a sensible heat change with the approximately constant specific heat, it is shown in the figure by a continuous straight line, while since refrigerant undergoes latent heat change and sensible heat change, it is shown by a horizontal line for the region with latent heat change. Therefore, the temperature of regeneration air at the outlet of the condenser 220B is determined, the regeneration air temperature at the outlet of the sensible heat heat-exchanger 220A can be calculated based on heat balance, not based on the temperature of superheated vapor of the refrigerant with which heat is to be exchanged.

Therefore, in FIG. 25, if the refrigerant cycle is the same as in FIG. 24, the regeneration temperature at the inlet of the condenser 220B is 40° C., and the refrigerant condensing temperature is 65° C., the temperature Ts of the state S is $Ts=40+(65-40)\times 80/100=60°$ C., assuming the heat exchange efficiency of the condenser 220B of the heat pump to be 80% in this embodiment. Then, if the regeneration air is heated by the superheated refrigerant vapor by 35% of the total heat quantity by heating, the temperature Tt of the air in the state T is $Tt=60+20\times 35/65=70.8°$ C., from heat balance as described above. Therefore, regeneration air can be obtained, the temperature of which is higher than the condensing temperature of 65° C. by 5.8° C.

Therefore, since in this embodiment, desiccant can be regenerated at a higher temperature than the condensing temperature, the dehumidifying ability of the desiccant can be improved remarkably, thereby providing an air conditioning system with excellent dehumidifying ability as well as energy saving properties. Regarding regeneration air, discharged air from the room in association with room ventilation may be utilized with the same effects as in foregoing embodiment.

Figure 26:
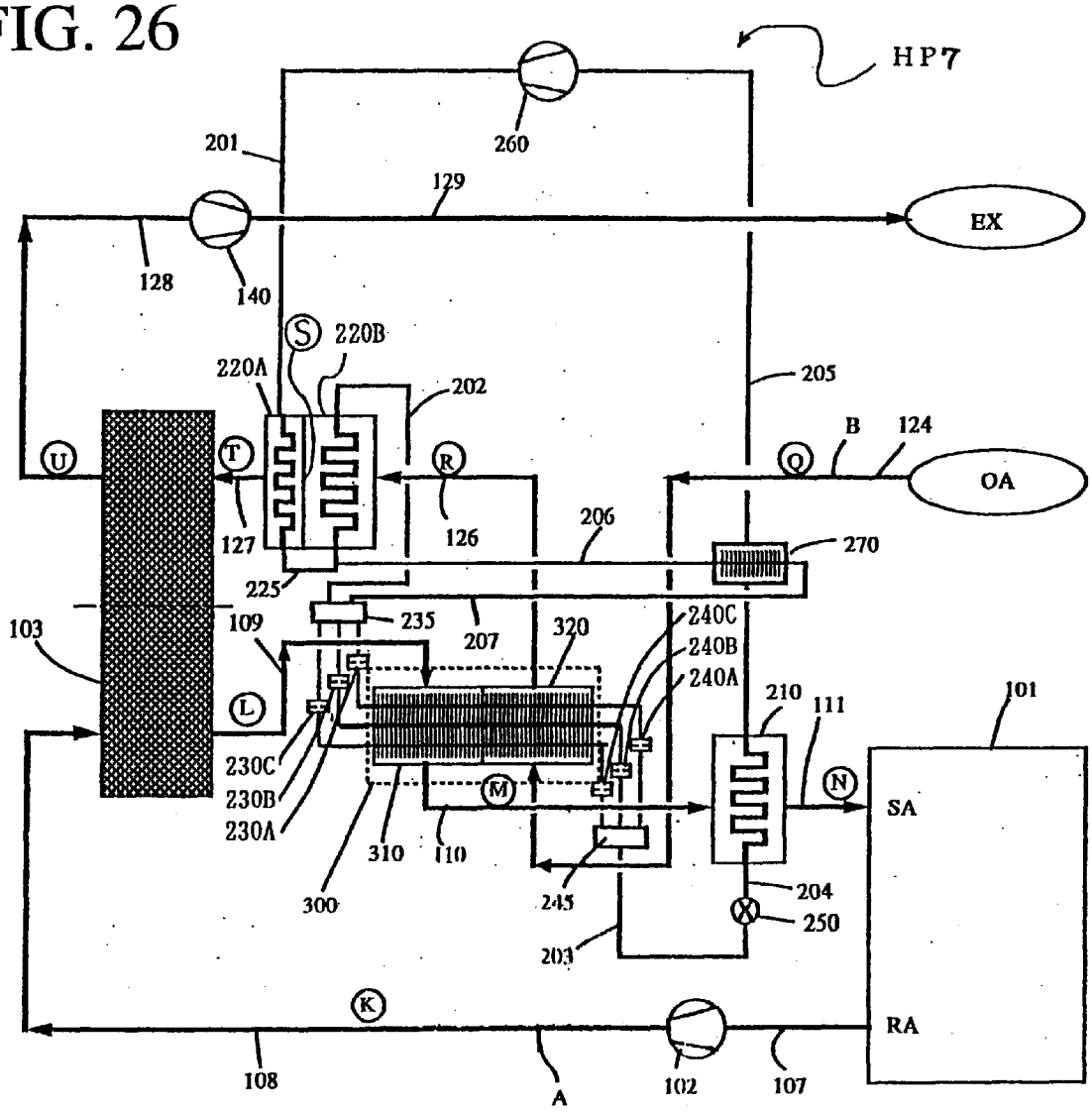
FIG. 26 is a flow chart of a dehumidifying air conditioner as another embodiment of the invention.

Referring to FIG. 26, the structure of the dehumidifying air conditioner of an embodiment of this invention will be described. The difference from the embodiment of FIG. 22 is that while in the example of FIG. 22, refrigerant flowing out from the sensible heat heat-exchanger 220A, is deprived of sensible heat and in the state of approximate saturation, and all of the refrigerant is introduced into the refrigerant heat exchanger 270, in the embodiment of FIG. 26 the refrigerant path 206 connected to the refrigerant heat exchanger 270 is branched off from the refrigerant path 225 from the sensible heat exchanger 220A, and part of the refrigerant from the sensible heat heat-exchanger 220A is adapted to pass through the refrigerant heat exchanger 270. The refrigerant deprived of its heat is introduced from the refrigerant heat exchanger 270 to the header 235, through the refrigerant path 207, and joins the refrigerant from the condenser 220B. Therefore, while in the embodiment in FIG. 22 the refrigerant from the sensible heat heat-exchanger 220A is deprived of its heat to the extent that it turns into the wetting state in the refrigerant heat exchanger 270, in the embodiment of FIG. 26, the refrigerant condenses almost completely as a result of the heat deprivation in the refrigerant heat exchanger 270. In this embodiment, if the appropriate selection is made with respect to the ratio of the amount of refrigerant flowing in the refrigerant heat exchanger 270 to that of refrigerant flowing in the condenser 220B, the temperature of the point b on the Mollier chart in FIG. 24 can be set appropriately. Other general effects and functions are approximately the same as those in the embodiment of FIG. 22.

Figure 27:
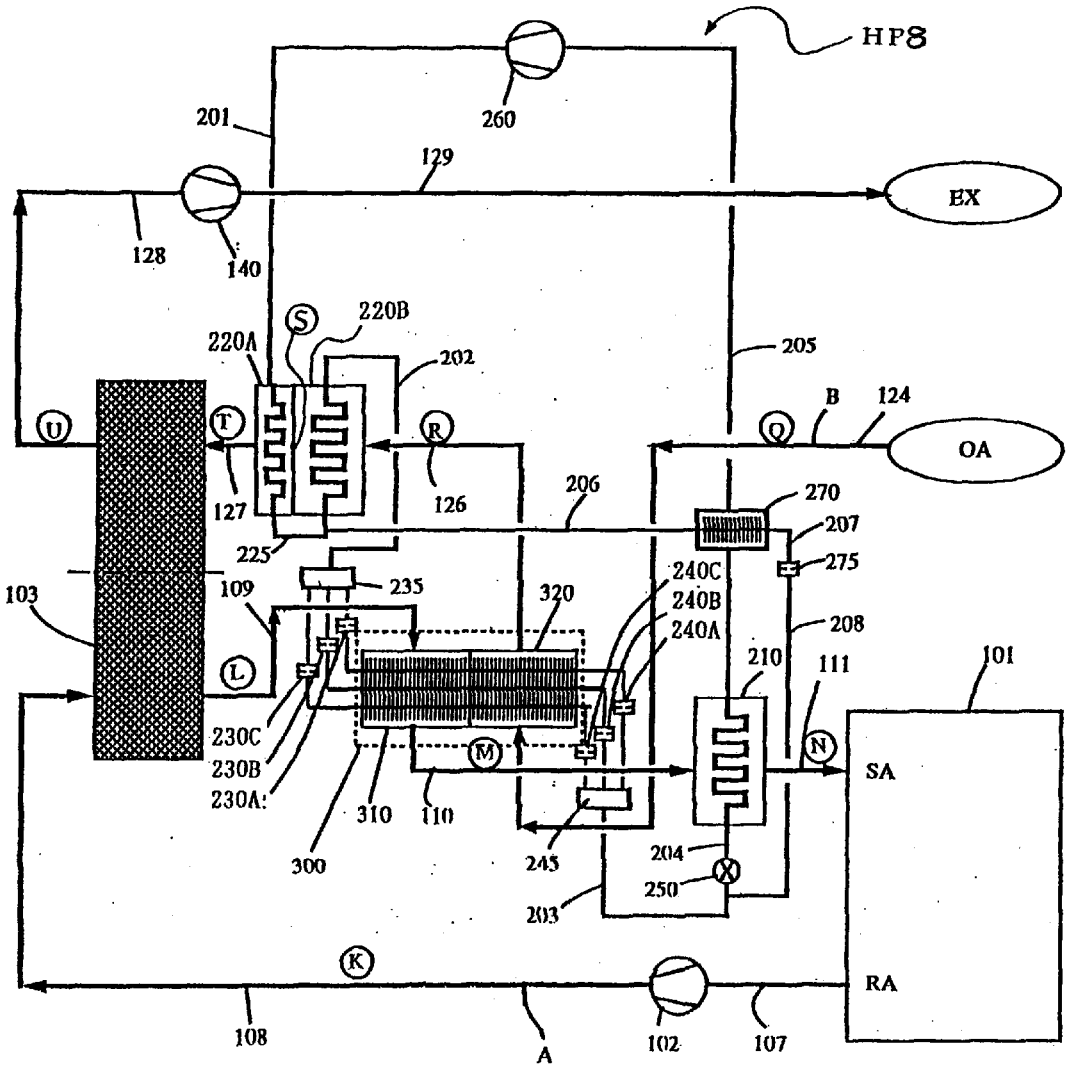
FIG. 27 is a flow chart of a dehumidifying air conditioner as still another embodiment of the invention.

Referring new to FIG. 27, the structure will be described of the dehumidifying air conditioner of still another embodiment of the invention. In this embodiment, like the embodiment of FIG. 26, refrigerant flows out from the sensible heat heat-exchanger 220A and is almost deprived of sensible heat, and part of the refrigerant is introduced through the refrigerant path 206 into the refrigerant heat exchanger 270, to be deprived of its heat and condensed, but unlike the embodiment of FIG. 26, the refrigerant from the refrigerant heat exchanger 270 passes through the path 207, throttle 275, and path 208 and joins the path 203 between the header 245 and expansion valve 250 or the evaporator 210.

Therefore, on the Mollier chart in FIG. 24, refrigerant from the refrigerant heat exchanger 270 is throttled at the throttle 275 (and the expansion valve 250) from the state of the point d and evaporates in the evaporator 210, so that cooling effect is somewhat lower than that in the foregoing embodiment, though problems in arrangement of the heat exchanger can be eliminated.

Figure 28:
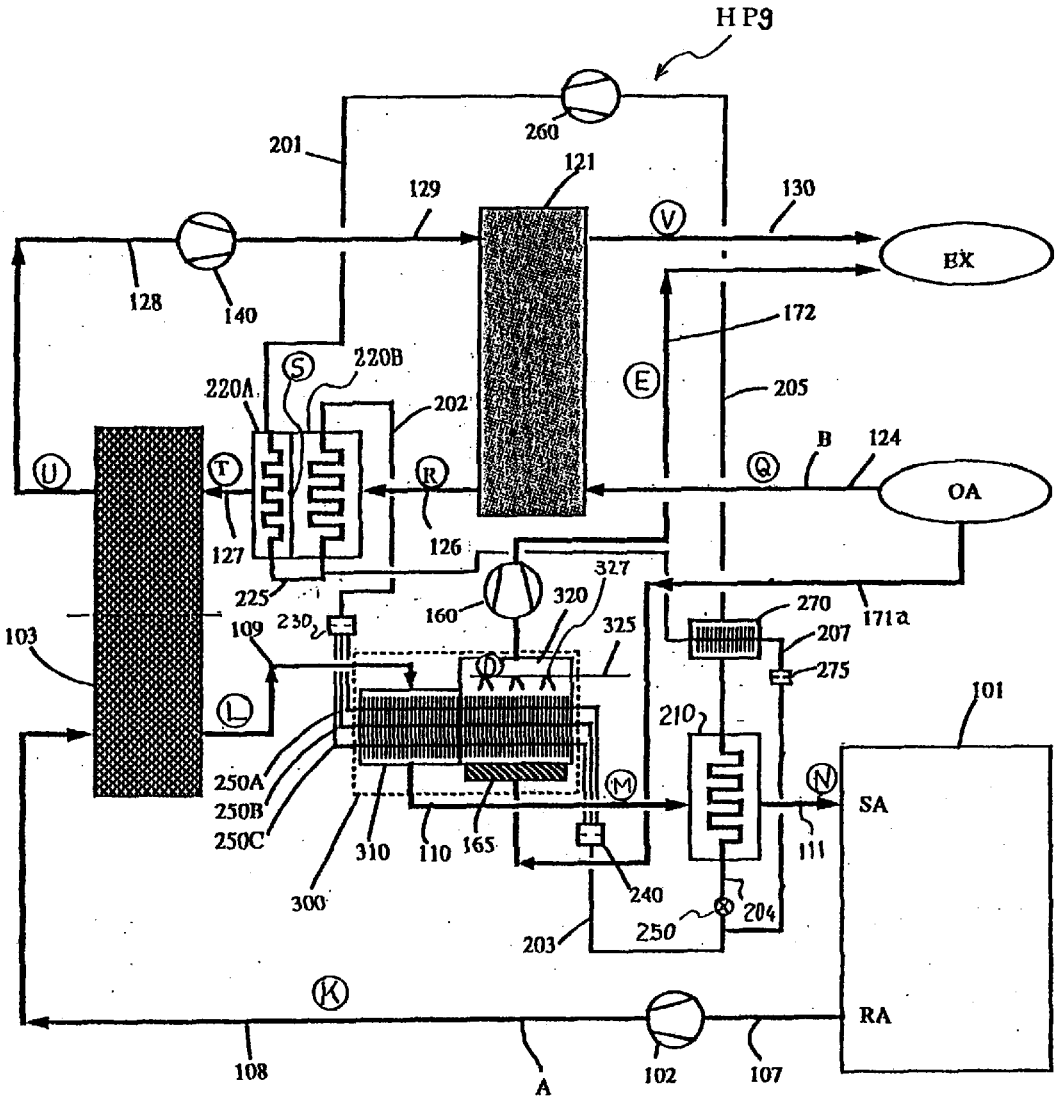
FIG. 28 is a flow chart of a dehumidifying air conditioner as still another embodiment of the invention.

Referring to FIG. 28, the structure will be described of the dehumidifying air conditioner of yet another embodiment of the invention. In this embodiment, the process air cooler can suitably utilize the heat exchanger 300 described above with reference to FIG. 1. This heat exchanger 300, as described above, utilizes evaporating heat transfer and condensing heat transfer, so that heat transfer coefficient is excellent and thus heat exchange efficiency is very high. The refrigerant is passed through from the evaporating section 251 toward the condensing section 252, that is, forced to flow approximately in one direction, so that heat exchange efficiency is high between process air, and outside air as a cooling fluid.

In this embodiment, the flow of process air is the same as that in other embodiments, and its description is not repeated. Now, the flow of regeneration air B will be described. In FIG. 28, regeneration air (state Q) from outside OA is drawn through the regeneration air path 124 and sent into the heat exchanger 121, where it exchanges heat with regeneration air (air of the state U described later) which has a raised temperature and needs be discharged, raises the dry-bulb temperature, and then turns into air of the state R. This air is sent through the path 126 into the refrigerant condenser 220B, where it is heated to raise the dry-bulb temperature and then turns into air of state S, and flows into the sensible heat heat-exchanger 220A to be heated and then turns into air of the state T. This air is sent through the path 127 into the desiccant wheel 103, where it deprives, of moisture, the desiccant in the drying element 103*a* (FIG. 16) for regeneration, raises its own absolute humidity, lowers dry-bulb temperature by moisture removal heat, and reaches the state U. This air is drawn through the path 128 into the blower 140 for providing regeneration air circulation, sent through the path 129 into heat exchanger 121, exchanges heat with regeneration air (air of the state Q) before feed-in to the desiccant wheel 103, as described above, lowers its own temperature to turn into the air of the state V, and is discharged EX through the path 130..

The flow of outside air C as a cooling fluid is the same as described in FIG. 5. That is, in this embodiment, as a result of functions of the humidifier 165 and spray pipes 325, the temperature of outside air as a cooling fluid is lowered, which is useful for improving cooling effect. Also, on the second compartment side of the condensing section 252, cooling effect due to latent heat produced by water evaporation can be expected.

In the cooling cycle, regarding refrigerant from the sensible heat heat-exchanger 220A, like the embodiment shown in FIG. 27, part of the refrigerant is sent to the refrigerant heat exchanger 270, and the refrigerant condensed in the refrigerant heat exchanger 270 joins, through the throttle 275, to the path 203 between the throttle 240 acting also as a header of the condensing section and the expansion valve 250 or the evaporator 210. On the Mollier chart in FIG. 24, refrigerant passing the throttle 230 is reduced in pressure from the state of the point d to, for example, the state of the point e2, at this point takes heat from process air, and proceeds to the point f2, where it is deprived of heat further by cooling fluid, and reaches the point g2. Then, it is reduced in pressure at the throttle 240 and reaches the point j2. That is, the evaporating pressure, or the condensing pressure in the process air cooler 300 takes one value, therefore it cannot be said that heat-exchange between process air and cooling fluid constitutes a counterflow. However, in the process air cooler 300, like the foregoing embodiment, it also utilizes evaporating heat transfer and condensing heat transfer, and further, water is sprayed so as to lower the temperature of the refrigerant and removes heat by evaporating heat transfer, thereby producing a high cooling effect as well.

In addition, as a variation of the embodiment of FIG. 28, like the embodiment of FIG. 22, all the refrigerant from the sensible heat heat-exchanger 220A may be inducted into the refrigerant heat exchanger 270 and then the condenser 220B. Also, like the embodiment of FIG. 26, part of refrigerant may be passed through the refrigerant heat exchanger 270, in which the refrigerant condensed may be then inducted to the throttle 230 so as to join the refrigerant condensed in the condenser 220B.

According to this invention as described above, refrigerant, after having been compressed by the compressor, exchanges heat with regeneration air before regeneration of desiccant, to be turned into approximately saturated vapor, and this refrigerant is therefore able to heat refrigerant before intake to the compressor, so that the discharge temperature of the refrigerant compressed by the compressor is raised, resulting in raising of regeneration air before regeneration of desiccant. Further, since the process air cooler is provided, heat exchange between process air and cooling fluid is performed by evaporating and condensing heat transfer with high heat transfer coefficient, thereby providing a dehumidifying air conditioner with high COP and compact size.

Figure 29:
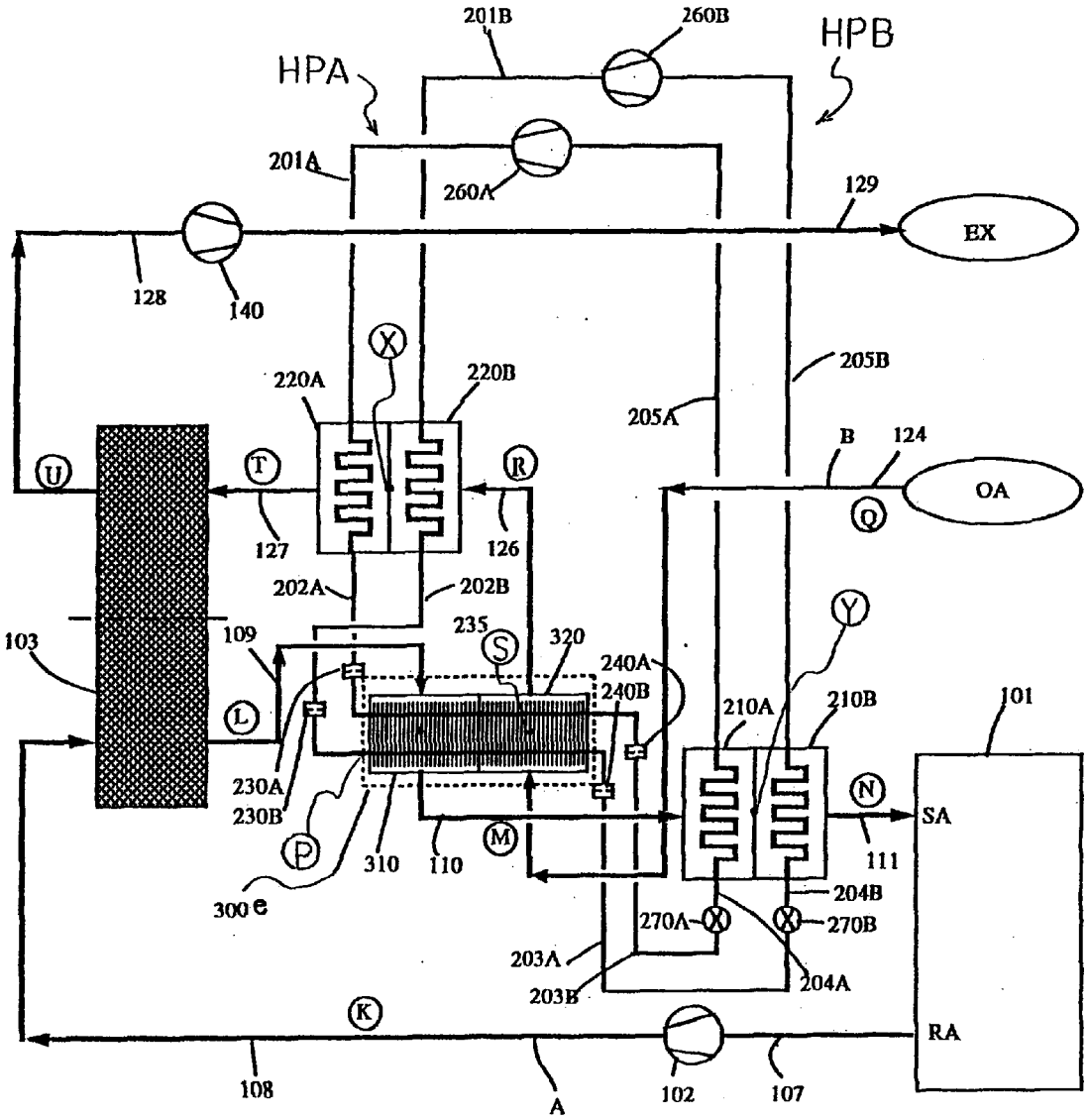
FIG. 29 is a flow chart of a dehumidifying air conditioner as an embodiment of the invention.
Figure 30:
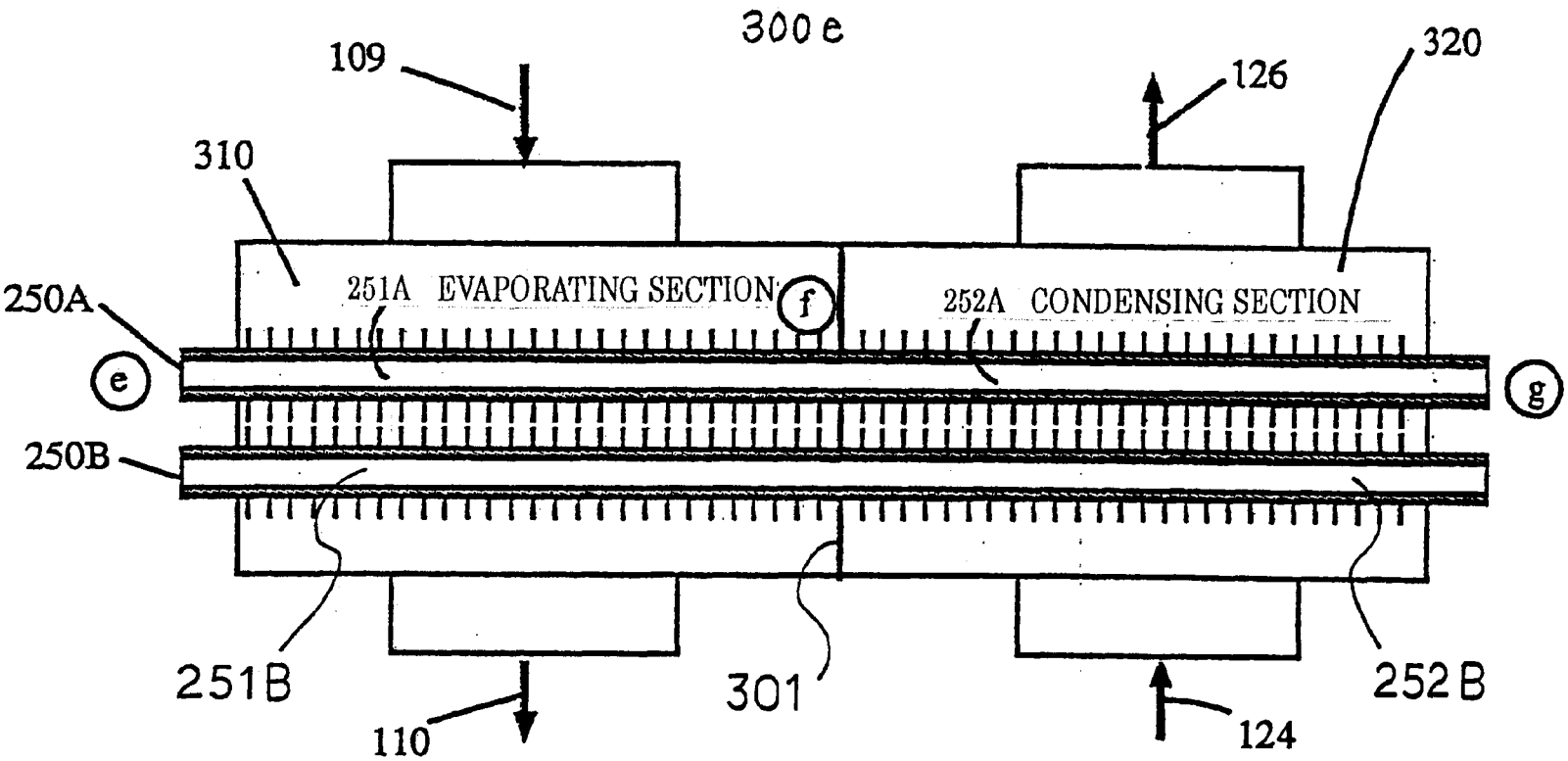
FIG. 30 is a schematic cross sectional view of a heat exchanger suitable for use as a process air cooler in the heat pump used in the dehumidifying air conditioner shown in FIG. 29.
Figure 31:
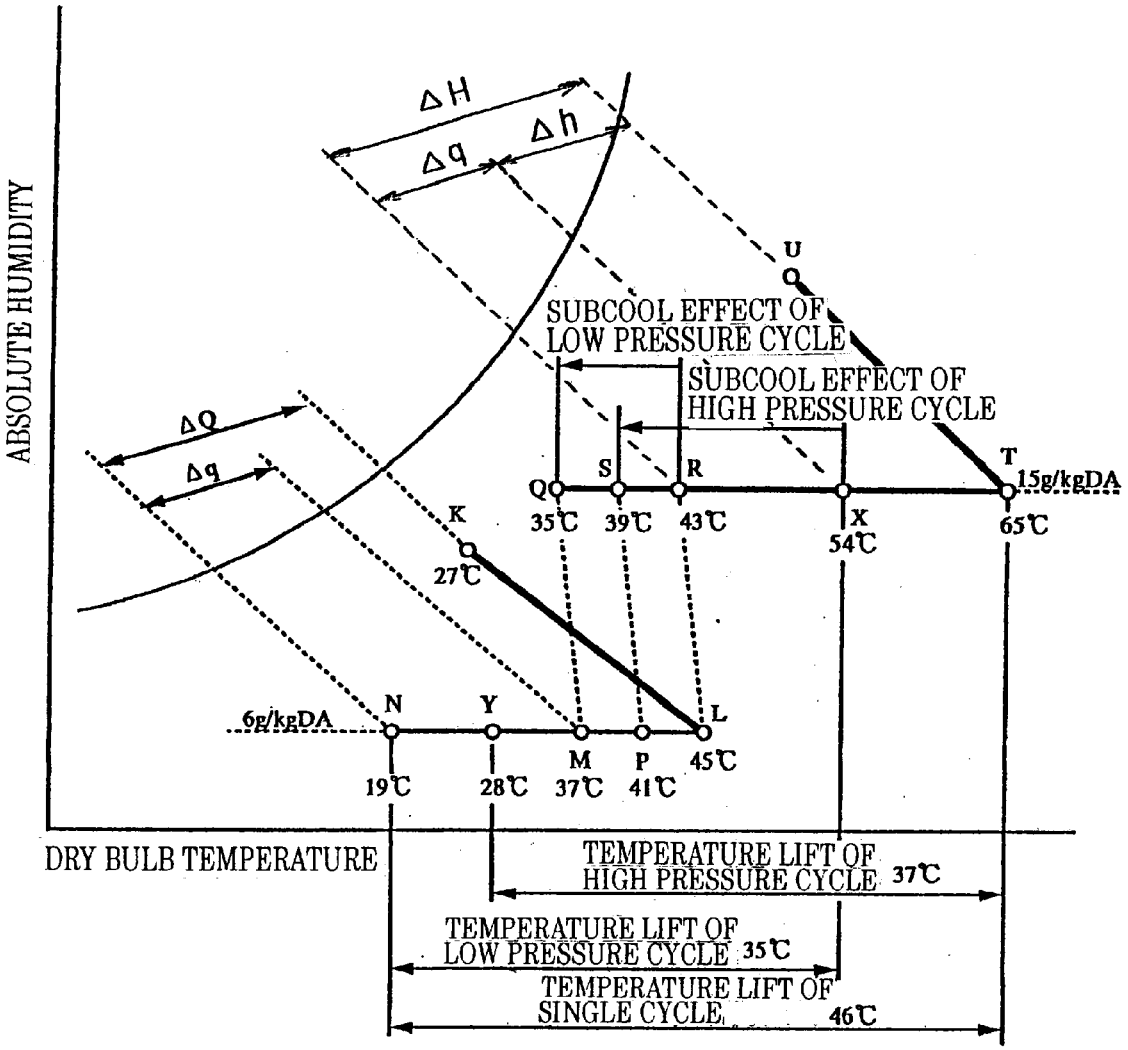
FIG. 31 is a moist air chart for explaining the operation of the dehumidifying air conditioner shown in FIG. 29.
Figure 32:
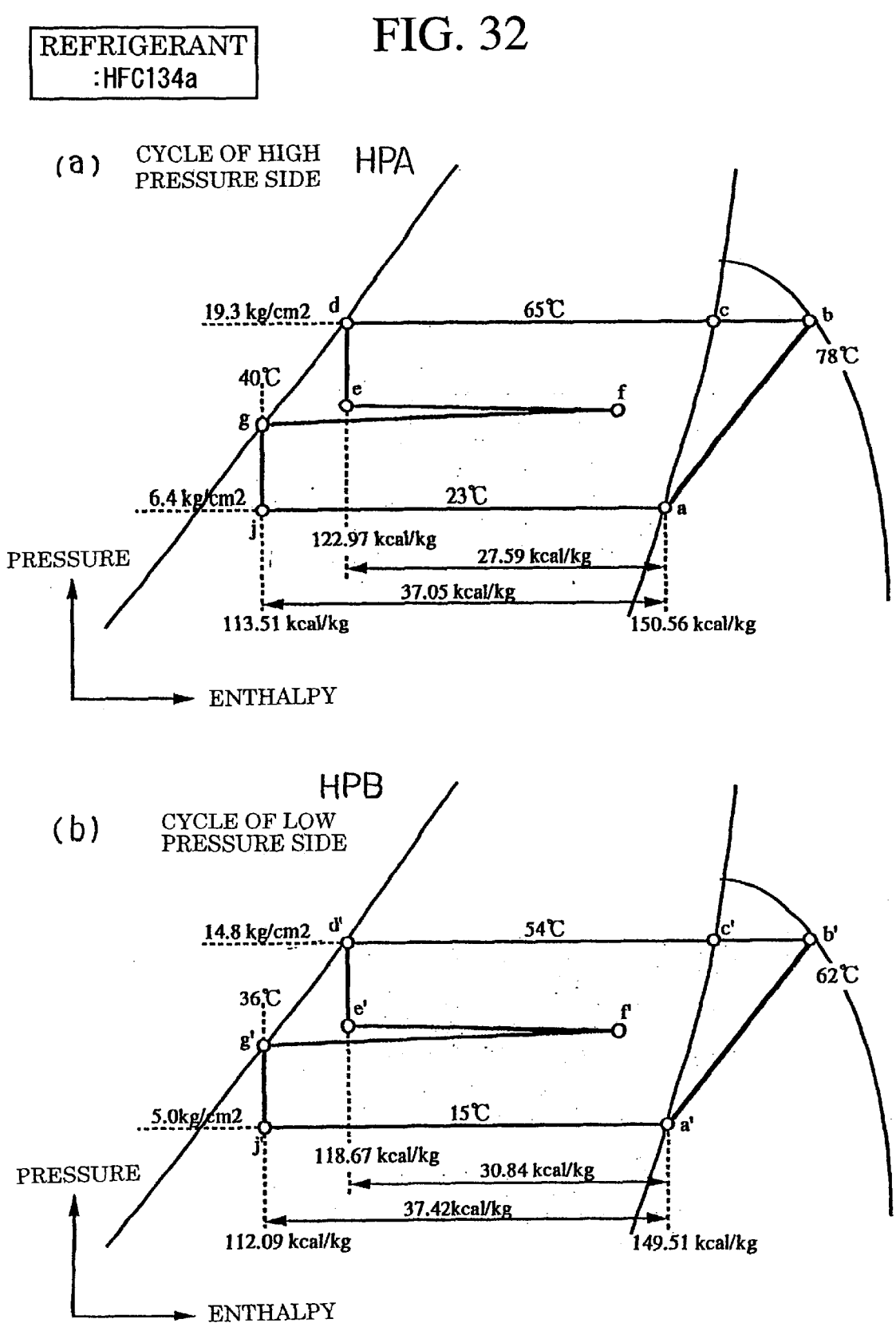
FIG. 32 is a Mollier chart for the heat pump used in the dehumidifying air conditioner shown in FIG. 29.

FIG. 29 is a flow chart of an air conditioning system incorporating the dehumidifying air conditioner of an embodiment of this invention, that is, the desiccant air conditioner; FIG. 30 is a schematic sectional view of an example of the heat exchanger as a process air cooler of this invention suitable to the air conditioning system of FIG. 29; FIG. 31 is a moist air chart of the dehumidifying air conditioner of an embodiment of this invention; FIG. 32 shows refrigerant Mollier charts of the heat pumps HPA, HPB incorporated in the air conditioning system of FIG. 29. The dehumidifying air conditioner of this embodiment has a high COP and compact size. Among others, temperature lift of the heat pump is low, thereby reducing the amount of power required.

Referring to FIG. 29, the structure will be described of a dehumidifying air conditioner of an embodiment of this invention. The air conditioning system is characterized in that the process air temperature is lowered by desiccant (drying agent), and the air conditioning space 101 supplied with the process air is maintained in a comfortable environment. As shown in the figure, the dehumidifying air conditioner is arranged such that from the air conditioning space 101, disposed along the path of process air A are the blower 102 for providing process air circulation; desiccant wheel 103 as a moisture adsorber filled with desiccant; process air cooler 300*e* of this invention; first evaporator (as a cooler viewed from process air) 210A of this invention; and second evaporator (as a cooler viewed from process air) 210B of this invention, in this order, and process air A returns to the air conditioning space 101 again.

Also, it is arranged such that from outside (OA), disposed along the path of regeneration air B are, first, the process air cooler 300*e* for receiving outside air as a cooling fluid; then, the second condenser (as a heater viewed from regeneration air) 220B of this invention; the first condenser (as a heater viewed from regeneration air) 220A of this invention; desiccant wheel 103; and blower 140 for providing regeneration air circulation, in this order, and the outside air which is the cooling fluid and used for regeneration air, is discharged (EX) to the outside.

Further, it is arranged such that from the refrigerant evaporator 210A, disposed along the path of refrigerant are compressor 260A, as a first compressor, for compressing the gasified refrigerant evaporated in the refrigerant evaporator 210A ; refrigerant condenser 220A; throttle 230A; process air cooler 300; throttle 240A corresponding to the throttle 230A; and expansion valve 270A, in this order, and the refrigerant returns to the refrigerant evaporator 210A again. The first heat pump HPA includes the refrigerant evaporator 210A; compressor 260A; refrigerant condenser 220A; throttle 230A; process air cooler 300*e* (evaporating section 251A and condensing section 252A); and throttle 240A.

Quite similarly, the second heat pump HPB is provided in parallel with the first heat pump HPA. That is, it is arranged such that from the refrigerant evaporator 210B, disposed along the path of refrigerant are compressor 260B, as a second compressor, for compressing the gasified refrigerant evaporated in the refrigerant evaporator 210B; refrigerant condenser 220B; throttle 230B; process air cooler 300 (evaporating section 251B and condensing section 252B); throttle 240B corresponding to the throttle 230B; and expansion valve 270B, in this order, and the refrigerant returns to the refrigerant evaporator 210B again. The heat pump HPB includes the refrigerant evaporator 210B; compressor 260B; refrigerant condenser 220B; throttle 230B; process air cooler 300; and throttle 240B.

The desiccant wheel 103 used here is as described with reference to FIG. 16, and the air paths of process air and regeneration air on the upstream and downstream sides of the desiccant wheel 103 are separated by an appropriate partition plate (not shown) such that the air in these two systems do not mix to each other.

Next, referring to FIG. 30, the structure will be described of the heat exchanger as a process air cooler preferred for use in the dehumidifying air conditioner of an embodiment of this invention. In the figure, the heat exchanger 300*e* is provided with the first compartment 310 in which process air A flows, and the second compartment 320 in which outside air (utilized as regeneration air) as a cooling fluid flows, adjacent to each other with a partition wall there between.

A plurality of heat-exchanging tubes (two tubes in this figure) are provided approximately horizontally, which go through the first and second compartment 310, 320 and the partition wall 301, and through which refrigerant 250 flows. One portion of this heat-exchanging tubing passing through the first compartment, constitutes the evaporating section 251 (a plurality of evaporating sections are designated by 251A and 251B) as a first fluid path, and the another portion passing through the second compartment constitutes the condensing section 252 (a plurality of condensing sections are designated by 252A and 252B) as a second fluid path.

In the embodiment shown in FIG. 30, each of the evaporating sections 251A, 251B and the condensing sections 252A, 252B is formed of a single tube and constitutes an integral path. Therefore, the heat exchanger 300 can be formed in compact size as a whole, in combination with the first and second compartments 310, 320 being provided adjacent to each other, with a partition plate 301 disposed therebetween. The evaporating section 251A may comprise a plurality (not single section, as shown) of sections 251A1, 251A2, 251A3 . . . , for one throttle 230A, depending on the length of the section, cross sectional compartment, or refrigerant flow rate. The condensing section may comprise a plurality of sections 252A1, 252A2, 252A3 . . . , accordingly. The plurality of sections may be disposed in multiple rows in the direction of the flow of process air and regeneration air or in the direction perpendicular to the flow, or both of the directions as a matter of course.

In the embodiment of FIG. 30, the evaporating sections are arranged in rows of 251A and 251B in this order from the upper side of the figure, and condensing sections, also in rows of 252A and 252B in this order from the upper side of the figure. When the evaporating sections 251A and the condensing sections 252A are disposed in multiple rows, respectively, in the direction of the flow of process air and regeneration air, the evaporating sections are arranged in rows of 251A1, 251A2, 251A3 . . . , in this order from the upper side of the figure, and the condensing sections, in rows of 252A1, 252A2, 252A3 . . .

On the other hand, in the figure, process air A flows into the first compartment at the upper side through the duct 109 and out from the lower side, while outside air B which is a cooling fluid and used for regeneration air, flows into the second compartment at the lower side through the duct 124 and out from the upper side. That is, the process air A and outside air B flow in counterflow manner.

In such a process air cooler or heat exchanger, the evaporating pressure at the evaporating section 251 and thus the condensing pressure at the condensing section 252A depend on the temperatures of the process air A and the outside air B as a cooling fluid. The heat exchanger 300*e* shown in FIG. 30 utilizes evaporating heat transfer and condensing heat transfer, so that heat transfer coefficient is excellent and thus heat exchange efficiency is very high. Also, the refrigerant is passed through from the evaporating section 251A toward the condensing section 252A, that is, forced to flow approximately in one direction, so that heat exchange efficiency is high between process air, and outside air as a cooling fluid. The heat exchange efficiency $\phi$ has been described with reference to FIG. 4.

Taking account of the direction of the refrigerant flow, though the evaporating pressure is a little higher than the condensing pressure, they are considered to be substantially the same because the evaporating section 251A and the condensing section 252A are configured with an integral, continuous heat-exchanging tube.

While the evaporating section 251A and the condensing section 252A has been described above, functions are quite the same for the evaporating section 251B and the condensing section 252B. However, since the process air flow is directed from the evaporating section 251A toward 251B, and the cooling fluid flow is directed from the condensing section 252B toward 252A, evaporating or condensing pressure of the evaporating section 251A or the condensing section 252A is higher than that of the evaporating section 251B or the condensing section 252B.

The inner surfaces of the heat-exchanging tubes constituting the evaporating section 251 and the condensing section 252, are preferably high quality heat transfer surfaces already described.

The plate fins on the outer side of the heat-exchanging tube in the first compartment or the ones in the second compartment are the same as described with reference to FIG. 1.

Functions of the embodiment of this invention will be described with reference to FIG. 31, and for the structure, to FIG. 29 as appropriate. In FIG. 31, alphabetical symbols K-N, P, Y, Q-U and X designate the states of air in respective sections. These symbols correspond to the letters encircled in the flow chart of FIG. 29.

First, the flow of process air A will be described. In FIG. 31, process air (in the state K) from the air conditioning space 101 is drawn by the blower 102 through the process air path 107, and sent through the process air path 108 into the desiccant wheel 103, where it is adsorbed of its moisture by desiccant in the drying element 103*a* (FIG. 16) to lower absolute humidity, raises dry-bulb temperature with adsorption heat of the desiccant, and reaches the state L. This air is sent through the process air path 109 to the first compartment 310 of the process air cooler 300 where it is cooled by refrigerant which evaporates, with absolute humidity kept constant, in the evaporating section 251A (FIG. 30) at the first intermediate temperature or the third pressure of this invention, to be turned into air in the state P; further cooled by refrigerant which evaporates in the evaporating section 251B (FIG. 30) at the second intermediate temperature or the fourth pressure of this invention, to be turned into air of the state M; and enters the cooler 210A through the path 110. There, it is cooled further, also with constant absolute humidity, at the first evaporation temperature or the first evaporating pressure of this invention, to be turned into air in the state Y, and subsequently enters the cooler 210B, to be cooled further at the second evaporation temperature or the second evaporating pressure of this invention, to be turned into air of state N. This air, after having been dried and cooled, is returned to the air conditioning space 101 via the duct 111, as process air SA with an adequate humidity and at an adequate temperature (absolute humidity of 6 kg/kg and 19° C. in FIG. 31).

Next, the flow of regeneration air B will be described. In FIG. 31, regeneration air (the state Q) from the outside (OA) is drawn through the regeneration air path 124 and sent to the second compartment 320 of the process air cooler 300, where it exchanges heat with refrigerant which condenses at a temperature approximately equal to the second intermediate temperature or a pressure approximately equal to the fourth pressure of this invention in the condensing section 252B, raises dry-bulb temperature, and then turns into air of the state S, and subsequently it exchanges heat with refrigerant which condenses at a temperature approximately equal to the first intermediate temperature or a pressure approximately equal to the third pressure of this invention in the condensing section 252A, raises dry-bulb temperature, and then turns into air of the state R. This air is sent through the path 126 into the refrigerant condenser (heater viewed from regeneration air) 220B, where it is heated at the second condensing temperature or the second condensing pressure, raises dry-bulb temperature, and then turns into air of the state X, and enters the refrigerant condenser 220A, where it is heated at the first condensing temperature or the first condensing pressure, raises dry-bulb temperature, and then turns into air of the state T. This air is sent through the path 127 into the desiccant wheel 103, where it removes moisture from the desiccant in the drying element 103*a* (FIG. 16) for regeneration, raises its own absolute humidity, lowers dry-bulb temperature with moisture removal heat, and reaches the state U. This air is drawn through the path 128 into the blower 140 for providing regeneration air circulation, and discharged EX through the path 129. In the air conditioner described above, as seen from the air cycle shown on the humid air chart in FIG. 31, assuming that heat quantity applied to the regeneration air for regeneration of the desiccant of the conditioner be $\Delta H$, heat quantity pumped up from process air be $\Delta q$, and drive energy of the compressor be $\Delta h$, then $\Delta H=\Delta q+\Delta h$. The cooling effect $\Delta Q$ obtained as a result of regeneration by the heat quantity $\Delta H$, is larger for a lower temperature of outside air (state Q) with which process air (state L) is to exchange heat after moisture adsorption. Also, it is larger for a smaller temperature difference between the state Q and state M, and between the state R and state L. In this embodiment, since heat exchange efficiency of the process air cooler 300 is very high, cooling effect can be improved remarkably. The temperature lift to be pumped up by the heat pump is 37° C., the temperature difference between the state T and state Y, for the first heat pump HPA, and 35° C., the temperature difference between the state X and state N, for the second heat pump HPB.

Now, referring to FIG. 29 and FIG. 32, the refrigerant flow between devices and functions of heat pumps HPA, HPB will be described.

In FIG. 29, refrigerant gas compressed by the first refrigerant compressor 260A is introduced through the refrigerant gas pipe 201A connected to the discharge port of the compressor into the first condenser or the regeneration air heater (refrigerant condenser) 220A. The refrigerant gas compressed in the compressor 260A is raised in temperature by compression heat and regeneration air is heated by this heat. The refrigerant gas is deprived of its own heat to be cooled, and is condensed further.

The refrigerant outlet of the refrigerant condenser 220A is connected by the refrigerant path 202A to the inlet of the evaporating section 251A of the process air cooler 300, and in the middle of the refrigerant path 202A and in the vicinity of the inlet of the evaporating section 251A is provided the throttle 230A. FIG. 29 shows only one throttle for the heat pump HPA system, but any number of throttles more than one may be provided depending on the number of evaporating sections 251A or condensing sections 252A.

Liquid refrigerant exiting the refrigerant condenser (heater viewed from regeneration air) 220A in the state of the first condensing pressure, is decreased in pressure by the throttle 230A to the third pressure, to be expanded, and part of the refrigerant evaporates (flushes). The refrigerant, mixture of liquid and gas, reaches the evaporating section 251A, where liquid refrigerant flows while wetting the inner walls of the tubes of the evaporating section, is evaporated, and cools the process air flowing in the first compartment.

The evaporating section 251A and condensing section 252A are formed of an integral tube. That is, they constitute an integral path, and therefore evaporated refrigerant gas (and unevaporated refrigerant liquid) flows into the condensing section 252A, and is deprived of own heat by outside air flowing in the second compartment, to be condensed.

In the first compartment, process air A flows in the first compartment, in the direction perpendicular to the heat-exchanging tubes of the evaporating section 251A, to exchange heat with refrigerant, and outside air B having the inlet temperature lower than the temperature of process air, flows, in the second compartment, in the direction perpendicular to the heat-exchanging tubes of the condensing section 252A.

In FIG. 30, the first and second compartments are provided adjacent to each other with a partition plate 301 disposed there between, and the evaporating section and condensing section are formed of an integral continuous heat-exchanging tube, but as shown in FIG. 3, the heat exchanger may be arranged such that the first and second compartments are separated and further the first and second paths are also separated. In this case, there is no difference in functions as a heat exchanger from that of FIG. 30.

The condensing section 252A is connected, by the refrigerant liquid pipe 203A, through the throttle 240A to the refrigerant evaporator (cooler viewed from process air) 210A. The pressure is reduced by the throttle 240A from the third pressure to the first evaporating pressure. The throttle 240A may be disposed anywhere from a place immediately after the condensing section 252A to the inlet of the refrigerant evaporator 210A, but if it is disposed immediately before the inlet of the refrigerant evaporator 210A, thermal insulation of piping can be thinner. The refrigerant liquid condensed in the condensing section 252A is reduced in pressure at the throttle 240A and expanded to lower the temperature, enters the refrigerant evaporator 210A to be evaporated, and cools process air by the evaporating heat.

Here, an orifice of constant opening is usually employed for the throttle 240A. In addition to this fixed throttle, between the throttle 240A and the evaporator 210A may be provided an expansion valve 270A, and a temperature sensor (not shown) may be attached to the heat-exchanging section of the refrigerant evaporator 210A or the refrigerant outlet of the refrigerant evaporator 210 A so as to detect the superheating temperature, for adjustment of the opening of the expansion valve 270A. In this way, excessive refrigerant liquid supply to the refrigerant evaporator 210A will be avoided, resulting in avoiding intake of unevaporated refrigerant to the compressor 260A.

The refrigerant evaporated to be gasified in the refrigerant evaporator 210A is introduced to the suction side of the refrigerant compressor 260A, and the foregoing cycle is repeated.

The heat pump HPB has quite the same functions as those of the heat pump HPA, except that its operating pressures (evaporating pressure and condensing pressure) are lower than those of the heat pump HPA. Also, the second evaporator 210B is disposed downstream of the process air flow from the first evaporator 210A, and the second condenser 220B is disposed upstream of the regeneration air flow from the first condenser 220A. To the evaporating section 251A is connected the refrigerant path 202A for the refrigerant flow from the first condenser 220A, and to the evaporating section 251B is connected the refrigerant path 202B for the refrigerant flow from the second condenser 220B.

In the structure described above, process air A flows, in the first compartment, in the direction perpendicular to the heat-exchanging tubes, in contact with the evaporating sections 251A, 251B in this order, to exchange heat with refrigerant, and outside air B having the inlet temperature lower than that of process air, flows, in the second compartment, in the direction perpendicular to the heat-exchanging tubes, in contact with the condensing sections 252B, 252A in this order. In this case, the evaporating pressure or the evaporating temperature is reduced from high to low in order from 251A to 251B in the evaporating section, and raised from low to high in order from 252B to 252A in the condensing section. That is, the process air cooler 300 has two evaporating pressures of the third and the fourth pressures of refrigerant used for cooling process air A, and has two condensing pressures of refrigerant cooled and then condensed by outside air B as a cooling fluid, corresponding to the foregoing evaporating pressures.

Thus, noting the flow of process air A and outside air B, they exchange their heat, so to speak, in counterflow manner, thereby effecting a remarkably high heat exchange efficiency of, for example, 80% or higher.

Next, referring to FIG. 32, functions of the heat pumps HPA and HPB will be described. FIG. 32 shows Mollier charts of the systems using HFC 134*a* as refrigerant. In these charts, the horizontal axis represents the enthalpy and the vertical axis the pressure. FIG. 32(*a*) is a Mollier chart for the first heat pump HPA, and FIG. 32(*b*) a Mollier chart for the second heat pump HPB.

In the FIG. 32(*a*), the point a represents the state at the refrigerant outlet of the cooler 210A shown in FIG. 29, in the state of saturated gas. The pressure as a first evaporating pressure is 6.4 kg/cm$^2$, the temperature as a fist evaporating temperature 23° C., and the enthalpy 150.56 kcal/kg. A state in which this gas is compressed by the compressor 260A, that is, the state of the discharge port of the compressor 260A, is shown by point b. In this state, the pressure as a first condensing pressure is 19.3 kg/cm$^2$, and the temperature is superheated to 78° C.

This refrigerant gas is cooled in the heater (refrigerant condenser) 220A and reaches the point c on the Mollier chart. This point represents the state of saturated gas; the pressure is 19.3kg/cm$^2$ and the temperature as the first condensing temperature is 65° C. The gas is further cooled at this pressure, condenses, and reaches the point d. This point represents the state of saturated liquid; the pressure and the temperature are the same as those of the point c, and the pressure is 19.3 kg/cm$^2$, the temperature 65° C., and the enthalpy 122.97 kcal/kg.

The state of one part of refrigerant liquid, which is reduced in pressure at the throttle 230A and flows in the evaporating section 251A, is represented by the point e on the Mollier chart. The temperature as a first intermediate temperature is 40° C., and the pressure as a first intermediate pressure is a saturation pressure corresponding to the temperature of 40° C.

At the point e, the refrigerant is in the state of a mixture of liquid and gas in which part of the liquid is evaporated (flushed). The refrigerant liquid is evaporated in the evaporating section at a saturation pressure as the first intermediate pressure, and reaches the point f intermediate between the saturated liquid line and saturated gas line for the pressure.

The refrigerant in this state flows into the condensing section 252A. In the condensing section, the refrigerant is deprived of heat by outside air flowing in the second compartment, and reaches the point g. This point is on the saturated liquid line in the Mollier chart. The temperature is approximately 40° C. This refrigerant liquid passes through the throttle 240A and reaches the point j. The pressure at point j is the first evaporating pressure of this invention and is a saturation pressure of 6.4 kg/cm$^2$ at 23° C.

Here, the refrigerant is in the state of a mixture of liquid and gas. The refrigerant deprives process air of its heat in the cooler (refrigerant evaporator) 210A, evaporates to be a saturated gas in the state of the point a on the Mollier chart, and is taken into the compressor 260A again, repeating the foregoing cycle.

Functions of the second heat pump HPB is quite the same, except that the heat pump HPB operates as a whole, generally at lower pressures (lower temperatures) than those of the heat pump HPA. That is, the evaporating pressure as a second evaporating pressure in the second evaporator 210B is 5.0 kg/cm$^2$, the evaporating temperature as a second evaporating temperature is 15° C., the condensing pressure as a second condensing pressure in the second condenser 220B is 14.8 kg/cm$^2$, the condensing temperature as a second condensing temperature is 54° C., and the evaporating or condensing temperature as a second intermediate temperature in the condensing section 251B or the condensing section 252B is 36° 0C.

As described above, since within the heat exchanger 300*e,* refrigerant evaporates in each evaporating section and condenses in each condensing section while heat-exchange is performed by evaporating heat transfer and condensing heat transfer, heat transfer coefficient is very high. Further, process air is cooled in the first compartment 310 from a higher temperature to a lower temperature by temperatures of 40° C. and 36° C. arranged in rows as it flows from the upper side to the lower side in the Figure, so that heat exchange efficiency can be improved compared with cooling at a temperature of, for example, 40° C. The same is true for the condensing section. That is, outside air (regeneration air) is heated in the second compartment 320 from a lower temperature to a higher temperature by temperatures of 36° C. and 40° C. arranged in rows as it flows from the lower side to the upper side in the Figure, so that heat exchange efficiency can be improved, compared with heating at a temperature of, for example, 40° C.

In addition, in the case where the compression heat pump HPA including the compressor 260A, heater (refrigerant condenser) 220A, throttle, and cooler (refrigerant evaporator) 210A, is provided without heat exchangers 300*e,* the enthalpy difference available in the cooler (evaporator) in returning refrigerant in the state of the point d in the heater (condenser) 220A through the throttle, is only 27.59 kcal/kg, while in the case of this embodiment where the heat exchanger 300 is provided, the enthalpy difference is 150.56−113.51=37.05 kcal/kg, therefore gas volume circulated to the compressor for the same cooling load and thus required power (even if the temperature lift is the same) can be decreased by as much as 26%. Oppositely saying, cooling effect achievable for the same power can be enhanced by as much as 34%. That is, even though the compressor 260A is of a single stage type, it is able to act as a device similar to that of a multi-stage type and having an economizer for removing flush gas in the intermediate stage. Indeed, the compressor in this embodiment does not need to remove flush gas in the higher stage, thereby effecting a higher COP than a two-stage type.

The same is true for the second heat pump HPB. As shown in FIG. 32(*b*), gas volume circulated to the compressor for the same cooling load and thus required power (even if the temperature lift is the same), can be decreased by as much as 18%. Oppositely saying, cooling effect achievable for the same power can be enhanced by as much as 21%. Also, temperature lift pumped up in the cooling cycle is 65−23=42° C. for the first heat pump HPA, and 54−15=39° C. for the second heat pump HPB. Temperature lift in case of one heat pump amounts to 65−15=50° C., therefore the temperature lift in this embodiment is much smaller. Thus, the process air cooler 300*e* is capable of improving the COP of the heat pump, in combination with reduced refrigerant flow rate per required cooling load or heating load.

Though in the foregoing description, as a preferable embodiment, the condenser 220A is connected to the evaporating section 251A and the condenser 220B to the evaporating section 251B, the condenser 220A may however, be connected to the evaporating section 251B, and the condenser 220B to the evaporating section 251A.

Figure 33:
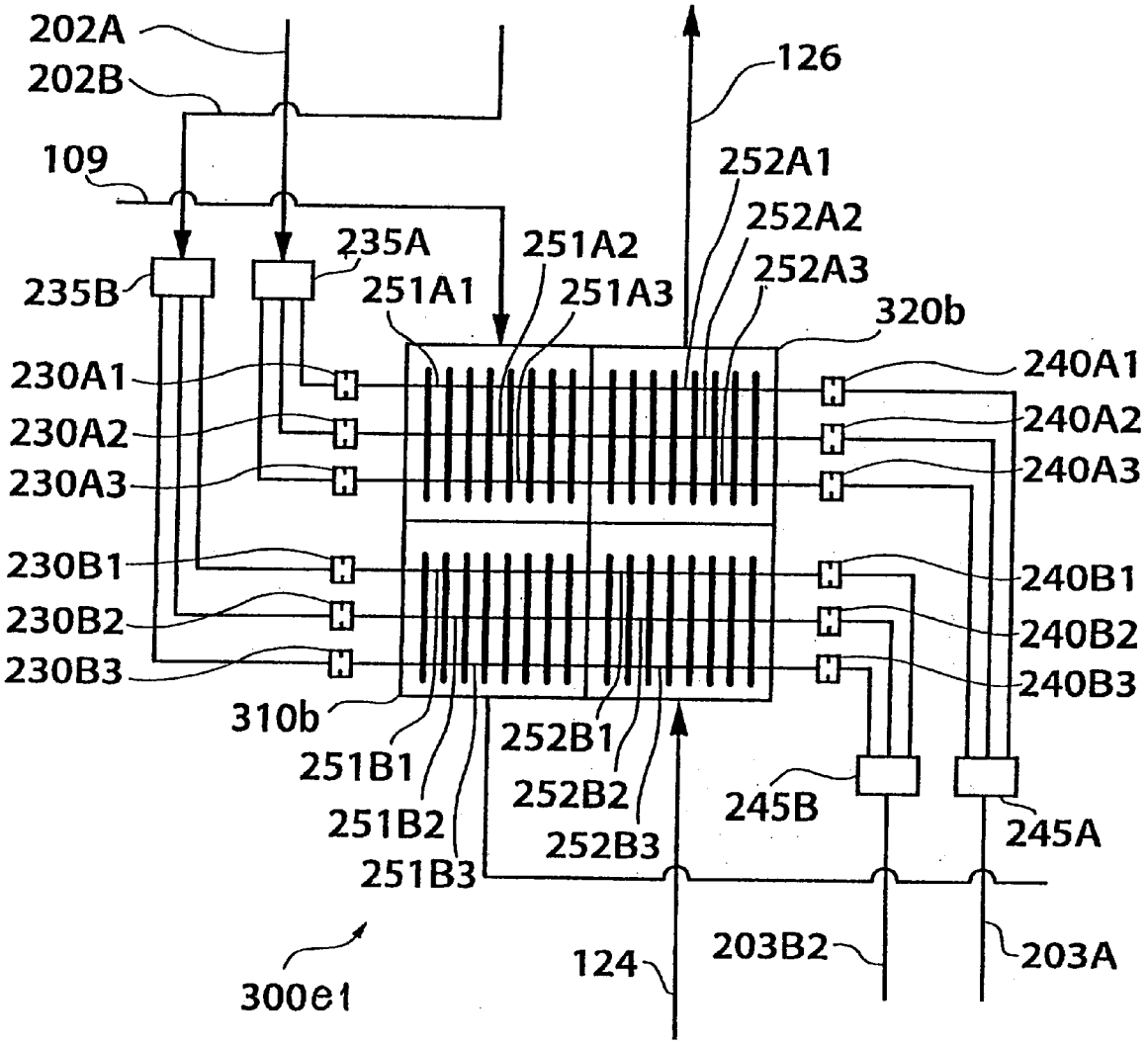
FIG. 33 is an enlarged, schematic view of a process air cooler for use in the dehumidifying air conditioner as an embodiment of the invention.

Next, referring to FIG. 33, the dehumidifying air conditioner of another embodiment of this invention will be described. FIG. 33 is an enlarged flow chart showing only the process air cooler 300*e*1 and its vicinity in the dehumidifying air conditioner, the other structures are the same as in FIG. 29.

This heat exchanger or the process air cooler 300*e*1, like the heat exchanger in FIG. 29, is provided with a plurality of heat-exchanging tubes approximately horizontally which go through the first and second compartments 310*b,* 320*b* and the partition wall 301 and through which refrigerant 250 flows, except that in the first heat pump HPA system, the number of evaporating sections 251A passing through the first compartment is not one, but they are plurality, arranged in the direction of the process air flow (three sections of 251A1, 251A2, 251A3 shown in FIG. 33), and the section passing through the second compartment is composed of a plurality of condensing sections 252A1, 252A2 and 252A3 arranged in the direction of the regeneration air flow, corresponding to the evaporating sections. The evaporating sections 251A1, 251A2 and 251A3 are provided with the respective throttles 230A1, 230A2 and 230A3 in the paths branched off from the one header 235A provided in the refrigerant path 202A. The condensing sections 252A1, 252A2 and 252A3 are provided with the respective throttles 240A1, 240A2 and 240A3, and they are joined to one header 245A, which is connected to the refrigerant path 203A. These evaporating sections 251A1, 251A2, 251A3 are arranged in rows in this order along the process air flow, and the condensing sections 252A3, 252A2 and 252A1 in rows in this order along the regeneration air flow. They may be arranged such that a plurality of evaporating sections 240A11, 240A12, 240A13 . . . , are disposed in the direction perpendicular to the process air flow for one throttle, for example, 240A1, depending on the length of the section, cross sectional compartment of the passage, and refrigerant flow rate as appropriate.

The same is true for the second heat pump HPB. The evaporating sections 251B1, 251B2 and 251B3 are arranged in rows in this order along the process air flow, downstream of the evaporating section 251A3, and the condensing sections 252B3, 252B2 and 252B1 in rows in this order along the regeneration air flow, at the upstream side from the condensing section 252A3.

In the structure described above, process air A flows, in the first compartment, in the direction perpendicular to the heat-exchanging tubes, in contact with the evaporating sections 251A1, 251A2, 251A3, 251B1, 251B2 and 251B3 in this order, to exchange heat with refrigerant, and outside air B having the inlet temperature lower than that of process air, flows, in the second compartment, in the direction perpendicular to the heat-exchanging tubes, in contact with the condensing sections 252B3, 252132, 252B1, 252A3, 252A2 and 252A1 in this order. In this case, the evaporating pressure (temperature) or the condensing pressure (temperature) of refrigerant, which is determined for each section grouped by a throttle, is lowered from high to low in the evaporating sections of 251A1, 251A2, 251A3, 251B1, 251B2 and 251B3 in this order, and raised from low to high in the condensing sections of 252B3, 252B2, 252B1, 252A3, 252A2 and 252A1 in this order. That is, the process air cooler 300*e*1 has a plurality of evaporating pressures of refrigerant used for cooling process air A, for each of the first and second heat pumps, and has a plurality of condensing pressures of refrigerant cooled and then condensed by outside air B as a cooling fluid, corresponding to the foregoing evaporating pressures. Accordingly, this plurality of the evaporating pressures or the condensing pressures is arranged in order of intensity.

Thus, noting the flow of process air A and outside air B, because of the temperature difference in the heat pumps and temperature gradient between the plurality of the evaporating sections or the condensing sections within each heat pump, they exchange their heat, so to speak, in counterflow manner, thereby effecting remarkably high heat exchange efficiency of, for example, 80% or more.

Now, further detailed description will be made on the plurality of evaporating pressures arranged in order of intensity. The evaporating pressures in the plurality of evaporating sections 251A1, 251A2 and 251A3 are able to take different values, respectively, as a result of separate throttles 230A1, 230A2 and 230A3 at the inlets of the evaporating sections, and process air, which flows in the first compartment 310 in contact with the evaporating sections 251A1, 251A2 and 251A3 in this order, is deprived of its sensible heat, so that temperature from the inlet toward the outlet is lowered. As a result, the evaporating pressures within the evaporating sections 251A1, 251A2 and 251A3 are reduced in this order, therefore the evaporating temperatures will be arranged in order.

Quite similarly, the condensing temperatures are arranged from a lower temperature to a higher temperature in order of the sections 252A3, 252A2 and 252A1, and like the evaporating sections, the condensing sections, each of which are provided with separate throttles 240A3, 240A2, 240A1, respectively, are able to have separate condensing pressures or condensing temperatures, therefore as a result of outside air flowing from inlet of the second compartment toward the outlet in contact with the condensing sections 252A3, 252A2 and 252A1 in this order, the condensing pressures will be arranged in order. The same is true for the second heat pump HPB system. Therefore, noting the process air A and outside air B, the so-called counterflow type heat exchanger can be formed as described above, thereby achieving high heat exchange efficiency.

Figure 34:
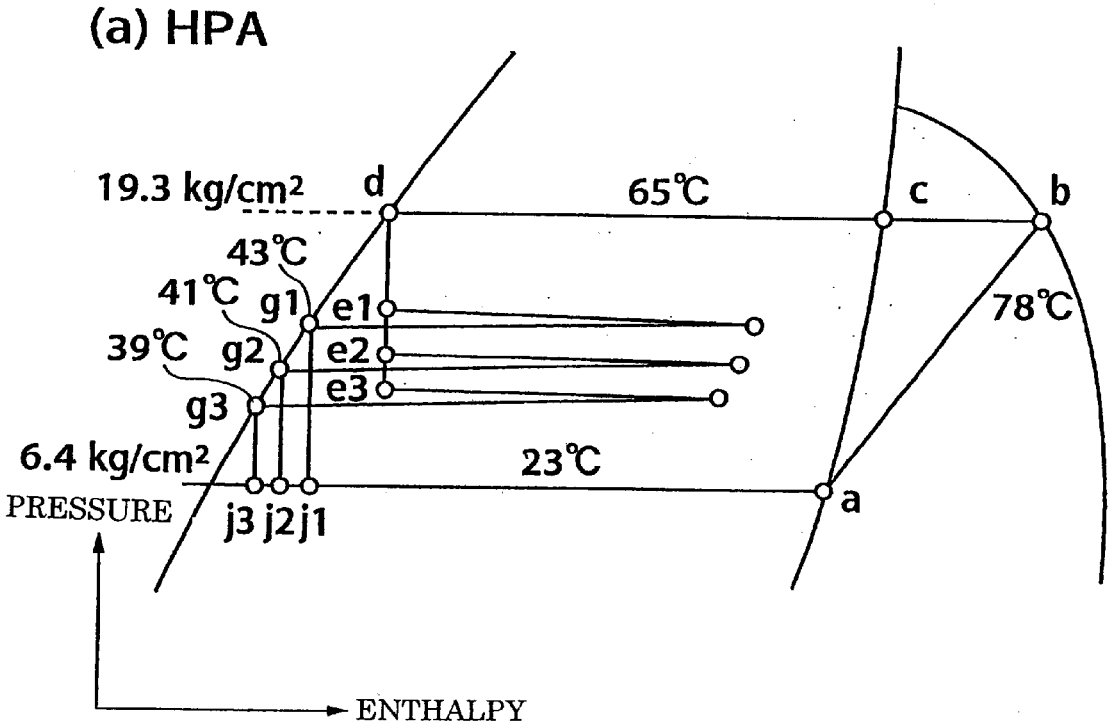
FIG. 34 is a Mollier chart when the process air cooler of FIG. 33 is used for the heat pump used in the dehumidifying air conditioner shown in FIG. 29.
Figure 34:
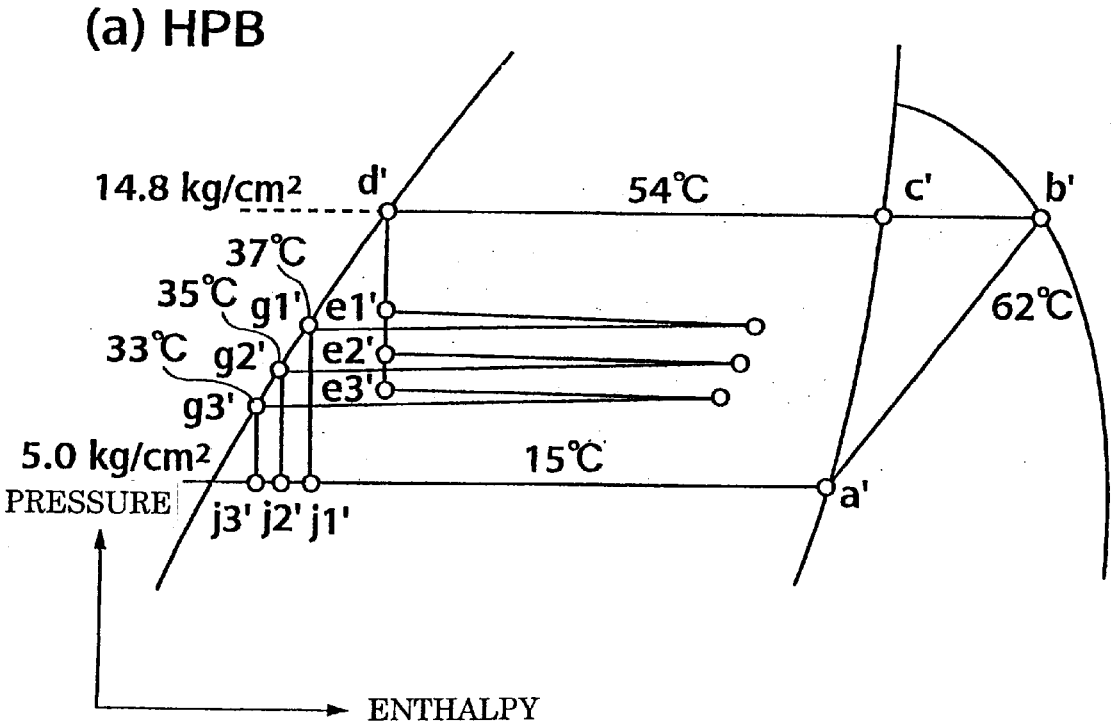

Next, referring to FIG. 34, functions of the heat pumps HPA, HPB will be described. FIG. 34 shows Mollier charts of the systems using HFC 134*a* as refrigerant. In these charts, the horizontal axis represents the enthalpy and the vertical axis the pressure. FIG. 34(*a*) is a Mollier chart for the heat pump HPA, and FIG. 34(*b*) a Mollier chart for the heat pump HPB.

Referring to FIG. 34(*a*), the point a represents the state at refrigerant outlet of the cooler 210A shown in FIG. 29, that is, in the state of saturated gas. The pressure is 6.4 kg/cm$^2$ and the temperature is 23° C. A state in which this gas is compressed by the compressor 260A, that is, the state of the discharge port of the compressor 260A, is shown by point b. In this state, the pressure is 19.3 kg/cm$^2$ and the temperature is 78° C.

This refrigerant gas is cooled in the heater (refrigerant condenser) 220A and reaches the point c on the Mollier chart. The pressure of this point is 19.3 kg/cm$^2$ and the temperature is 65° C. The refrigerant is further cooled and then condensed, and reaches the point d. This point represents the state of saturated liquid; the pressure and the temperature are the same as those of the point c, and the pressure is 19.3 kg/cm$^2$, the temperature 65° C.

The state of one refrigerant, part of refrigerant liquid, which is reduced in pressure at the throttle 230A1 and flows in the evaporating section 251A1, is represented at the point e1 on the Mollier chart. The temperature is approximately 43° C. The pressure is one of the plurality of different pressures of this invention, a saturation pressure corresponding to the temperature of 43° C. Likewise, the state of another refrigerant which is reduced in pressure at the throttle 230A2 and flows in the evaporating section 251A2, is represented at the point e2 on the Mollier chart; the temperature is 41° C. and the pressure is one of the plurality of different pressures of this invention, a saturation pressure corresponding to the temperature of 41° C. Likewise, the state of another refrigerant which is reduced in pressure at the throttle 230A3 and flows in the evaporating section 251A3, is represented at the point e3 on the Mollier chart; the temperature is 39° C. and the pressure is one of the plurality of different pressures of this invention, a saturation pressure corresponding to the temperature of 39° C.

At any one of points e1, e2 or e3, the refrigerant is in the state of a mixture of liquid and gas in which part of the liquid is evaporated (flushed). The refrigerant liquids each evaporate within the respective evaporating section at one of the foregoing respective plurality of different pressures, and reach the points f1, f2 and f3 intermediate between the saturated liquid lines and saturated gas lines for the respective pressures, respectively.

The refrigerants in these states flow in the condensing sections 252A1, 252A2 and 252A3. In the condensing sections, the refrigerants are deprived of heat by outside air flowing in the second compartment, and reach the points g1, g2 and g3, respectively. These points are on the saturated liquid lines in the Mollier chart. The temperatures are 43° C., 41° C. and 39° C., respectively. These refrigerant liquids pass through the throttles and reach the points j1, j2 and j3, respectively. The pressures at these points are a saturation pressure of 6.4 kg/cm$^2$ at 23° C.

Here, the refrigerants are in the state of mixtures of liquid and gas. These refrigerants are joined to one header 245A, and the enthalpy there is an average of enthalpies of points j1, j2 and j3 which are weighted by the corresponding refrigerant flow rates, respectively.

This refrigerant deprives process air of its heat in the cooler (refrigerant condenser) 210A, evaporates to be turned into saturated gas in the state of the point a on the Mollier chart, and is taken into the compressor 260A again, resulting in a repetition of the foregoing cycle.

For the heat pump HPB, like the heat pump HPA, the condensing temperature is 54° C. in the condenser 220B, and the temperatures of the points g1', g2' and g3' corresponding to the points g1, g2 and g3 of the heat pump HPA are, for example, 37° C., 35° C. and 33° C., respectively, as shown in FIG. 34(*b*). The evaporating temperature of the evaporator 210B is 15° C.

As described above, since within the heat exchanger 300*e*1, refrigerant evaporates in each evaporating section and condenses in each condensing section while heat-exchange is performed by evaporating heat transfer and condensing heat transfer, heat transfer coefficient is very high. Further, process air is cooled in the first compartment 310 from a higher temperature to a lower temperature by temperatures of 43° C., 41° C., 39° C., 37° C., 35° C. and 33° C. arranged in rows as it flows from the upper side to the lower side in the figure, so that heat exchange efficiency can be improved in comparison with cooling by one temperature for each heat pump of, for example, 40° C. and 36° C. The same is true for the condensing section. That is, outside air (regeneration air) is heated in the second compartment 320 from a lower temperature to a higher temperature by temperatures of 33° C., 35° C., 37° C., 39° C., 41° C. and 43° C. arranged in rows as it flows from the lower side to the upper side in the Figure, so that heat exchange efficiency can be improved, in comparison with heating by one temperature for each heat pump of, for example, 36° C. and 40° C.

As described above, the dehumidifying air conditioner of this embodiment is characterized in that it is provided with a process air cooler, process air is cooled by evaporation of refrigerant in the process air cooler, and the evaporated refrigerant is cooled by cooling fluid, to condense.

Therefore, evaporating heat transfer and condensing heat transfer of a high heat transfer coefficient can be utilized, thus achieving heat transfer between process air and cooling fluid, with a high heat transfer coefficient. Further, heat transfer between process air and cooling fluid is performed through refrigerant, thereby providing a simple arrangement of components of the dehumidifying air conditioner. Furthermore, heat-exchange between process air and cooling fluid is formed into the so-called counterflow and a first and second heat pumps are provided, so that it is possible to provide a dehumidifying air conditioner having reduced temperature (thermal) lifts and a high COP as well as compact size.

Figure 35:
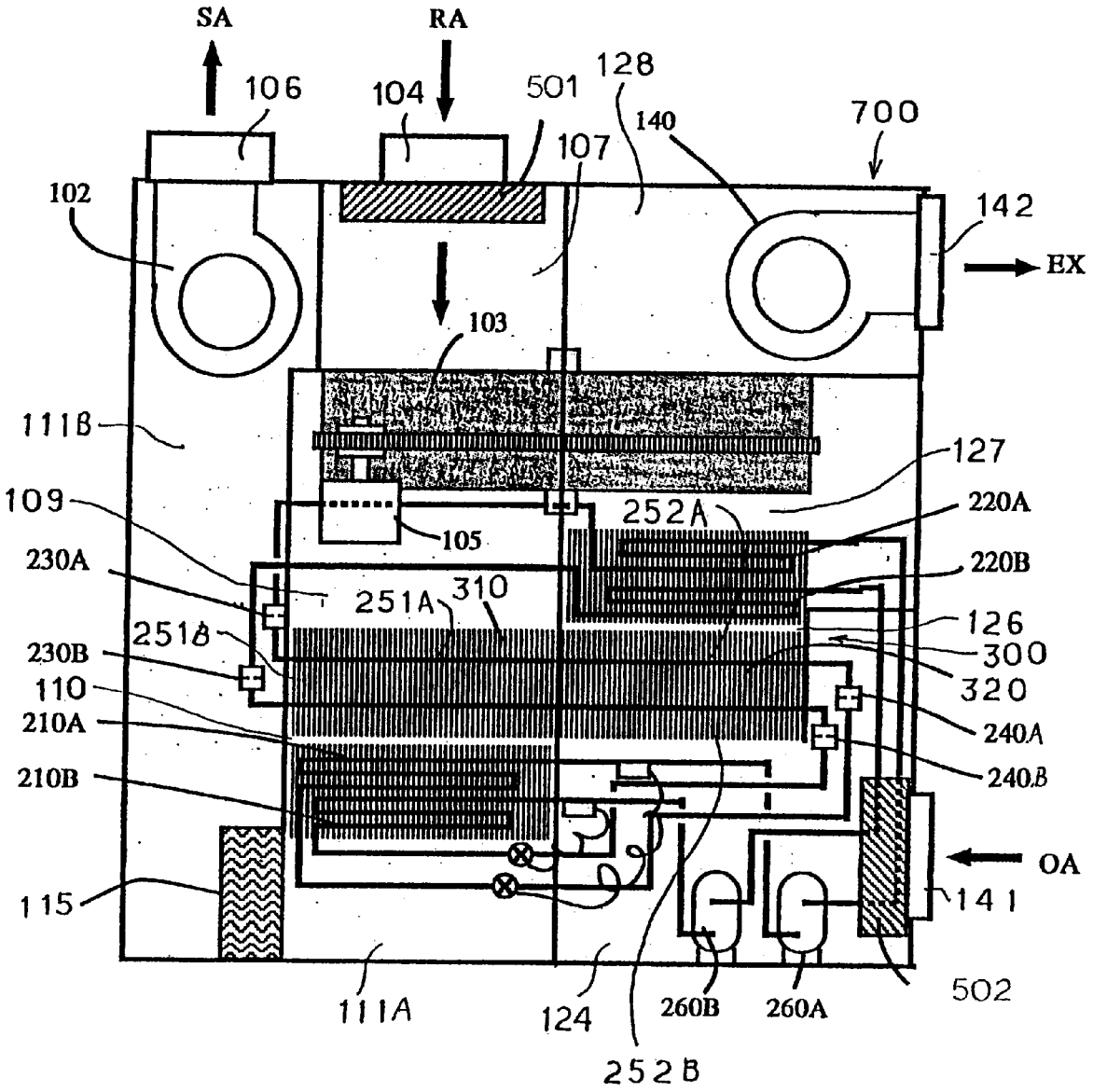
FIG. 35 is a schematic front cross sectional view, showing the configuration of a dehumidifying air conditioner as an embodiment of the invention.
Figure 36:
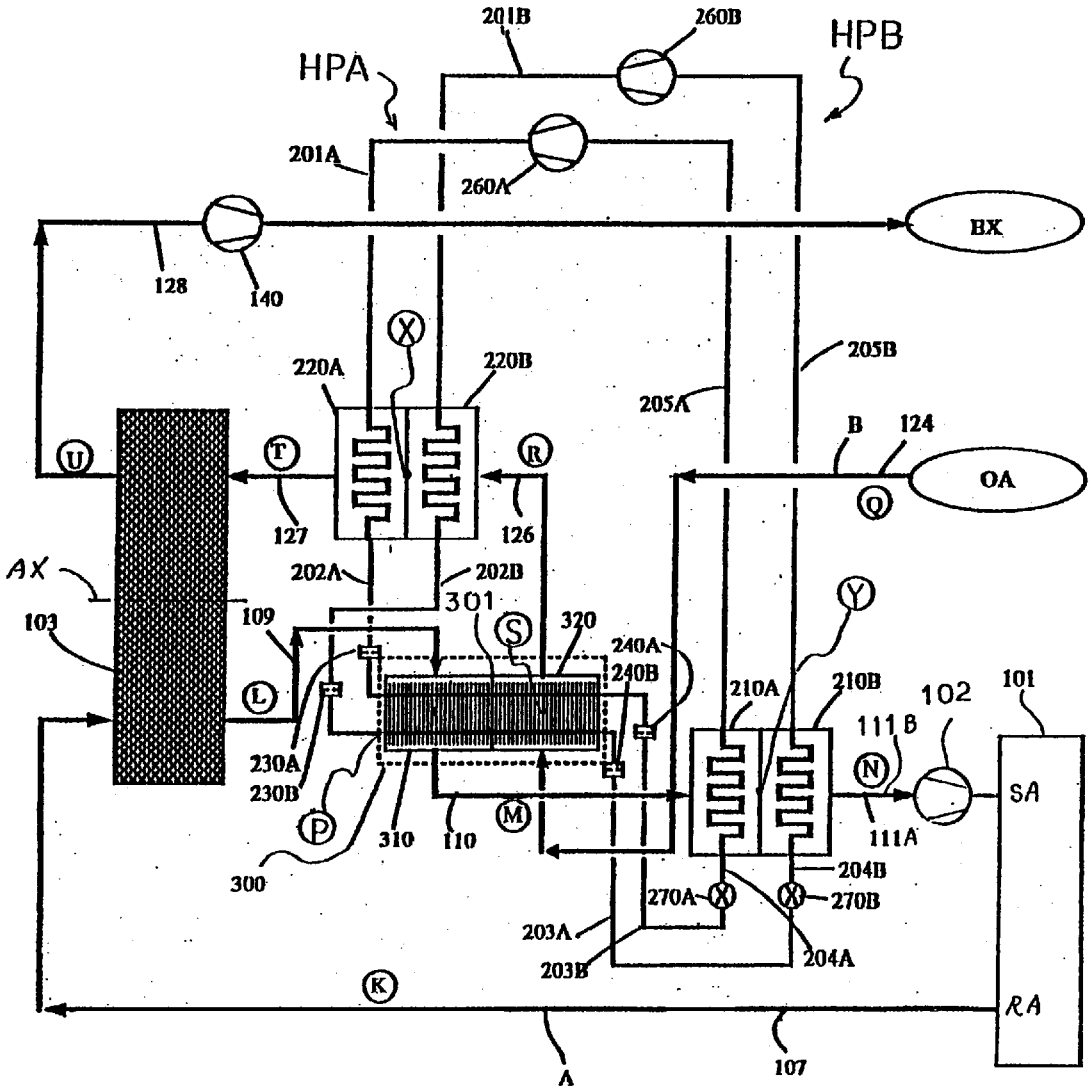
FIG. 36 is a flow chart of a dehumidifying air conditioner as another embodiment shown in FIG. 35.

Referring to FIGS. 35 and 36, the structure and arrangement will be described of a dehumidifying air conditioner as a dehumidifier of an embodiment of this invention. FIG. 35 is a schematic front sectional view of the dehumidifying air conditioner, and FIG. 36 is a flow chart of the dehumidifying air conditioner. The flow chart of FIG. 36 is different from that of FIG. 29 in that the blower 102 is disposed, in FIG. 36, in the vicinity of the discharge port rather than the vicinity of the intake port, but otherwise is approximately the same. That is, the blower 102 among the devices constituting the dehumidifying air conditioner, is enclosed in the vicinity of the discharge port 106 in the cabinet 700. The cabinet 700 is formed in the shape of a rectangular housing made of, for example, sheet steel, and on one side of the cabinet at the lower portion is opened an intake port 104 for drawing (RA) process air a from the air conditioning space 101. In the opening of the intake port 104 is provided a filter 501 for preventing ingress of dust from the air conditioning space into the apparatus.

Vertically downwardly of the filter 501 is disposed, through a downwardly vertically running passage 107, a desiccant wheel 103 as the moisture adsorption device filled with desiccant (drying agent) as shown in FIG. 16. The desiccant wheel 103 is connected, through a belt or chain, etc, to an electric motor 105 as a driver disposed in the vicinity thereof with rotational shaft AX in the vertical direction for rotation at a speed as low as approximately one revolution per several minutes.

When the desiccant wheel 103 is disposed for rotation about the vertical rotational shaft approximately in a horizontal plane, process air A flowing along the downwardly running passage 107 is able to pass through the semi-circular region of the circular desiccant wheel 103, or a process air zone, without changing the direction, simplifying the process air passage and thus providing compact size. Further, filling of desiccant into the desiccant wheel 103 is easier and a more uniform distribution of desiccant is achieved in the desiccant wheel 103.

Downwardly of the desiccant wheel 103 and vertically downwardly of the process air zone into which process air flows, is disposed a first compartment 310 of the process air cooler 300, which compartment 310 comprises an evaporating section 251A on the vertical upper side and an evaporating section 251B on the vertical lower side. Process air passes through the evaporating section 251A and evaporating section 251B in this order. A passage 109 connecting the desiccant wheel 103 and the first compartment 310 is formed as a passage running vertically downwardly and connecting the desiccant wheel 103 disposed horizontally in this embodiment and tubes (and fins attached to these tubes) of the condensing section 251A also disposed horizontally.

Vertically downwardly of the first compartment 310 are disposed a refrigerant evaporator 210A as the first heat exchanger on the upper side and a refrigerant evaporator 210B as the second heat exchanger on the lower side, with cooling pipes for refrigerant in the horizontal direction. Process air A passes through the refrigerant evaporator 210A and refrigerant evaporator 210B in this order. In this embodiment, the passage 110 is a space between the first compartment 310 and the refrigerant evaporator 210A, but the two components are disposed closely, so that there exists little space between them. Vertically downwardly of the refrigerant evaporator 210 runs a passage 111A, which introduces process air A laterally horizontally and is connected, through a humidifier 115 at the bottom of the passage 111A, to the passage 111B disposed just adjacent to the passage 107, passage 109, and passage 110. The passage 111B is running vertically upwardly.

At the top of the passage 111B is attached a blower 102 as the first blower, which draws process air A introduced to the passage 111B and supplies it (SA) to the air conditioning space 101 from the opening in the top surface of the cabinet 700, or the discharge port 106. The discharge port 106 is formed on the top surface of the cabinet 700 on the vertical extended line of the passage 111B.

On the other hand, at the lower one side of the cabinet 700 is opened an intake port 141 for drawing OA outside air, or regeneration air B, in which is provided a filter 502 for preventing ingress of dust from in the outside air, or regeneration air B.

Regeneration air B, after passing through the filer 502, enters the passage 124, and is fed laterally horizontally along the passage 124 and then vertically upwardly. Above the passage 124 is disposed a process air cooler 300 as the third heat exchanger, and regeneration air passes through the condensing section 252A and condensing section 252B in this order vertically upwardly. Vertically above the process air cooler 300 are disposed a refrigerant condenser 220B as the second heat exchanger and refrigerant condenser 220A as the second heat exchanger. In the refrigerant condenser 220A and the refrigerant condenser 220B are respectively disposed heat exchanger tubes approximately horizontally.

A space vertically below the refrigerant condenser 220 and between the refrigerant condenser 220 and the desiccant wheel 103, constitutes a passage 127, via which regeneration air B is introduced to the other half region of the desiccant wheel 103 as a regeneration air zone with respect to the foregoing half region on the process air A side. The space vertically above the half region of the desiccant wheel 103 for the regeneration air B to pass through, constitutes a passage 128, in which a blower 140 as the second blower is disposed with the intake port facing this space.

The discharge port of the blower 140, facing sideward, is connected to another discharge port 142 opened on one side of the cabinet 700 at the upper portion, and regeneration air B is discharged EX from the discharge port 142.

On the other hand, the refrigerant gas pipe 201A for feeding refrigerant gas delivered from the compressor 260A to the condenser 220A, runs laterally to approach the side of the cabinet, then upwardly, and laterally again in the direction away from the side of the cabinet, to be connected to the refrigerant condenser 220A. The refrigerant pipe 202A exiting the outlet of the refrigerant condenser 220A runs laterally through the path 109, and downwardly at the path 119. In the middle of this downwardly running pipe is provided a header incorporating a throttle 230A, which decreased the pressure of refrigerant and is connected to the evaporating section 251A. Refrigerant decreased in pressure through the throttle 240A in the header, is fed to the evaporating section 251A composed of a plurality of tubes, and evaporates. Then, another header for inducting refrigerant condensed in the condensing section 252A and having a throttle 240A therein, is provided in the middle of a refrigerant pipe 203A running downwardly from the outlet of the condensing section 252A.

The refrigerant liquid pipe 203A runs further laterally, then vertically downwardly again, and laterally through the passage 111A, below the refrigerant evaporator 210B, and lastly rises to be connected to the refrigerant evaporator 210A. Refrigerant is decreased in pressure at an expansion valve 270A in the refrigerant pipe running laterally below the refrigerant evaporator 210B, and proceeds to the refrigerant evaporator 210A through the refrigerant liquid pipe 204A downstream from the expansion valve 270A. Further, the refrigerant pipe 205A connecting the refrigerant evaporator 210A and the compressor 260, runs laterally from the refrigerant evaporator 210A, and then downwardly.

As described above, the passages 107, 109, 110 of process air A run vertically downwardly and the passage 111B vertically upwardly; the passages 124, 126, 127 of regeneration air run vertically upwardly; the intake port 104 and discharge port 106 of process air are disposed on the top surface of the apparatus; and the intake port 141 of regeneration air is disposed in the vicinity of the bottom of the apparatus, and the discharge port 142 in the vicinity of the top surface of the apparatus, so that the process air passage is in the shape of a letter U and the regeneration air passage is formed straight, both of which are of simplified shape.

Further, the blower 102, blower 140, desiccant wheel 103, refrigerant condenser 220A/220B, process air cooler 300, refrigerant evaporator 210A/210B are arranged vertically in the upper and lower positions in a orderly manner, providing compact size and a smaller installation area. Further, process air A and regeneration air B passing through the desiccant wheel 103, need not change their direction immediately before and after the desiccant wheel 103, proving a smooth flow.

Functions of the dehumidifying air conditioner of an embodiment of this invention as shown in FIG. 35 are substantially the same as those described on the humid air diagram in FIG. 31. Also, the refrigerant flow between devices and functions of the heat pumps HPA, HPB are substantially the same as those described in FIG. 29.

Figure 37:
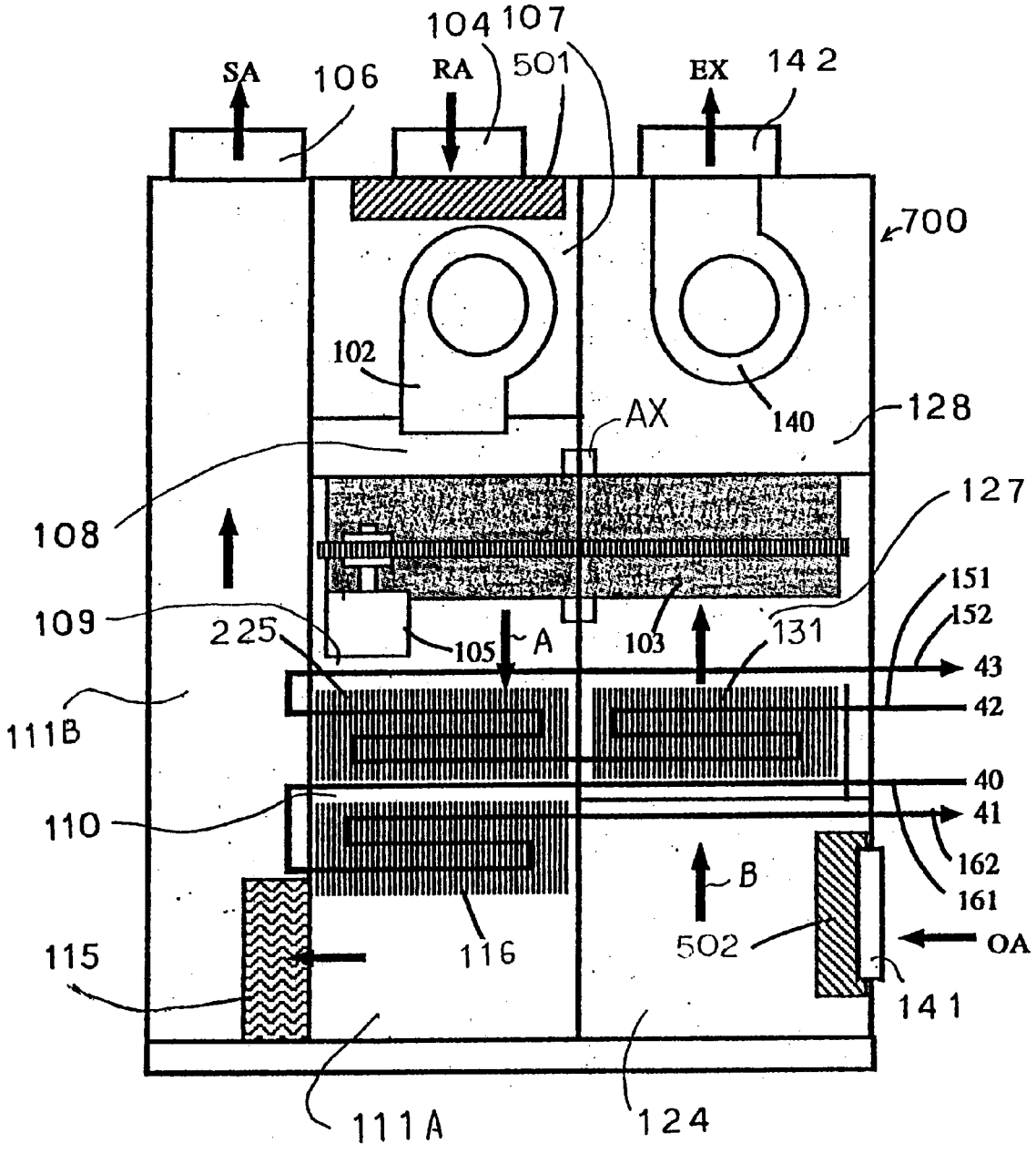
FIG. 37 is a schematic, front cross sectional view showing the configuration of a dehumidifying air conditioner as another embodiment of the invention.

Referring to FIG. 37, the structure of the dehumidifying air conditioner of another embodiment of this invention will be described. In the Figure, process air drawn from the air conditioning space through the intake port 104 at the top of the cabinet 700 and through the filter 501 into the cabinet, passes through the downwardly running passage 107 along the process air A path, to be drawn into the blower 102 for providing process air A circulation and discharged from the discharge port of the blower 102; then passes through the downwardly running passage 108, downwardly through the process air zone of the desiccant wheel 103 filled with desiccant, then passes through the downwardly running passage 109, and continuos downwardly through the heat exchanger 225 for collecting heat from process air A; then passes through the downwardly running passage 110, and downwardly through the heat exchanger 116 for cooling process air; flows horizontally along the passage 111A through the humidifier 115; and then passes through the upwardly running passage, and through the discharge port 106 at the top of the cabinet 700 to be returned to the air conditioning space.

Also, regeneration air B drawn through the intake port 141 on one side of the lower portion of the cabinet 700, via the filter 502, into the cabinet 700, flows along the regeneration air B path and along the passage 124 to be inducted upwardly; then passes through the heat exchanger 131 for heating regeneration air B before ingress of the desiccant wheel 103, upwardly; then passes through the upwardly running passage 127, and through the regeneration air zone of the desiccant wheel 103, upwardly; then passes through the upwardly running passage 128 to be drawn into the blower 140 for providing the regeneration air B circulation and discharged from the discharge port of the flower 140; and then is discharged to the outside from the discharge port 142 at the top of the cabinet 700.

Regarding arrangement inside the actual dehumidifying air conditioner, the blowers 102, 140 are disposed at the very top of the apparatus. The blower 140 is mounted on the underside (on the inside of the apparatus) of the upper wall of the apparatus, while the blower 102 is mounted to the mounting plate provided in the process air passage horizontally and having an opening of the same size as the discharge port of the blower 102. The rotational axes of the blowers 102, 140 are disposed at approximately the same height. Vertically downwardly of the blowers 102, 140 is disposed the desiccant wheel 103 with the rotational shaft in the vertical direction. Also, downwardly of the desiccant wheel 103 are disposed the heat exchanger 225 and the heat exchanger 131 horizontally at the same height in a row. Further, downwardly of the heat exchanger 225 is disposed the heat exchanger 116 horizontally.

A hot water medium pipe 151 for inducting the hot medium, or hot water, is connected to the hot medium supply port 42 of the refrigerant condenser (not shown in FIG. 37) of the outside heat pump (not shown in FIG. 37), and the hot water inlet of the heat exchanger 131. The heat exchanger 131 is counterflow type heat exchanger configured such that hot water and regeneration air B are adapted to exchange heat in counterflow relation. The hot water outlet of the heat exchanger 131 is connected, by a hot water pipe, to the hot water inlet of the heat exchanger 225. The heat exchanger 225 is also configured such that hot water and process air A are adapted to exchange heat in counterflow relation. The hot water outlet of the heat exchanger 225 is connected, by a hot water pipe 152, to a hot medium return port 43 of the refrigerant condenser of the outside heat pump. Hot water is returned to the refrigerant condenser, to be heated by condensation of refrigerant in the refrigerant condenser, and then inducted to the heat exchangers 131 and 225, to be circulated.

A cold water pipe 161 for inducting the cold medium, or cold water, is connected to the cold medium supply port 40 of the refrigerant condenser (not shown in FIG. 37) of the outside heat pump, and the cold water inlet of the heat exchanger 116. The heat exchanger 116 is configured such that cold water and process air A as a heat-exchanging object are adapted to exchange heat in counterflow relation. The cold water outlet of the heat exchanger 116 is connected, by a cold water pipe 162, to a cold medium return port 41 of the cold evaporator of the outside heat pump. Cold water is returned to the refrigerant evaporator, to be cooled by evaporating the refrigerant in the evaporator, and then inducted to the heat exchanger 116, to be circulated.

Next, referring to FIG. 37 again, functions of this embodiment will be described. In the following description, temperature conditions are shown as an example.

First, regarding the process air A flow, process air of approximately 27° C. is drawn from the air conditioning space, then adsorped of its moisture by desiccant in the desiccant wheel 103 which decreases its absolute humidity, and the heat of adsorption of the desiccant raises the dry bulb temperature, to approximately 50° C. This air is cooled by the hot medium (decreased in temperature in the heat exchanger 130 as described later) in the heat exchanger 225, with the absolute humidity kept constant, turned into air at approximately 38° C., and enters the heat exchanger 116.

There, it is cooled further by the cold medium and turned into air at 15° C. This air makes an isoenthalpic change in the humidifier 115, absolute humidity is raised and the dry-bulb temperature is decreased and is returned to the air conditioning space as a process air A of appropriate humidity and appropriate temperature.

Next, regarding the regeneration air B flow, regeneration air B of approximately 32° C. drawn from the outside (outdoor) OA, exchanges heat in the heat exchanger 131 with the hot medium of a raised temperature from the heat pump HP, and increases dry-bulb temperature, to be turned into air at approximately 70° C.

The hot medium decreased in temperature in the heat exchanger 131, raises its own temperature while cooling process air A, as described above. This effects heat collection for the hot medium. The hot medium is returned with collected heat to the heat pump HP, to be heated there, and supplied to the heat exchanger 131 to heat regeneration air B. As described above, regeneration air B is heated from about 32° C. to about 70° C., and of this temperature rise, the portion collected by the heat exchanger 225 from process air A amounts to the temperature rise from about 32° C. to about 46° C.

Regeneration air B heated up to 70° C. in the heat exchanger 131 as described, passes through the passage 126 to the desiccant wheel 103, where it deprives the desiccant of moisture to regenerate it, raises its own absolute humidity, and is decreased in dry-bulb temperature by moisture removal heat of the desiccant. This air is drawn into the blower 140 for providing regeneration air B circulation, and then discharged EX.

Now, with respect to the embodiment shown in FIG. 37, functions of the heat exchanger 131 and heat exchanger 225 will be described. First, in the heat exchanger 131, the hot water medium heated up to about 75° C. by the heat pump, exchanges heat with outside air of about 32° C. used for regeneration air B in counterflow relation. The hot medium decreases in temperature from about 75° C. to about 36° C. Meanwhile, the regeneration air B exchanging heat with the hot medium, raises temperature from about 32° C. to about 70° C.

As described above, the hot medium cooled to about 36° C. exchanges heat in counterflow low relation with process air A. The hot medium is heated from about 36° C. to about 47° C. Meanwhile, the process air A exchanging heat with the hot medium, decreases in temperature from about 50° C. to about 38° C.

In the embodiment shown in FIG. 37, the heat equivalent to the portion of total heat utilized in heating regeneration air B in the heat exchanger 131, can be collected from process air A in the heat exchanger 225, thereby effecting increased heating capacity, improved efficiency, smaller-size of the apparatus, and thus cost reduction.

Further, as described above, the passages 107, 108, 109, and 110 of process air A run vertically downwardly, the passage 111B vertically upwardly, and the passages 124, 127, and 128 of regeneration air run vertically upwardly; the intake port 104, and discharge port 106 of process air are disposed at the top of the apparatus, the intake port 141 of regeneration air in the vicinity of the bottom of the apparatus, and the discharge port 142 at the top of the apparatus, so that the passage of process air is in the shape of a letter U, and the passage of regeneration air is straight, both of which are of simplified shape.

Furthermore, the blowers 102, 104, desiccant wheel 103, heat exchanger 225, process air cooler 300, and heat exchanger 116 are arranged in orderly manner vertically in the upper and lower positions, thereby providing a compact apparatus as well as smaller installation area. Moreover, process air A and regeneration air B passing through the desiccant wheel 103, need not change their flow directions immediately before and after the desiccant wheel 103, effecting a smooth flow.

Next, referring to FIG. 38, the structure of the dehumidifying air conditioner of another embodiment of this invention will be described. The same features as the embodiment shown in FIG. 37 are not repeated and only the differences will be referred to.

Figure 38:
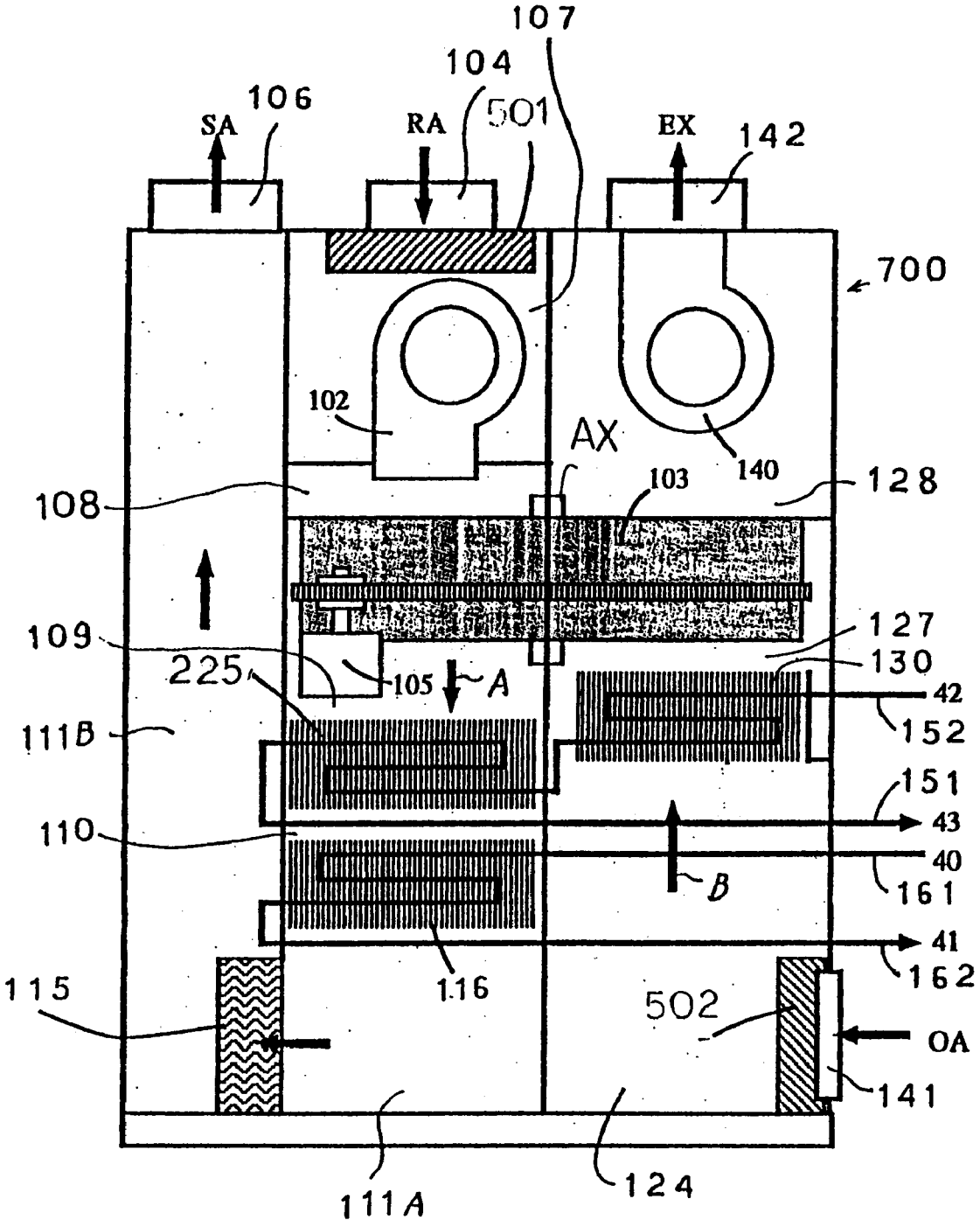
FIG. 38 is a schematic front cross sectional view showing the configuration of a dehumidifying air conditioner as another embodiment of the invention.

In the embodiment shown in FIG. 38, the cold medium, in the state of liquid, supplied from the cold medium supply port 40 of the heat pump (not shown), changes its phase within the heat exchanger 116, that is, evaporates to be gasified, cools process air, and the cold medium returns to the port 41 of the heat pump. On the other hand, the hot medium, in the state of gas, supplied from the hot medium supply port 42 of the heat pump, changes it phase within the heat exchanger 131, that is, condenses to be liquefied, turns into the state of supercooling (or subcooling/cooling lower than saturation temperature), and sent to the heat exchanger 225, and cools process air A in the heat exchanger 225.

The structure, functions, and effects of the dehumidifying air conditioner of an embodiment shown in FIG. 38, are the same as those of the dehumidifying air conditioner of this embodiment shown in FIG. 37, other than the foregoing description.

As described above, the dehumidifying air conditioner of an embodiment according to this invention is characterized by a dehumidifying air conditioner comprising a desiccant wheel 103 with the rotational axis AX disposed in the vertical direction, wherein the process air passage includes mainly a first passage portion running vertically downwardly and a second passage portion running vertically upwardly, so that the process air flow passing through the apparatus, can be arranged mainly in the vertical direction in orderly manner and main devices can be disposed vertically in the upper and lower positions without need for process air to change its flowing directions before and after the desiccant wheel, thus providing a compact apparatus as well as a smaller installation area, compared with a dehumidifying air conditioner incorporating a desiccant wheel with the rotational axis disposed horizontally. The term, "mainly including", means that the process air passage or regeneration air passage in which main components such as the desiccant wheel, heat exchanger, and condenser are provided, run, for example, vertically downwardly, but they may transitionally run laterally so as to take upward routes.

In the following, another embodiment of this invention will be described with reference to the drawings.

Figure 39:
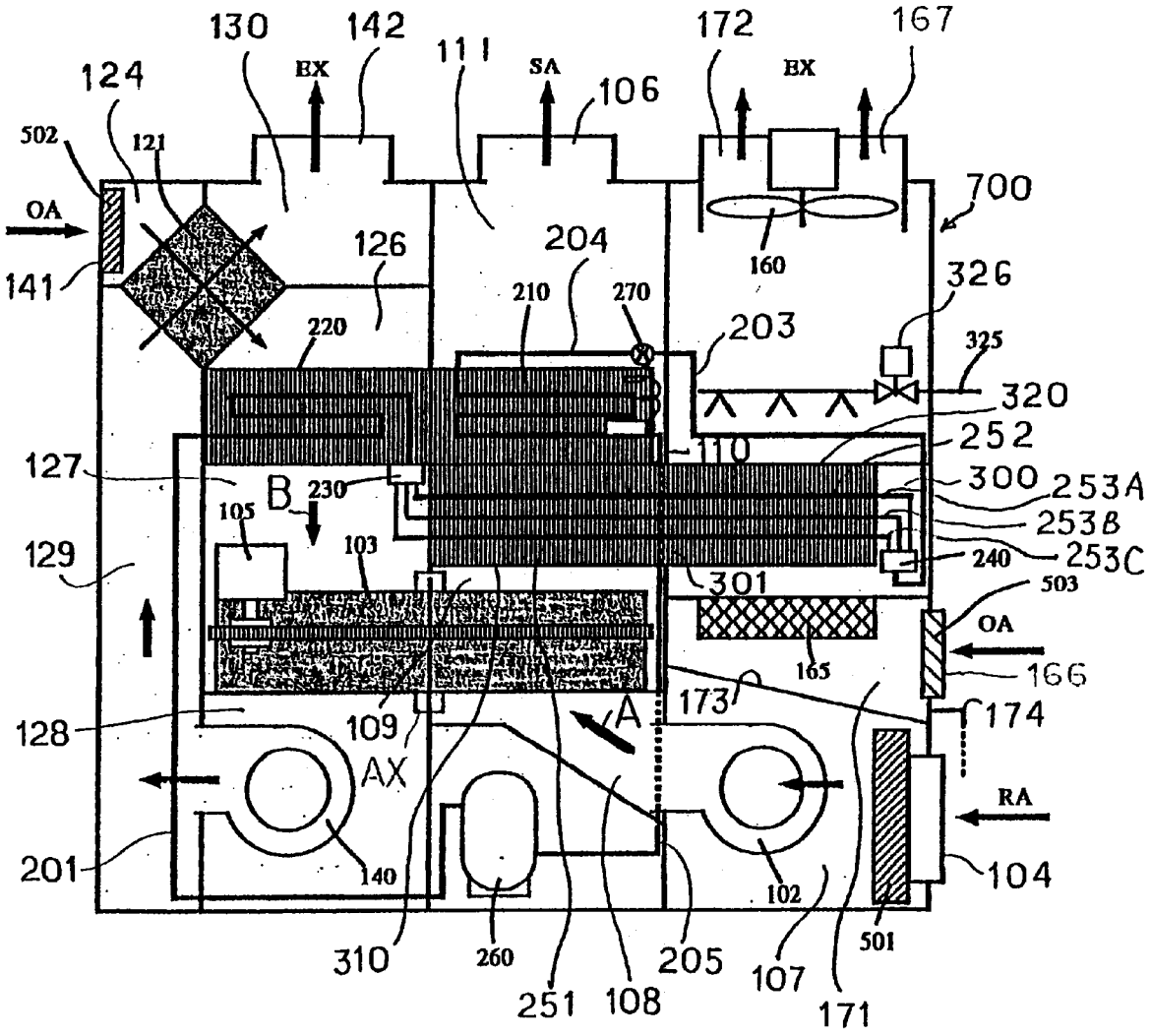
FIG. 39 is a schematic front cross sectional view showing the configuration of a dehumidifying air conditioner as another embodiment of the invention.

Referring to FIG. 39, an example of the mechanical structure and arrangement of the dehumidifying air conditioner will be described. This is appropriate for the structure of the apparatus described with reference to FIG. 5, except that in FIG. 5, a throttle 270 is added at the upstream side of the refrigerant line from the refrigerant evaporator 210. In the Figure, devices constituting the apparatus are enclosed within the cabinet 700. The cabinet 700 is formed in the shape of a rectangular box made of, for example, sheet steel, and on one side of the cabinet at the lower portion is opened an intake port 104 for drawing (RA) process air A from the air conditioning space 101. In the opening of the intake port 104 is provided a filter 501 for preventing ingress of dust from the air conditioning space into the apparatus. Inside the filter 501 in the cabinet 700 is disposed a blower 102 as the second blower, and the intake port of the blower 102 is in communication, through the filter 501, with an intake port 104 for process air A of the cabinet. Passage 107 is formed between intake port 104 and intake port of blower 102.

The compressor 260 and a blower 140 as the first blower are arranged in a space in the lower section of the cabinet 700 in a row in places approximately horizontally sideward of the blower 102. High speed rotary machines are disposed concentrated in one section, providing easy soundproofing. Also, immediately upwardly of the compressor 260 and the blower 140 is disposed the desiccant wheel 103 with the rotational axis in the vertical direction. Weighty compressor 260, blowers 102, 140, driving motor, and desiccant wheel 103 are disposed relatively lower positions, thus lowering the center of gravity of the apparatus. The desiccant wheel 103 is connected, for rotation at a speed as low as one revolution per several minutes by a belt, chain, etc, to the driver disposed in the vicinity thereof with the rotational axis in the vertical direction.

In this way, the desiccant wheel 103 is disposed for rotation about the rotational axis in the vertical direction in an approximately horizontal plane, therefore the total height of the apparatus can be kept low, effecting compact size. Further, filling of desiccant in the desiccant wheel 103 is easier and uniform distribution of desiccant in the desiccant wheel 103 can be achieved. Moreover, almost all the moving elements or the rotary machines, such as the blowers 102, 140, and the desiccant wheel 103, including the weighty compressor 260, are arranged in the lower section of the apparatus or the bottom of the cabinet, that is, near the base, preventing adverse effects of vibration and increasing stability of installation.

The discharge port of the blower 102 is connected to the desiccant wheel 103 by a passage 108. The passage 108, and the above described passage 107 is configured such that they are separated from other portions with partitions made of, for example, sheet steel the same as that of the cabinet 700. It is into the approximately half (semi-circular) region of the circular desiccant wheel 103 as a process air zone that process air A flows.

Vertically upwardly of the desiccant wheel 103, especially, upwardly of the half (semi-circular) region into which process air A flows, is disposed a first compartment 310 of the process air cooler 300, or an evaporating section 251. A passage 109 connecting the desiccant wheel 103 and the first compartment 310 is formed as a narrow space between the desiccant wheel 103 disposed horizontally in FIG. 39 and tubes (and fins on the tubes) of the evaporating section 251 also disposed horizontally. Upwardly of the first compartment 310 is disposed a refrigerant evaporator 210 as the second heat exchanger with cooling pipes for refrigerant in the horizontal direction. In the example shown in FIG. 39, a passage 110 is the space between the first compartment 310 and the refrigerant evaporator 210, but these two elements are disposed close to each other, so that there exists little space. Upwardly of the refrigerant evaporator 210 lies a passage 111, and the opening for supplying SA process air A to the air conditioning space 101, or a discharge port 106, is formed on the top of the cabinet 700.

As described above, it can be seen that the intake port 104 for process air A is disposed in the vicinity of the bottom of the cabinet 700 (actually on one side thereof at the lower portion); the passages 109, 110, 111 of process air passing through the process air side half of the desiccant wheel 103, evaporating section 251 of the process air cooler 300, and the refrigerant evaporator 210, are formed upwardly; and the discharge port 106 of process air A is disposed on the top of the cabinet 700.

On the other hand, on one side of the cabinet 700 at the upper portion is opened an intake port 141 for drawing OA regeneration air B, in which is provided a filter 502 for preventing ingress of dust from the outside air, or regeneration air B. The space inside the filter 502 constitutes a passage 124, and a cross flow heat exchanger 121 is disposed, defining part of the space. At the side of one outlet of the heat exchanger 121 is disposed a refrigerant condenser 220. The refrigerant condenser 220 as a first heat exchanger with heat-exchanging tubes as a fluid passage disposed approximately horizontally, is arranged in a row at the same height as the refrigerant evaporator 210. The outlet of the heat exchanger 121 is connected, by the passage 126, to the refrigerant condenser 220.

The space below the refrigerant condenser 220 and between the refrigerant condenser 220 and the desiccant wheel 103, constitutes a passage 127, through which regeneration air B is inducted to the rest half region as a regeneration air zone of the desiccant wheel 103 with respect to the above described half region on the process air A side. The space below the half region, of the desiccant wheel 103, for the regeneration air B to pass through, constitutes a passage 128, and in this space is disposed a blower 140 with the intake port facing this space.

The discharge port of the blower 140, facing sideward, is connected to the heat exchanger 121 by a passage 129 defined vertically in the cabinet 700. Regeneration air B flowing in the passage 129 upwardly through the heat exchanger 121, passes through a passage 130 crossing the above described passage 124 at the heat exchanger 121 to the space defined by the heat exchanger 121 and the cabinet 700, or a passage (part of the passage 130), and is discharged (EX) through a discharge port 142 opened on the top of the cabinet 700.

As described above, it can be seen that the intake port 141 for regeneration air B is disposed in the vicinity of the top of the cabinet 700 (actually on one side thereof at upper portion); the passages 127, 128 for regeneration air B passing through the refrigerant condenser, and the regeneration air side half of the desiccant wheel 103, are formed downwardly; the passage 129 for regeneration air B exiting the blower 140 is formed mainly upwardly; and the discharge port 142 of regeneration air B is disposed on the top of the cabinet 700.

Further, on one side of the cabinet 700 and approximately directly above the intake port 104 for process air, is opened an intake port 166 for drawing OA outside air C as a cooling fluid. In this opening is provided a filter 503 for preventing ingress of dust in the outside air C into the apparatus. A passage 171 is defined including the space inside the filter 503, and upwardly of the space is disposed a humidifier 165 approximately horizontally. The space above the humidifier 165 constitutes a second compartment 320, in which is disposed heat-exchanging tubes of the condensing section 252 approximately horizontally. The condensing section 252 and the foregoing evaporating section 251 is constituted by integral tubes. In the space above the condensing section 252 is disposed a spray pipe 325, which is adapted to spray water over the tubes (and fins) of the condensing section 252. The spray pipe 325 is provided with a regulating valve 326 so as to regulate the amount of sprayed water properly, for example, to provide proper wetness of the humidifier 165 or to inhibit excessive wetting.

The lower portion of the space defining the passage 171 forms a drain pan 173, to which is attached a discharge pipe 174 for discharging excessive water sprayed by the spray pipe 325 to the outside of the cabinet 700. The space above the second compartment 320 also serves as a passage 172, and upwardly of this space at the top of the cabinet 700, is opened an air discharge port 168. In the air discharge port 168 is provided a blower 160 for discharging EX air.

On the other hand, a refrigerant gas pipe 201 for feeding refrigerant gas delivered from the compressor 260 to the refrigerant condenser 220, is provided, running laterally at the bottom of the cabinet and then rising upwardly. At the outlet of the refrigerant condenser 220 is provided a header 230 incorporating a throttle, through which condensed refrigerant is decreased in pressure, to be inducted to the evaporating section 251. The refrigerant decreased in pressure by the throttle (not shown) incorporated in the header 230, is fed to the evaporating section 251 composed of a plurality of tubes, to be evaporated. Next, a header 240 for collecting refrigerants condensed in the condensing section 252, is provided at the outlet of the condensing section 252.

The refrigerant liquid pipe 203 rises from the header 240, and refrigerant, decreased in pressure at the throttle provided near the highest portion of the pipe, flows through the refrigerant liquid pipe 204 to the refrigerant evaporator 210. Also, a refrigerant pipe 205 connecting the refrigerant evaporator 210 and the compressor 260, is disposed, running downwardly from the refrigerant evaporator 210.

As a result of the passage of process air A being disposed as described above, the location of the main devices associated with process air A is such that with the desiccant wheel 103 as a base position, the blower 102 is below the desiccant wheel 103, the process air cooler 300 is above the desiccant wheel 103, and the refrigerant evaporator 201 is above the process air cooler 300.

As a result of the passage of regeneration air B being disposed as described above, the location of the main devices associated with regeneration air B is such that with the desiccant wheel 103 as a base position, the blower 140 is below the desiccant wheel 103, the refrigerant condenser 220 is above the desiccant wheel 103. In addition, process air and regeneration air passing through the desiccant wheel need not change their flow direction before and after the desiccant wheel, providing a smooth flow.

Therefore, main devices are disposed vertically in the upper and lower positions in orderly manner, effecting compact size as well as a smaller installation area.

Next, referring to FIG. 40, the arrangement of the devices of a dehumidifying air conditioner which is another embodiment of this invention will be described. This embodiment is appropriate for the structure of the apparatus described with reference to FIG. 18. The same features as the foregoing embodiment shown in FIG. 39 are omitted and only the differences will be referred to.

In the embodiment shown in FIG. 39, the dehumidifying air conditioner is operated mainly in the cooling operation mode, but in this embodiment, the air conditioner is configured so as to be operated mainly in the heating operation mode in addition to the cooling operation mode.

Figure 40:
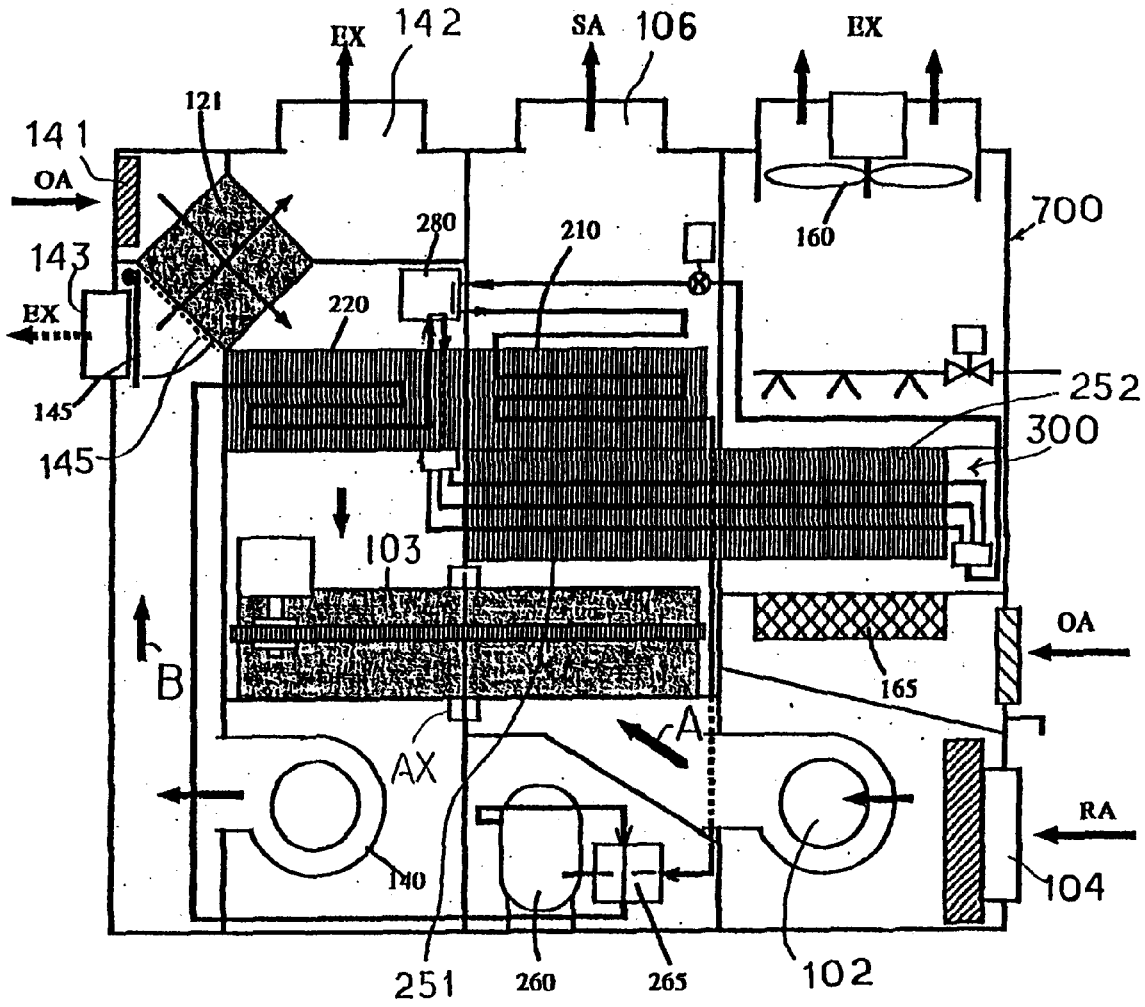
FIG. 40 shows the configuration of a dehumidifying air conditioner as another embodiment of the invention, FIG. 40(*a*) shows a schematic front cross sectional view, FIG. 40(*b*) shows the refrigerant flow through a 4-way valve 265 in a heating mode, and FIG. 40(*c*) shows the refrigerant flow through a 4-way valve 280 in the heating mode.
Figure 40:
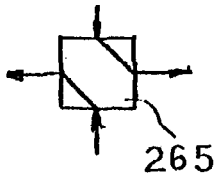
Figure 40:
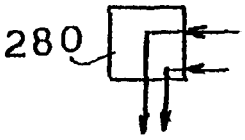

FIG. 40(*a*) is a schematic front view of the dehumidifying air conditioner of an embodiment of this invention. In the Figure, the dehumidifying air conditioner is characterized in that the refrigerant pipe around the compressor for refrigerant is provided with a four-way valve 265, the refrigerant pipe around the process air cooler 300 as a third heat exchanger is provided with four-way valve 280, and the refrigerant passage is provided with a discharge port 143 and a three-way valve 145, so that the dehumidifying air conditioner is capable of heating operation in addition to cooling operation as described above. Other components, passage, and their arrangement are the same as described with respect to the embodiment of the dehumidifying air conditioner shown in FIG. 39.

In FIG. 40(*a*), the fluid flow in the four-way valves 265, 280, and three-way valve 145 shows an instance in cooling operation. That is, refrigerant flows through the refrigerant evaporator 210, compressor 260, refrigerant condenser 220, and the evaporating section 251 and condensing section 252 of the process air cooler 300 in this order, and returned to the refrigerant evaporator 210 for circulation. Also, regeneration air B exiting the blower 140 flows through the heat exchanger 121 to the discharge port 142. The three-way valve 145 is in the position of opening the regeneration air side inlet of the heat exchanger 121. During cooling operation, the three-way valve 145 closes the second discharge port 143.

FIG. 40(*b*) shows the refrigerant flow through the four-way valve 265 in the heating operation, and FIG. 40(*c*) shows the refrigerant flow through the four-way valve 280 in the heating operation. The position of the three-way valve 145 is shown in FIG. 40(*a*) by broken lines. That is, refrigerant flows through the refrigerant evaporator 210, evaporating section 251 of the process air cooler 300, condensing section 252 of the process air cooler 300, refrigerant condenser 220, and compressor 260 in this order, and returns to the refrigerant evaporator 210 for circulation. During the heating operation, the blower 160 is not operated and no water is sprayed in the humidifier 165. Also, as the three-way valve 145 is in the position of closing the inlet of the heat exchanger 121, regeneration air B exiting the blower 140 does not pass through the heat exchanger 121, but is discharged from the second discharge port 143.

In the embodiment shown in FIG. 40, like the embodiment shown in FIG. 39, the blowers 102, 140 and compressor 260 are disposed below the desiccant wheel 103, and the refrigerant condenser 220 and refrigerant evaporator 210 are disposed above the desiccant wheel 103. In the process air cooler 300, process air A and cooling air (outside air C) exchange their heat through refrigerant; the process air A is cooled and the cooling air (outside air C) is heated.

The embodiment shown in FIG. 40 is the same as the embodiment shown in FIG. 39 in that the intake port 104 of process air A is disposed in the vicinity of the bottom of the cabinet 700 (actually on one side thereof at the lower portion), and the discharge port 106 of process air A is disposed on the top of the cabinet 700; that the process air passage is disposed, running upwardly from the desiccant wheel 103 to the discharge port 106; that the intake port 141 of regeneration air B is disposed in the vicinity of the top of the cabinet 700 (actually at one side thereof at the upper portion), and the discharge port 142 of regeneration air B is disposed on the top of the cabinet 700; the regeneration air passages are disposed proceeding downwardly until they reach the blower 140 after exiting the heat exchanger 121, and upwardly until they reach the heat exchanger 121 after exiting the blower 140; and that the compressor 260 and blowers 102, 140 are disposed in the lowermost positions, and main devices are disposed vertically in the upper and lower positions.

Next, referring to FIG. 41, arrangement of the devices of dehumidifying air conditioner of another embodiment of this invention will be described. The same features as the foregoing embodiment shown in FIG. 39 are omitted and only the differences will be referred to. This embodiment is appropriate for the structure of the apparatus described with reference to FIG. 8.

The embodiment shown in FIG. 39 is arranged such that tubes 253A, 253B, 253C constituting the process air cooler 300 equipped in the dehumidifying air conditioner, are disposed horizontally, and vertically in rows, and the temperatures of refrigerant flowing in this tubes are the same at the mouths of the heat-exchanging tubes.

Figure 41:
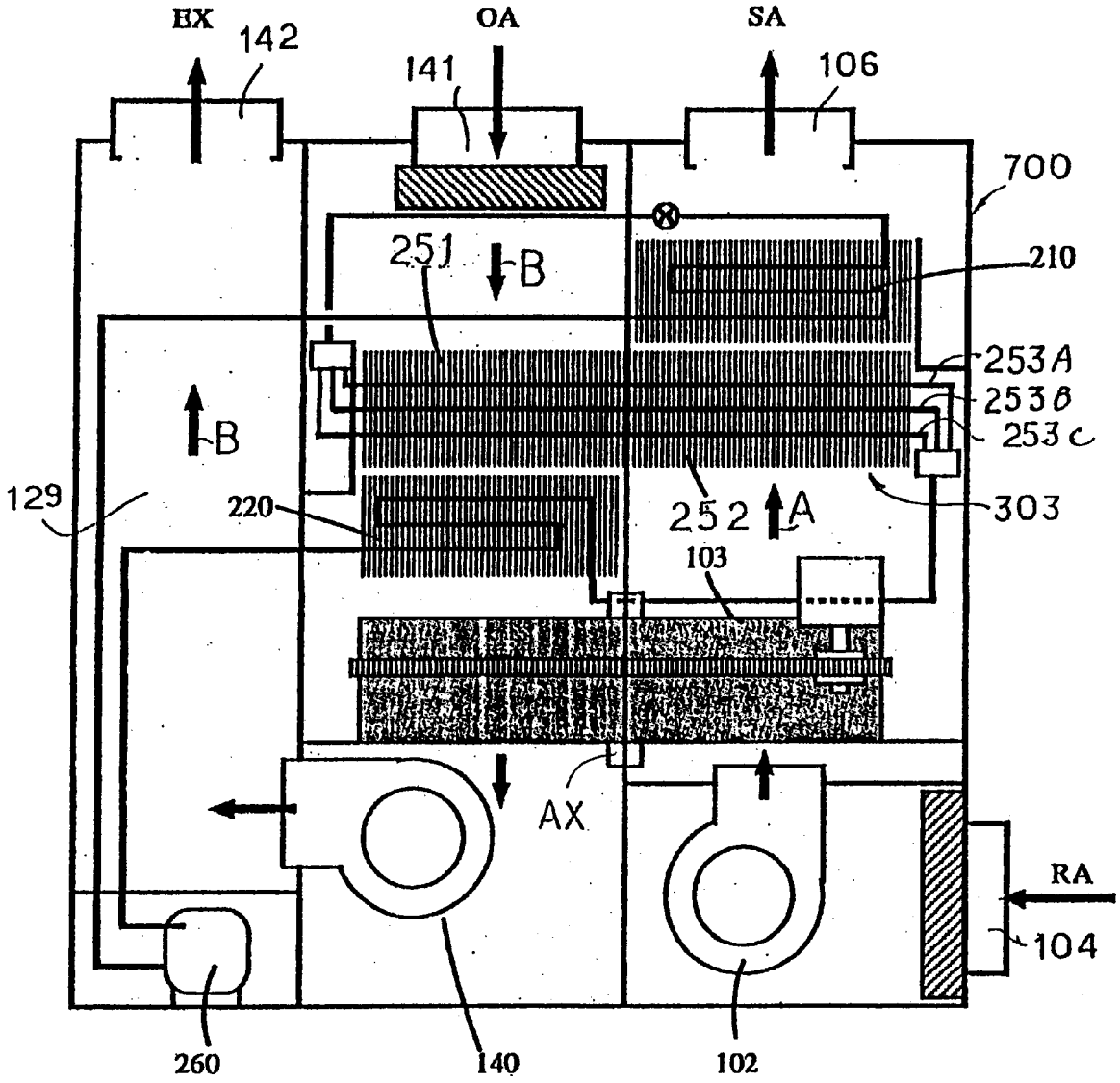
FIG. 41 is a schematic front cross sectional view, showing the configuration of a dehumidifying air conditioner as another embodiment of the invention.

On the other hand, the embodiment of the dehumidifying air conditioner shown in FIG. 41 is arranged such that the temperatures, at the mouths of the heat-exchanging tubes, of refrigerant flowing in the heat-exchanging tubes of the process air cooler 303 as the third heat exchanger, are the highest for the heat-exchanging tube 253A disposed in the highest position, and are lowered toward the heat-exchanging tubes disposed lower positions from the second tube 254B to the third tube 253C. Therefore, heat exchange efficiency of the process air cooler 303 can be enhanced.

No water is sprayed to the heat-exchanging tubes of the condensing section 252 of the process air cooler 303. In the process air cooler 303, process air A and regeneration air B exchange their heat through refrigerant; process air A is cooled and regeneration air B is heated. The blower 102 for process air is disposed directly below the desiccant wheel 103.

Regeneration air B is heated by the condensing section 252 of the process air cooler 303, and the passage of regeneration air B is disposed proceeding downwardly, therefore the refrigerant condenser 220 is disposed directly below the condensing section 252 of the process air cooler 303. No heat exchanger (numeral 121 in FIG. 39) is mounted, and the intake port 141 for regeneration air B is provided on the top of the cabinet 700.

The compressor 260 is mounted at the bottom of the cabinet 700, and disposed directly below the passage 129 of regeneration air proceeding upwardly.

In the embodiment shown in FIG. 41, like the embodiment shown in FIG. 39, the blowers 102, 140 and compressor 260 are disposed below the desiccant wheel 103, and the refrigerant condenser 220 and refrigerant evaporator 210 are disposed above the desiccant wheel 103. In the process air cooler 300, process air A and cooling air (outside air C) exchange their heat through refrigerant; the process air A is cooled and the cooling air (outside air C) is heated. The refrigerant condenser 220, process air cooler 303, and refrigerant evaporator 210 are disposed from the lower position to the upper position in this order.

In the embodiment shown in FIG. 41, the process air passage proceeds upwardly from the blower 102 to the discharge port 106, then downwardly until it reaches the blower 140 after passing through the intake port 141, and then upwardly until it reaches the discharge port 142 after exiting the blower 140 horizontally and changing its direction by 90 degrees. Also, the discharge port 106 of process air A is disposed on the top of the cabinet 700, and the discharge port 142 of regeneration air B is disposed on the top of the cabinet 700.

Next, referring to FIG. 42, arrangement of the devices of dehumidifying air conditioner of another embodiment of this invention will be described. This embodiment is appropriate for the structure of the dehumidifying air conditioner described with reference to FIG. 29. The same features as the foregoing embodiments shown in FIG. 39 and FIG. 41, are omitted and only the differences will be referred to.

Figure 42:
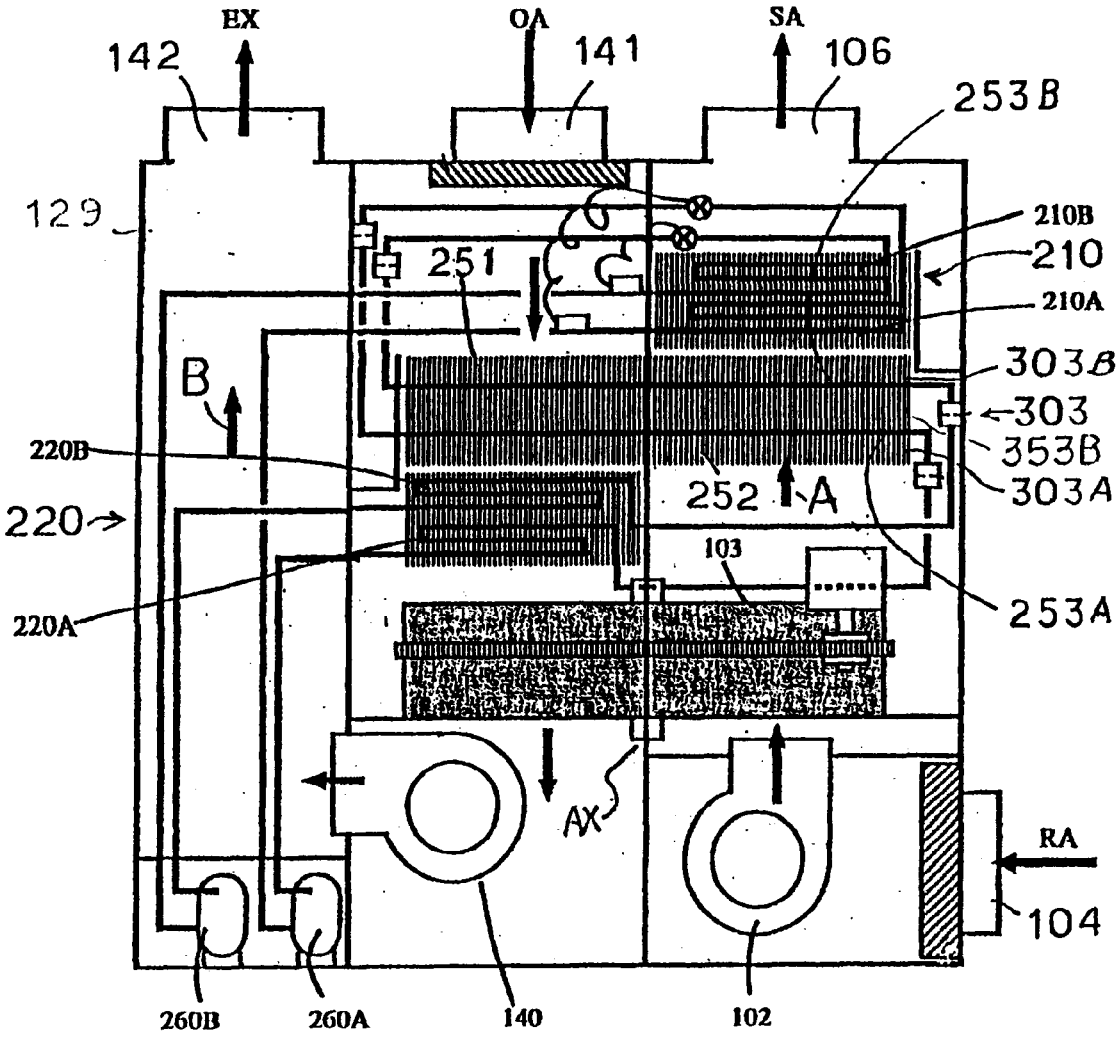
FIG. 42 is a schematic front cross sectional view, showing the configuration of a dehumidifying air conditioner as another embodiment of the invention.

In the embodiment of the dehumidifying air conditioner shown in FIG. 42, the refrigerating cycle is composed of a high pressure cycle and a low pressure cycle to improve heat exchange efficiency. In this case, the refrigerant evaporator 210 of the dehumidifying air conditioner in the embodiment shown in FIG. 41, is divided into two sections, a high pressure section 210A and a low pressure section 210B, and the refrigerant condenser 220 into a high pressure section 220A and a low pressure section 220B, each constituting part of the high pressure cycle and the low pressure cycle. The process air cooler 303 as a third heat exchanger is divided into a high pressure section 303A with a heat-exchanging tube 235A through which refrigerant of a low pressure cycle flows, and a high pressure section with a heat-exchanging tube 253B through which refrigerant of a high pressure cycle flows, and provided with two compressors, a high pressure compressor 260A and a low pressure compressor 260B, each constituting part of the high and low pressure cycles.

The process air A passes through the blower 102, desiccant wheel 103, and evaporating section 251 of the process air cooler 303 in this order, and then the high pressure section 210A of the refrigerant evaporator 210 to the low pressure section 210B, therefore the passage of process air A proceeds upwardly from the bottom to the top. In the evaporating section 251 of the process air cooler 303, it passes through from the high pressure section 303A to the low pressure section 303B. In the process air cooler 303, process air A and regeneration air B exchange their heat through refrigerant; process air A is cooled in the evaporating section 251 and regeneration air B is heated in the condensing section 252.

Regeneration air B passes through the condensing section 252 of the process air cooler 303, then the low pressure section 220B of the refrigerant condenser 220 to the high pressure section 220A, then through the desiccant wheel 103 and blower 140, therefore the passage of regeneration air B proceeds downwardly from the top to the bottom throughout the route. In the condensing section 252 of the process air cooler 303, it passes through from the low pressure section 303B to the high pressure section 303A. The heat-exchange between refrigerant and regeneration air B and between refrigerant and process air, is performed only in the process air cooler 303, refrigerant condenser 220, and refrigerant evaporator 210, so that for example, regeneration air B flowing through the passage 129 from the blower 140, is thermally separated from refrigerant flowing into and out from the compressors 260A, 260B.

In the embodiment shown in FIG. 42, like the embodiment shown in FIG. 39, the blowers 102, 140 and compressor 260 are disposed below the desiccant wheel 103, and the refrigerant condenser 220 and refrigerant evaporator 210 are disposed above the desiccant wheel 103. The refrigerant condenser 220, process air cooler 303, and refrigerant evaporator 210 are disposed from the lower position to the upper position in this order.

The embodiment shown in FIG. 42 is the same as described in the embodiment shown in FIG. 41 in that the refrigerant air passage proceeds upwardly from the blower 120 to the discharge port 106, and that the regeneration air passage proceeds downwardly until it reaches the blower 140 after passing through the intake port 141, and then upwardly until it reaches the discharge port 142 after exiting the blower 140 horizontally and changing the direction by 90 degrees. Further, this embodiment is the same as in the embodiment in FIG. 41 in that the intake port 104 of process air A is disposed in the vicinity of the bottom of the cabinet 700 (actually on one side thereof at the lower portion), and the discharge port 106 of process air A is disposed on the top of the cabinet 700; and that the intake port 141 of regeneration air B is disposed on the top of the cabinet 700, and the discharge port 142 of regeneration air B is disposed on the top of the cabinet 700.

Next, referring to FIG. 43, the arrangement of devices of dehumidifying air conditioner, which is another embodiment according to the present invention will be described below. In comparison with the embodiments shown in FIGS. 39 and 42, only dissimilar features will be described and similar ones will not be repeated. This structure is preferable for the dehumidifying air conditioner described, referring to FIG. 33.

Figure 43:
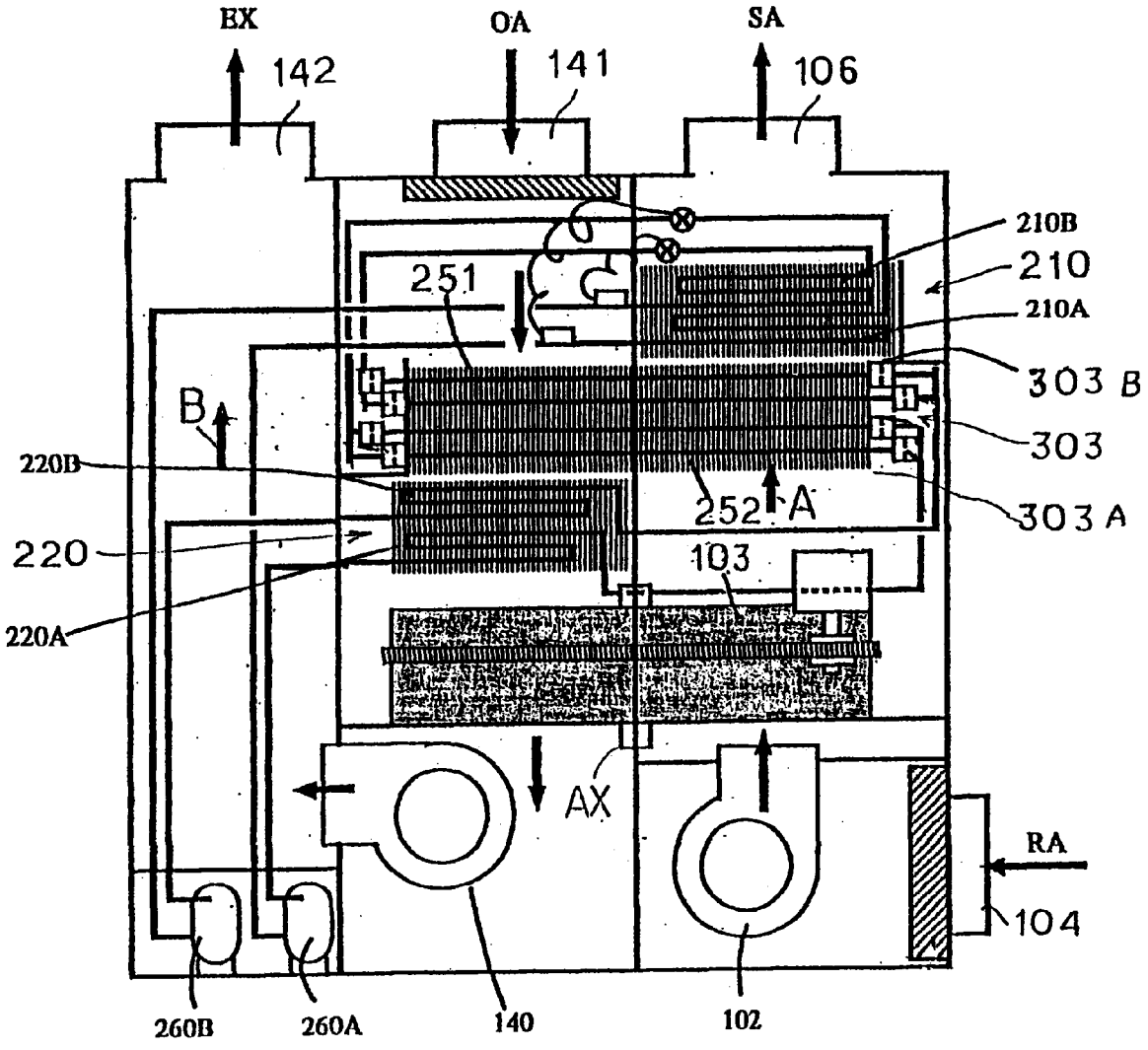
FIG. 43 is a schematic front cross sectional view, showing the configuration of a dehumidifying air conditioner as another embodiment of the invention.

In the embodiment of a dehumidifying air conditioner shown in FIG. 43, a process air cooler 303 as a second is divided into a high pressure part 303A which is located vertically on the lower side and a low pressure part 303B which is located vertically on the upper side. Four heat exchanging tubes extending in horizontal direction are mounted vertically on the process air cooler 303. Each heat exchanging tube has one throttle opening at the respective inlet and outlet of the process air cooler. Two of the four heat exchanging tubes are disposed on the low pressure part 303B and the other two heat exchanging tubes are disposed on the high pressure part 303A.

Evaporating section 251 of the process air cooler 303 contains a high pressure cycle heat exchanging tube for the high pressure part, a high pressure cycle heat exchanging tube for the low pressure part, a low pressure cycle heat exchanging tube for the high pressure part and a low pressure cycle heat exchanging tube for the low pressure part which are disposed vertically in this order. Operating temperatures decrease also in this order.

On the other hand, condensing section 252 of the process air cooler 303 contains a high pressure cycle heat exchanging tube for the high pressure part, a high pressure cycle heat exchanging tube for the low pressure part, a low pressure cycle heat exchanging tube for the high pressure part, and allow pressure cycle heat exchanging tube for the high pressure part which are disposed vertically in this order. Throttle opening diameter is set such that operating temperature can decrease in this order. If the operating temperatures of the heat exchanging tubes are set in this manner, a refrigerant condenser, a process air cooler and a refrigerant evaporator can maintain a high heat exchange efficiency. Additionally, the process air cooler 303 exchanges heat with the process air A and the regeneration air B, i.e., the process air A is cooled in the evaporating section 251 while the regeneration air B is heated in the condensing section 252.

In the embodiment shown in FIG. 43, in the same manner as shown in FIG. 39, a blower 102, a blower 140 and compressors 260A, 260B are disposed vertically below the desiccant wheel, while a refrigerant condenser 220 and a refrigerant evaporator 210 are disposed vertically above the desiccant wheel. The refrigerant condenser 220, the process air cooler 303 and the refrigerant evaporator 210 are also disposed vertically upward in this order.

Additionally, in the embodiment shown in FIG. 43, it is the same with the embodiment shown in FIG. 41 in that the passage for the process air extends vertically upward from the blower 102 to the discharge port 106, that the passage for the regeneration air extends vertically downward from the intake port 141 to the blower 140, and extends vertically upward to the discharge port 142, after extending from the blower 140 and then bent at a right angle. Furthermore, it is also the same with the embodiment shown in FIG. 41 in that the intake port 104 for the process air A is disposed near the bottom face of cabinet 700 (actually in the lower side face), that the discharge port 106 of the regeneration air A is disposed on the top face of the cabinet 700, that the intake port 141 of the regeneration air B is disposed on the top face of the cabinet 700, and that the discharge port 142 of the regeneration air B is disposed on the top face of the cabinet 700.

Next, referring to FIG. 44, the arrangement of the devices of dehumidifying air conditioner, which is another embodiment will be described below. In comparison with the embodiments shown in FIGS. 39 and 41, only dissimilar features are described and similar ones are not repeated. This structure is preferable for the dehumidifying air conditioner described, referring to FIG. 26.

Figure 44:
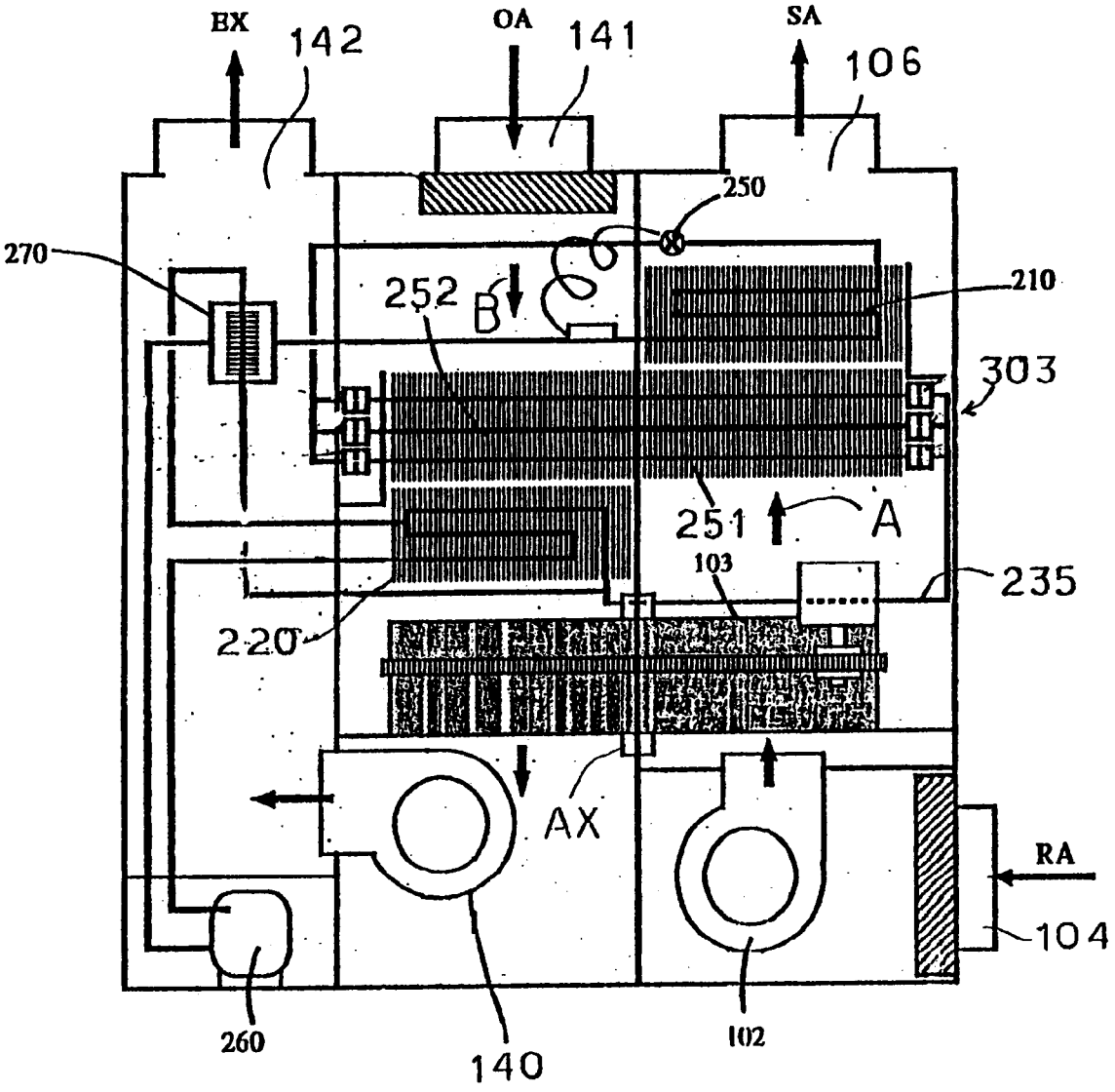
FIG. 44 is a schematic front cross sectional view, showing the configuration of a dehumidifying air conditioner as another embodiment of the invention.

In the embodiment of dehumidifying air conditioner shown in FIG. 44, refrigerant path in the refrigerant condenser 220 is made to branch out on the way and the refrigerant is taken out from the refrigerant condenser 220. The heat exchanger 270 exchanges heat between the refrigerant taken out and the refrigerant flowing into the compressor 260 from refrigerant evaporator 210, and the former refrigerant is joined, at the header 235, with the refrigerant immediately before flowing into the process air cooler 303 as the second heat exchanger.

In the heat exchanger 270, refrigerant flowing into the compressor 260 is heated with saturated steam of the refrigerant which has been compressed. The refrigerant which has been compressed and raised in temperature is condensed in the refrigerant condenser 220 and exchanges heat with the regeneration air B (secondary heating of the regeneration air). The refrigerant is then evaporated in the evaporating section 251 of the process air cooler 303, undergoes heat exchange with the process air A (cooling of the process air), and additionally condensed in the condensing section 252 to exchange heat with the regeneration air B (primary heating of the regeneration air). The regeneration air B thus has a temperature high enough to regenerate the desiccant, which will result in the desiccant having a higher dehumidifying capacity.

As described above, the regeneration air B is primarily heated at the condensing section 252 of the process air cooler 303 and then secondarily heated in the refrigerant condenser 220 before regenerating the desiccant.

Additionally, the process air cooler 303 exchanges heat through refrigerant, with the process air A and regeneration air B, and the process air A is cooled at the evaporating section 251, while the regeneration air B is heated in the condensing section 252.

The embodiment shown in FIG. 44 is the same with the embodiment shown in FIG. 39 in that a blower 102, a blower 140 and a compressor 260 are disposed vertically below the desiccant wheel 103, while a refrigerant condenser 220 and a refrigerant evaporator 210 are disposed above the desiccant wheel 103. The refrigerant condenser 220, the process air cooler 303 and the refrigerant evaporator 210 are disposed vertically upward in this order.

Furthermore, the embodiment shown in FIG. 44 is the same with the embodiment shown in FIG. 41 in that the passage for the process air extends vertically upward from the blower 102 to the discharge port 106, that the passage for the regeneration air extends vertically downward from the intake port 141 to the blower 140, and extends vertically upward to the discharge port 142, after extending from the blower 140 and then bent at right angle. Furthermore, it is also the same with the embodiment shown in FIG. 41 in that the intake port 104 for the process air A is disposed near the bottom face of cabinet 700 (actually in the lower side face), that the discharge port 106 of the regeneration air A is disposed on the top face of the cabinet 700, that the intake port 141 of the regeneration air B is disposed on the top face of the cabinet 700, and that the discharge port 142 of the regeneration air B is disposed on the top face of the cabinet 700.

Next, referring to FIG. 45, the arrangement of the devices of dehumidifying air conditioner, which is another embodiment will be described below. In comparison with the embodiments shown in FIGS. 39 and 44, only dissimilar features are described and similar ones are not repeated.

Figure 45:
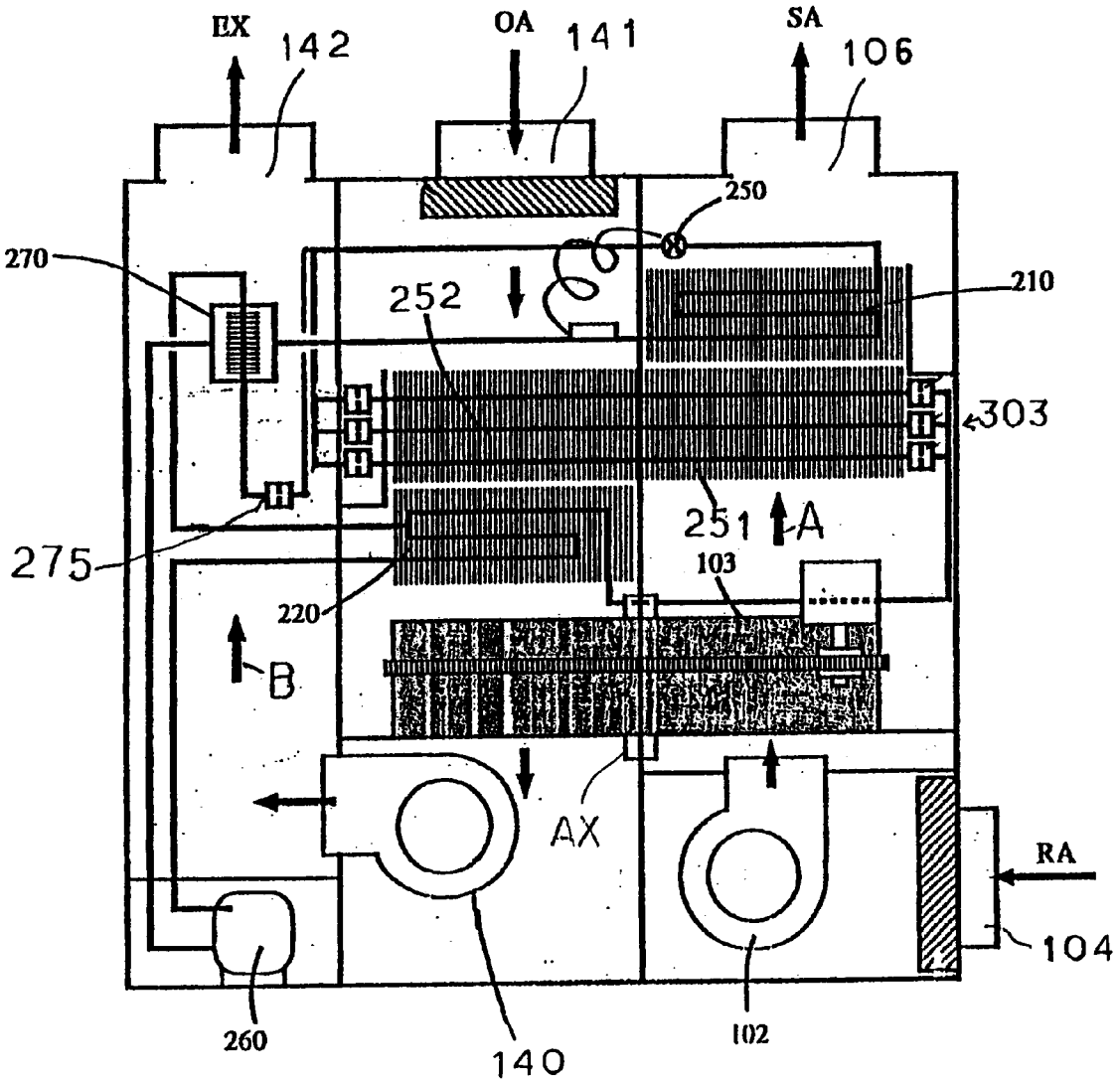
FIG. 45 is a schematic front cross sectional view, showing the configuration of a dehumidifying air conditioner as another embodiment of the invention.

In the embodiment of dehumidifying air conditioner shown in FIG. 45, refrigerant path in the refrigerant condenser 220 is made to branch out on the way and the refrigerant is taken out from the refrigerant condenser 220. The heat exchanger 270 exchanges heat between the refrigerant taken out and the refrigerant flowing into the compressor 260 from refrigerant evaporator 210. The former refrigerant then passes through a throttle 275 and is joined, at the upstream side of the expansion valve 250 located immediately before the refrigerant evaporator 210. This structure is preferable for the dehumidifying air conditioner described, referring to FIG. 27.

In the heat exchanger 270, refrigerant flowing into the compressor 260 is heated with saturated steam of the refrigerant which has been compressed. The refrigerant which has been compressed to be raised in temperature is condensed in the refrigerant condenser 220 and exchanges heat with the regeneration air B (secondary heating of the regeneration air). The refrigerant is then evaporated in the evaporating section 251 of the process air cooler 303 as the second heat exchanger, undergoes heat exchange with the process air A (cooling of the process air), and additionally condensed in the condensing section 252 to exchange heat with the regeneration air B (primary heating of the regeneration air). The regeneration air B thus has a temperature high enough to regenerate desiccant, which will result in the desiccant having a higher dehumidifying capacity. As described above, the regeneration air B is primarily heated at the condensing section 252 of the process air cooler 303 and then secondarily heated in the refrigerant condenser 220 before regenerating desiccant.

Additionally, the process air cooler 303 exchanges heat through refrigerant, with the process air A and regeneration air B, and the process air A is cooled at the evaporating section 251, while the regeneration air B is heated in the condensing section 252.

The embodiment shown in FIG. 45 is the same with the embodiment shown in FIG. 39 in that a blower 102, a blower 140 and a compressor 260 are disposed vertically below the desiccant wheel 103, while a refrigerant condenser 220 and a refrigerant evaporator 210 are disposed above the desiccant wheel 103. The refrigerant condenser 220, the process air cooler 303-and the refrigerant evaporator 210 are disposed vertically upward in this order.

Furthermore, the embodiment shown in FIG. 44 is the same with the embodiment shown in FIG. 41 in that the passage for the process air extends vertically upward from the blower 102 to the discharge port 106, that the passage for the regeneration air extends vertically downward from the intake port 141 to the blower 140, and extends vertically upward to the discharge port 142, after extending from the blower 140 and then bent at a right angle. Furthermore, it is also the same with the embodiment shown in FIG. 41 in that the intake port 104 for the process air A is disposed near the bottom face of cabinet 700 (actually in the lower side face), that the discharge port 106 of the regeneration air A is disposed on the top face of the cabinet 700, that the intake port 141 of the regeneration air B is disposed on the top face of the cabinet 700, and that the discharge port 142 of the regeneration air B is disposed on the top face of the cabinet 700.

Figure 46:
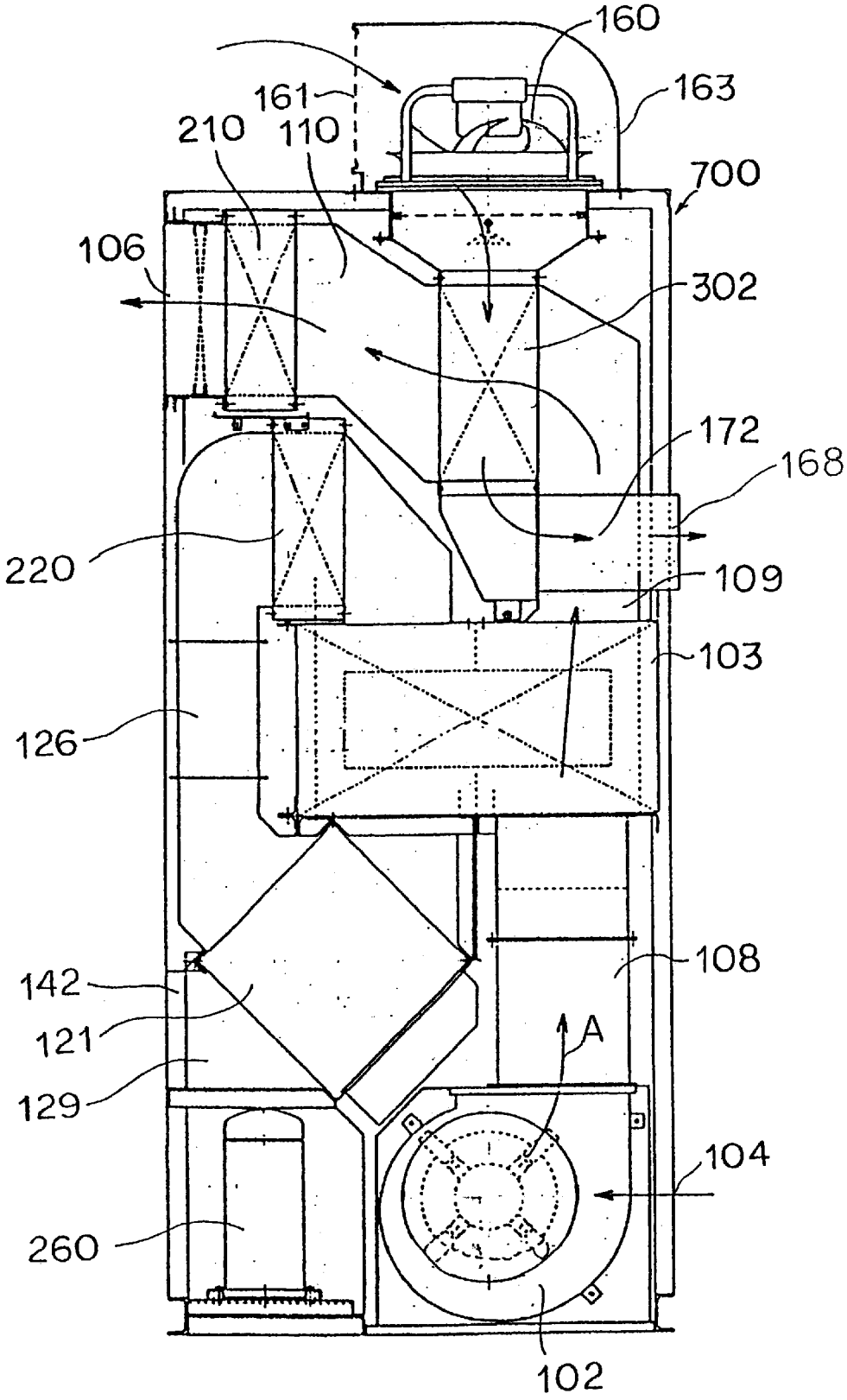
FIG. 46 is a schematic front cross sectional view, showing the configuration of a dehumidifying air conditioner as another embodiment of the invention, with the regeneration air blower omitted.

Next, referring to FIGS. 46, 47 and 48, the arrangement of the devices of dehumidifying air conditioner, which is an embodiment will be described below. FIG. 46 is a drawing omitting the blower 140 for the regeneration air from the FIG. 47. FIG. 48 is a side view in the left of FIGS. 46 and 47.

The process air A is drawn by the blower 102 through the intake port 104 fitted to the side face near the bottom face of the cabinet 700 and then sent vertically upward through the passage. The process air A passes vertically upward through one half (semicircle) of the desiccant wheel 103, the axis of rotation of which is disposed vertically, and the desiccant adsorbs moisture. The process air A, which passed the desiccant wheel 103, flows vertically upward through the passage 109, then changes its direction by 90° and horizontally passes through the process air cooler 302 as the third heat exchanger which is disposed to extend vertically, while being cooled by the cooling air. The process air A further flows through the passage 110 sloped upward, then horizontally passes through the refrigerant evaporator 210 which is vertically disposed, and flows into the discharge port 106 provided near the top face of the side face opposite to the side having the intake port 104 in the cabinet.

The regeneration air B is horizontally drawn through the intake port 141 that is provided on the side face near the bottom face of the cabinet 700. The regeneration air B, which was raised in pressure the blower 140, flows aslant and upward through the passage 124 and then pass through the heat exchanger 121 for exchanging heat with the regeneration air B heated by the refrigerant condenser 220. After flowing into the passage 126, the regeneration air B changes its direction to flow vertically upward and passes through the refrigerant condenser 220 that is disposed to extend vertically upward, while changing its direction by 180° around there. After leaving the refrigerant condenser 220, the regeneration air B flows vertically downward through the passage 127, and then reaches and passes through, the heat exchanger 121 while changing its direction to flow aslant and downward. After leaving the heat exchanger 121, it changes its direction to pass horizontally through the passage 129 and then flow horizontally through the discharge port 142 which is disposed on the side face near the bottom face of the cabinet 700.

On the top face of the cabinet 700 is provided a vertical type blower 160 that can draw the cooling air. The blower 160 is shielded by hood 163. An intake port which is located horizontally and laterally with respect to the blower 150, is the intake port 166 of the device. The cooling air flows vertically downward and passes through the process air cooler 302 while cooling the process air. Immediately after leaving the process air cooler 302, the cooling air, after changing its direction by 90°, flows horizontally through the passage 172 and then flow horizontally through the discharge port 172 which is disposed at a position third of the full height from the uppermost side face of the cabinet 700.

The flow of refrigerant (not shown in FIGS. 46–47 though) cools the process air viathe refrigerant evaporator 210. Evaporated refrigerant is compressed by the compressor 260, condensed after heating the regeneration air via the refrigerant condenser 220 and returned to the refrigerant evaporator 210 for circulation.

Figure 47:
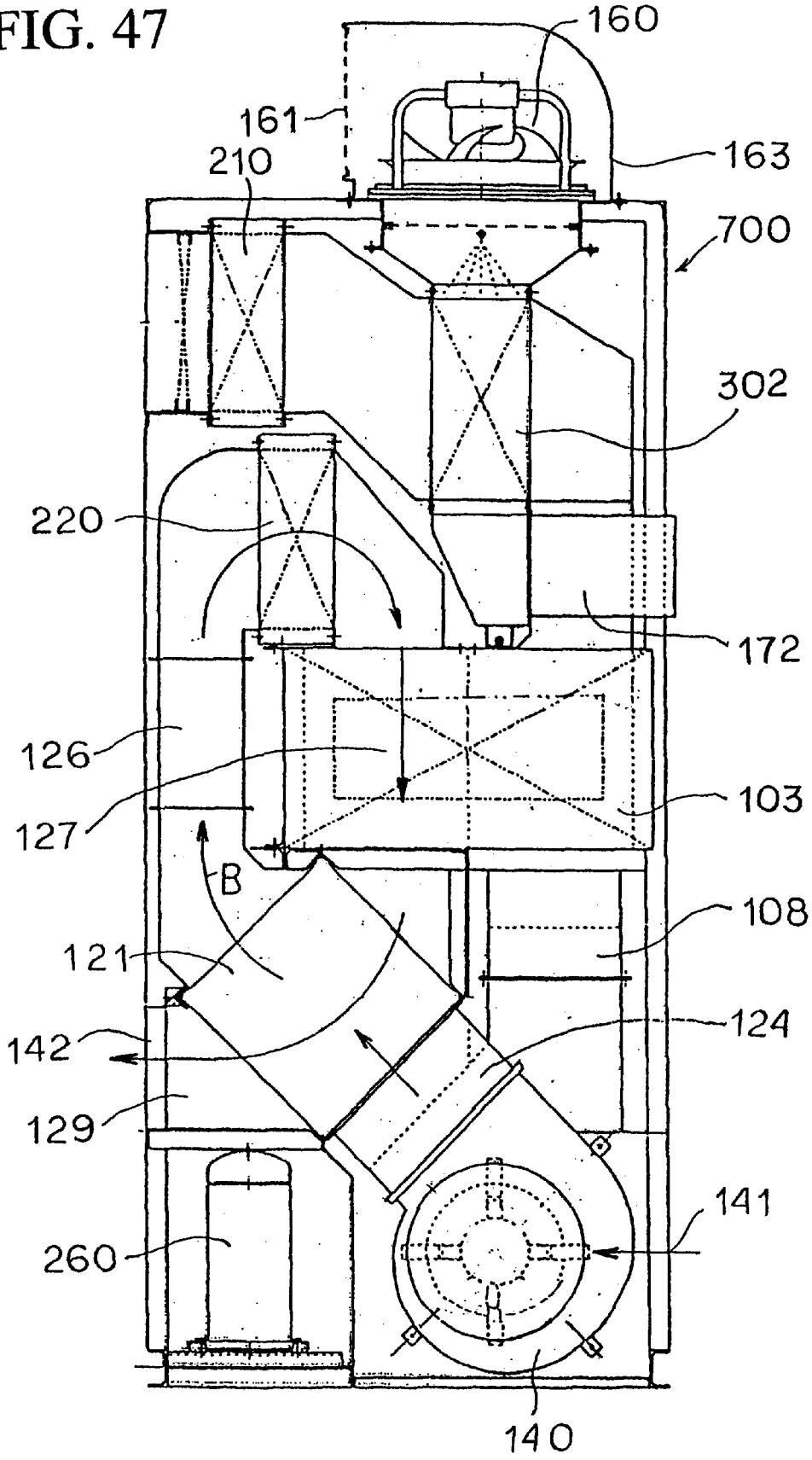
FIG. 47 is a schematic front cross sectional view, showing the configuration of a dehumidifying air conditioner as another embodiment of the invention.
Figure 48:
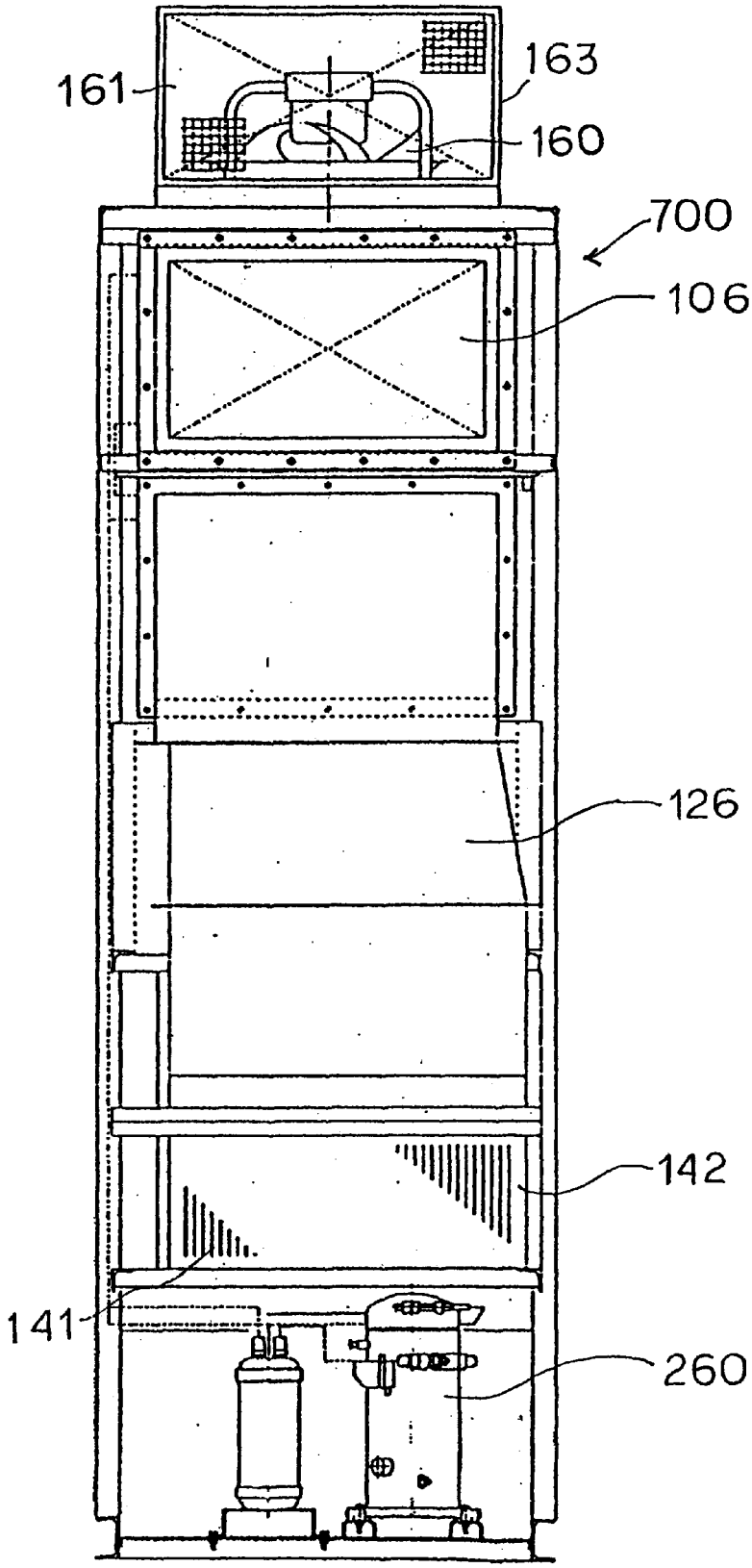
FIG. 48 is a schematic side view, showing the configuration of the dehumidifying air conditioners shown in FIGs.46 and 47.

In the embodiments of FIGS. 46–48, blowers 102, 140, a compressor 260 and a heat exchanger 121 are disposed vertically below the desiccant wheel 103, while a refrigerant evaporator 210, a refrigerant condenser 220 and a process air cooler 302 are disposed vertically above the desiccant wheel 103.

Here, in the fluid passage portion, through which the process air A flows vertically upward, are fluid passages 108 and passage 109. A second fluid passage portion, through which the regeneration air B flows vertically downward, is a fluid passage 127, while a first fluid passage portion, through which it flows vertically upward, is a passage 126.

If the fluid passages for the process air A and regeneration air B are arranged as described above, the process air A and regeneration air B passing through the desiccant wheel 103 will not have to change its direction around there, and therefore flow smoothly. Furthermore, the compressor 260 and blowers 102, 104 can be disposed on the bottom face while main devices can be arranged vertically upward. Thus the equipment can become compact and decrease the space for installation.

Main devices as described above may contain the compressor 260, blowers 102, 140, refrigerant compressor 220, refrigerant evaporator 210, process air cooler 300, desiccant wheel 103 and so forth.

As described above, the embodiments of dehumidifying air conditioner according to the present invention contain a desiccant wheel, the axis of rotation of which is vertically disposed. The fluid passages for the regeneration air can be constructed such that they have a first passage portion for vertically downward flow and a second passage portion for vertically upward flow. Thus the flows of regeneration air through the equipment can be streamlined, so that they may flow mainly vertically downward to upward. As a result, the regeneration air will not have to change its direction around the desiccant wheel and the main devices can be arranged vertically upward. In comparison with those humidifying air conditioners which have desiccant wheels, axis of rotation of which are horizontally disposed, the equipment herein can become compact and will reduce the space needed for installing the equipment.

Furthermore, because the present invention contains a blower for the process air/blower for the regeneration air and compressor which are disposed vertically below desiccant wheel, while having refrigerant compressor which are disposed vertically above the desiccant wheel, space can be horizontally reduced and thus the space needed for installing the equipment can be reduced. Additionally the process air can flow upward through the blower for the process air and desiccant wheel, as arranged in this order, while the regeneration air can flow downward through refrigerant compressor, desiccant wheel and blower for the regeneration air, as arranged in this order. Thus a compact and less tall humidifying air conditioner will come realized.

Additionally, if the refrigerant evaporator is disposed vertically above the desiccant wheel, space will be more reduced horizontally and thus the space needed for installing the equipment will be even more reduced. Allowing the process air to flow upward through the blower for the process air then the desiccant wheel is a smoother arrangement order. Allowing the regeneration air to flow downward through the refrigerant evaporator then the desiccant wheel is a smoother arrangement order. Thus a much more compact and much less tall humidifying air conditioner will come realized.

As the process air blower, regeneration air blower, compressor and desiccant wheel are disposed near the bottom face, the humidifying air conditioner will have a lower center of gravity. Additionally, because the process air blower, regeneration air blower and compressor are arranged at lower positions close to the foundation bolts of the equipment, the humidifying air conditioner will be less affected by any vibration and have a greater stability during installation.

Industrial Applicability

As described above, the present invention allows the provision of a heat exchanger of a higher heat exchange efficiency, higher COP heat pump, higher COP dehumidifying air conditioner, and a more space-saving dehumidifying air conditioner.

What is claimed is:

1. A heat exchanger comprising:

a first compartment for a first fluid flowing therethrough;

a second compartment for a second fluid flowing therethrough;

a first flow passage passing through the first compartment and for a third fluid flowing therethrough, the third fluid exchanging heat with the first fluid; and a second flow passage passing through the second compartment and for the third fluid flowing therethrough, the third fluid exchanging heat with the second fluid;

wherein the first and second flow passages are formed as an integral passage; the third fluid flows through from the first flow passage to the second flow passage, and the third fluid evaporates on a heat transfer surface located at a flow passage side of the first flow passage at a specific pressure, the flow passage side being for the third fluid flowing therein, and condenses on a heat transfer surface located at a flow passage side of the second flow passage at approximately the same pressure as the specific pressure, the flow passage side being for the third fluid flowing therein.

2. A heat exchanger as recited in claim 1, wherein the second fluid flowing through the second compartment is caused to contain water.

3. A heat exchanger as recited in claim 1, further comprising a third flow passage passing through the second compartment and disposed parallel to the second flow passage for the third fluid flowing threrethrough, the third fluid exchanging heat with the second fluid, wherein the third fluid substantially bypasses the first compartment and is supplied to the third flow passage.

4. A heat exchanger as recited in claim 3, wherein the third fluid mainly in liquid phase is supplied to the first flow passage, and the third fluid mainly in vapor phase is supplied to the third flow passage.

5. A heat exchanger comprising:

a first compartment for a first fluid flowing therethrough;

a second compartment for a second fluid flowing therethrough;

first flow passages passing through the first compartment and for a third fluid flowing therethrough, the third fluid exchanging heat with the first fluid; and second flow passages passing through the second compartment and for the third fluid flowing therethrough, the third fluid exchanging heat with the second fluid;

wherein the third fluid flows through from the first flow passage to the second flow passage, the third fluid evaporates on the heat transfer surfaces located on the flow passage side of the first flow passages at specific pressures and condenses on the heat transfer surfaces located on the flow passage side of the second flow passages at approximately the same pressures as the specific pressures; the first flow passages are provided in a plurality; and the specific pressures in the plurality of flow passages are different from each other.

6. A heat pump comprising a heat exchanger including:

a first compartment for a first fluid flowing therethrough;

a second compartment for a second fluid flowing therethrough;

a first flow passage passing through the first compartment and for a third fluid flowing therethrough, the third fluid exchanging heat with the first fluid; and a second flow passage passing through the second compartment and for the third fluid flowing therethrough, the third fluid exchanging heat with the second fluid;

wherein the first and second flow passages are formed as an integral passage; the third fluid flows through from the first flow passage to the second flow passage, and the third fluid evaporates on a heat transfer surface located at a flow passage side of the first flow passage at a specific pressure, the flow passage side being for the third fluid flowing therein, and condenses on a heat transfer surface located at a flow passage side of the second flow passage at approximately the same pressure as the specific pressure, the flow passage side being for the third fluid flowing therein;

a pressure raiser for raising the pressure of the third fluid in vapor phase;

a first heat exchanger for taking heat from the third fluid in vapor phase, the third fluid in vapor phase having been boosted with the pressure raiser, with a high temperature fluid, thus causing the third fluid in vapor phase to condense under a first pressure;

a first throttle for reducing the third fluid in pressure, the third fluid having been condensed with the first heat exchanger, to the specific pressure and for leading the third fluid to the first flow passage;

a second throttle for reducing the third fluid in pressure, the third fluid having been condensed at the specific pressure, to a third pressure; and a third heat exchanger for evaporating the third fluid, the third fluid having been reduced in pressure with the second throttle, by imparting heat to the third fluid from a low temperature fluid under the third pressure.

7. A heat pump comprising a heat exchanger including:

a first compartment for a first fluid flowing therethrough;

a second compartment for a second fluid flowing therethrough;

a first flow passage passing through the first compartment and for a third fluid flowing therethrough, the third fluid exchanging heat with the first fluid; and a second flow passage passing through the second compartment and for the third fluid flowing therethrough, the third fluid exchanging heat with the second fluid;

wherein the first and second flow passages are formed as an integral passage; the third fluid flows through from the first flow passage to the second flow passage, and the third fluid evaporates on a heat transfer surface located at a flow passage side of the first flow passage at a specific pressure, the flow passage side being for the third fluid flowing therein, and condenses on a heat transfer surface located at a flow passage side of the second flow passage at approximately the same pressure as the specific pressure, the flow passage side being for the third fluid flowing therein a compressor for compressing the pressure of the third fluid in vapor phase;

a first heat exchanger for taking heat from the third fluid in vapor phase, the third fluid in vapor phase having been compressed with the compressor, with a high temperature fluid, thus causing the third fluid in vapor phase to condense under a first pressure;

a first throttle for reducing the third fluid in pressure, the third fluid having been condensed with the first heat exchanger, to the specific pressure and for leading the third fluid to the first flow passage;

a second throttle for reducing the third fluid in pressure, the third fluid having been condensed at the specific pressure, to a third pressure; and a third heat exchanger for evaporating the third fluid, the third fluid having been reduced in pressure with the second throttle, by imparting heat to the third fluid from a low temperature fluid under the third pressure.

8. A dehumidifier comprising;

the heat pump as recited in claim 7; and a moisture adsorber having a desiccant for adsorbing moisture in the first fluid;

wherein the heat exchanger is disposed on the downstream side of the first fluid flow relative to the moisture adsorber, so as to cool the first fluid from which moisture is adsorbed by the desiccant.

9. A heat pump comprising;

a pressure raiser for raising the pressure of a refrigerant;

a first heat exchanger for condensing the refrigerant, the refrigerant having been boosted with the pressure raiser, by taking heat from the refrigerant with a high temperature fluid under a first pressure;

a first throttle for reducing the refrigerant in pressure, the refrigerant having been condensed with the first heat exchanger, to a second pressure;

a second heat exchanger for evaporating the refrigerant, the refrigerant having been reduced in pressure with the first throttle, by the heat from the first fluid under the second pressure, and for condensing the refrigerant, after the evaporation, by taking heat from the refrigerant with a second fluid;

a second throttle for reducing the refrigerant in pressure, after being condensed with the second heat exchanger, to a third pressure; and a third heat exchanger for evaporating the refrigerant, the refrigerant having been reduced in pressure with the second throttle, by imparting heat to the refrigerant from low temperature fluid under the third pressure.

10. A heat pump comprising;

a compressor for compressing a refrigerant;

a first heat exchanger for condensing the refrigerant, the refrigerant having been compressed with the compressor, by taking heat from the refrigerant with a high temperature fluid under a first pressure;

a first throttle for reducing the refrigerant in pressure, the refrigerant having been condensed with the first heat exchanger, to a second pressure;

a second heat exchanger for evaporating the refrigerant, the refrigerant having been reduced in pressure with the first throttle, by the heat from the first fluid under the second pressure, and for condensing the refrigerant, after the evaporation, by taking heat from the refrigerant with a second fluid;

a second throttle for reducing the refrigerant in pressure, after being condensed with the second heat exchanger, to a third pressure; and a third heat exchanger for evaporating the refrigerant, the refrigerant having been reduced in pressure with the second throttle, by imparting heat to the refrigerant from low temperature fluid under the third pressure.

11. A heat pump as recited in claim 10:

wherein the second heat exchanger comprises;

a first compartment for the first fluid flowing therethrough, a second compartment for the second fluid flowing therethrough, a first flow passage passing through the first compartment and for the refrigerant flowing therethrough, the refrigerant exchanging heat with the first fluid, and a second flow passage passing through the second compartment and for the refrigerant flowing therethrough, the refrigerant exchanging heat with the second fluid;

wherein the refrigerant flows through from the first flow passage to the second flow passage, the refrigerant evaporates under the second pressure on the heat transfer surface located on the flow passage side of the first flow passage, and condenses approximately under the second pressure on the heat transfer surface located on the flow passage side of the second flow passage.

12. A heat pump as recited in claim 10, comprising:

a vapor-liquid separator disposed between the first throttle and the second heat exchanger so as to separate the refrigerant, that has been reduced in pressure to the second pressure, into refrigerant liquid and refrigerant vapor.

13. A heat pump as recited in claim 11, comprising:

a vapor-liquid separator disposed between the first throttle and the second heat exchanger so as to separate the refrigerant, the refrigerant having been reduced in pressure to the second pressure, into refrigerant liquid and refrigerant vapor; and a third flow passage disposed parallel to the second flow passage;

wherein the refrigerant liquid separated with the vapor-liquid separator is caused to flow to the first flow passage, and the refrigerant vapor separated with the vapor-liquid separator is caused to bypass the first flow passage and to flow to the third flow passage.

14. A heat pump as recited in claim 10:

wherein the second heat exchanger comprises;

a first compartment for the first fluid flowing therethrough;

a second compartment for the second fluid flowing therethrough;

first flow passages passing through the first compartment and for the refrigerant flowing therethrough, the refrigerant exchanging heat with the first fluid; and second flow passages passing through the second compartment and for the refrigerant flowing therethrough, the refrigerant exchanging heat with the second fluid;

wherein the refrigerant flows through from the first flow passages to the second flow passages; the refrigerant evaporates under the second pressure on the heat transfer surfaces located on the flow passage side of the first flow passages, and condenses approximately under the second pressure on the heat transfer surfaces located on the flow passage side of the second flow passages; the first flow passages are provided in a plurality; and the second pressures in the plurality of flow passages are different from each other.

15. A dehumidifier comprising:

the heat pump as recited in claim 10; and a moisture adsorber having a desiccant for adsorbing moisture in the low temperature fluid;

wherein the second heat exchanger is disposed on the downstream side of the low temperature fluid flow relative to the moisture adsorber, so as to cool the low temperature fluid, from which moisture has been adsorbed with the desiccant, and before low temperature fluid causes the refrigerant to evaporate with the third heat exchanger.

16. A dehumidifier comprising:

a moisture adsorber having a desiccant for adsorbing moisture in the process air; and a process air cooler, disposed on the downstream side of the process air flow relative to the moisture adsorber, for cooling the process air from which moisture has been adsorbed with the desiccant;

wherein the process air cooler cools the process air by the evaporation of a refrigerant, the evaporation being at a specific pressure, wherein all of the refrigerant is forced to flow generally in one direction and the process air cooler condenses the evaporated refrigerant at approximately the same pressure as the specific pressure in the process air cooler, cooled with a cooling fluid.

17. A method of dehumidifying process air, comprising:

a first step of cooling the process air with a refrigerant that evaporates at a low pressure;

a second step of raising the pressure of the refrigerant, that has evaporated in the first step, to a high pressure;

a third step of heating regeneration air for regenerating a desiccant with the refrigerant that condenses at the high pressure;

a fourth step of regenerating the desiccant by desorbing moisture from the desiccant with the regeneration air heated in the third step;

a fifth step of adsorbing moisture in the process air with the desiccant regenerated in the fourth step;

a sixth step of cooling the process air, from which moisture has been removed by adsorption in the fifth step, by evaporating the refrigerant, that has condensed in the third step, at an intermediate pressure between the low pressure and the high pressure; and a seventh step of condensing the refrigerant, that has evaporated at the intermediate pressure, at a pressure which is approximately the same as the intermediate pressure.

18. A dehumidifier comprising:

a first refrigerant-air heat exchanger having a first refrigerant inlet-outlet port and a second refrigerant inlet-outlet port, and for causing heat exchange between a refrigerant and a process air;

a compressor having an intake port and a discharge port for taking in and discharging the refrigerant, with the second refrigerant inlet-outlet port being disposed to be selectively connectable to either the intake port or the discharge port;

a second refrigerant-air heat exchanger having a third refrigerant inlet-outlet port and a fourth refrigerant inlet-outlet port, and for causing heat exchange between the refrigerant and the process air, with either the intake port or the discharge port, that has not been connected to the second refrigerant inlet-outlet port, being disposed to be connectable to the third refrigerant inlet-outlet port;

a third refrigerant-air heat exchanger, disposed on the upstream side of the process air flow flowing through the first refrigerant-air heat exchanger, having a fifth refrigerant inlet-outlet port and a sixth refrigerant inlet-outlet port, and for causing heat exchange among the refrigerant, the process air, and a cooling fluid, with the fourth refrigerant inlet-outlet port being disposed to be selectively connectable to either the fifth refrigerant inlet-outlet port or a sixth refrigerant inlet-outlet port, and a moisture adsorber disposed on the upstream side of the process air flow passing through the third refrigerant-air heat exchanger and having a desiccant for adsorbing moisture in the process air, wherein:

either the fifth refrigerant inlet-outlet port or the sixth refrigerant inlet-outlet port that has not been connected to the fourth refrigerant inlet-outlet port is connected to the first refrigerant inlet-outlet port, and the third refrigerant-air heat exchanger cools the process air passing through the third refrigerant-air heat exchanger by the evaporation of the refrigerant supplied from the fourth refrigerant inlet-outlet port to the fifth refrigerant inlet-outlet port when the fourth refrigerant inlet-outlet port and the fifth refrigerant inlet-outlet port are interconnected, and cools and condenses the evaporated refrigerant with the cooling fluid, so that the condensed refrigerant can be supplied to the first refrigerant-air heat exchanger.

19. A dehumidifier as recited in claim 18, further comprising:

a first switching mechanism for switching the selective connecting relation of the intake and discharge ports of the compressor to the second and the third refrigerant inlet-outlet ports; and a second switching mechanism for switching the selective connecting relation of the fifth and the sixth refrigerant inlet-outlet ports to the fourth and the first refrigerant inlet-outlet ports.

20. A dehumidifier comprising:

a first refrigerant-air heat exchanger having a first refrigerant inlet-outlet port and a second refrigerant inlet-outlet port, and for causing heat exchange between a refrigerant and a process air;

a compressor having an intake port and a discharge port for taking in and discharging the refrigerant, with the second refrigerant inlet-outlet port being disposed to be selectively connectable to either the intake port or the discharge port;

a second refrigerant-air heat exchanger having a third refrigerant inlet-outlet port and a fourth refrigerant inlet-outlet port, and for causing heat exchange between the refrigerant and the process air, with either the intake port or the discharge port, that has not been connected to the second refrigerant inlet-outlet port, being disposed to be connectable to the third refrigerant inlet-outlet port;

a third refrigerant-air heat exchanger, disposed on the upstream side of the process air flow flowing through the first refrigerant-air heat exchanger, having a fifth refrigerant inlet-outlet port and a sixth refrigerant inlet-outlet port, and for causing heat exchange among the refrigerant, the process air, and a cooling fluid, with the fourth refrigerant inlet-outlet port being disposed to be selectively connectable to either the fifth refrigerant inlet-outlet port or a sixth refrigerant inlet-outlet port, and a moisture adsorber disposed on the upstream side of the process air flow passing through the third refrigerant-air heat exchanger and having a desiccant for adsorbing moisture in the process air, wherein:

either the fifth refrigerant inlet-outlet port or the sixth refrigerant inlet-outlet port that has not been connected to the fourth refrigerant inlet-outlet port is connected to the first refrigerant inlet-outlet port, the third refrigerant-air heat exchanger cools the process air passing through the third refrigerant-air heat exchanger by the evaporation of the refrigerant supplied from the fourth refrigerant inlet-outlet port to the fifth refrigerant inlet-outlet port when the fourth refrigerant inlet-outlet port and the fifth refrigerant inlet-outlet port are interconnected, and cools and condenses the evaporated refrigerant with the cooling fluid, so that the condensed refrigerant can be supplied to the first refrigerant-air heat exchanger a first switching mechanism for switching the selective connecting relation of the intake and discharge ports of the compressor to the second and the third refrigerant inlet-outlet ports;

a second switching mechanism for switching the selective connecting relation of the fifth and the sixth refrigerant inlet-outlet ports to the fourth and the first refrigerant inlet-outlet ports an expansion valve disposed in the refrigerant passage between the sixth refrigerant inlet-outlet port and the second switching mechanism, the expansion valve having a first temperature sensor and a second temperature sensor, wherein the first temperature sensor is disposed in the refrigerant passage between the second refrigerant inlet-outlet port and the first switching mechanism, and the second temperature sensor is disposed in the refrigerant passage between the first switching mechanism and the third refrigerant inlet-outlet port, and the first and the second temperature sensors can be selectively switched.

21. A dehumidifier as recited in claim 18;

wherein the regeneration air is passed through the second refrigerant-air heat exchanger and the moisture adsorber, the desiccant being regenerated with the regeneration air, is disposed on the downstream side of the regeneration air flow relative to the second refrigerant-air heat exchanger; and further comprising:

a sensible heat exchanger, disposed on the upstream side of the regeneration air relative to the second refrigerant-air heat exchanger, for causing heat exchange between the regeneration air that has passed through the moisture adsorber and the regeneration air before exchanging heat in the second refrigerant-air heat exchanger; and a switching mechanism for switching the sensible heat exchanger between operative and inoperative states.

22. A dehumidifier comprising:

a first refrigerant-air heat exchanger having a first refrigerant inlet-outlet port and a second refrigerant inlet-outlet port, and for causing heat exchange between a refrigerant and a process air;

a compressor having an intake port and a discharge port for taking in and discharging the refrigerant, with the second refrigerant inlet-outlet port being disposed to be selectively connectable to either the intake port or the discharge port;

a second refrigerant-air heat exchanger having a third refrigerant inlet-outlet port and a fourth refrigerant inlet-outlet port, and for causing heat exchange between the refrigerant and the process air, with either the intake port or the discharge port, that has not been connected to the second refrigerant inlet-outlet port, being disposed to be connectable to the third refrigerant inlet-outlet port;

a third refrigerant-air heat exchanger, disposed on the upstream side of the process air flow flowing through the first refrigerant-air heat exchanger, having a fifth refrigerant inlet-outlet port and a sixth refrigerant inlet-outlet port, and for causing heat exchange among the refrigerant, the process air, and a cooling fluid, with the fourth refrigerant inlet-outlet port being disposed to be selectively connectable to either the fifth refrigerant inlet-outlet port or a sixth refrigerant inlet-outlet port, and a moisture adsorber disposed on the upstream side of the process air flow passing through the third refrigerant-air heat exchanger and having a desiccant for adsorbing moisture in the process air, wherein:

either the fifth refrigerant inlet-outlet port or the sixth refrigerant inlet-outlet port that has not been connected to the fourth refrigerant inlet-outlet port is connected to the first refrigerant inlet-outlet port, the third refrigerant-air heat exchanger cools the process air passing through the third refrigerant-air heat exchanger by the evaporation of the refrigerant supplied from the fourth refrigerant inlet-outlet port to the fifth refrigerant inlet-outlet port when the fourth refrigerant inlet-outlet port and the fifth refrigerant inlet-outlet port are interconnected, and cools and condenses the evaporated refrigerant with the cooling fluid, so that the condensed refrigerant can be supplied to the first refrigerant-air heat exchanger, wherein air is used as the cooling fluid, and liquid state water is supplied together with the air before condensing the refrigerant in the third refrigerant-air heat exchanger.

23. An operation method of a dehumidifier including a first refrigerant-air heat exchanger having a first refrigerant inlet-outlet port and a second refrigerant inlet-outlet port, and for causing heat exchange between a refrigerant and a process air;

a compressor having an intake port and a discharge port for taking in and discharging the refrigerant, with the second refrigerant inlet-outlet port being disposed to be selectively connectable to either the intake port or the discharge port;

a second refrigerant-air heat exchanger having a third refrigerant inlet-outlet port and a fourth refrigerant inlet-outlet port, and for causing heat exchange between the refrigerant and the process air, with either the intake port or the discharge port, that has not been connected to the second refrigerant inlet-outlet port, being disposed to be connectable to the third refrigerant inlet-outlet port;

a third refrigerant-air heat exchanger, disposed on the upstream side of the process air flow flowing through the first refrigerant-air heat exchanger, having a fifth refrigerant inlet-outlet port and a sixth refrigerant inlet-outlet port, and for causing heat exchange among the refrigerant, the process air, and a cooling fluid, with the fourth refrigerant inlet-outlet port being disposed to be selectively connectable to either the fifth refrigerant inlet-outlet port or a sixth refrigerant inlet-outlet port, and a moisture adsorber disposed on the upstream side of the process air flow passing through the third refrigerant-air heat exchanger and having a desiccant for adsorbing moisture in the process air, wherein:

either the fifth refrigerant inlet-outlet port or the sixth refrigerant inlet-outlet port that has not been connected to the fourth refrigerant inlet-outlet port is connected to the first refrigerant inlet-outlet port, the third refrigerant-air heat exchanger cools the process air passing through the third refrigerant-air heat exchanger by the evaporation of the refrigerant supplied from the fourth refrigerant inlet-outlet port to the fifth refrigerant inlet-outlet port when the fourth refrigerant inlet-outlet outlet port and the fifth refrigerant inlet-outlet port are interconnected, and cools and condenses the evaporated refrigerant with the cooling fluid, so that the condensed refrigerant can be supplied to the first refrigerant-air heat exchanger, said method comprising the steps of:

interconnecting, in the cooling operation mode, the second refrigerant inlet-outlet port and the intake port, the discharge port and the third refrigerant inlet-outlet port, the fourth refrigerant inlet-outlet port and the fifth refrigerant inlet-outlet port, and the sixth refrigerant inlet-outlet port and the first refrigerant inlet-outlet port, respectively;

interconnecting, in the heating mode, the second refrigerant inlet-outlet port and the discharge port, the intake port and the third refrigerant inlet-outlet port, the fourth refrigerant inlet-outlet port and the sixth refrigerant inlet-outlet port, and the fifth refrigerant inlet-outlet port and the first refrigerant inlet-outlet port, respectively; and setting the third refrigerant-air heat exchanger at inoperative state.

24. An operation method as recited in claim 23, further comprising a step of interconnecting, in the defrosting mode, the second refrigerant inlet-outlet port and the intake port, the discharge port and the third refrigerant inlet-outlet port, the fourth refrigerant inlet-outlet port and the sixth refrigerant inlet-outlet port, and the fifth refrigerant inlet-outlet port and the first refrigerant inlet-outlet port, respectively.

25. A dehumidifier comprising:

a moisture adsorber having a desiccant for adsorbing moisture in the process air; and a process air cooler for cooling the process air from which moisture has been removed by adsorption with the desiccant;

wherein the process air cooler has a construction of cooling the process air by the evaporation of the refrigerant, and the evaporated refrigerant is cooled and condensed with a cooling fluid at substantially the same pressure as the evaporating pressure; and the process air cooler has a plurality of evaporation pressures of the refrigerant for cooling the process air and a plurality of condensation pressures of the refrigerant cooled and condensed with the cooling fluid corresponding to the evaporation pressures, the plurality of evaporation pressures being different from each other.

26. A dehumidifier as recited in claim 25, comprising:

an evaporator for further cooling the process air, the process air having been cooled with the process air cooler, by evaporating the refrigerant condensed with the process air cooler;

a compressor for compressing the refrigerant vaporized by evaporation with the evaporator; and a condenser for cooling and condensing the refrigerant, the refrigerant having been compressed with the compressor, with the regeneration air;

wherein, the refrigerant having been condensed with the condenser is supplied to the process air cooler.

27. A dehumidifier as recited in claim 25:

wherein air is used as the cooling fluid, and the air, after having condensed the refrigerant in the process air cooler, is led as the regeneration air for regenerating the desiccant, to the moisture adsorber.

28. A dehumidifier comprising:

a moisture adsorber having a desiccant adsorbing moisture from the process air and being regenerated with the regeneration air;

a heat pump, having a compressor for compressing a refrigerant, for pumping up heat from a low temperature heat source to a high temperature heat source using the process air as the low temperature heat source and the regeneration air as the high temperature heat source; and a process air cooler, disposed on the downstream side of the process air flow relative to the moisture adsorber, for cooling the process air from which moisture has been removed by adsorption with the desiccant;

wherein the refrigerant before being taken into the compressor is heated by the refrigerant after being compressed with the compressor subsequently exchanging heat with the regeneration air before regenerating the desiccant, and the process air cooler has a construction of cooling the process air by the evaporation of the refrigerant, and of cooling to condense the refrigerant with a cooling fluid at substantially the same pressure as the evaporating pressure.

29. A dehumidifier as recited in claim 28, comprising:

an evaporator for further cooling the process air, the process air having been cooled with the process air cooler, by evaporating the refrigerant, the refrigerant having been condensed with the process air cooler; and a condenser for cooling to condense the refrigerant, the refrigerant having been compressed with the compressor;

wherein the refrigerant having been condensed with the condenser is supplied to the process air cooler.

30. A dehumidifier as recited in claim 29, wherein the regeneration air, before flowing into the condenser, is used as the cooling fluid.

31. A dehumidifier comprising:

a moisture adsorber having a desiccant adsorbing moisture from the process air and being regenerated with the regeneration air;

a heat pump, having a compressor for compressing a refrigerant, for pumping up heat from a low temperature heat source to a high temperature heat source using the process air as the low temperature heat source and the regeneration air as the high temperature heat source; and a process air cooler, disposed on the downstream side of the process air flow relative to the moisture adsorber, for cooling the process air from which moisture has been removed by adsorption with the desiccant;

wherein the refrigerant before being taken into the compressor is heated by the refrigerant after being compressed with the compressor subsequently exchanging heat with the regeneration air before regenerating the desiccant, and the process air cooler has a construction of cooling the process air by the evaporation of the refrigerant, and of cooling to condense the refrigerant with a cooling fluid, wherein the process air cooler has a construction such that air is used as the cooling fluid, and liquid state water is supplied together with the air.

32. A dehumidifier comprising:

a moisture adsorber having a desiccant for adsorbing moisture in process air, with the adsorbed moisture being desorbed with regeneration air;

a first heat pump for pumping up heat from a first evaporation temperature to a first condensation temperature by circulating a refrigerant, the first heat pump evaporating the refrigerant at a first intermediate temperature between the first evaporation temperature and the first condensation temperature, followed by condensing the refrigerant at a temperature that is approximately equal to the first intermediate temperature; and a second heat pump for pumping up heat from a second evaporation temperature which is lower than the first evaporation temperature to a second condensation temperature which is lower than the first condensation temperature by circulating a refrigerant, the second heat pump evaporating the refrigerant at a second intermediate temperature between the second evaporation temperature and the second condensation temperature, followed by condensing the refrigerant at a temperature that is approximately equal to the second intermediate temperature;

wherein the process air from which moisture has been removed by adsorption with the desiccant is first cooled with the refrigerant that evaporates at either the first intermediate temperature or the second intermediate temperature whichever higher, then cooled with the refrigerant that evaporates at the lower intermediate temperature, then cooled with the refrigerant that evaporates at the first evaporation temperature, then cooled with the refrigerant that evaporates at the second evaporation temperature;

the regeneration air is heated with the refrigerant that condenses at either a temperature that is approximately equal to the first intermediate temperature or a temperature that is approximately equal to the second intermediate temperature, whichever is lower, then heated with the refrigerant that condenses at the higher temperature, then heated with a refrigerant that condenses at the second condensation temperature, then heated with a refrigerant that condenses at the first condensation temperature, and then the moisture is removed from the desiccant by desorption with the heated regeneration air.

33. A dehumidifier comprising:

a moisture adsorber having a desiccant for adsorbing moisture in process air, the moisture being desorbed with regeneration air;

a process air cooler, disposed on the downstream side of the process air flow relative to the moisture adsorber, for cooling the process air;

a first condenser for heating the regeneration air by condensing a refrigerant at a first condensing pressure; and a second condenser for heating the regeneration air by condensing a refrigerant at a second condensing pressure which is lower than the first condensing pressure;

wherein the process air cooler has a construction of cooling the process air by the evaporation of the refrigerant, and of cooling to condense the evaporated refrigerant with the regeneration air before removing moisture from the desiccant in the moisture adsorber;

the second condenser and the first condenser are disposed in that order in the passage from the regeneration air between the process air cooler and the moisture adsorber;

the process air cooler has, as evaporation pressures of the refrigerant for cooling the process air, a first intermediate pressure which is lower than the first condensation pressure and a second intermediate pressure which is lower than the first intermediate pressure;

the process air cooler has a construction of cooling the refrigerant with the regeneration air to condense the refrigerant at approximately the first intermediate pressure and at approximately the second intermediate pressure;

the process air cooler has a construction of cooling the process air with the refrigerant that evaporates at the second intermediate pressure after the regeneration air is cooled with the refrigerant that evaporates at the first evaporation pressure, and heating the regeneration air with the refrigerant that condenses approximately at the first intermediate pressure, after heating the regeneration air is heated with the refrigerant that condenses approximately at the second intermediate pressure; and the refrigerant condensed with the first condenser is supplied so as to be evaporated at either one of the first or the second intermediate pressures, and the refrigerant condensed with the second condenser is supplied so as to be evaporated at the other one of the first or the second intermediate pressures.

34. A dehumidifier as recited in claim 33, further comprising:

a first evaporator, disposed on the downstream side of the process air coming from the process air cooler, for cooling the process air by evaporating the refrigerant at a first evaporation pressure which is lower than the first intermediate pressure;

a second evaporator, disposed on the downstream side of the process air coming from the first evaporator, for cooling the process air by evaporating the refrigerant at a second evaporation pressure which is lower than the first evaporation pressure;

a first compressor for compressing the refrigerant evaporated with the first evaporator and sending the refrigerant to the first condenser; and a second compressor for compressing the refrigerant evaporated with the second evaporator and supplying the refrigerant to the second condenser.

35. A dehumdifier comprising:

a moisture adsorber having a desiccant for adsorbing moisture in process air, the moisture being desorbed with regeneration air;

a process air cooler, disposed on the downstream side of the process air flow relative to the moisture adsorber, for cooling the process air;

a first condenser for heating the regeneration air by condensing a refrigerant at a first condensing pressure; and a second condenser for heating the regeneration air by condensing a refrigerant at a second condensing pressure which is lower than the first condensing pressure;

wherein the process air cooler has a construction of cooling the process air by the evaporation of the refrigerant, and of cooling to condense the evaporated refrigerant with the regeneration air before removing moisture from the desiccant in the moisture adsorber;

the second condenser and the first condenser are disposed in that order in the passage from the regeneration air between the process air cooler and the moisture adsorber;

the process air cooler has, as evaporation pressures of the refrigerant for cooling the process air, a first intermediate pressure which is lower than the first condensation pressure and a second intermediate pressure which is lower than the first intermediate pressure;

the process air cooler has a construction of cooling the refrigerant with the regeneration air to condense the refrigerant at approximately the first intermediate pressure and at approximately the second intermediate pressure;

the process air cooler has a construction of cooling the process air with the refrigerant that evaporates at the second intermediate pressure after the regeneration air is cooled with the refrigerant that evaporates at the first evaporation pressure, and heating the regeneration air with the refrigerant that condenses approximately at the first intermediate pressure, after heating the regeneration air is heated with the refrigerant that condenses approximately at the second intermediate pressure; and the refrigerant condensed with the first condenser is supplied so as to be evaporated at either one of the first or the second intermediate pressures, and the refrigerant condensed with the second condenser is supplied so as to be evaporated at the other one of the first or the second intermediate pressures, wherein the first intermediate pressure further includes a plurality of pressures.

36. A dehumidifier comprising a moisture adsorber having a desiccant for adsorbing moisture in process air, the moisture being desorbed with regeneration air;

a process air cooler, disposed on the downstream side of the process air flow relative to the moisture adsorber, for cooling the process air;

a first condenser for heating the regeneration air by condensing a refrigerant at a first condensing pressure; and a second condenser for heating the regeneration air by condensing a refrigerant at a second condensing pressure which is lower than the first condensing pressure;

wherein the process air cooler has a construction of cooling the process air by the evaporation of the refrigerant, and of cooling to condense the evaporated refrigerant with the regeneration air before removing moisture from the desiccant in the moisture adsorber;

the second condenser and the first condenser are disposed in that order in the passage from the regeneration air between the process air cooler and the moisture adsorber;

the process air cooler has, as evaporation pressures of the refrigerant for cooling the process air, a first intermediate pressure which is lower than the first condensation pressure and a second intermediate pressure which is lower than the first intermediate pressure;

the process air cooler has a construction of cooling the refrigerant with the regeneration air to condense the refrigerant at approximately the first intermediate pressure and at approximately the second intermediate pressure;

the process air cooler has a construction of cooling the process air with the refrigerant that evaporates at the second intermediate pressure after the regeneration air is cooled with the refrigerant that evaporates at the first evaporation pressure, and heating the regeneration air with the refrigerant that condenses approximately at the first intermediate pressure, after heating the regeneration air is heated with the refrigerant that condenses approximately at the second intermediate pressure; and the refrigerant condensed with the first condenser is supplied so as to be evaporated at either one of the first or the second intermediate pressures, and the refrigerant condensed with the second condenser is supplied so as to be evaporated at the other one of the first or the second intermediate pressures, wherein the first and the second condensers are positioned vertically above the process air cooler.

37. A dehumidifier comprising a first air flow passage having a first intake port at its one end and a first discharge port at the other end, for flowing first air from the first intake port toward the first discharge port;

a second air flow passage having a second intake port at its one end and a second discharge port at the other end, for flowing regeneration air from the second intake port toward the second discharge port;

a desiccant wheel, having a desiccant for the process air to pass through, with its rotation axis directed vertically; and a third heat exchanger for cooling the process air, wherein the desiccant removes moisture from the process air before being cooled by the third heat exchanger; and wherein the first air passage mainly includes a downward flow passage portion directed vertically downward and an upward flow passage portion directed vertically upward; and wherein moisture of the desiccant is removed by the regeneration air, and the second air flow passage mainly includes a flow passage portion directed vertically upward.

38. A dehumidifier as recited in claim 37, comprising:

a first heat exchanger for heating the regeneration air; and a heat pump having a high temperature heat source and a low temperature heat source;

wherein the third heat exchanger constitutes the low temperature heat source, and the first heat exchanger constitutes the high temperature heat source.

39. A dehumidifier comprising:

a process air blower for blowing process air;

a regeneration air blower for blowing regeneration air;

a compressor for compressing a refrigerant;

a refrigerant condenser for heating the regeneration air by condensing the compressed refrigerant;

a refrigerant evaporator for cooling the process air by evaporating the refrigerant condensed with the refrigerant condenser; and a desiccant wheel, having a desiccant which is regenerated by the regeneration air heated with the refrigerant condenser as the regeneration air passes through the desiccant and which processes the process air as the process air passes through the desiccant;

wherein the process air blower, the regeneration air blower, and the compressor are positioned vertically below the desiccant wheel, and the refrigerant condenser is positioned vertically above the desiccant wheel.

40. A dehumidifier as recited in claim 39, wherein the process air is cooled with the refrigerant evaporator after being processed with the desiccant, and the refrigerant evaporator is positioned vertically above the desiccant wheel.

* * * * *